US010390592B2

(12) United States Patent
Godshaw et al.

(10) Patent No.: US 10,390,592 B2
(45) **Date of Patent: *Aug. 27, 2019**

(54) ANTI-THEFT CARRYING STRAP

(71) Applicant: Travel Caddy, Inc., Elk Grove Village, IL (US)

(72) Inventors: Donald E. Godshaw, Wilmette, IL (US); Du Hai, Uncasville, CT (US); Bryce Ryan Hickman, Schaumburg, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/624,171

(22) Filed: Jun. 15, 2017

(65) Prior Publication Data

US 2017/0280839 A1 Oct. 5, 2017

Related U.S. Application Data

(60) Continuation of application No. 14/641,206, filed on Mar. 6, 2015, now Pat. No. 9,681,716, which is a (Continued)

(51) Int. Cl.
*A45C 13/18* (2006.01)
*A45C 3/00* (2006.01)

(Continued)

(52) U.S. Cl.
CPC ..... *A45C 3/001* (2013.01); *A45C 3/06* (2013.01); *A45C 13/103* (2013.01); *A45C 13/18* (2013.01);

(Continued)

(58) Field of Classification Search
CPC ..... A45C 3/001; A45C 13/18; A45C 13/30

(Continued)

(56) References Cited

U.S. PATENT DOCUMENTS 873,195 A 12/1907 Willets
4,885,570 A * 12/1989 Chien ..... G08B 13/1445 150/101

(Continued)

FOREIGN PATENT DOCUMENTS

FR 2601566 B1 7/1986
GB 26827 B1 11/1910

(Continued)

*Primary Examiner* — Sue A Weaver
(74) *Attorney, Agent, or Firm* — Nancy R. Gamburd; Gamburd Law Group LLC

(57) ABSTRACT

In various embodiments, a carry (or carrying) bag is provided that includes an interior, substantially cut-resistant security panel assembly with a matrix of wires secured between or on one or more flexible material layers. Also in various embodiments, the security panel assembly may be positioned intermediate the bag outside wall and a lining of the bag, and in other embodiments, may also take the form of an expansion panel. Second or secondary locking fasteners are also provided to lock first or primary fasteners to or within the carrying bag, to provide security for compartments and pockets. A strap with one or more security cables, and various locking fasteners, may be attached to the carry bag. Methods for forming such security panel assemblies, expansion panels, and carrying straps are also disclosed.

28 Claims, 70 Drawing Sheets

Related U.S. Application Data continuation-in-part of application No. 14/559,086, filed on Dec. 3, 2014, now Pat. No. 9,655,424, which is a division of application No. 13/245,319, filed on Sep. 26, 2011, now Pat. No. 8,925,181, which is a continuation-in-part of application No. PCT/US2010/028557, filed on Mar. 24, 2010, which is a continuation-in-part of application No. 12/410,123, filed on Mar. 24, 2009, now abandoned.

(60) Provisional application No. 61/949,452, filed on Mar. 7, 2014.

(51) Int. Cl.

| | |
|---|---|
| ***A45C 3/06*** | (2006.01) |
| ***A45C 13/10*** | (2006.01) |
| ***A45C 13/20*** | (2006.01) |
| ***A45C 13/30*** | (2006.01) |
| *A45C 13/02* | (2006.01) |

(52) U.S. Cl.
CPC ..... *A45C 13/185* (2013.01); *A45C 13/20* (2013.01); *A45C 13/30* (2013.01); *A45C 2013/026* (2013.01); *A45C 2013/306* (2013.01); *Y10T 29/49* (2015.01); *Y10T 29/5187* (2015.01)

(58) Field of Classification Search
USPC ..... 150/107
See application file for complete search history.

(56) References Cited

U.S. PATENT DOCUMENTS

| | | | | |
|---|---|---|---|---|
| 7,743,713 | B2 * | 6/2010 | Volk | A45C 13/18 105/102 |
| 8,267,290 | B2 * | 9/2012 | Schlipper | A45F 3/04 224/259 |
| 9,681,716 | B2 * | 6/2017 | Godshaw | A45C 3/001 |
| 2003/0010801 | A1 * | 1/2003 | Schlipper | A45C 13/20 224/660 |
| 2007/0102469 | A1 | 5/2007 | Roth | |
| 2007/0240798 | A1 * | 10/2007 | Bihler | A45C 13/18 150/102 |
| 2008/0189917 | A1 * | 8/2008 | Maley | A44B 11/28 24/197 |
| 2009/0140020 | A1 * | 6/2009 | Schlipper | A45C 13/18 224/257 |
| 2011/0214787 | A1 * | 9/2011 | Schulte | A45C 13/00 150/102 |
| 2012/0125494 | A1 * | 5/2012 | Avganim | A45C 13/20 150/101 |
| 2013/0008752 | A1 * | 1/2013 | Avganim | A45C 13/103 190/101 |
| 2013/0276941 | A1 * | 10/2013 | Schlipper | A45C 13/30 150/107 |
| 2014/0126230 | A1 * | 5/2014 | Harris | A45C 13/30 362/382 |

FOREIGN PATENT DOCUMENTS

| | | | |
|---|---|---|---|
| GB | 162091 | B1 | 1/1920 |
| JP | 2002363838 | A1 | 12/2002 |

* cited by examiner

ANTI-THEFT CARRYING STRAP

CROSS-REFERENCE TO RELATED APPLICATIONS

This application is a continuation of and claims priority to and the benefit of U.S. patent application Ser. No. 14/641,206, filed Mar. 6, 2015, which is a nonprovisional of and claims priority to and the benefit of U.S. Provisional Patent Application No. 61/949,452, filed Mar. 7, 2014, and further is a continuation-in-part of U.S. patent application Ser. No. 14/559,086, filed Dec. 3, 2014 and issued May 23, 2017 as U.S. Pat. No. 9,655,424 B2, which is a division of U.S. patent application Ser. No. 13/245,319, filed Sep. 26, 2011 and issued Jan. 6, 2015 as U.S. Pat. No. 8,925,181 B2, which is a continuation-in-part of prior International Application PCT/US10/028557, filed Mar. 24, 2010, which is a continuation-in-part of U.S. patent application Ser. No. 12/410,123, filed Mar. 24, 2009, which are commonly assigned herewith, the entire contents of which are incorporated herein by reference with the same full force and effect as if set forth in their entirety herein, and with priority claimed for all commonly disclosed subject matter.

FIELD OF THE INVENTION

This invention relates to various types of carrying bags and, more particularly, to anti-theft constructions, security panel assemblies and methods of forming the same for carrying bags such as purses, backpacks, messenger bags, briefcases, luggage, and so on.

BACKGROUND OF THE INVENTION

In a principal aspect the present invention relates to a handbag, purse, travel bag, backpack, messenger bag, briefcase, waist pack, suitcase, luggage or the like (individually and collectively referred to as "bag(s)" or "carrying bag(s)") which incorporates construction features designed to preclude access to the interior of the bag by cutting though the sides of the bag, and other anti-theft constructions and designs to diminish or minimize theft of the carrying bag and its contents.

Handbags, travel bags, purses, other bags and the like are often made from flexible materials such as cloth, canvas, nylon, ballistic nylon, leather and similar materials. Such bags typically include one or more interior chambers through which access may be gained by an opening in the top or side of the bag. Such bags also often include a carry (or carrying) strap which is typically connected between opposite sides of the bag. Additionally, such bags often also include multiple side pockets with top and/or side access openings.

On occasion, such bags are subject to theft or attempted theft. For example, often a bag may be hung or supported by the bag carrying (or carry) strap on a chair or a hook or the like. In such circumstances, a thief may "snatch" the bag by grabbing the carry strap and departing. Another scheme that has been used by thieves is to use a sharp instrument to cut through the soft sided material comprising the bag, and thereby gain access to the contents which may be lifted through the cut opening in the bag. Yet another scheme that has been used by thieves includes various types of pick-pocketing, such as by unzipping a zipper in either a stealth manner or while the bag's owner is distracted, and thereby gaining access to the bag's contents while undetected by the bag's owner.

Issues of this nature have been addressed in various ways by certain security designs for soft sided types of bag constructions. For example, U.S. Pat. No. 6,026,662 entitled "Security Device for Luggage" issued Feb. 22, 2000 and the references cited therein teach a method for providing a metal mesh that is placed over a backpack in order to enhance the security of the soft sided backpack. A related patent, U.S. Pat. No. 6,244,081 is entitled "Security Device for Luggage" issued Jun. 12, 2001 discloses a security device in the form of a netting with a locking mechanism associated therewith. U.S. Pat. No. 7,069,753 entitled "Security Luggage Bag" issued Jul. 4, 2006 discloses the concept of placement of a wire mesh within the interior of a bag and further providing a draw cord made from a wire cable to close the top of the bag. These prior art patents and the references cited therein are incorporated herein by reference. While such constructions have potential applicability to handbags and other types of bags, they are difficult to assemble, can be bulky, rigid and inflexible, unattractive, and may not provide adequate security, particularly with respect to handbags that have carry straps and zippers associated therewith.

These prior art assemblies utilize a crimped wire mesh which not only is difficult and expensive to manufacture, but also has a comparatively stiff, expandable cage-like structure with very limited flexibility, rendering these types of assemblies unsuitable for many types of bags, such as handbags, purses, waist packs, and so on. Such crimps are utilized to couple adjacent, non-crossing wires forming the mesh or cage-like structure, and in addition to creating unwanted stiffness and limiting movement of the wires, are also a potentially weak link in providing cut resistance, as such crimps may break, shear, or come off the mesh when subjected to cutting or pulling forces. In addition, such crimps are often raised or protruding, thereby causing additional and unwanted wearing of the bag at these crimp locations.

Accordingly, a need remains for comparatively cut-proof assemblies and constructions which may be utilized with a wide variety of bags, which are relatively easy and comparatively inexpensive to assemble, which have comparatively thin, non-bulky configurations, and which are light and flexible. A need also remains for additional anti-theft features for carry straps and zipper openings of bags, to prevent cutting through any strap attached to the bag, to prevent typical "snatching" of bags, and further to provide readily and easily usable locking capabilities for straps and zippers, to eliminate or diminish the potential for undetected access to the contents of the bag, while nonetheless maintaining a comparatively flexible and attractive style of the bag for the consumer.

SUMMARY

Briefly, in one form, the present invention comprises a security construction having a panel assembly which, in one form, is placed within an exterior carrying bag of the type fabricated from generally flexible material such as fabric, leather or plastic. The security panel assembly is typically positioned between the exterior layer of material forming the bag and an interior lining as an interior security panel assembly. The concepts associated with the interior security panel assembly may be utilized as a single interior panel assembly or as multiple assemblies associated with multiple pockets of the exterior bag. Further, the high security bag may include a cable or wire which is flexible and incorporated into or with the elongate strap that connects to sides of the bag. The strap having the wire or cable may be further couplable to a locking carabiner or locking rectangular ring which may be released so that the carry strap can be placed around a post or some other object and relocked so that it cannot be "snatched" easily. Security clasps, additional locking carabiners, and other secondary closures are also provided on the zipper closures for the exterior bag as additional security features.

Representative embodiments provide numerous advantages. One such advantage is that the structure of the wire matrix of the representative security panel assemblies forms a plurality of closed wire shapes which do not require additional crimping for stability and therefore may be manufactured more economically. As an additional result, the wire matrix not only provides the desired level of security, but also does not have the potential weak link of crimping. The wire matrix, moreover, is smooth and continuous, without the raised bumps of the prior art which are palpable (and therefore undesirable by the consumer) and which cause unnecessary and undesirable wearing of the carrying bag.

The structure of the representative security panel assemblies with a wire matrix also allows a comparatively high degree of flexibility unavailable in the prior art. The plurality of uncoupled wire crossings forming the closed wire shapes of the wire matrix allow for a reasonable degree of rotation and or sliding of wire against wire within the various closed wire shapes, and serve to render the overall security panel assembly reasonably flexible and deformable while concomitantly providing the desired level of cut-resistance. This further allows the representative security panel assemblies to be utilized in a wide variety of carrying bags while simultaneously allowing a high degree of fashion and a desirable level of femininity in carrying bags designed for women, such as purses and shoulder bags.

The interior security panel assembly in one embodiment includes at least first and second layers of foldable material having at least one cut-resistant cable or wire positioned therebetween and stitched into place between the foldable first and second material layers. In one form, binding is provided around at least a portion of the foldable material first and second layers to further encapsulate the material layers and the matrix of wire or wires between those layers. In another preferred form, glue or adhesive may be incorporated between the layers to further retain the wire or wires in a fixed position. Additionally, the first and second layers of material are stitched together to facilitate maintenance of the matrix of wire or wires in a desired array between the first and second layers of material. The first and second layers of material are typically a fabric, non-woven, or plastic material which is foldable. The security panel assembly, which is comprised of the layers of fabric and the wire mesh matrix, may be fitted into the exterior bag and positioned intermediate the exterior material forming the bag and a liner material, tacked in that position and then stitched or otherwise attached to various seams or margins of the bag.

In another aspect, the security panel assembly can be provided along the exterior of a more rigid bag or container. In this form, the panel assembly can be resiliently flexible and thus also serve as a hinge between a rigid container base and a pivotal cover therefor. The security panel assembly can have a finishing cover thereon, such as of fabric material.

As another feature the wire cable that is associated with the carry strap may be fastened to the bag or to the security panel to thereby insure that the wire cable in the strap cannot be disengaged easily from the handbag itself. Further, clasps on the zipper pulls or fastener pulls for the opening to the bag lock or attach to the bag so that access openings cannot be easily opened.

In another aspect, a method for forming a security panel assembly is provided. The method can include holding a first layer of material in a substantially fixed position via mounting members and, in a preferred form, on a fixture via the insertion of mounting pegs of the fixture through openings of the material layer so that the mounting pegs project therethrough. Thereafter, a wire is routed around the pegs in a predetermined pattern. A second layer of material is then oriented so that openings thereof can be aligned with the mounting pegs and is placed onto the pegs so that they extend through the material layer openings. The layers are urged together so that adhesive therebetween is effective to hold the material layers and the wire therebetween securely relative to each other. While a single wire can advantageously be employed for forming the security panel assembly herein, it is manifest that the present method is not limited to a single wire and multiple wires can instead be secured between the material layers. Further, while the wire can be a metallic material, it could also be cut-resistant yarn material such as Vectran®. In addition, the material layers can be panels of flexible and foldable material, such as a fabric, non-woven or thin plastic material, and the panels can be of different material from each other such as use of a non-woven material for the first material layer or panel and a woven fabric material for the second material layer or panel.

The laminate of the material layers and wire or wires therebetween is then sewn to further secure the wire or wires permanently in place between the material layers. In this regard, the sewing can occur at random locations, as well as around the perimeter of the material layers. In addition, a connecting panel or panels such as in the form of wings or smaller tabs can be sewn to one or both of the ends and/or sides of the panel assembly for use in attaching the security panel assembly in a carrying bag.

As an alternative, the second layer of material need not include openings for being aligned with the mounting pegs. Rather, the layer of material can include notches such as V-shaped openings formed at the perimeter edge to be open thereto for being aligned with the mounting pegs. In this manner, the mounting pegs need not be fit into through openings in the second layer of material which translates to a decrease in assembly time for the security panel assembly herein.

Thus, it is an object of the invention to provide a security type bag or handbag having a security carry strap wherein the external materials forming the bag may be a flexible, fabric material which is attractive.

Yet another object of the invention is to provide a highly secure handbag which includes wires and cables that are incorporated therein, particularly within the interior chamber or chambers or pockets of the handbag to protect the contents of the bag and to prevent the cutting or slashing of the bag so as to secure access to the interior.

Yet another object of the invention is to provide a highly secure handbag having a carry strap which may be easily detached and reattached and fastened in a secure manner around a post or a chair, or some other object to prevent the bag from being "snatched". Another object of the invention is to provide a secure handbag construction which is reasonably priced, highly secure, with unobtrusive features and which is reasonably easy to assemble or manufacture.

A representative embodiment of a security panel assembly, for placement within an interior of a carrying bag, comprises: a first flexible material layer; a second flexible material layer coupled to the first flexible material layer; and a wire matrix arranged between the first flexible material layer and the second flexible material layer, the wire matrix comprising a plurality of wire crossings forming a plurality of closed wire shapes, each wire crossing comprising at least two sections of wire abutting but uncoupled to each other.

In a representative embodiment, the wire matrix is comprised of a single wire routed in a predetermined pattern to form the plurality of wire crossings. The plurality of closed wire shapes may comprise, for example, at least one shape selected from the group consisting of: square, rectangular, diamond, rhomboid, parallelogram, triangular, and combinations thereof. In a representative embodiment, the second flexible material layer is coupled to the first flexible material layer with a plurality of stitches having a pattern, such as a sawtooth or another pattern. In another representative embodiment, the second flexible material layer is coupled to the first flexible material layer with a plurality of stitches within one or more of the closed wire shapes of the plurality of closed wire shapes and without crossing the wire matrix, such as using a rectangular stitch pattern, a circular stitch pattern, a diamond stitch pattern, a bar tack stitch pattern; and combinations thereof.

In another representative embodiment, adjacent the periphery of the first flexible material layer, the wire matrix is arranged as a plurality of bent or curved portions spaced apart from the periphery of the first flexible material layer. For example, the wire matrix may be comprised of a single wire having a first end and a second end which are spaced apart from the periphery further than and closer to a center of the first flexible material layer than the bent or curved portions of the wire matrix. In addition, at least one polymeric cap may be coupled to the first end or to the second end of the single wire or to both the first end and the second end of the single wire.

In another representative embodiment, the security panel assembly may be comprised of a plurality of subpanels, each subpanel having a section of a plurality of sections of the wire matrix. For example, between adjacent subpanels of the plurality of subpanels, the wire matrix may be comprised of a single wire without any closed wire shapes. Such a security panel assembly may be foldable between adjacent subpanels into a closed or compressed configuration and into an open or expanded configuration, including to form a gusseted configuration.

A representative security panel may further comprise an adhesive coupling the second flexible material layer to the wire matrix and to the first flexible material layer, or at least one tab, flange or panel member for securing the security panel assembly within the interior of the carrying bag. Alternatively, the first flexible material layer and/or the second flexible material layer may further comprise a plurality of edges forming a plurality of tabs, flanges or panel members for securing the security panel assembly within the interior of the carrying bag.

In a representative embodiment, the security panel may be foldable into a box shape. For example, the security panel assembly may be foldable into a gusset to form an expansion panel of the carrying bag. As another example, the first flexible material layer, the wire matrix and the second flexible material layer may be configured in the form of an upper case "I" and foldable into a box shape, which may also include a plurality of pre-stitched flanges or panel members coupled to the second flexible material layer, each pre-stitched flange or panel member is disposed at a corresponding corner when the security panel assembly is folded into a box shape. As another example, the first flexible material layer and the second flexible material layer are each configured in a stellate pattern having a plurality of notches for folding the security panel assembly into a box shape.

In another representative embodiment, a security panel assembly may comprise: a first flexible material layer; a wire matrix comprising a plurality of wire crossings forming a plurality of closed wire shapes, each wire crossing comprising at least two abutting and uncoupled sections of wire; a second flexible material layer adjacent the wire matrix and coupled to the first flexible material layer with a plurality of stitches; and at least one flexible material flange coupled to at least one of the first or second flexible material layers to secure the security panel assembly within the interior of the carrying bag.

A security expansion panel is also disclosed. In a representative embodiment, a security expansion panel comprises: a first security panel assembly having a first lateral side and a first wire matrix; and a second security panel assembly having a first lateral side and a second wire matrix, the first lateral side of the second security panel assembly pivotably or rotatably coupled to the first lateral side of the first security panel assembly to provide an expanded state and an unexpanded state of the security expansion panel.

For example, the first security panel assembly may further comprise a first flexible material layer having a first side, and wherein the first wire matrix is arranged on the first side of the first flexible material layer, the first wire matrix comprising a plurality of first wire crossings forming a plurality of closed wire shapes, each first wire crossing comprising at least two sections of a first wire abutting but uncoupled to each other. Also for example, the second security panel assembly may further comprise a second flexible material layer having a first side, and wherein the second wire matrix is arranged on the first side of the second flexible material layer, the second wire matrix comprising a plurality of second wire crossings forming a plurality of closed wire shapes, each second wire crossing comprising at least two sections of a second wire abutting but uncoupled to each other. In a representative embodiment, the first wire matrix has a first width and the second wire matrix has a second width smaller than the first width.

In a representative embodiment, the second security panel assembly is pivotable or rotatable with respect to the first security panel assembly. For example, when the security expansion panel is in the open and expanded state, the second wire matrix overlaps or overlays the first wire matrix. Typically, the second security panel assembly is coupled to the first security panel assembly across or along a first lateral region of the first wire matrix. For example, when a second lateral side of the second security panel assembly has been pivoted or rotated to a position nonadjacent to the second lateral side of the first security panel assembly and the second security panel assembly is substantially parallel to the first security panel assembly, a first lateral region of the second wire matrix is positioned adjacent the first lateral region of the first wire matrix.

In a representative embodiment, the first security panel assembly further comprises a third flexible material layer adjacent to the first wire matrix and coupled with a plurality of stitches to the first flexible material layer, and wherein the second security panel assembly further comprises a fourth flexible material layer adjacent to the second wire matrix and coupled with a plurality of stitches to the second flexible material layer. In another representative embodiment, each of the first security panel assembly and second security panel assembly further comprise a plurality of tabs or flanges to couple the security expansion panel to a carrying bag, or may further comprise one or more releasable fasteners or hinges to couple the security expansion panel to a carrying bag.

In a representative embodiment, a security expansion panel may further comprise a third security panel assembly having a first lateral side and a third wire matrix, the first lateral side of the third security panel assembly pivotably or rotatably coupled to a second lateral side of the first security panel assembly. For example, the third security panel assembly may further comprise a third flexible material layer having a first side; and wherein the third wire matrix is arranged on the first side of the third flexible material layer, the third wire matrix comprising a plurality of third wire crossings forming a plurality of closed wire shapes, each third wire crossing comprising at least two sections of a third wire abutting but uncoupled to each other.

In a representative embodiment, a security expansion panel may further comprise a third security panel assembly having a first lateral side and a third wire matrix; and a fourth security panel assembly having a first lateral side and a fourth wire matrix, the first lateral side of the fourth security panel assembly pivotably or rotatably coupled to a first lateral side of the third security panel assembly; and wherein the third and fourth security panel assemblies are respectively longitudinally adjacent and overlapping the respective first and second security panel assemblies.

In another representative embodiment, a security expansion panel comprises: a first security panel assembly having a first lateral side, the first security panel assembly comprising a first wire matrix and a first flexible material layer having a first side, the first wire matrix arranged on the first side of the first flexible material layer, the first wire matrix having a first width; and a second security panel assembly having a first lateral side, the first lateral side of the second security panel assembly pivotably or rotatably coupled to a first lateral side of the first security panel assembly, the second security panel assembly comprising a second wire matrix and a second flexible material layer having a first side, the second wire matrix arranged on the first side of the second flexible material layer, the second wire matrix having a second width smaller than the first width of the first wire matrix.

In another representative embodiment, a security expansion panel comprises: a first security panel assembly having a first lateral side, the first security panel assembly comprising: a first flexible material layer having a first side; a first wire matrix arranged on the first side of the first flexible material layer, the first wire matrix comprising a plurality of first wire crossings forming a plurality of closed wire shapes, each first wire crossing comprising at least two sections of a first wire abutting but uncoupled to each other, the first wire matrix having a first width; and a second security panel assembly having a first lateral side, the first lateral side of the second security panel assembly pivotably or rotatably coupled to a first lateral side of the first security panel assembly, comprising a second flexible material layer having a first side; and a second wire matrix arranged on the first side of the second flexible material layer, the second wire matrix comprising a plurality of second wire crossings forming a plurality of closed wire shapes, each second wire crossing comprising at least two sections of a second wire abutting but uncoupled to each other, the second wire matrix having a second width smaller than the first width.

A substantially cut-resistant carry strap for a carrying bag is also disclosed, with a representative embodiment of a carry strap comprising: a first substantially cut-resistant cable; a second substantially cut-resistant cable; and a first flexible material having its length substantially greater than its width, having a central region extending longitudinally, having a first lateral region extending longitudinally along a first side of the central region and laterally wrapping around the first substantially cut-resistant cable to laterally enclose the first substantially cut-resistant cable, and having a second lateral region extending longitudinally along a second side of the central region and laterally wrapping around the second substantially cut-resistant cable to laterally enclose the second substantially cut-resistant cable.

In a representative embodiment, the first lateral region has a first lateral edge region and a first medial region adjacent the central region, the first lateral edge region coupled to the first medial region, and wherein the second lateral region has a second lateral edge region and a second medial region adjacent the central region, the second lateral edge region coupled to the second medial region. In a representative embodiment, the central region has a first thickness and the first and second lateral regions have a second thickness, the first thickness greater than the second thickness.

In another representative embodiment, the central region has a first side edge and a second side edge, wherein the first lateral edge region abuts the first side edge of the central region, and wherein the second lateral edge region abuts the second side edge of the central region. For example, the central region may have a first thickness and the first and second lateral regions may have a second thickness, the first thickness equal to or greater than twice the second thickness; alternatively, the central region and the first and second lateral regions may have substantially the same thickness. In a representative embodiment, wherein the first flexible material comprises at least one material selected from the group consisting of: a woven fabric; a woven ballistic nylon fabric; leather; a nonwoven material; a woven webbing material having finished lateral edges; and combinations thereof.

In another representative embodiment, the carry strap may further comprise: a second flexible material having its length substantially greater than its width, the second flexible material folded along first and second lateral edges and coupled to a first side of the first flexible material. In another representative embodiment, the carry strap may further comprise: an end cap having a mating recess and coupled to an end of the first flexible material to enclose respective ends of the first and second substantially cut-resistant cables.

In another representative embodiment, a substantially cut-resistant carry strap may comprise: a first flexible material having its length substantially greater than its width, the first flexible material having a first lateral edge and a second lateral edge along its length and having first and second lateral regions along its length; a second flexible material having its length substantially greater than its width, the second flexible material having a first lateral edge and a second lateral edge along its length and having first and second lateral regions along its length, the second flexible material coupled to the first flexible material; and a first substantially cut-resistant cable longitudinally coupled to the first lateral edge or first lateral region of the first flexible material. In a representative embodiment, the first substantially cut-resistant cable longitudinally also may be further coupled to the first lateral edge or first lateral region of the second flexible material.

In a representative embodiment, a carry strap may further comprise a first edge piping longitudinally coupled to the first lateral region of the first flexible material and to the first lateral region of the second flexible material and encasing the first substantially cut-resistant cable. In another representative carry strap embodiment, the first flexible material and second flexible material are laterally offset from each other to form at least one of the first or second lateral regions of the first flexible material and at least one of the first or second lateral regions of the second flexible material. For example, a carry strap may further comprise a second substantially cut-resistant cable longitudinally coupled to the second lateral edge or second lateral region of the second flexible material. Also for example, the first lateral region of the first flexible material may be wrapped around the first substantially cut-resistant cable and first lateral edge of the first flexible material is secured adjacent the first lateral edge of the second flexible material, and wherein the second lateral region of the second flexible material may be wrapped around the second substantially cut-resistant cable and second lateral edge of the second flexible material is secured adjacent the second lateral edge of the first flexible material.

In another representative embodiment, a carry strap may further comprise a second substantially cut-resistant cable longitudinally coupled to the second lateral edge or second lateral region of the first flexible material and to the second lateral edge or second lateral region of the second flexible material, and may also include a second edge piping longitudinally coupled to the second lateral region of the first flexible material and to the second lateral region of the second flexible material and encasing the second substantially cut-resistant cable.

In another representative embodiment, a substantially cut-resistant carry strap may comprise: a first flexible material having a first length substantially greater than a first width, the first flexible material having a first lateral edge and a second lateral edge along its length, having first and second lateral regions along its length, and having a central region along its length in between the first and second lateral regions; a substantially cut-resistant cable longitudinally arranged on the central region of the first flexible material; and a second flexible material having a second length substantially greater than a second width, the second width smaller than the first width, the second flexible material coupled over the substantially cut-resistant cable and to the first central region of the first flexible material to secure the substantially cut-resistant cable between the second flexible material and the central region of the first flexible material.

Various carrying bags are also disclosed. In a representative embodiment, a carrying bag comprises: a substantially cut-resistant security panel assembly comprising a first flexible material layer having a first side, a wire matrix arranged on the first side of the first flexible material layer, and a second flexible material layer adjacent to the wire matrix and coupled to the first flexible material layer; an exterior bag having an inside chamber enclosing the security panel assembly, the exterior bag including at least one opening for access to the inside chamber of the exterior bag; a first fastener coupled to the at least one opening; and a second fastener removably coupled between the first fastener and the exterior bag, the second fastener having a first spring bias to a closed or locked configuration. For example, the second fastener may be coupled to the first fastener and removably coupled to a ring coupled to the exterior bag, or the second fastener may be coupled to the exterior bag and removably coupled to the first fastener. For example, the primary fastener may be a zipper, and the secondary fastener may be a clasp or a locking carabiner.

In a representative embodiment, the wire matrix comprises a plurality of wire crossings forming a plurality of closed wire shapes, each wire crossing comprising at least two sections of wire abutting but uncoupled to each other. For example, the wire matrix may be comprised of a single wire arranged in a pattern to form the plurality of wire crossings. In a representative embodiment, the second flexible material layer may be coupled to the first flexible material layer with a plurality of stitches, or with an adhesive, or with both a plurality of stitches and an adhesive.

In a representative embodiment, the wire matrix may be comprised of a metallic wire or cable, or substantially cut-resistant polymeric threads, fibers or yarn, or a woven or knitted fabric having a plurality of substantially cut-resistant polymeric threads, fibers or yarn.

A representative carrying bag may further comprise an expansion panel. In a representative embodiment, the expansion panel comprises: a second security panel assembly having a first lateral side and a second wire matrix; and a third security panel assembly having a first lateral side and a third wire matrix, the first lateral side of the third security panel assembly pivotably or rotatably coupled to the first lateral side of the second security panel assembly to provide an expanded state and an unexpanded state of the security expansion panel.

For example, the second security panel assembly further may comprise a second flexible material layer having a first side, wherein the second wire matrix is arranged on the first side of the second flexible material layer, the second wire matrix comprising a plurality of second wire crossings forming a plurality of closed wire shapes, each second wire crossing comprising at least two sections of a first wire abutting but uncoupled to each other; wherein the third security panel assembly may further comprise a third flexible material layer having a first side, and wherein the third wire matrix is arranged on the first side of the third flexible material layer, the third wire matrix comprising a plurality of third wire crossings forming a plurality of closed wire shapes, each third wire crossing comprising at least two sections of a second wire abutting but uncoupled to each other. Also for example, the second wire matrix may have a first width and the third wire matrix has a second width smaller than the first width. Typically, when the security expansion panel is in the open and expanded state, the second wire matrix overlaps or overlays the first wire matrix.

A representative carrying bag may further comprise a carry strap coupled to a third fastener, the third fastener removably coupled to the exterior bag, the carry strap comprising a first flexible material and a first substantially cut-resistant cable. Typically, the third fastener may have a second spring bias to a closed or locked configuration. For example, the third fastener may be a locking carabiner or a multi-glide locking snap hook fastener. In a representative embodiment, the first flexible material of the carry strap comprises a first webbing material having its length substantially greater than its width and having a first edge and a second edge along its length, and wherein the carry strap further comprises: a second webbing material having its length substantially greater than its width and having a first edge and a second edge along its length, the second webbing material coupled to the first webbing material; and wherein the first substantially cut-resistant cable is longitudinally coupled to the first edge of the first webbing material and to the first edge of the second webbing material.

In another representative embodiment, the carry strap further comprises: a second substantially cut-resistant cable; and wherein the first flexible material has a length substantially greater than its width, has a central region extending longitudinally, has a first lateral region extending longitudinally along a first side of the central region and laterally wrapping around the first substantially cut-resistant cable to laterally enclose the first substantially cut-resistant cable, and has a second lateral region extending longitudinally along a second side of the central region and laterally wrapping around the second substantially cut-resistant cable to laterally enclose the second substantially cut-resistant cable.

In another representative embodiment, the first flexible material of the carry strap has a first length substantially greater than a first width, the first flexible material having a first lateral edge and a second lateral edge along its length, having first and second lateral regions along its length, and having a central region along its length in between the first and second lateral regions; wherein the first substantially cut-resistant cable is arranged longitudinally on the central region of the first flexible material; and wherein the carry strap further comprises: a second flexible material having a second length substantially greater than a second width, the second width smaller than the first width, the second flexible material coupled over the first substantially cut-resistant cable and to the first central region of the first flexible material to secure the substantially cut-resistant cable between the second flexible material and the central region of the first flexible material.

In a representative embodiment, the first flexible material of the carry strap comprises at least one material selected from the group consisting of: a woven fabric; a woven ballistic nylon fabric; leather; a nonwoven material; a woven webbing material having finished lateral edges; polyester; polypropylene; acrylic; and combinations thereof.

In another representative embodiment, a carrying bag may comprise: a first substantially cut-resistant security panel assembly comprising a first flexible material layer having a first side, a first wire matrix arranged on the first side of the first flexible material layer, and a second flexible material layer adjacent to the first wire matrix and coupled to the first flexible material layer; an exterior bag having an inside chamber enclosing the security panel assembly, the exterior bag including at least one opening for access to the inside chamber of the exterior bag; and a flexible security expansion panel coupled to the exterior bag, the security expansion panel comprising an exterior flexible material cover and a second substantially cut-resistant security panel assembly. A representative carrying bag may further comprise: a first fastener coupled to the at least one opening; a second fastener removably coupled between the first fastener and the exterior bag, the second fastener having a first spring bias to a closed or locked configuration; and a carry strap coupled to a third fastener, the third fastener removably coupled to the exterior bag, the third fastener having a second spring bias to a closed or locked configuration, the carry strap comprising a first flexible material and a first substantially cut-resistant cable.

In another representative embodiment, a carrying bag may comprise: a first substantially cut-resistant security panel assembly; an exterior bag having an inside chamber enclosing the security panel assembly, the exterior bag including at least one opening for access to the inside chamber of the exterior bag; a flexible security expansion panel coupled to the exterior bag, the security expansion panel comprising an exterior flexible material cover and a second substantially cut-resistant security panel assembly; a first fastener coupled to the at least one opening; a second fastener removably coupled between the first fastener and the exterior bag, the second fastener having a first spring bias to a closed or locked configuration; and a carry strap coupled to a third fastener, the third fastener removably coupled to the exterior bag, the carry strap comprising a first flexible material and a first substantially cut-resistant cable.

In another representative embodiment, an expandable carrying bag may comprise: a main body component configured to form an interior compartment to hold the plurality of contents; a secondary body component at least partially coupled to the main body component on a first side and having one or more second sides removably couplable to the main body component to access and to enclose the interior compartment, and a flexible security expansion panel couplable to the main body component or to the secondary body component, the security expansion panel comprising an exterior flexible material cover and a security panel assembly. For example, the main body component and secondary body component may be comprised of a hard polymeric material or a flexible material. Also for example, the security panel assembly may be integrated with the exterior flexible material cover.

In another representative embodiment, an expandable carrying bag may comprise: a main body component configured to form an interior compartment to hold the plurality of contents; a secondary body component at least partially coupled to the main body component on a first side and having one or more second sides removably couplable to the main body component to access and to enclose the interior compartment; and a flexible security expansion panel couplable to the main body component or to the secondary body component, the security expansion panel comprising an exterior flexible material cover and a security panel assembly, the security panel assembly comprising: a first security panel subassembly having a first lateral side and a first wire matrix; and a second security panel subassembly having a first lateral side and a second wire matrix, the first lateral side of the second security panel subassembly pivotably or rotatably coupled to the first lateral side of the first security panel subassembly to provide an expanded state and an unexpanded state of the security expansion panel.

In yet another representative embodiment, an expandable carrying bag may comprise: a main body component configured to form an interior compartment to hold the plurality of contents; a secondary body component at least partially coupled to the main body component on a first side and having one or more second sides removably couplable to the main body component to access and to enclose the interior compartment; a flexible security expansion panel couplable to the main body component or to the secondary body component, the security expansion panel comprising an exterior flexible material cover and a security panel assembly; a first fastener coupled to the main body component and the secondary body component; a second fastener removably coupled between the first fastener and either or both the main body component and the secondary body component, the second fastener having a first spring bias to a closed or locked configuration; and a carry strap coupled to a third fastener, the third fastener removably coupled to either or both the main body component and the secondary body component, the carry strap comprising a first flexible material and a first substantially cut-resistant cable.

A method of making such a security panel assembly is also disclosed, with the method comprising: routing a first wire in a first predetermined pattern on a first flexible material layer; routing a second wire in a second predetermined pattern on a second flexible material layer; positioning the second material layer having the second wire in the second predetermined pattern to be substantially orthogonal to the first predetermined pattern; and coupling the positioned second flexible material layer having the second wire to the first flexible material layer having the first wire to form the security panel assembly.

A method of making a security panel assembly is also disclosed, with a representative method comprising: routing a single wire in a predetermined pattern above a first, upwardly facing surface of a first material layer to form a wire matrix, the wire having first and second ends, the wire matrix comprising a plurality of wire crossings forming a plurality of closed wire shapes, each wire crossing comprising at least two sections of wire abutting but uncoupled to each other; and coupling a first side of a second material layer to the wire matrix and the first material layer to form the security panel assembly.

In a representative embodiment, the step of coupling further comprises applying an adhesive, which may consist of exposing a pre-applied adhesive on the first material layer or the second material layer. The step of coupling may further comprise applying downward pressure on the second material layer.

In a representative embodiment, the method may further comprise, prior to routing the wire, mounting the first material layer to a fixture having a plurality of mounting members. The mounting members may comprise a plurality of mounting pegs or needles. The mounting step may further comprise fitting the plurality of mounting members into corresponding openings of the first material layer. The routing step may further comprise routing the wire in the predetermined pattern about the mounting members to form the plurality of wire crossings.

In a representative embodiment, the method may further comprise stitching the second flexible material layer to the first flexible material layer with a plurality of stitches having a predetermined pattern, such as a sawtooth pattern. In another representative embodiment, the method may further comprise stitching the second flexible material layer to the first flexible material layer using at least one stitch pattern within one or more of the closed wire shapes of the plurality of closed wire shapes and without crossing the wire matrix, such as using a rectangular stitch pattern, a circular stitch pattern, a diamond stitch pattern, a bar tack stitch pattern; and combinations thereof.

In a representative embodiment, the routing step may further comprise: routing the wire to form a plurality of bent or curved portions of the wire matrix adjacent and spaced apart from a periphery of the first flexible material layer; coupling a plurality of stabilizing anchors, each stabilizing anchor coupled to a bent or curved portion of the wire matrix; and/or routing the wire to space the first end and second end apart from the periphery further than and closer to a center of the first flexible material layer than the bent or curved portions of the wire matrix. In a representative embodiment, the method may further comprise coupling at least one polymeric cap to the first end or to the second end of the single wire or to both the first end and the second end of the single wire.

In another a representative embodiment, the routing step may further comprise routing the wire in the predetermined pattern to form a plurality of subpanels, each subpanel having a section of a plurality of sections of the wire matrix, and forming a single crossing between adjacent subpanels of the plurality of subpanels without any closed wire shapes. In a representative embodiment, the method may further comprise folding adjacent subpanels into a closed or compressed configuration or into an open or expanded configuration, or folding adjacent subpanels to form a gusseted configuration.

In another representative embodiment, the method may further comprise, prior to routing the wire, attaching a tab, flange or panel member on a second side of the first material layer, and/or attaching a tab, flange or panel member on a second side of the second material layer. In a representative embodiment, the method may further comprise, prior to coupling the second material layer, attaching a plurality of pre-stitched flanges or panel members on a second side of the second flexible material layer, in a position that when the security panel assembly is folded into a box shape, each pre-stitched flange or panel member is disposed at a corresponding corner.

In another a representative embodiment, the first flexible material layer further comprises a first plurality of edges, and the method may further comprise, using the first plurality of edges, forming a plurality of flanges or panel members for securing the security panel assembly within an interior of a carrying bag, including within center and bottom edge seams of the carrying bag. In another a representative embodiment, the second flexible material layer further comprises a second plurality of edges, and the method may further comprise: using the second plurality of edges, forming a plurality of flanges or panel members for securing the security panel assembly within an interior of a carrying bag, also within center and bottom edge seams of the carrying bag.

In a representative embodiment, the method may further comprise folding the security panel assembly into a box shape, and may also include riveting a plurality of sides of the folded security panel assembly to maintain the box shape.

In a representative embodiment, the method does not including crimping the wire matrix.

In another representative embodiment, the method may comprise: forming or attaching a tab, flange or panel member to a first material layer or to a second material layer; mounting the first material layer to a fixture having a plurality of mounting members; applying an adhesive or exposing a pre-applied adhesive a first, upwardly facing surface of the first material layer; routing a single wire in a predetermined pattern about the mounting members and above the first, upwardly facing surface of the first material layer to form a wire matrix, the wire having first and second ends, the wire matrix comprising a plurality of wire crossings forming a plurality of closed wire shapes, each wire crossing comprising at least two sections of wire abutting but uncoupled to each other; applying downward pressure to couple a first side of the second material layer to the wire matrix and the first material layer to form the security panel assembly; and stitching the second flexible material layer to the first flexible material layer with a plurality of stitches having a predetermined pattern.

In another representative embodiment, the method may comprise: forming or attaching a tab, flange or panel member to a first material layer or to a second material layer; mounting the first material layer to a fixture having a plurality of mounting members; applying an adhesive or exposing a pre-applied adhesive a first, upwardly facing surface of the first material layer; routing a single wire in a predetermined pattern about the mounting members and above the first, upwardly facing surface of the first material layer to form a wire matrix having a plurality of bent or curved portions adjacent and spaced apart from a periphery of the first flexible material layer and further having a first end and a second end of the single wire spaced apart from the periphery further than and closer to a center of the first flexible material layer than the bent or curved portions, the wire matrix further having a plurality of wire crossings forming a plurality of closed wire shapes, each wire crossing comprising at least two sections of wire abutting but uncoupled to each other; coupling at least one polymeric cap to the first end or to the second end of the single wire or to both the first end and the second end of the single wire; applying downward pressure to couple a first side of the second material layer to the wire matrix and the first material layer to form the security panel assembly; and stitching the second flexible material layer to the first flexible material layer with a plurality of stitches having a predetermined pattern.

Numerous other advantages and features of the present invention will become readily apparent from the following detailed description of the invention and the embodiments thereof, from the claims and from the accompanying drawings.

BRIEF DESCRIPTIONS OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

Figure 19:
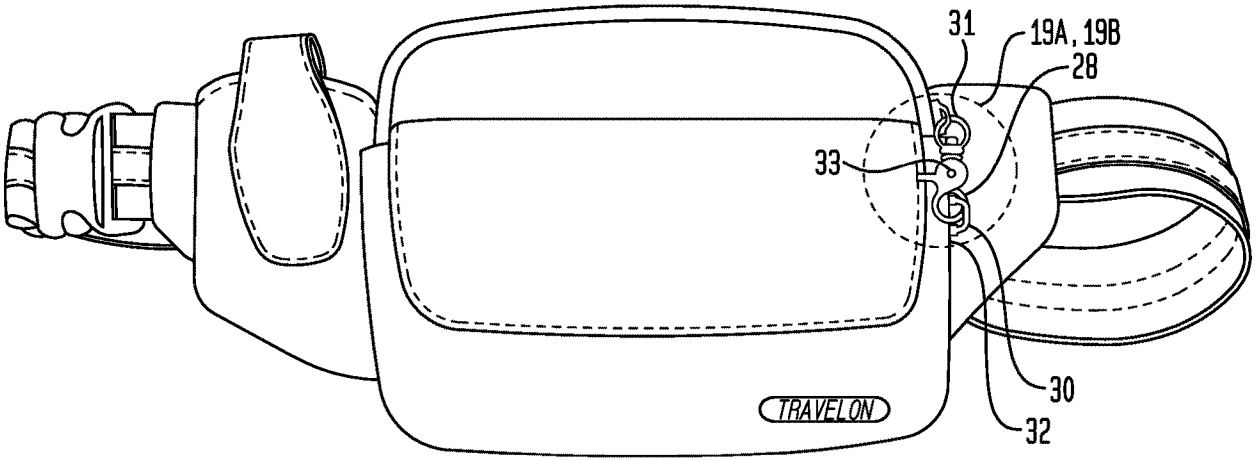
Figure 19B:
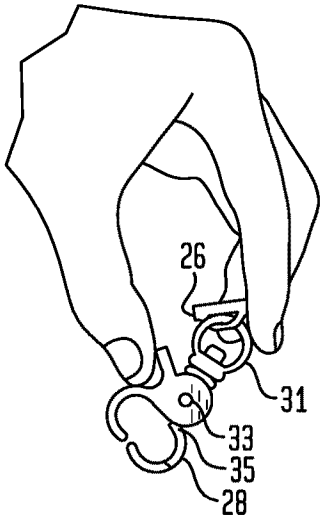
Figure 19A:
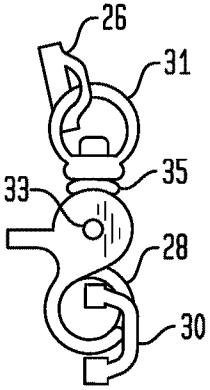
Figure 21:
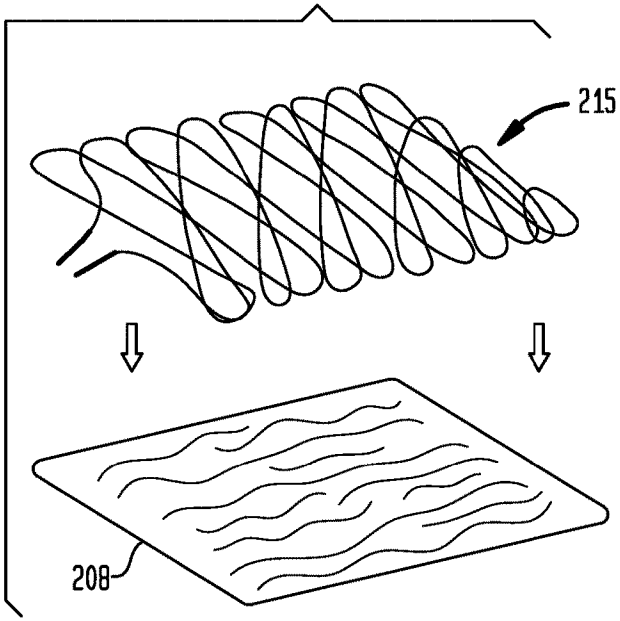
Figure 20:
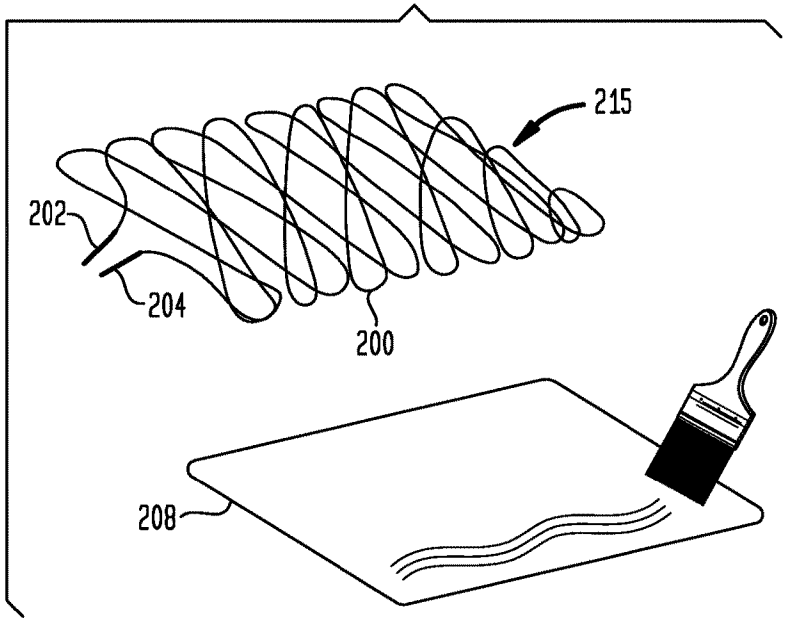
Figure 22:
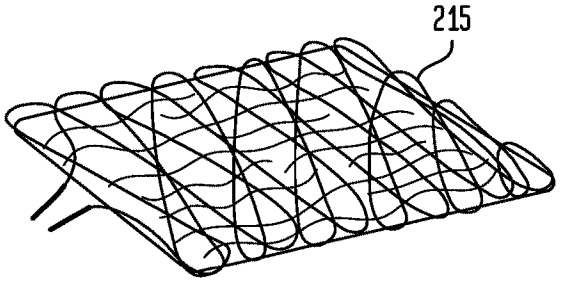
Figure 23:
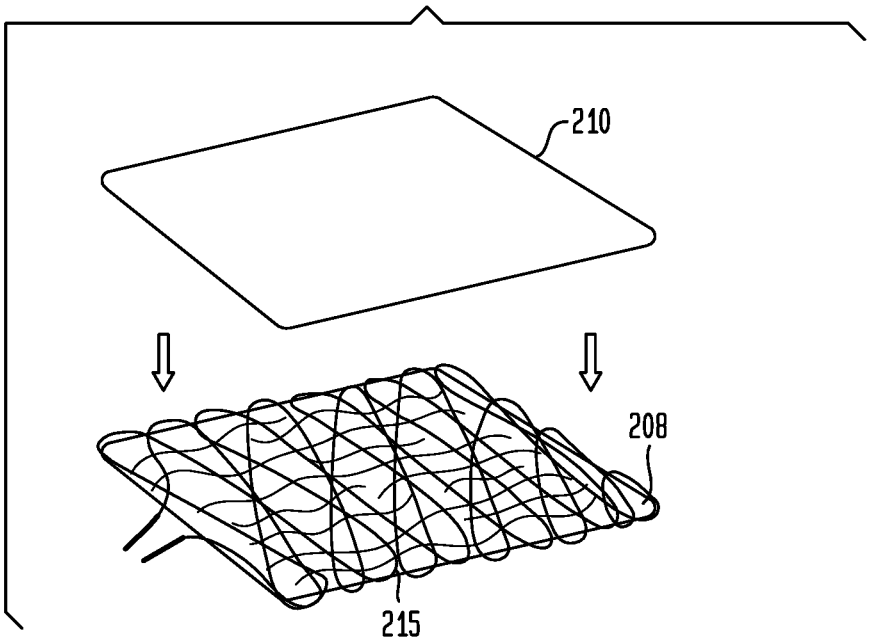
Figure 24:
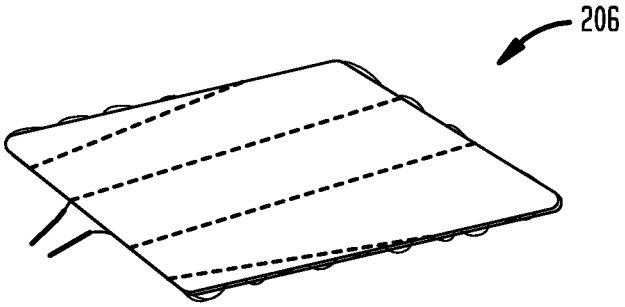
Figure 25:
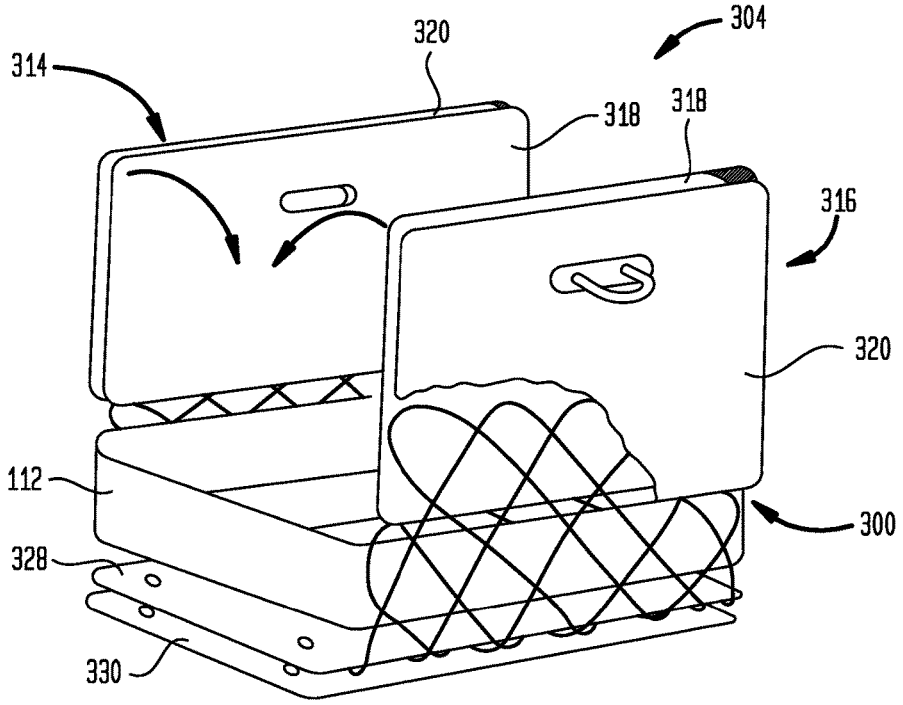
Figure 26:
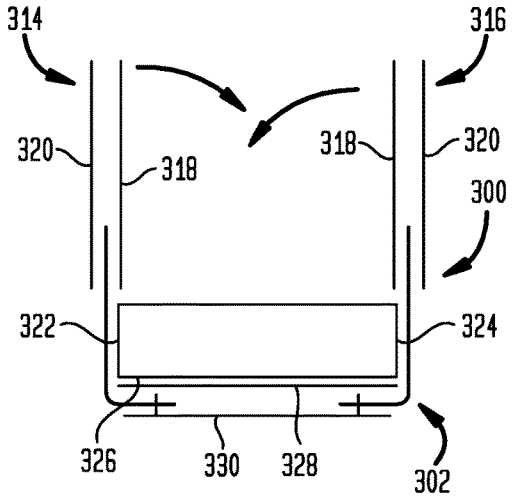
Figure 27:
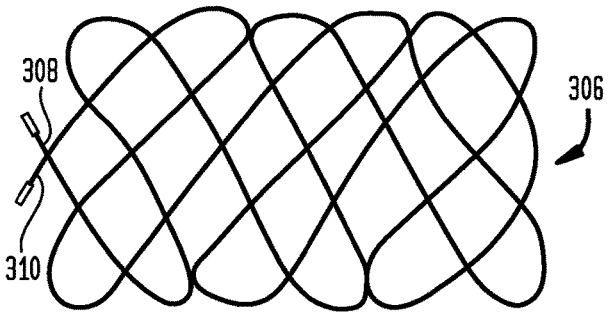
Figure 28:
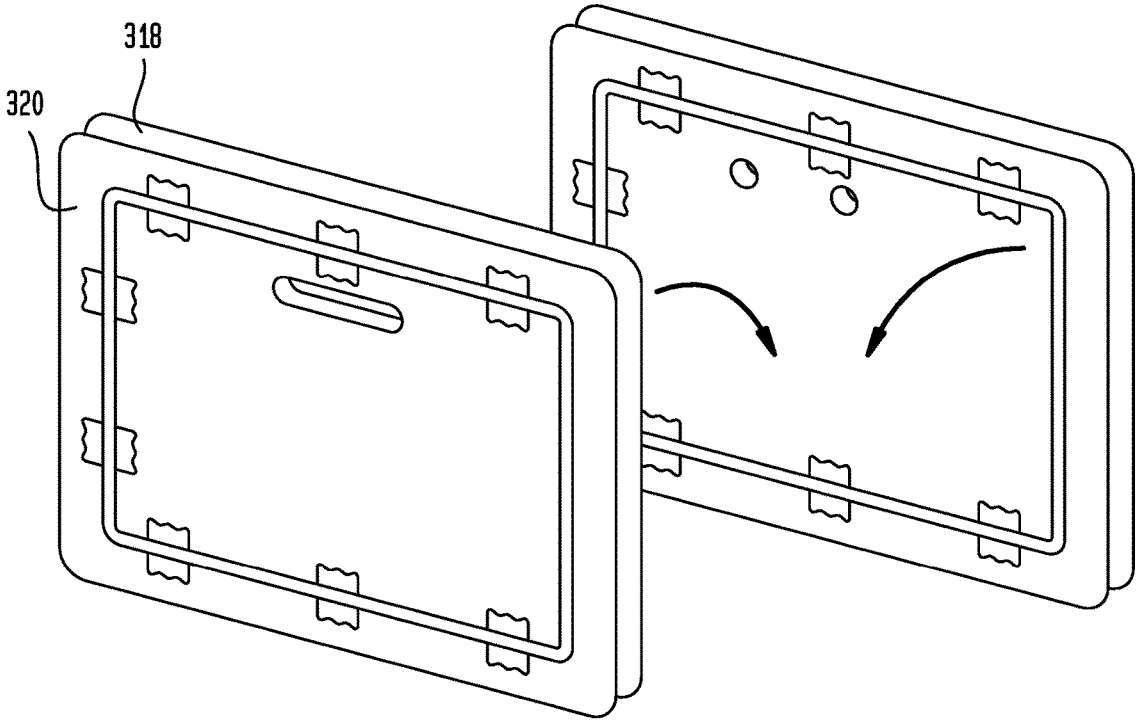
Figure 29:
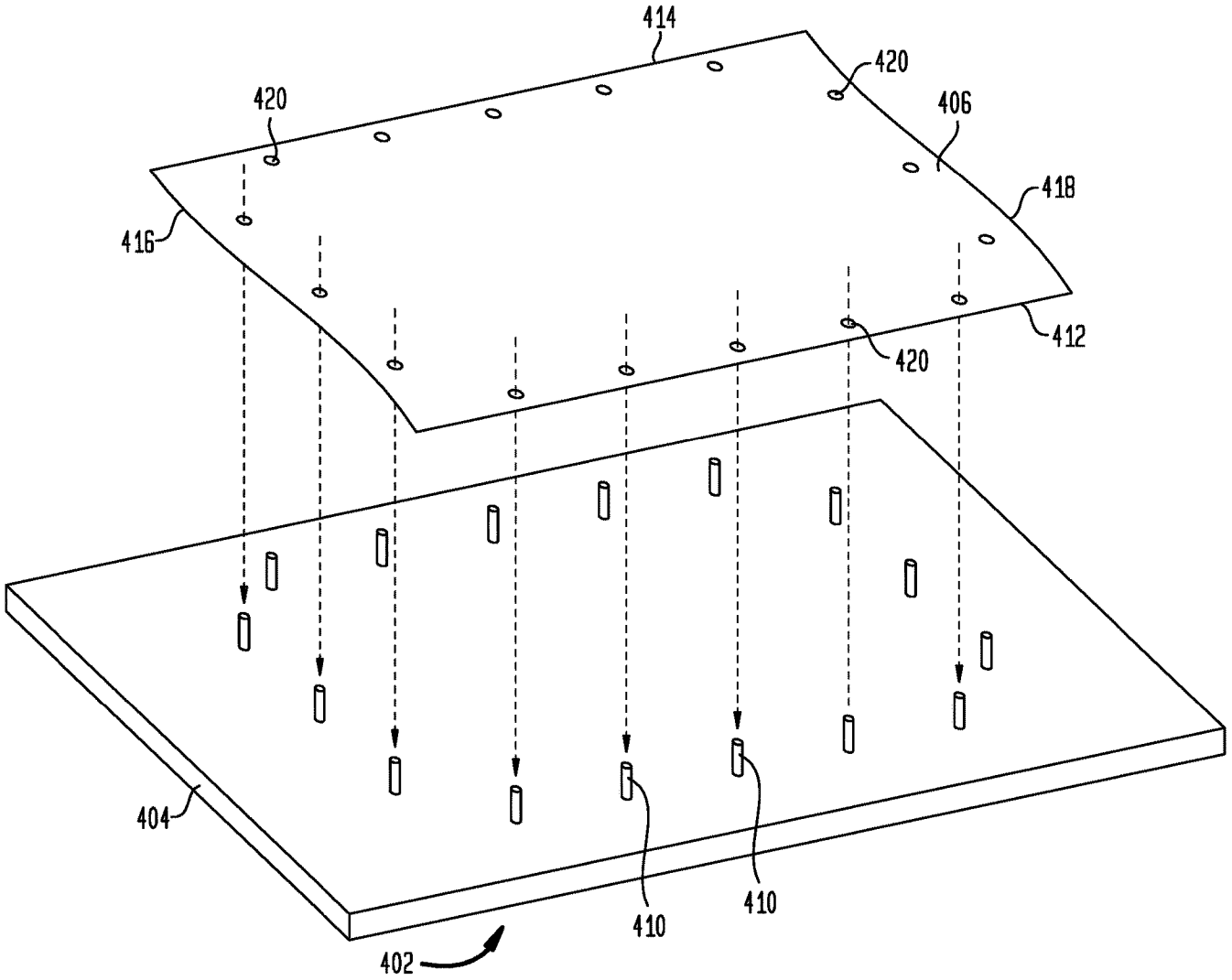
Figure 31:
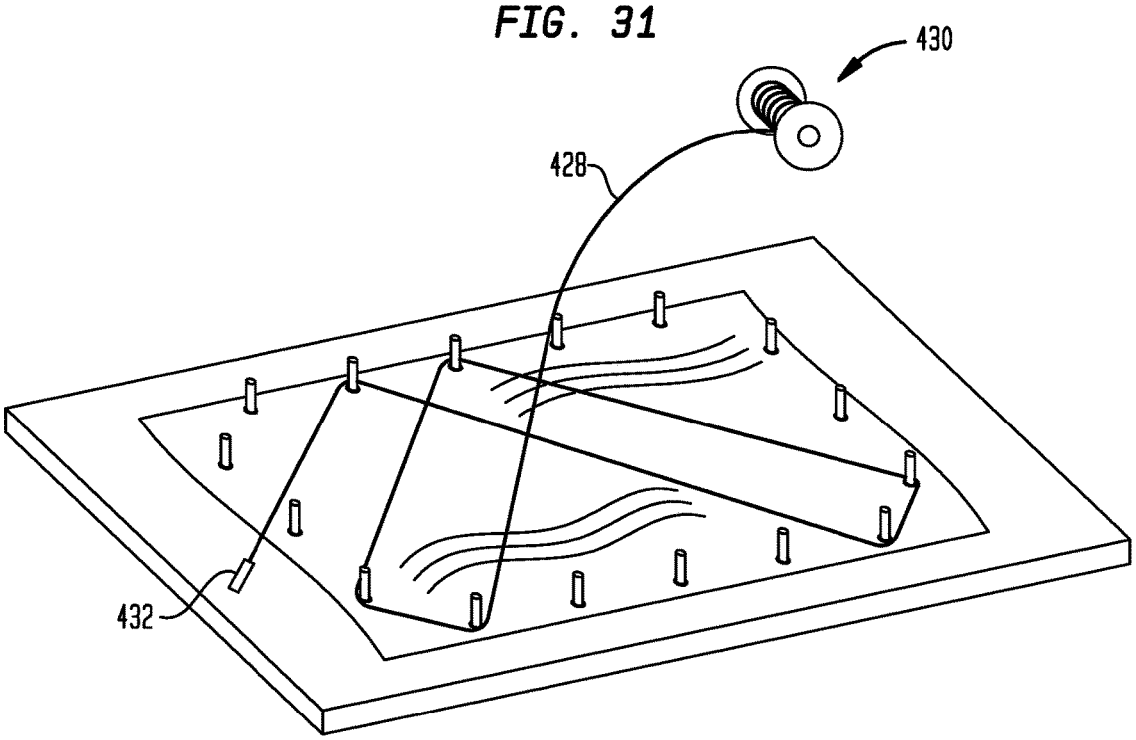
Figure 32:
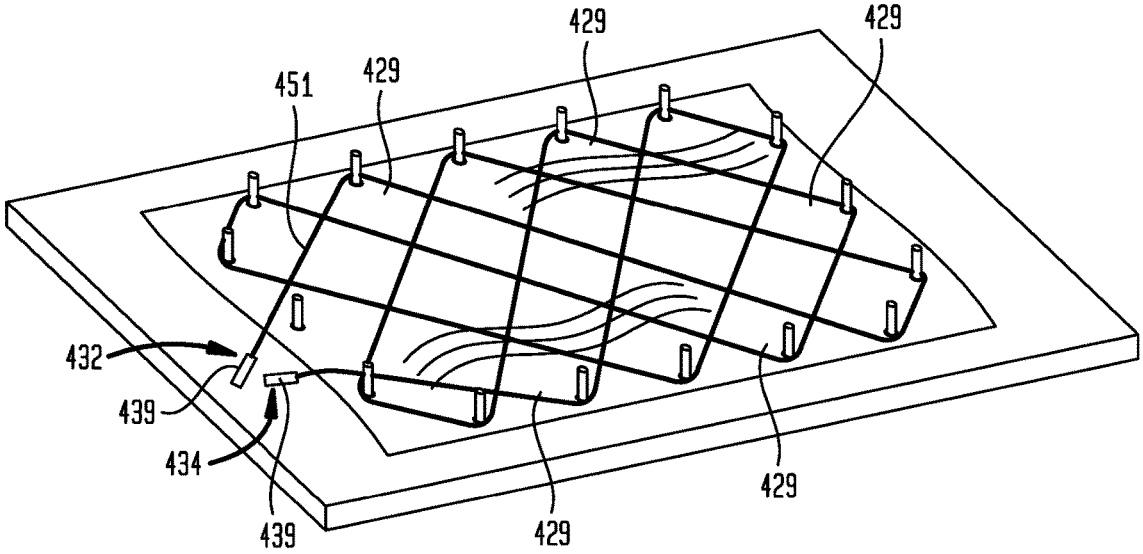
Figure 33A:
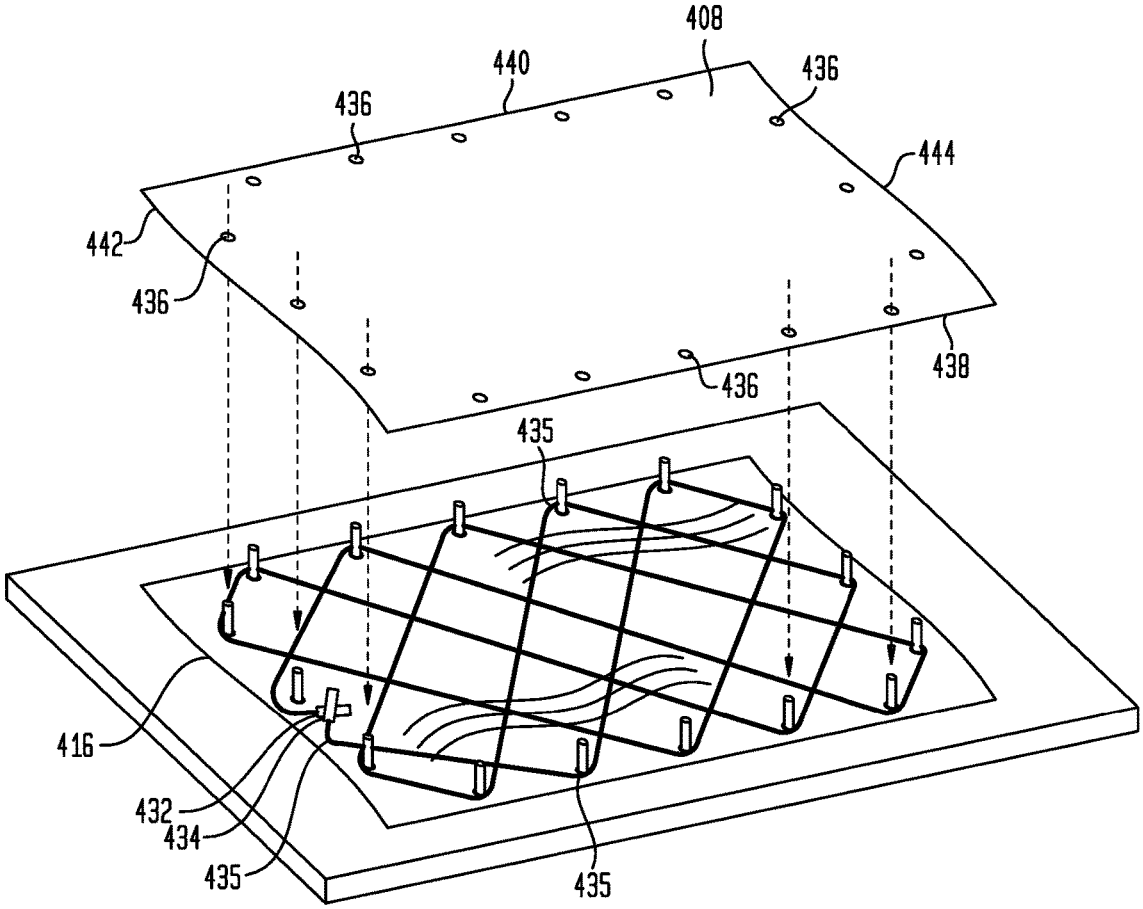
Figure 33B:
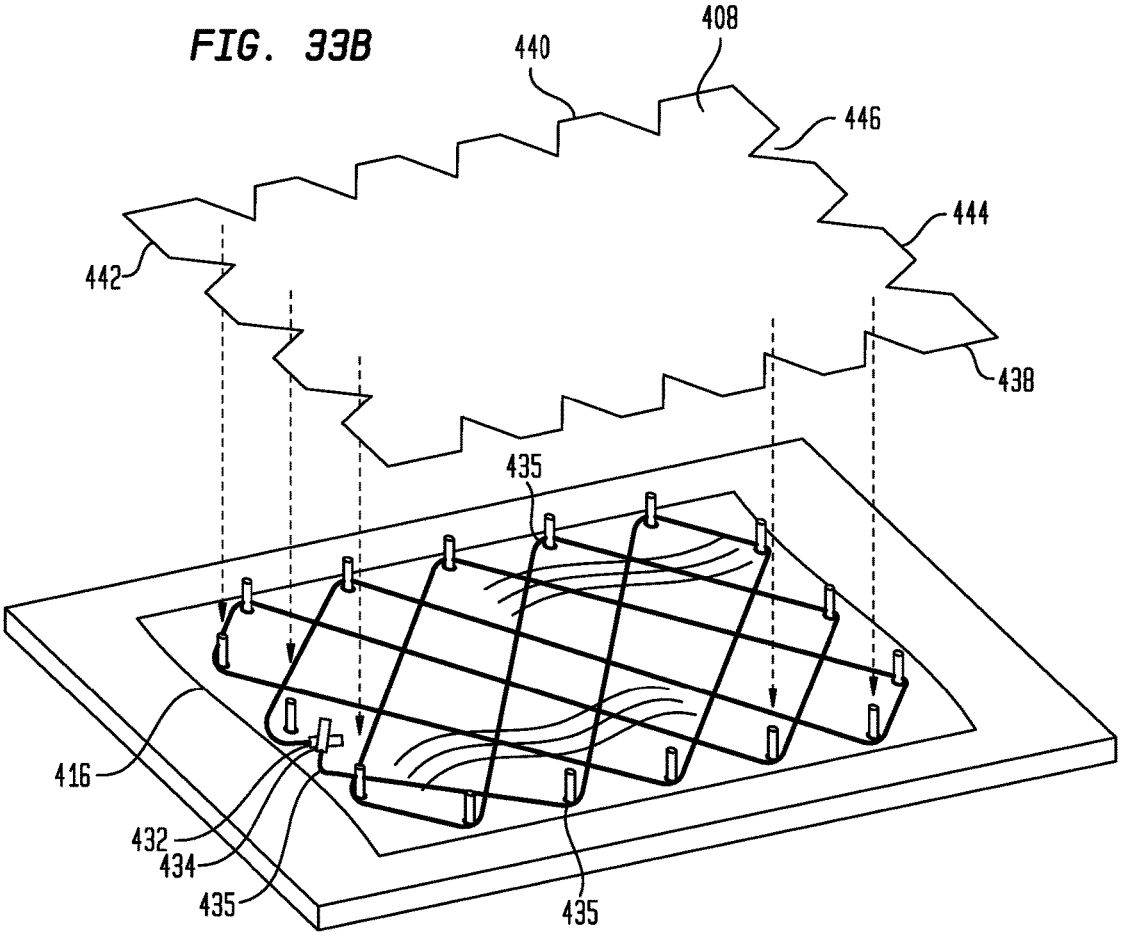
Figure 37:
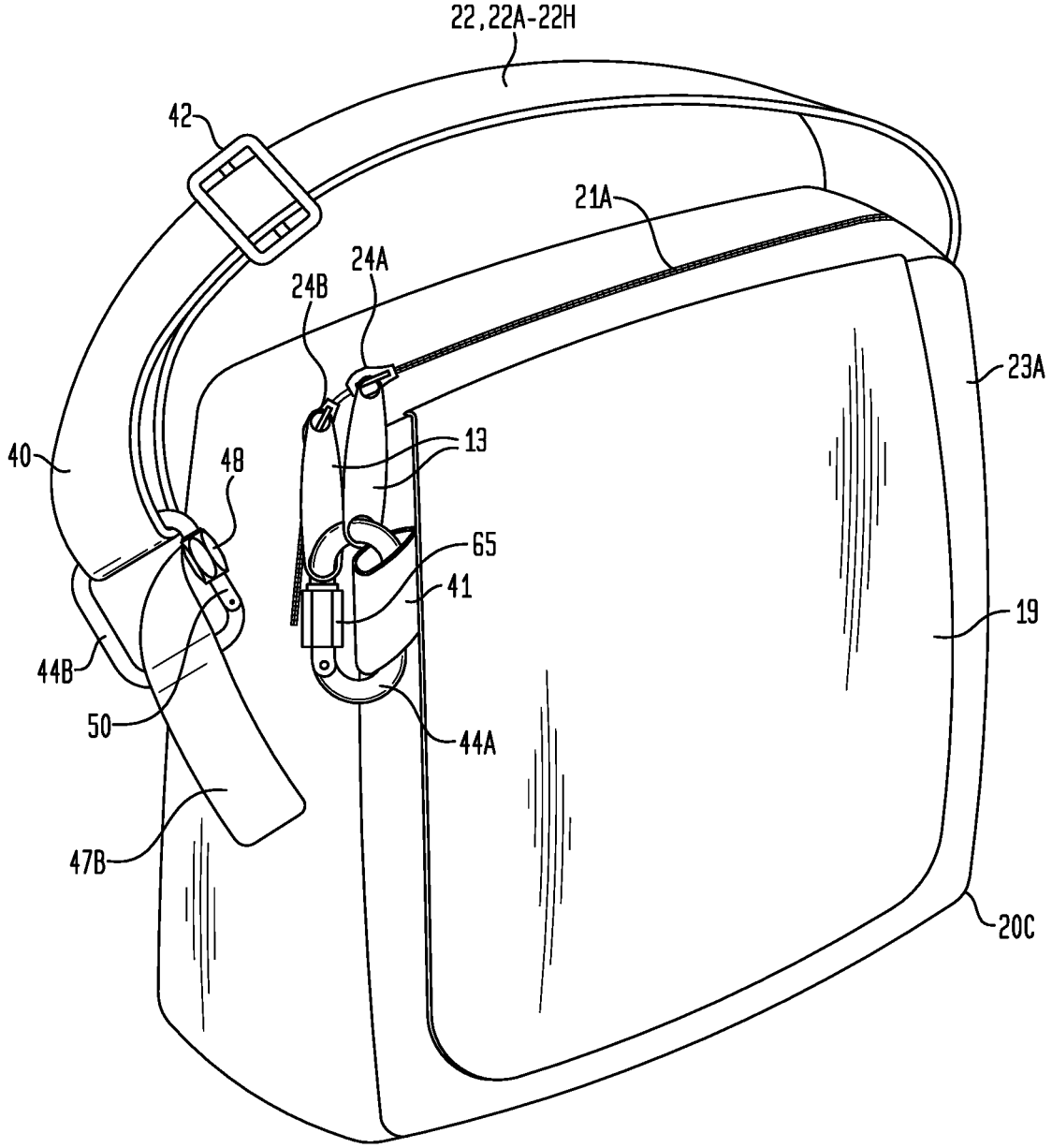
Figure 37A:
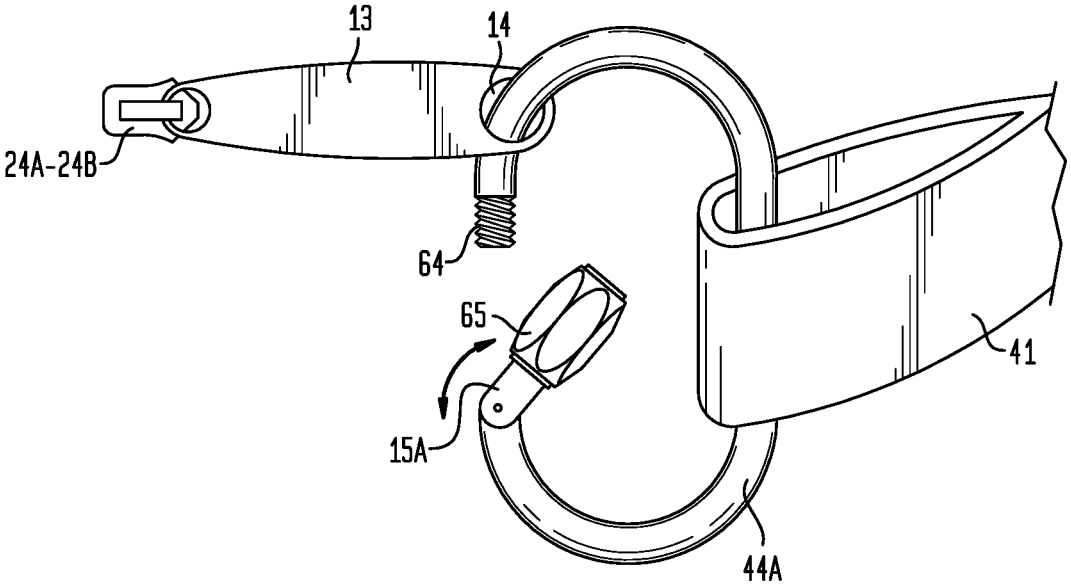
Figure 38:
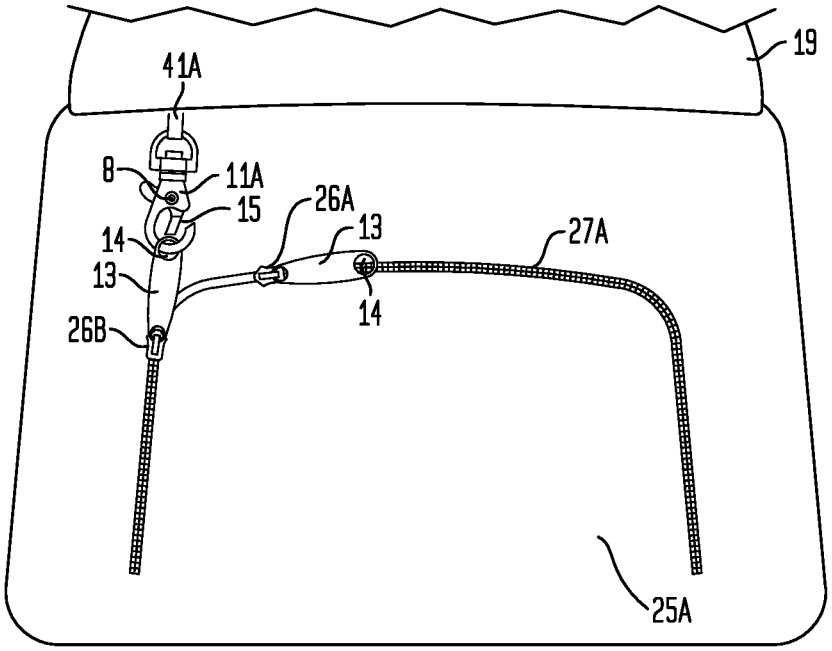
Figure 38A:
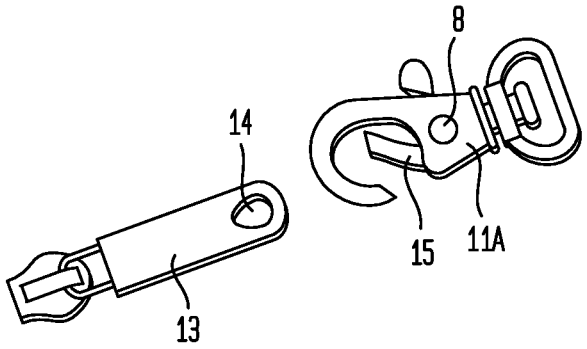
Figure 38B:
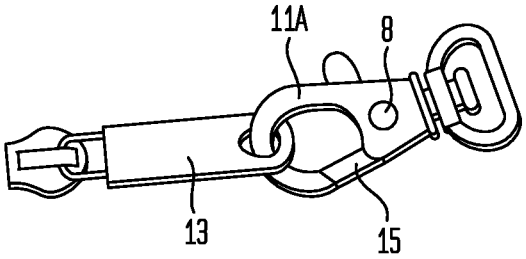
Figure 38C:
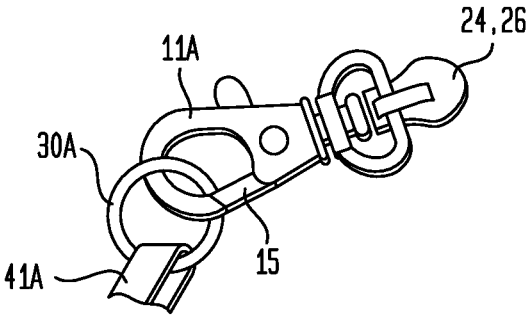
Figure 39:
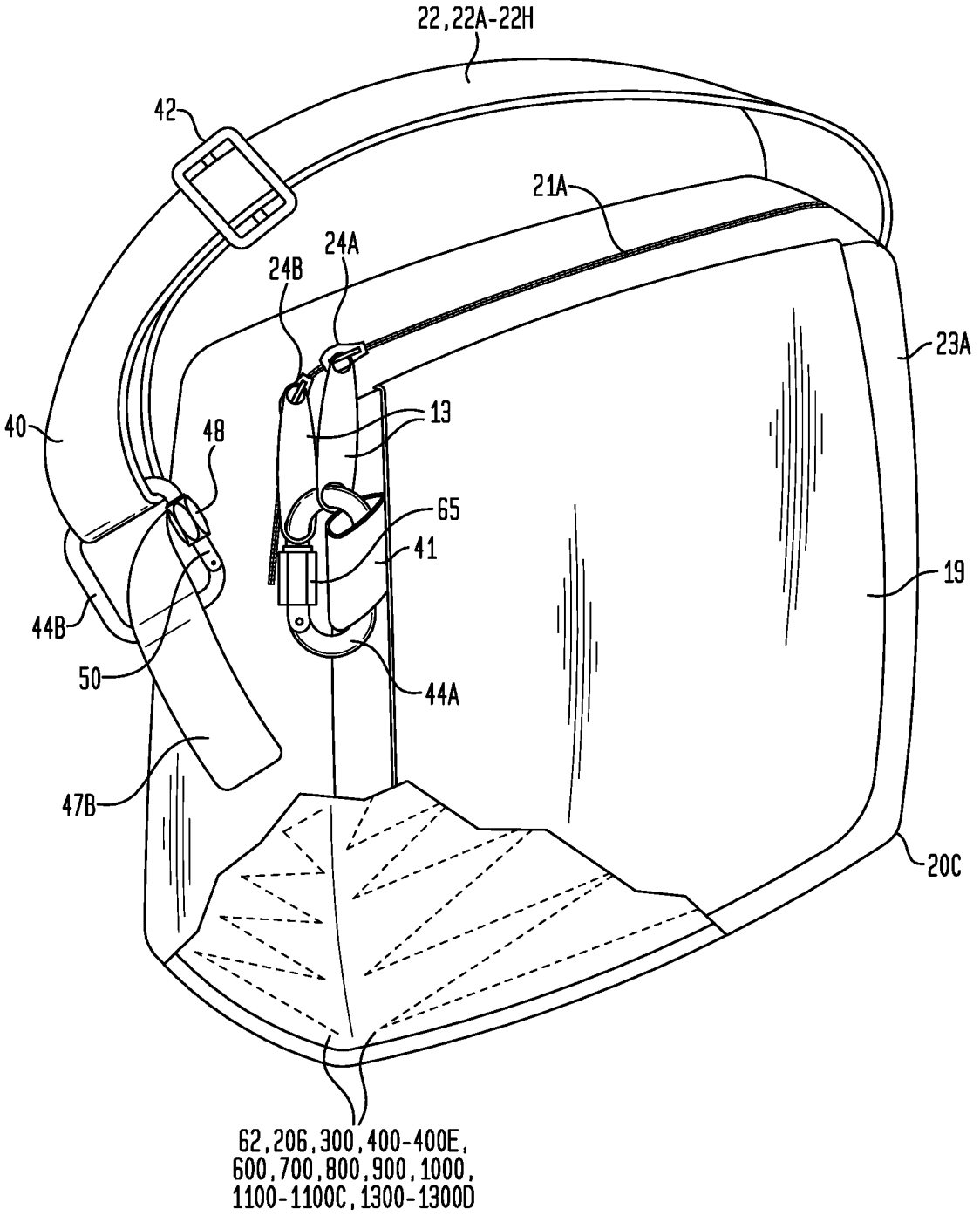
Figure 41:
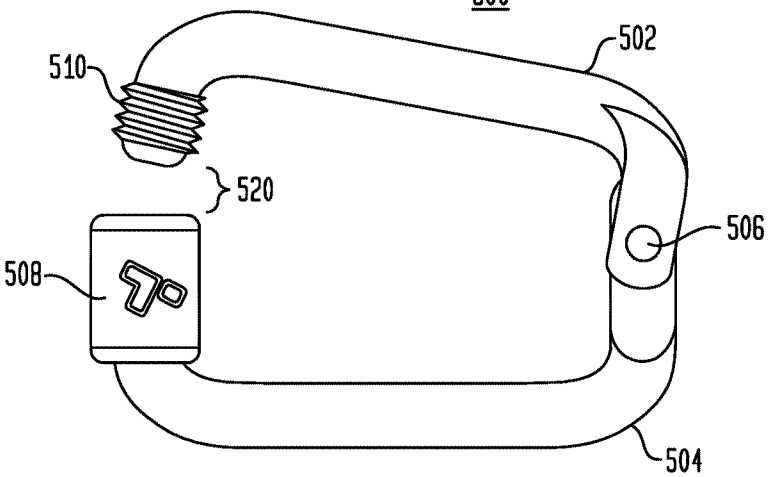
Figure 40:
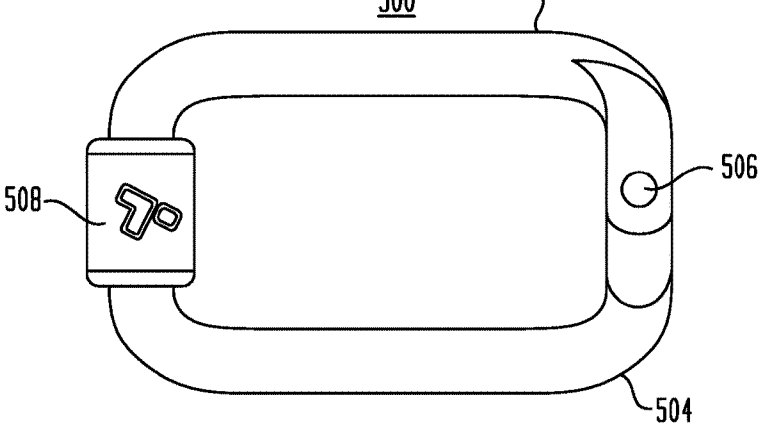
Figure 43:
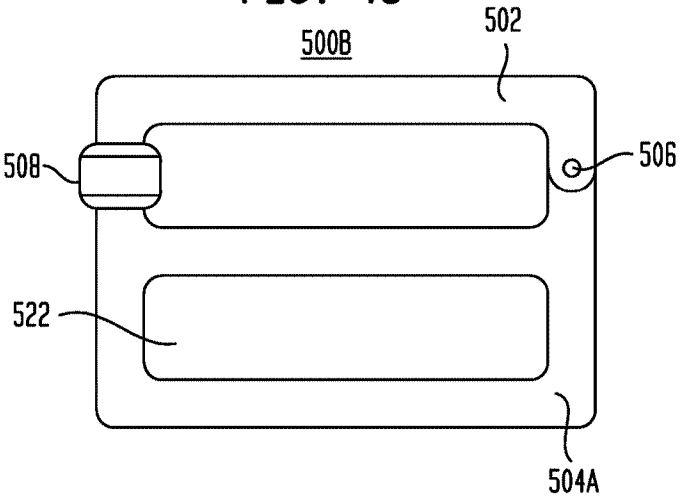
Figure 42:
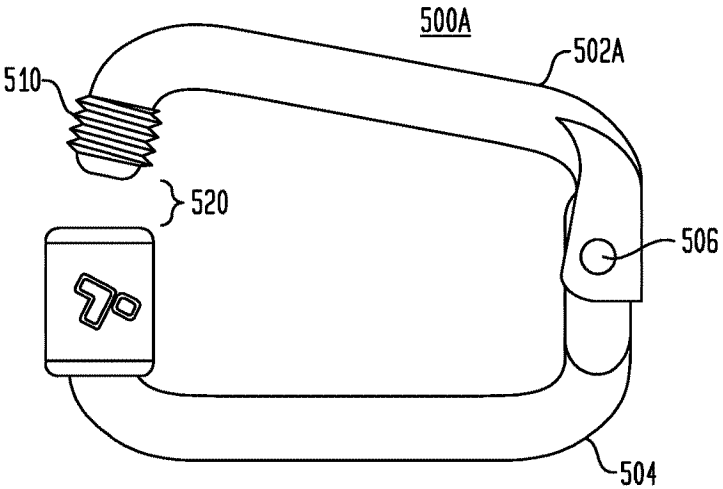
Figure 44:
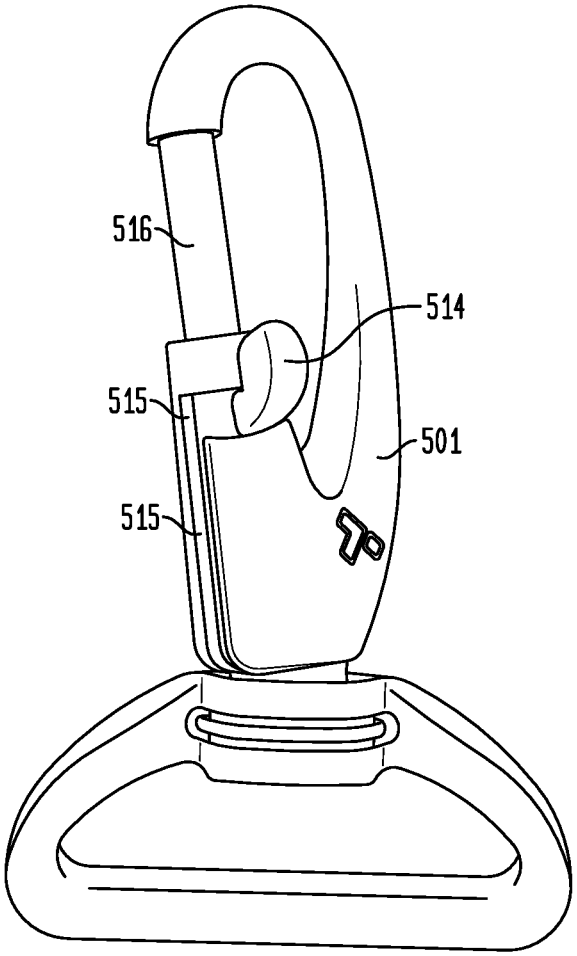
Figure 45:
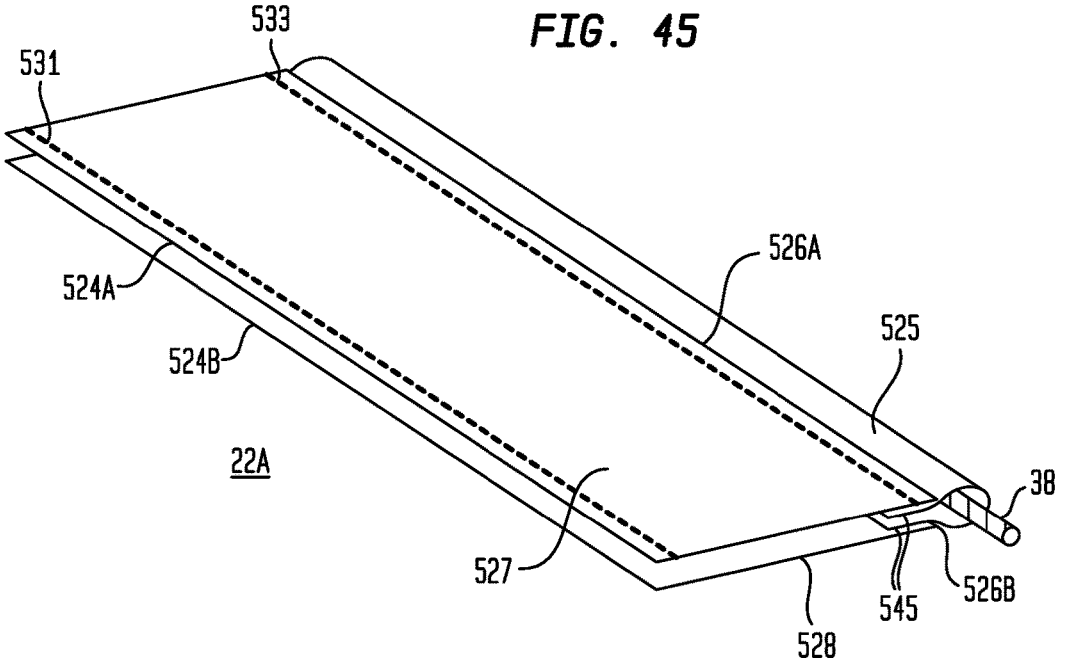
Figure 46:
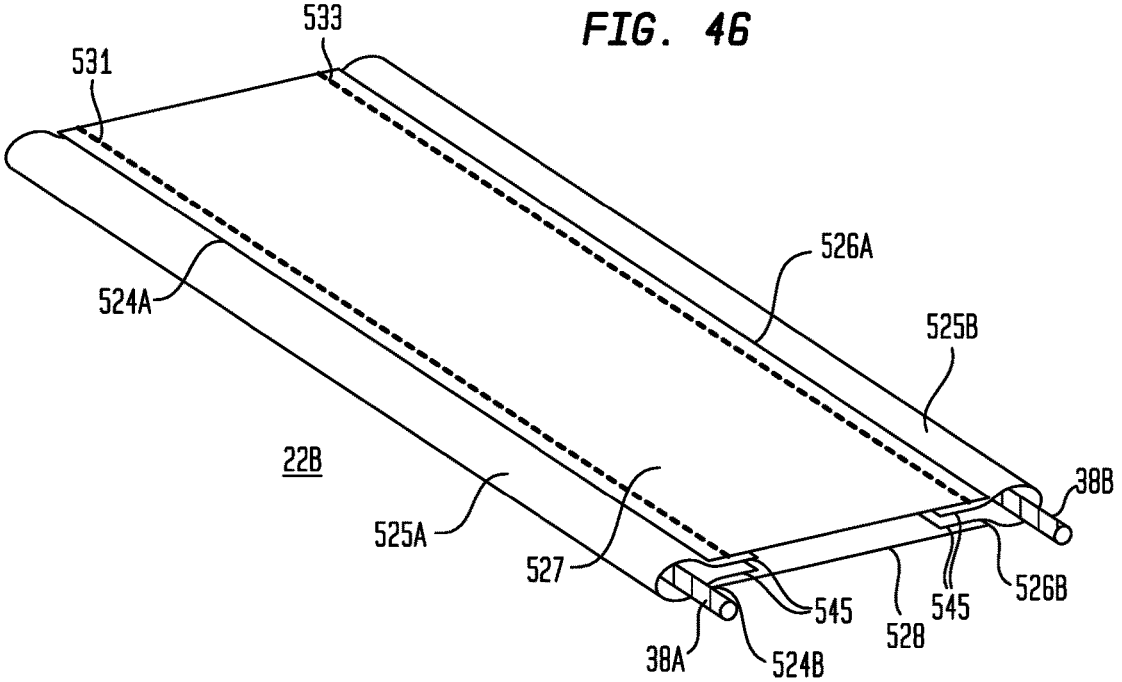
Figure 47:
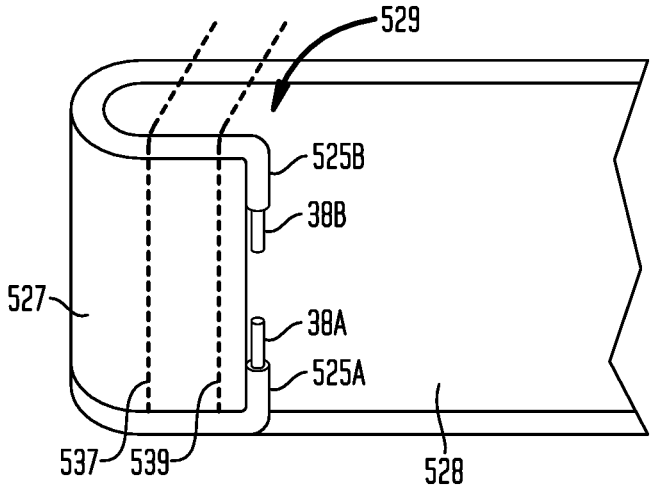
Figure 48:
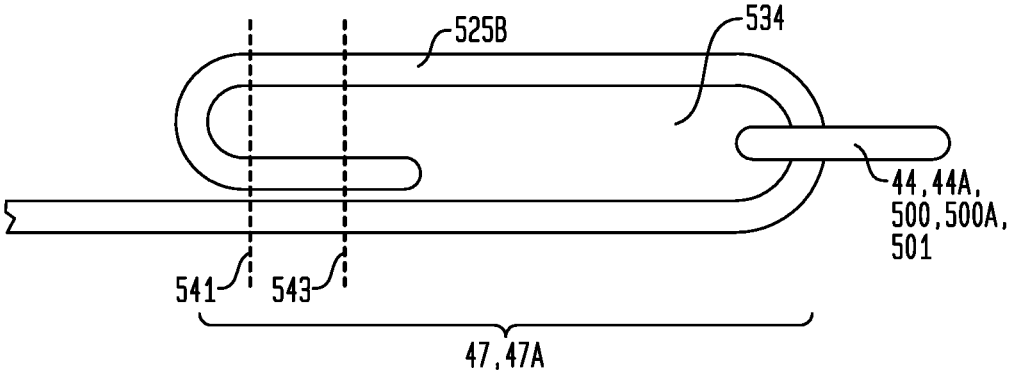
Figure 49:
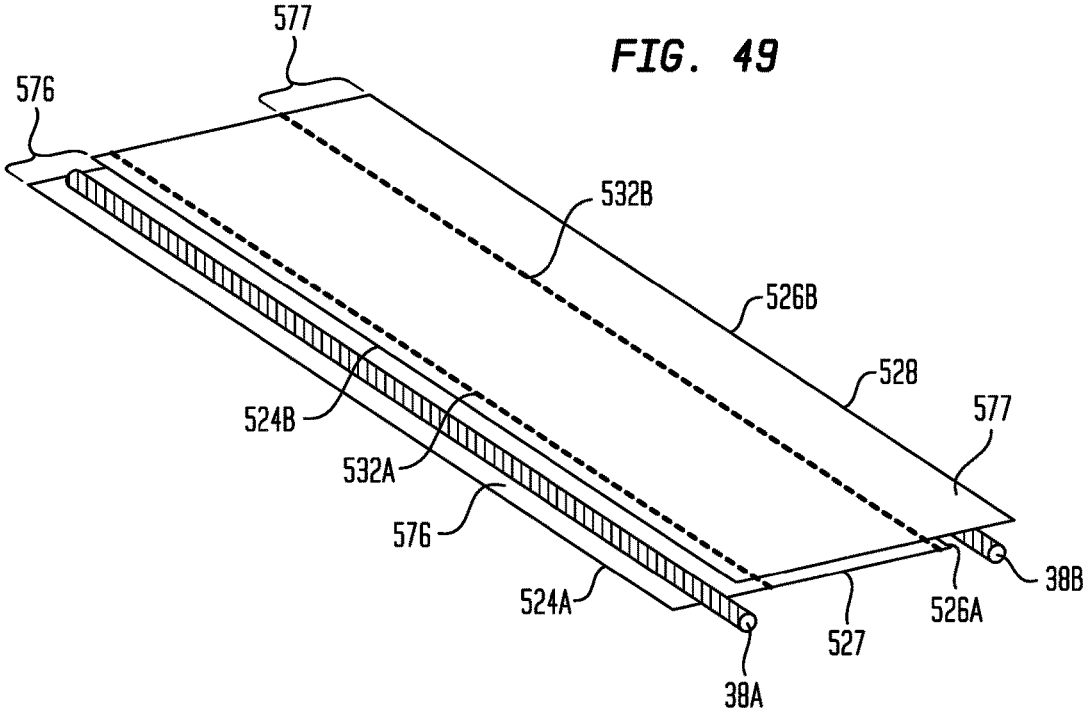
Figure 50:
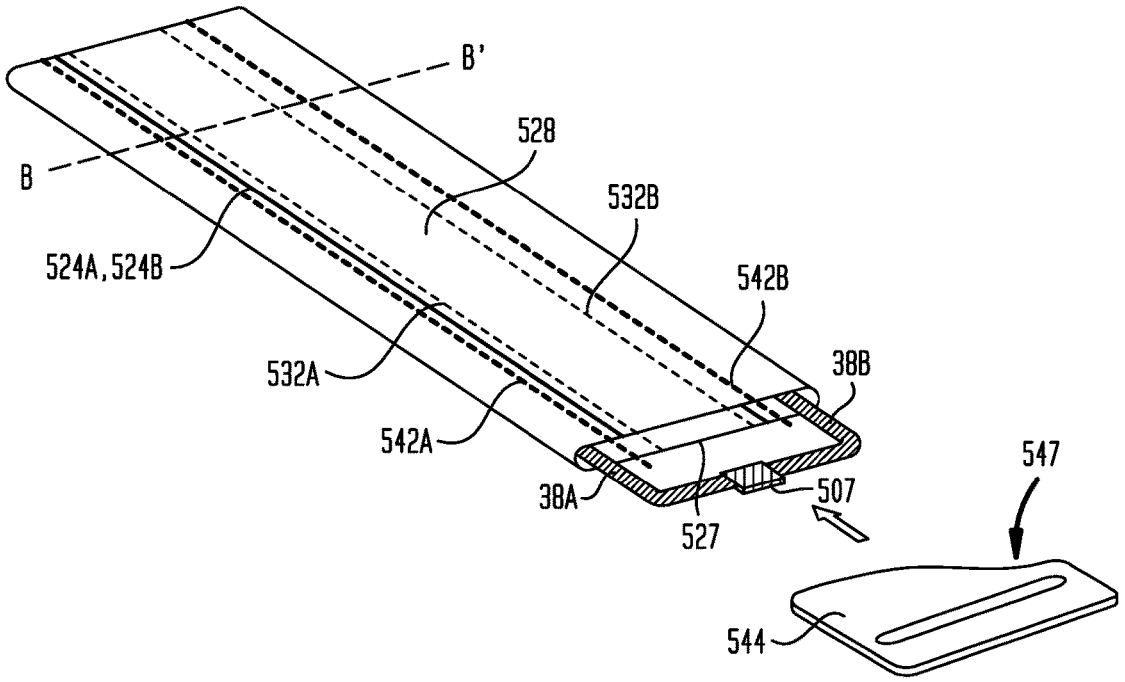
Figure 51:
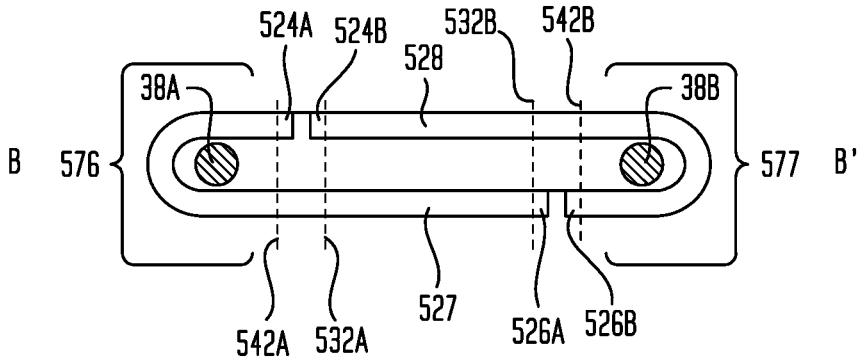
Figure 52:
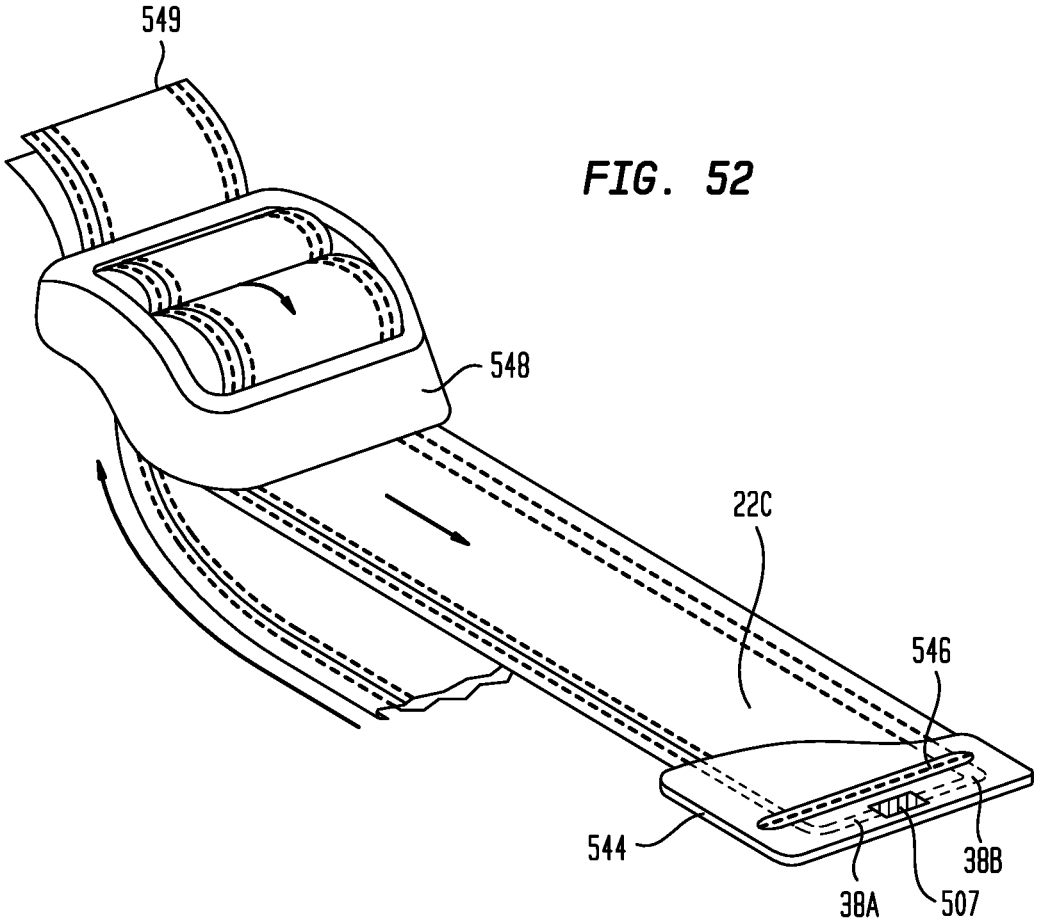
Figure 53:
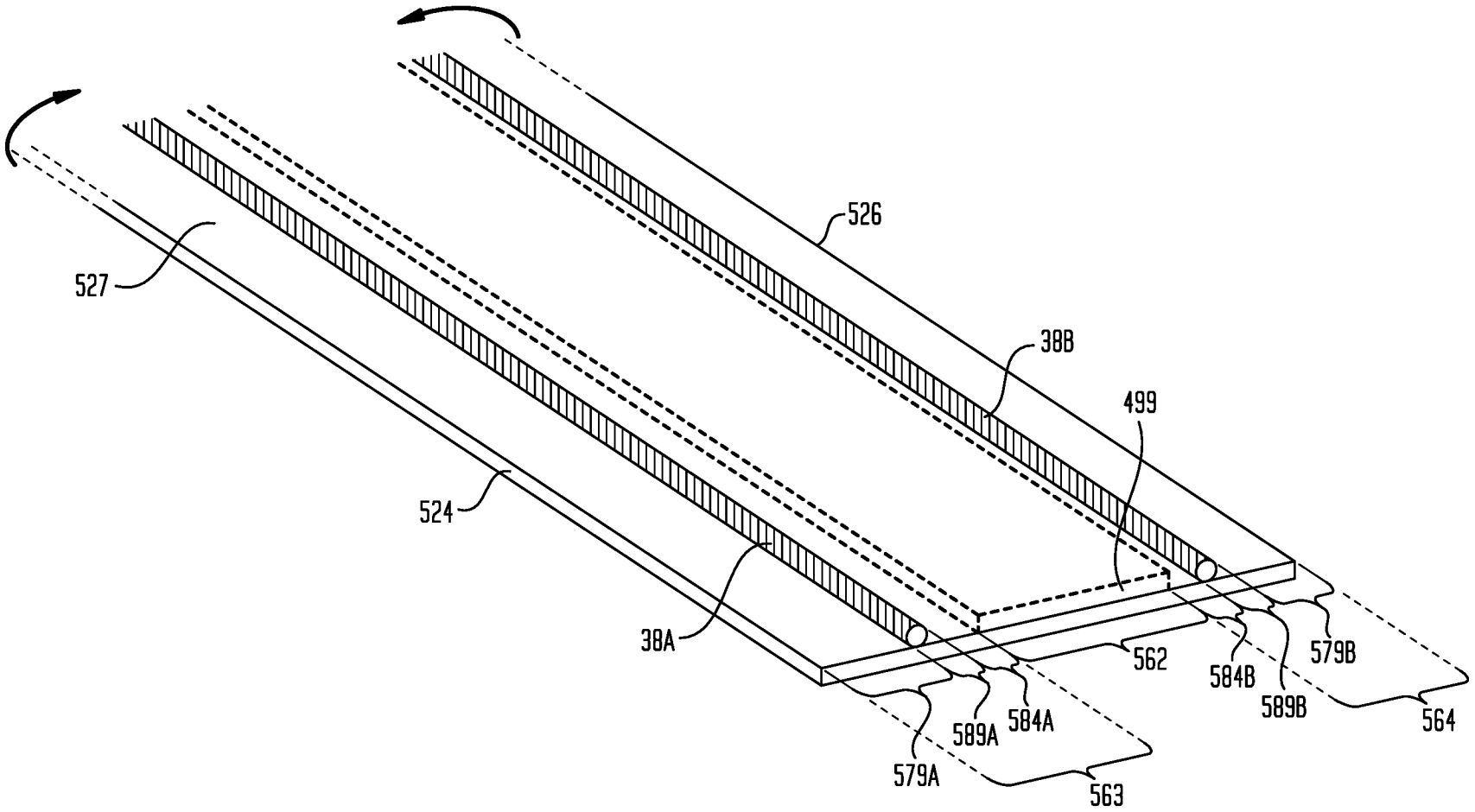
Figure 54:
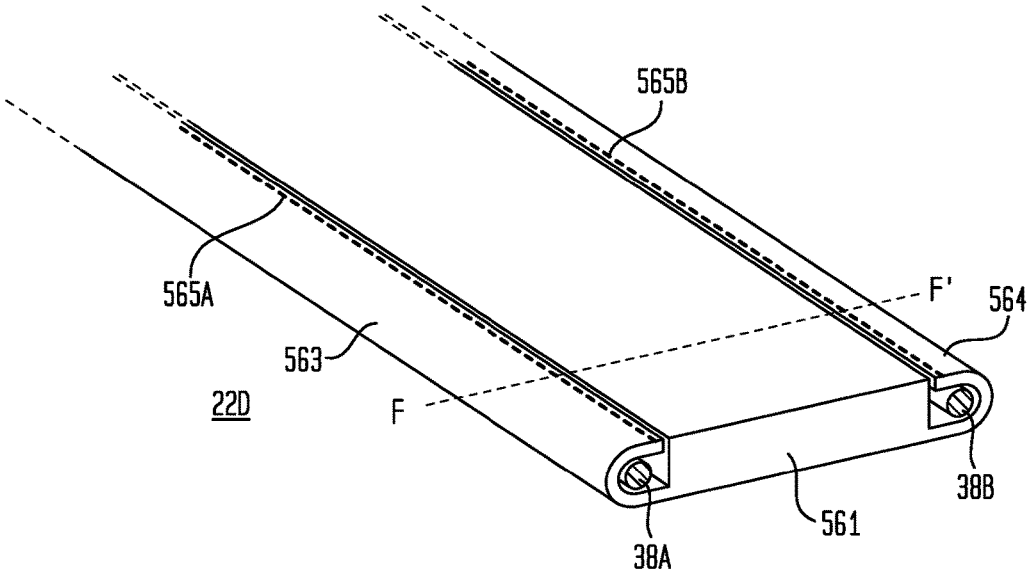
Figure 55:
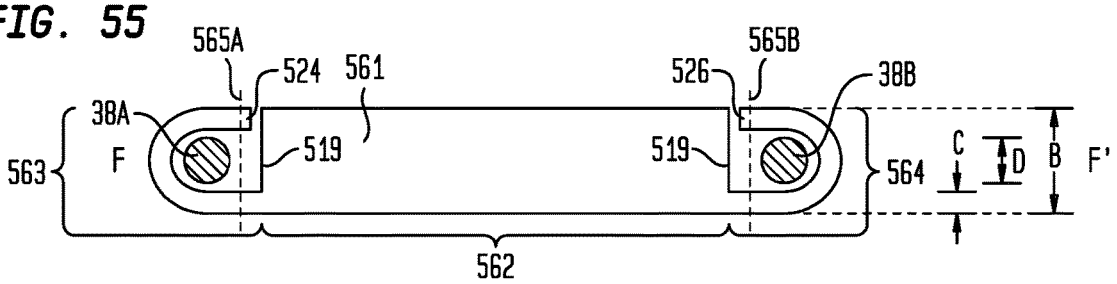
Figure 56:
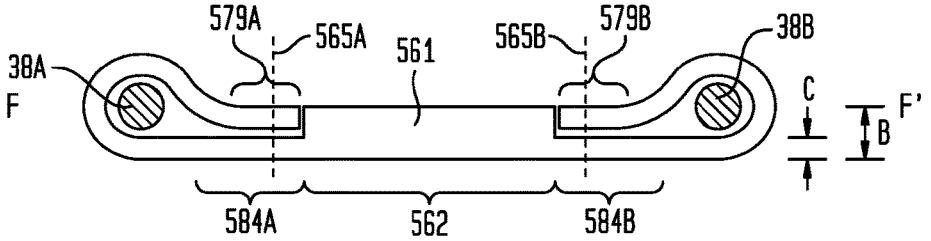
Figure 57:
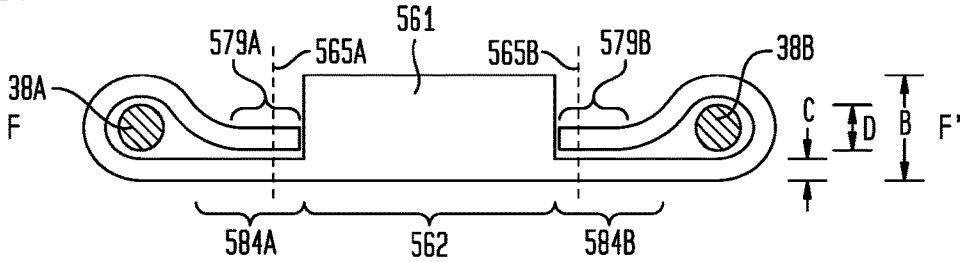
Figure 58:
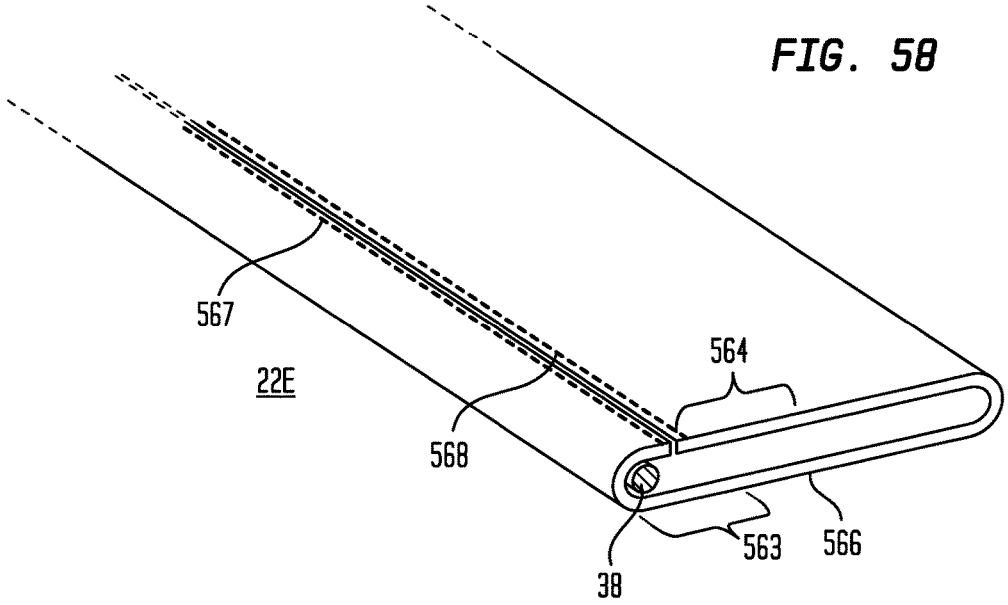
Figure 59:
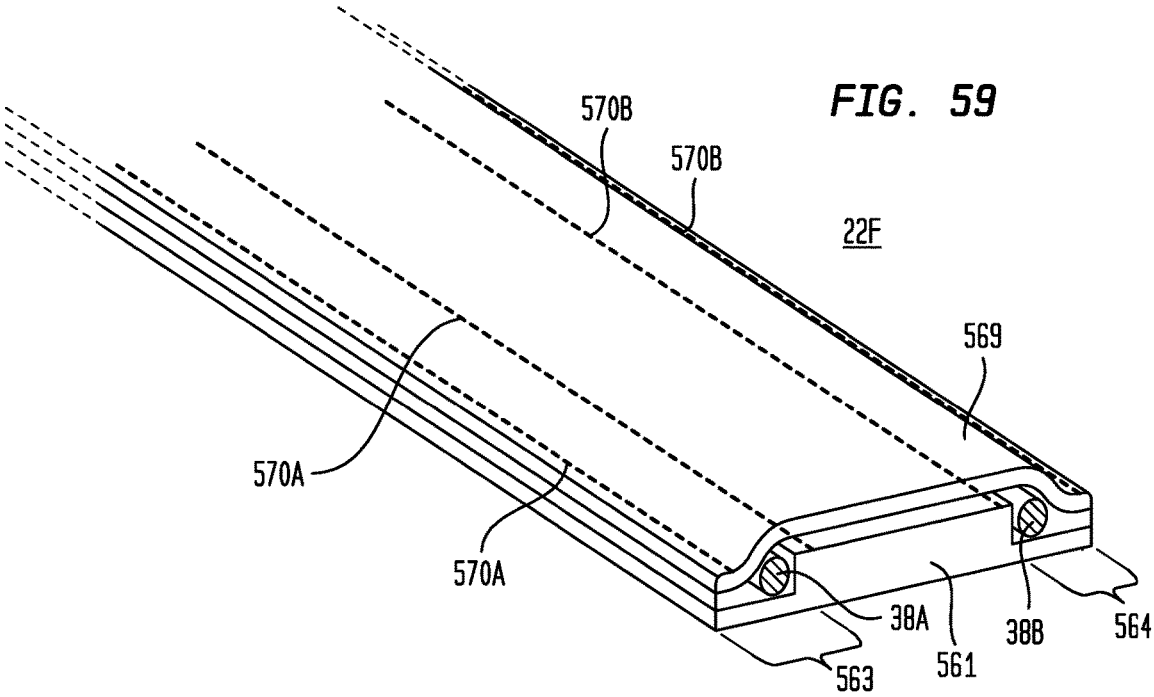
Figure 60:
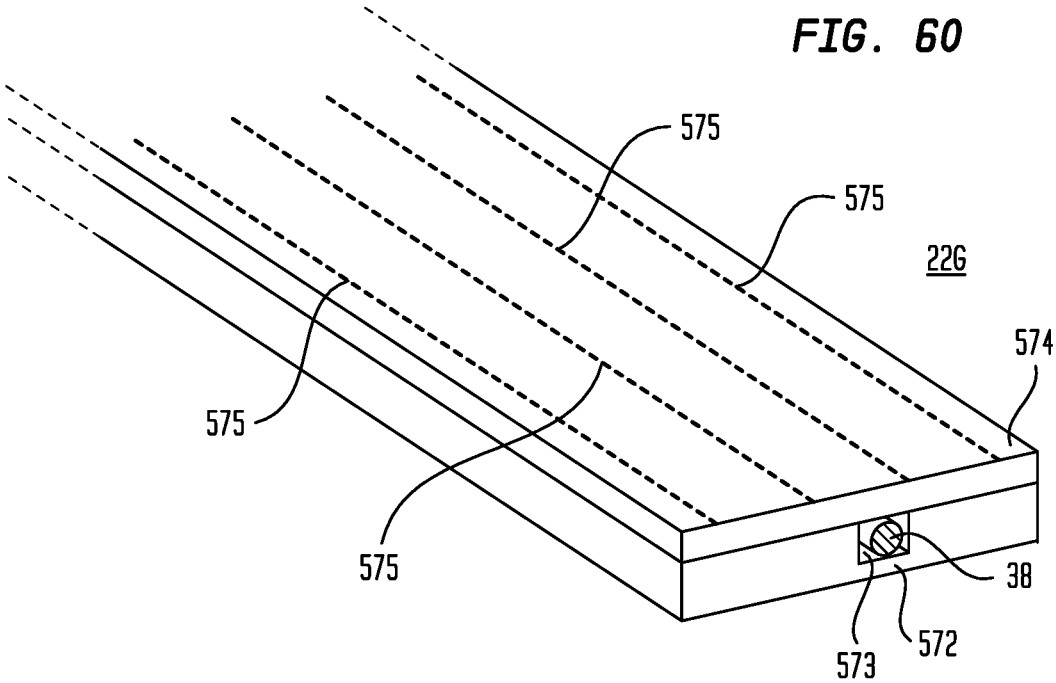
Figure 61:
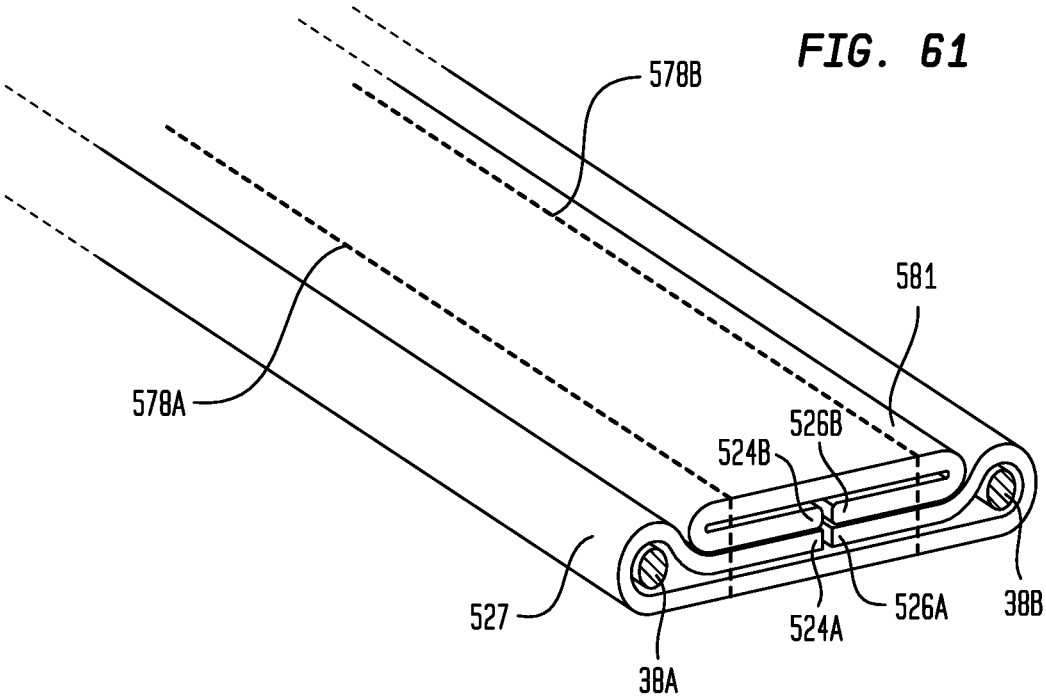
Figure 62:
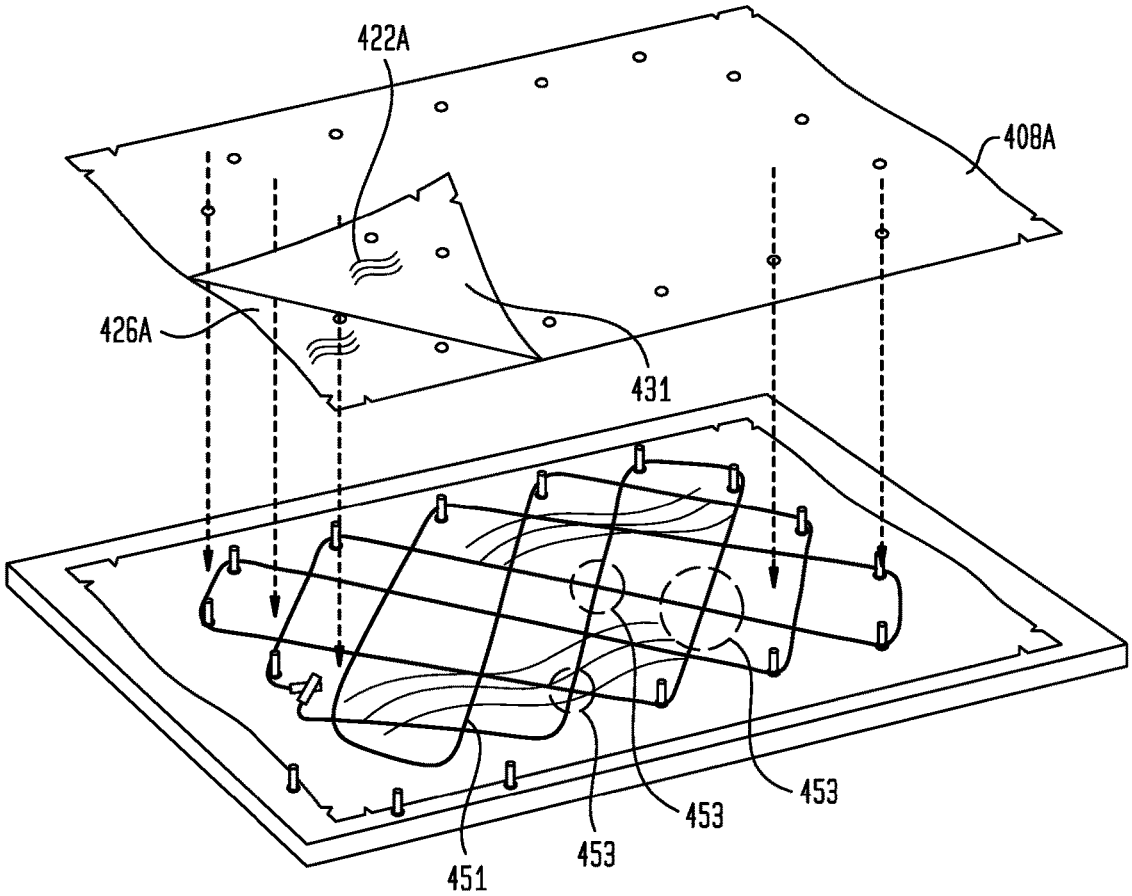
Figure 67:
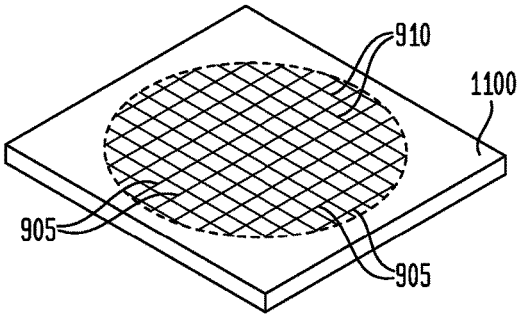
Figure 68:
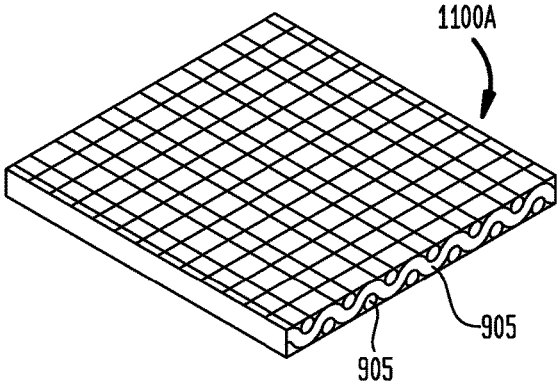
Figure 69:
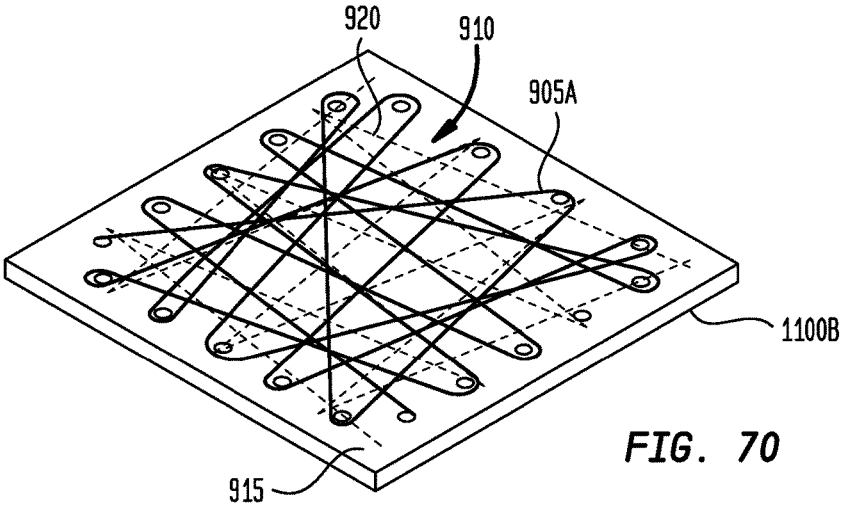
Figure 70:
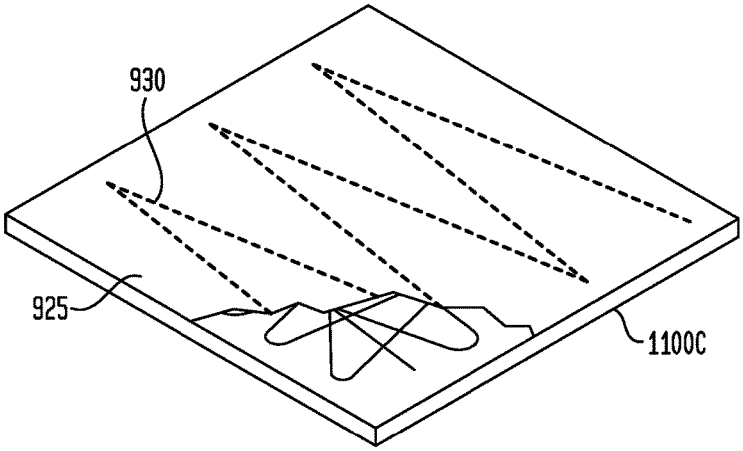

FIGS. 19, 19*a* and 19*b* are enlarged isometric views of a first embodiment of a security clasp for a zipper mechanism;

FIGS. 20-24 are isometric views that illustrate steps in the manufacture of another, representative second embodiment of a security panel assembly;

FIG. 25 is an isometric view of a third embodiment of a security panel assembly used in a rigid bag application;

FIG. 26 is a sectional, schematic view showing the panel assembly extending up from the bottom of the bag frame along the cover members that close the rigid bag;

FIG. 27 shows a pattern of the cut-resistant cable used in various representative embodiments of a security panel assembly;

FIG. 28 shows reinforcement wire for the plates of the cover members;

FIGS. 29-36 are isometric views illustrating steps in the manufacture of another representative fourth embodiment of a security panel assembly, with FIG. 33 divided into FIG. 33A and FIG. 33B;

FIG. 37 is an isometric view of another typical purse or shoulder bag incorporating various features of a representative carrying bag embodiment;

FIG. 37A is an enlarged isometric view of a zipper pull tab coupled to a locking carabiner of the carrying bag of FIG. 37;

FIG. 38 is an isometric view of a front or side pocket of a purse or shoulder bag incorporating various features of a representative carrying bag embodiment;

FIGS. 38A and 38B are enlarged isometric views of a second embodiment of a security clasp for a zipper mechanism illustrated in open and closed positions;

FIG. 38C is an enlarged isometric views of a third embodiment of a security clasp for a zipper mechanism illustrated in a closed position;

FIG. 39 is an isometric cut-away view of a typical purse or shoulder bag showing the placement of a security panel assembly within the exterior bag construction of FIG. 37;

FIG. 40 is an isometric view of a representative first embodiment of a hinged, locking rectangular ring in a closed position;

FIG. 41 is an isometric view of a representative first embodiment of a hinged, locking rectangular ring in an open position;

FIG. 42 is an isometric view of a representative second embodiment of a hinged, locking rectangular ring in an open position;

FIG. 43 is an isometric view of a representative third embodiment of a hinged, locking rectangular ring in a closed position;

FIG. 44 is a photograph showing an isometric view of a multi-glide locking snap hook fastener in a closed position;

FIG. 45 is an isometric view of a representative second embodiment of a carry strap;

FIG. 46 is an isometric view of a representative third embodiment of a carry strap;

FIG. 47 is an isometric view of first and second finishing steps for a representative embodiment of a carry strap;

FIG. 48 is a side view of third finishing step of a representative embodiment of a carry strap;

FIG. 49 is an isometric view illustrating steps in the manufacture of the representative fourth embodiment of a carry strap;

FIG. 50 is an isometric view illustrating the representative fourth embodiment of a carry strap;

FIG. 51 is cross-sectional view of the representative fourth embodiment of a carry strap;

FIG. 52 is an isometric view of a representative fourth embodiment of a carry strap with a flat end cap;

FIG. 53 is an isometric view of a representative fourth embodiment of a carry strap in conjunction with a ladder lock-type buckle;

FIG. 54 is an isometric view of a representative fifth embodiment of a carry strap;

FIG. 55 is cross-sectional view of a representative fifth embodiment of a carry strap having a first configuration and a first thickness arrangement;

FIG. 56 is cross-sectional view of a representative fifth embodiment of a carry strap having a second configuration and a second thickness arrangement;

FIG. 57 is cross-sectional view of a representative fifth embodiment of a carry strap having a second configuration and a first thickness arrangement;

FIG. 58 is an isometric view of a representative sixth embodiment of a carry strap;

FIG. 59 is an isometric view of a representative seventh embodiment of a carry strap;

FIG. 60 is an isometric view of a representative eighth embodiment of a carry strap;

FIG. 61 is an isometric view of a representative ninth embodiment of a carry strap;

FIG. 62 is an isometric view illustrating an alternative step in the manufacture of a fourth embodiment of a security panel assembly;

FIGS. 63-66 are isometric views illustrating various alternative and/or additional steps of securing the wire matrix in the manufacture of any of the various representative embodiments of a security panel assembly to form additional, representative fifth through eighth embodiments of a security panel assembly;

FIGS. 67-68 are isometric views illustrating various additional and representative nonmetallic, cut-resistant yarn or fiber-based embodiments of security panel assemblies;

FIGS. 69-70 are isometric views illustrating various additional and representative wire matrix embodiments of security panel assemblies.

Figure 1:
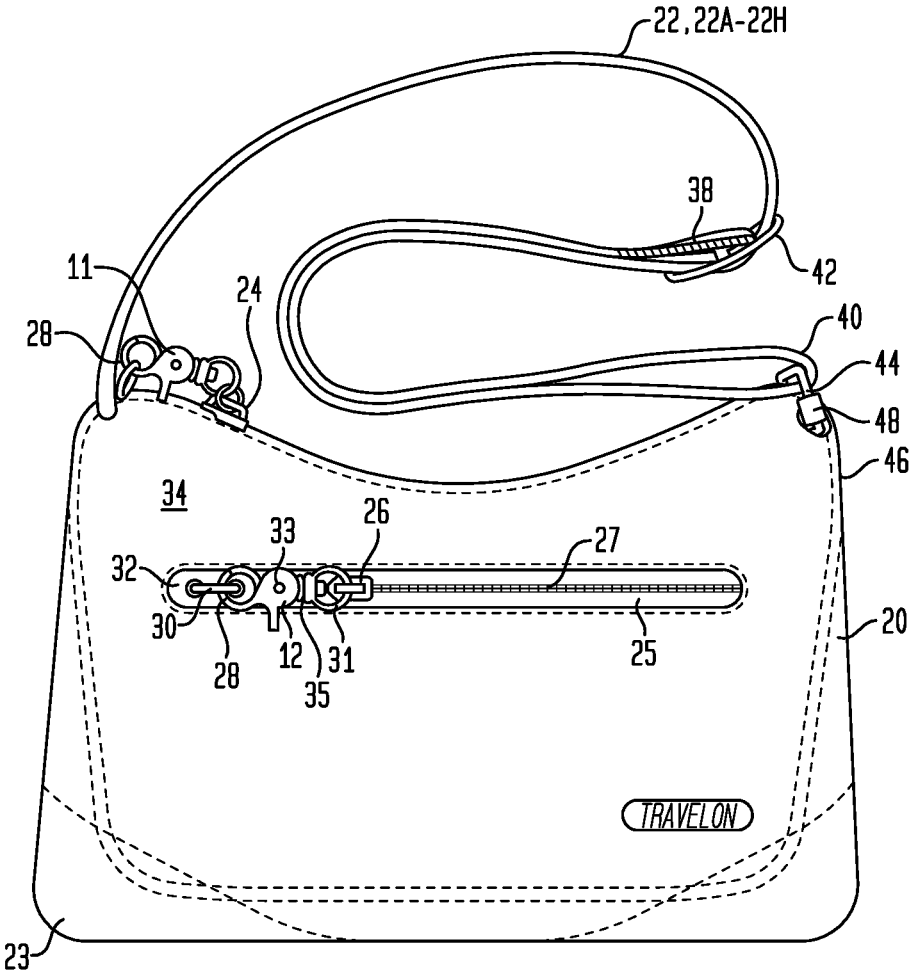
FIG. 1 is a front side elevation of a typical handbag incorporating various features of a representative embodiment.
Figure 72:
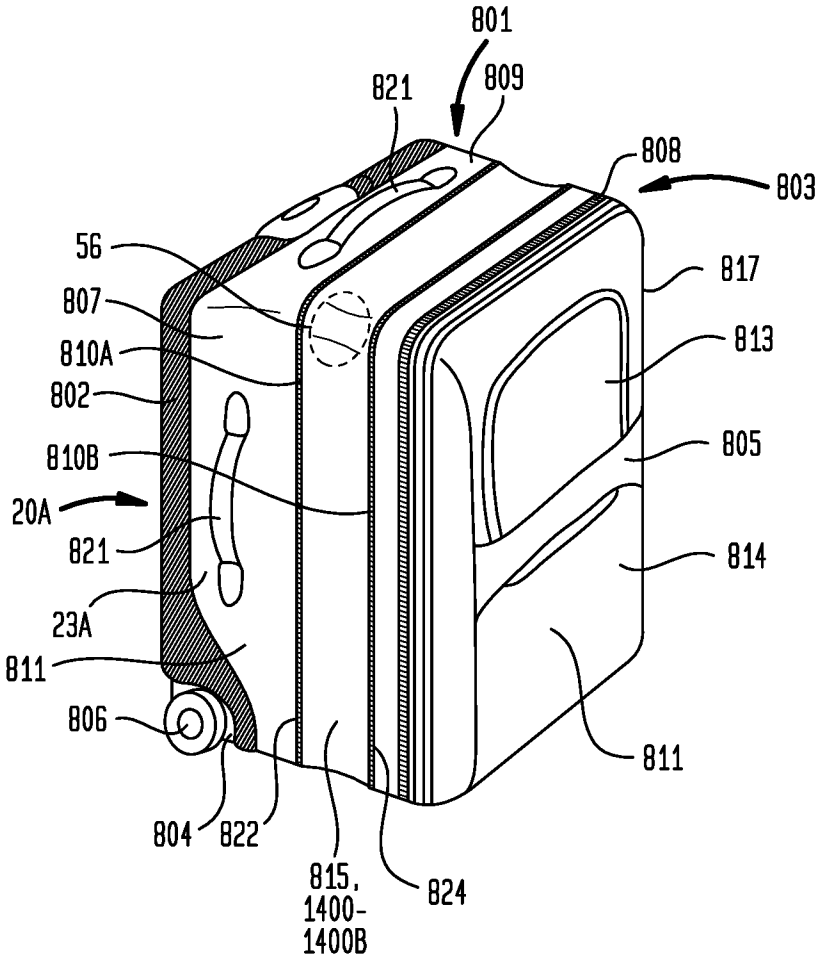
Figure 71:
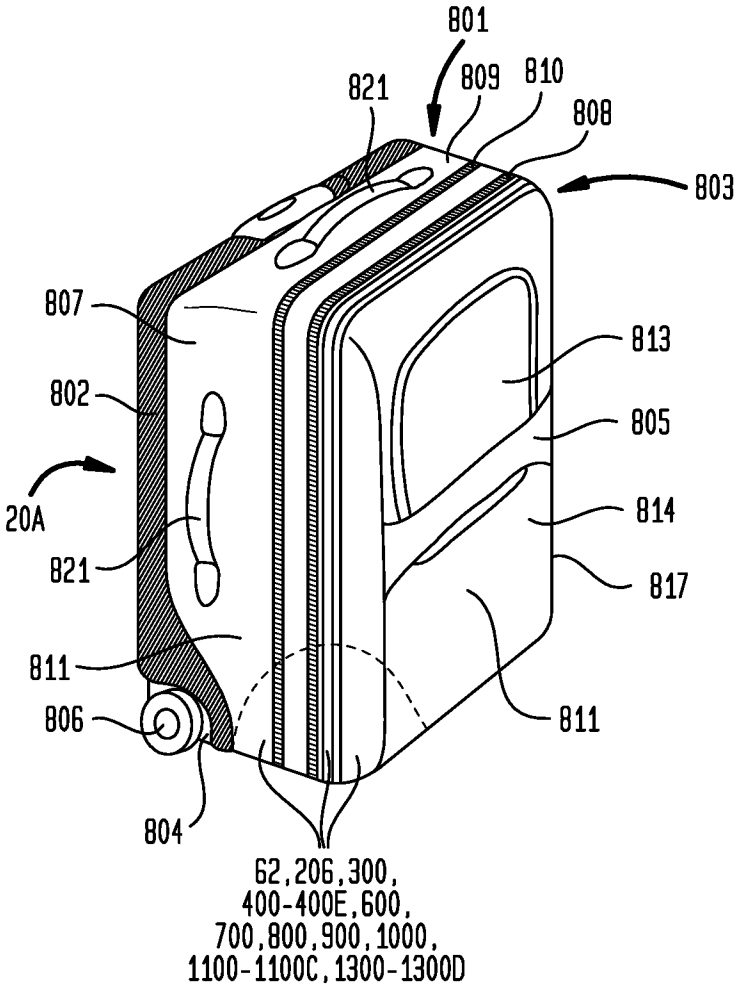
Figure 74:
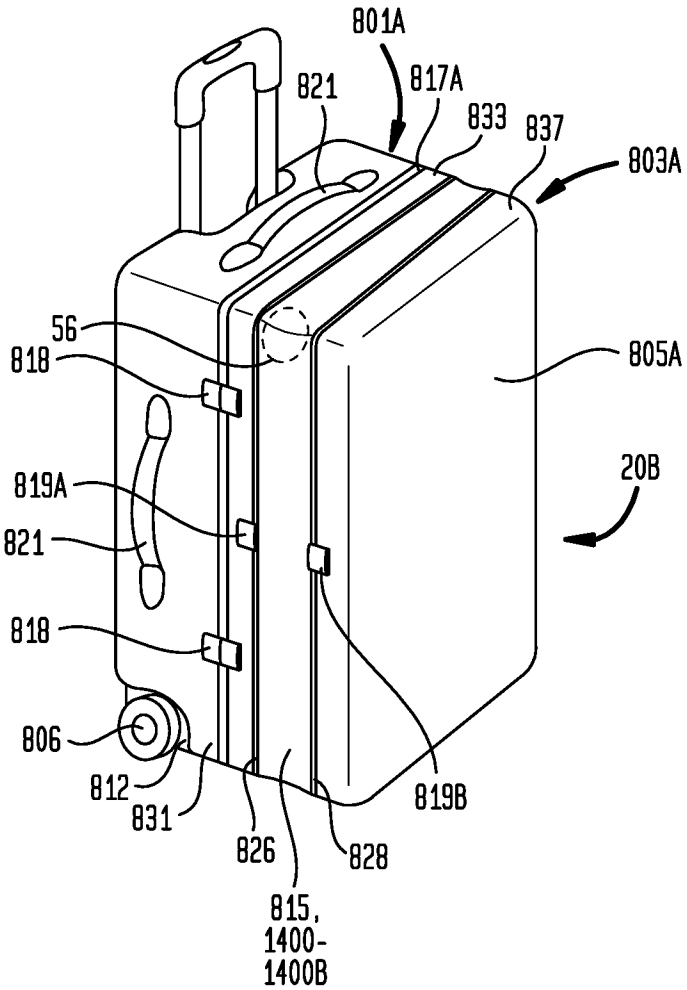
Figure 73:
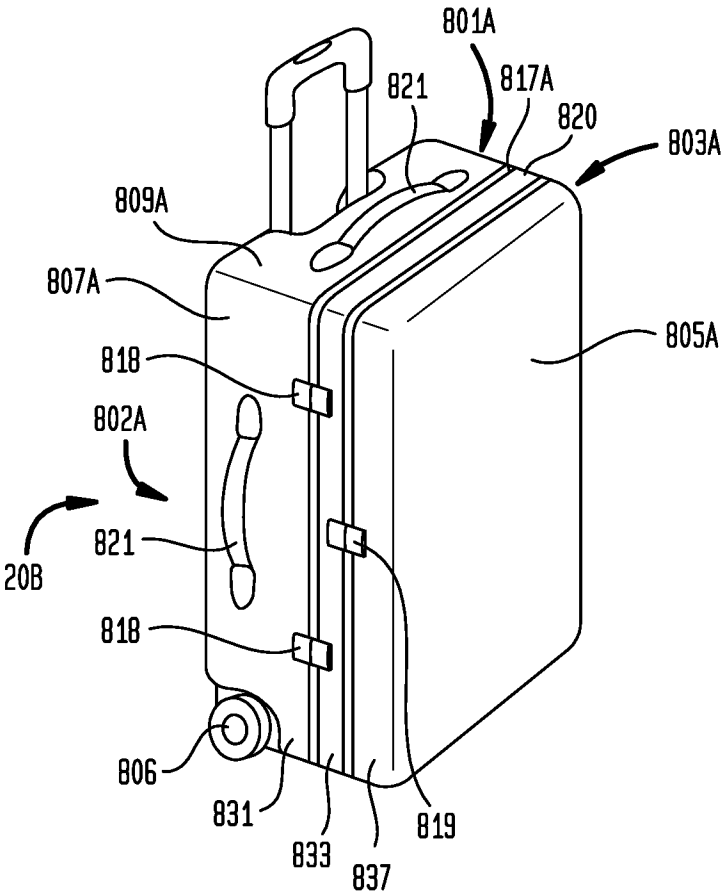
Figure 75:
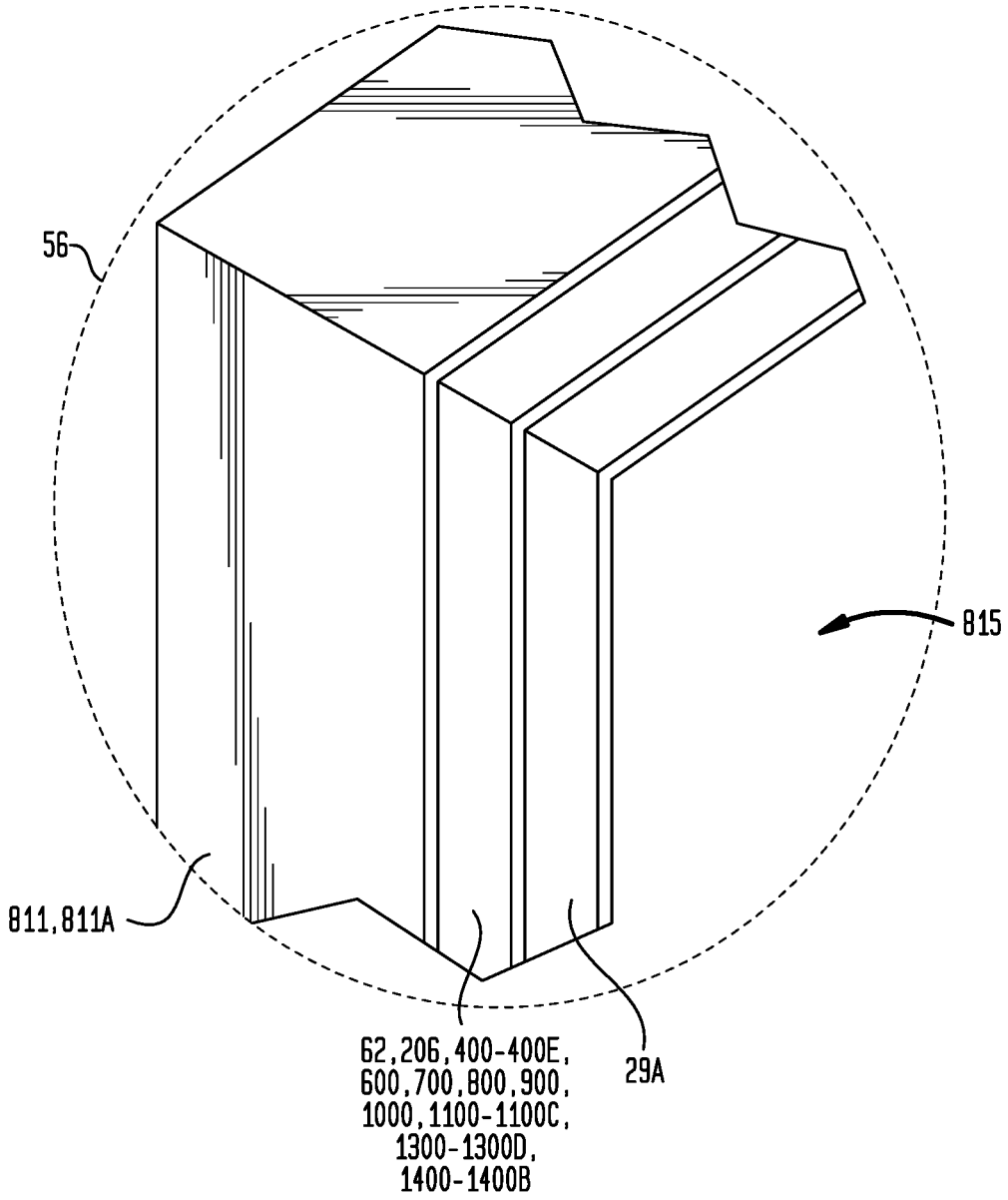
Figure 76:
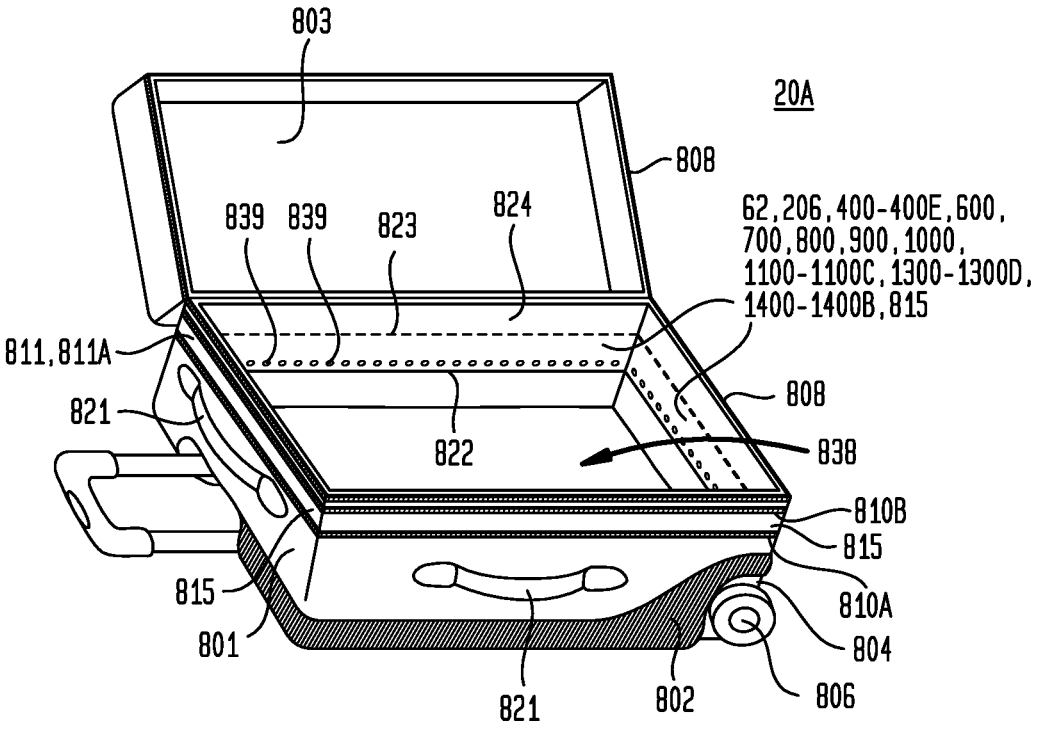
Figure 77:
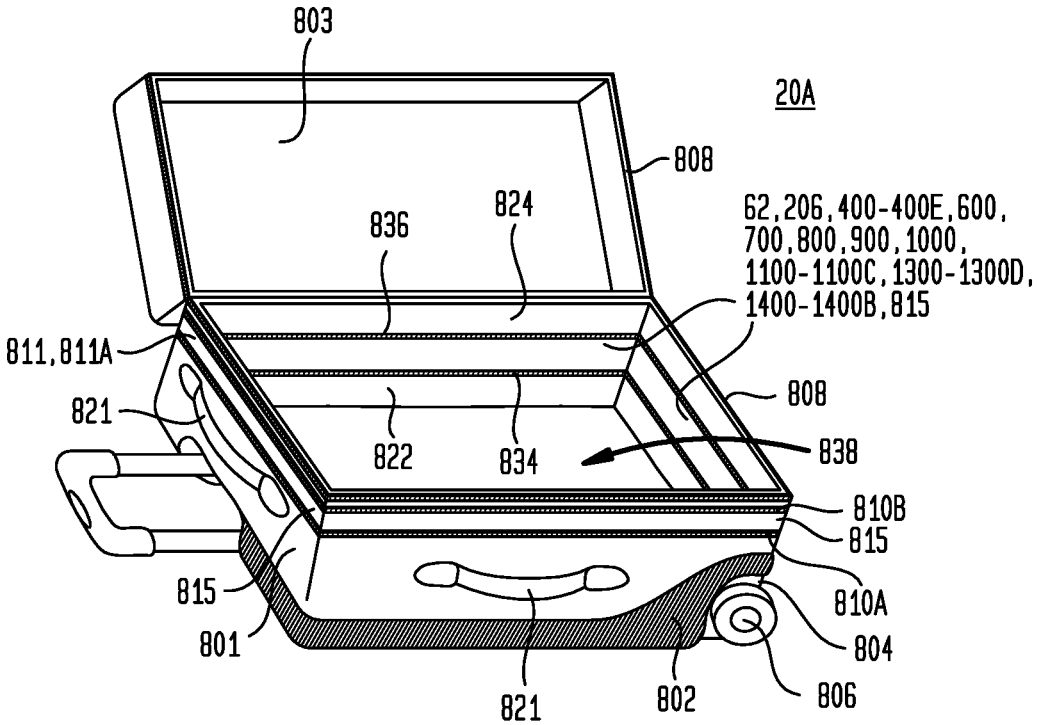
Figure 78:
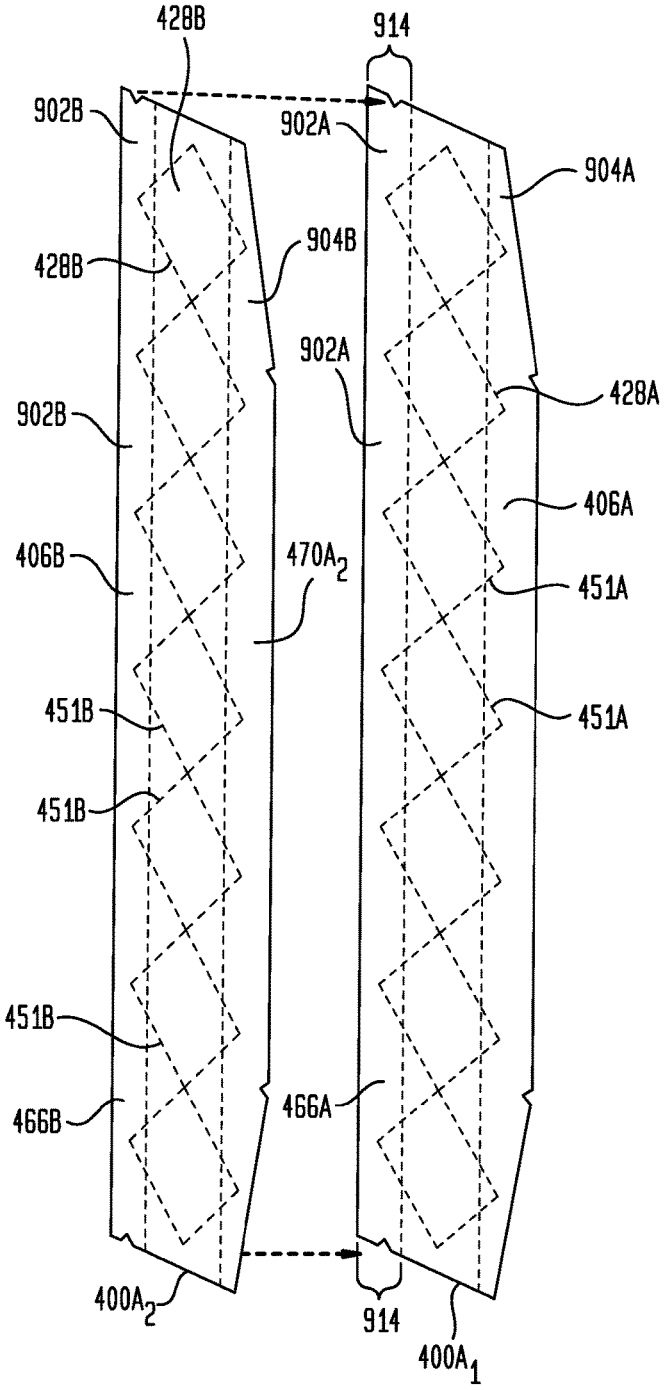
Figure 79:
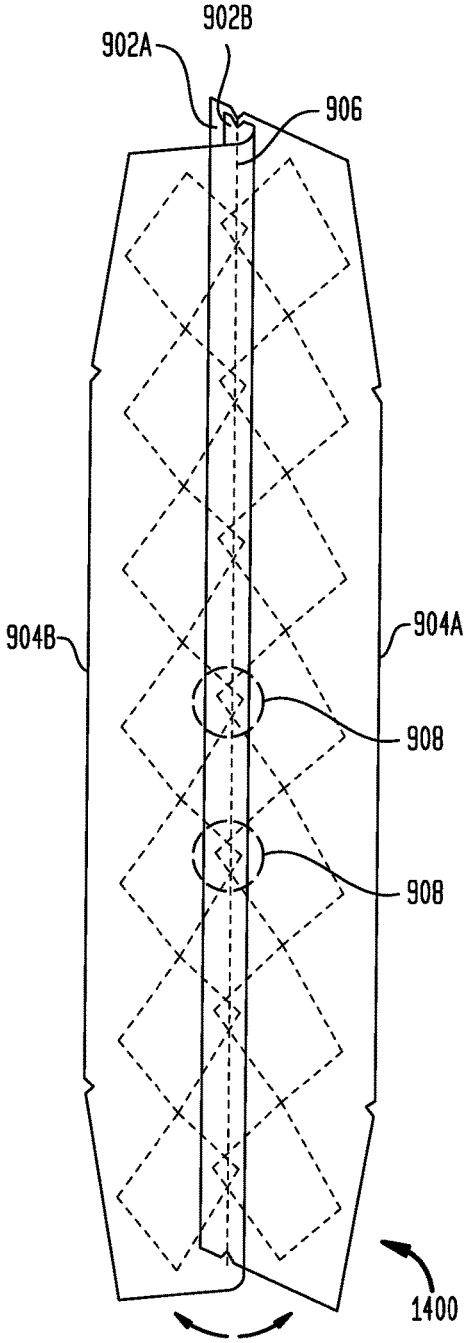
Figure 95:
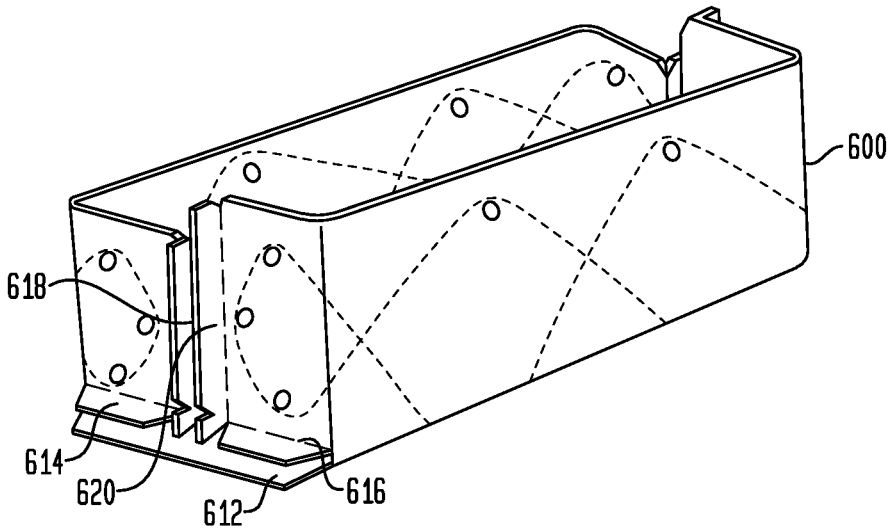
Figure 96:
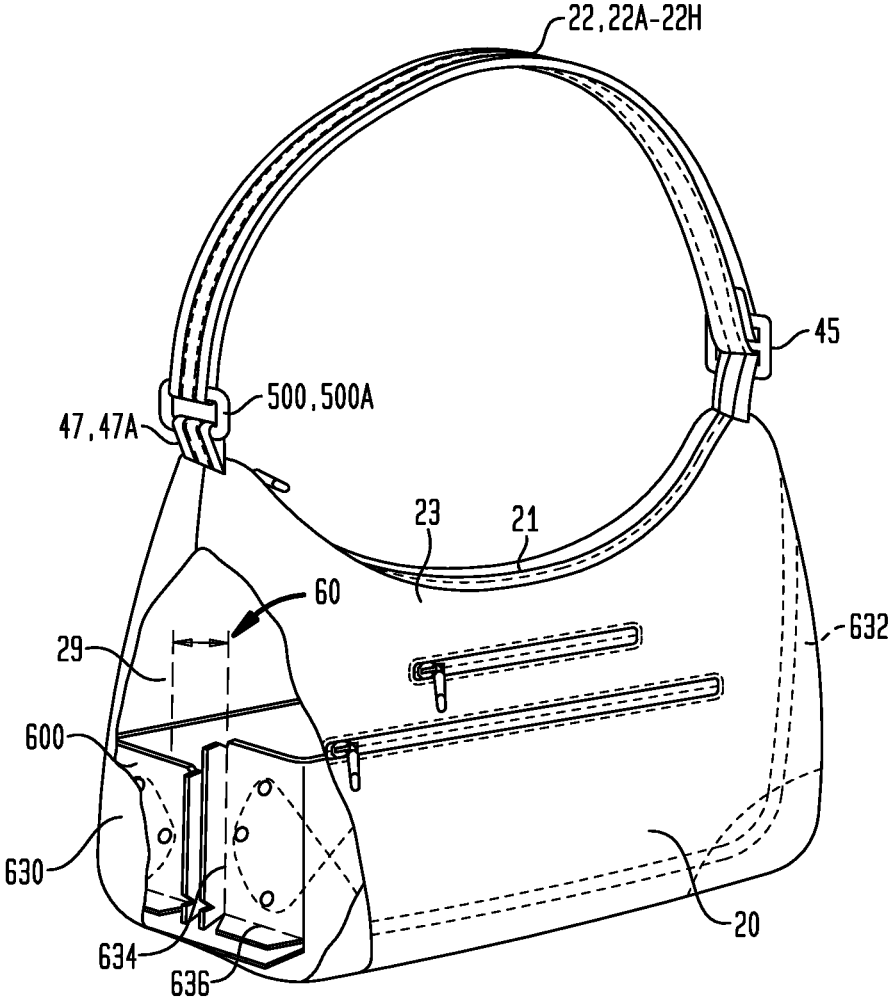
Figure 98:
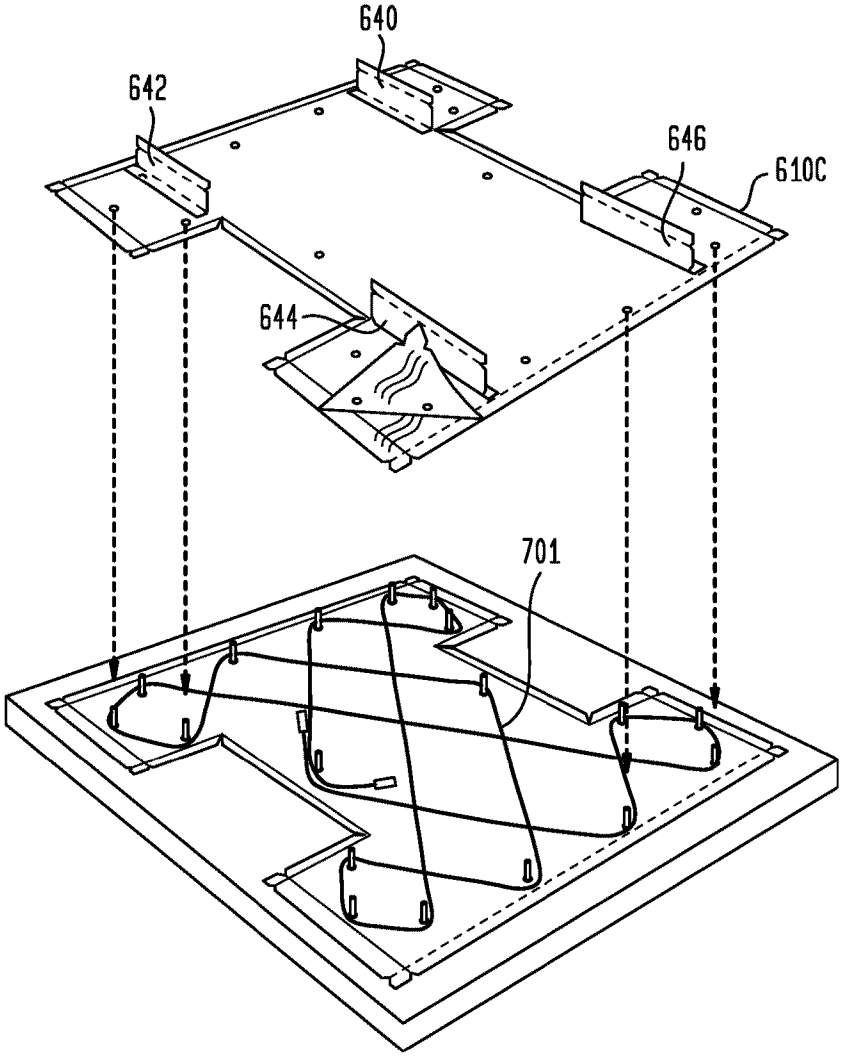
Figure 97:
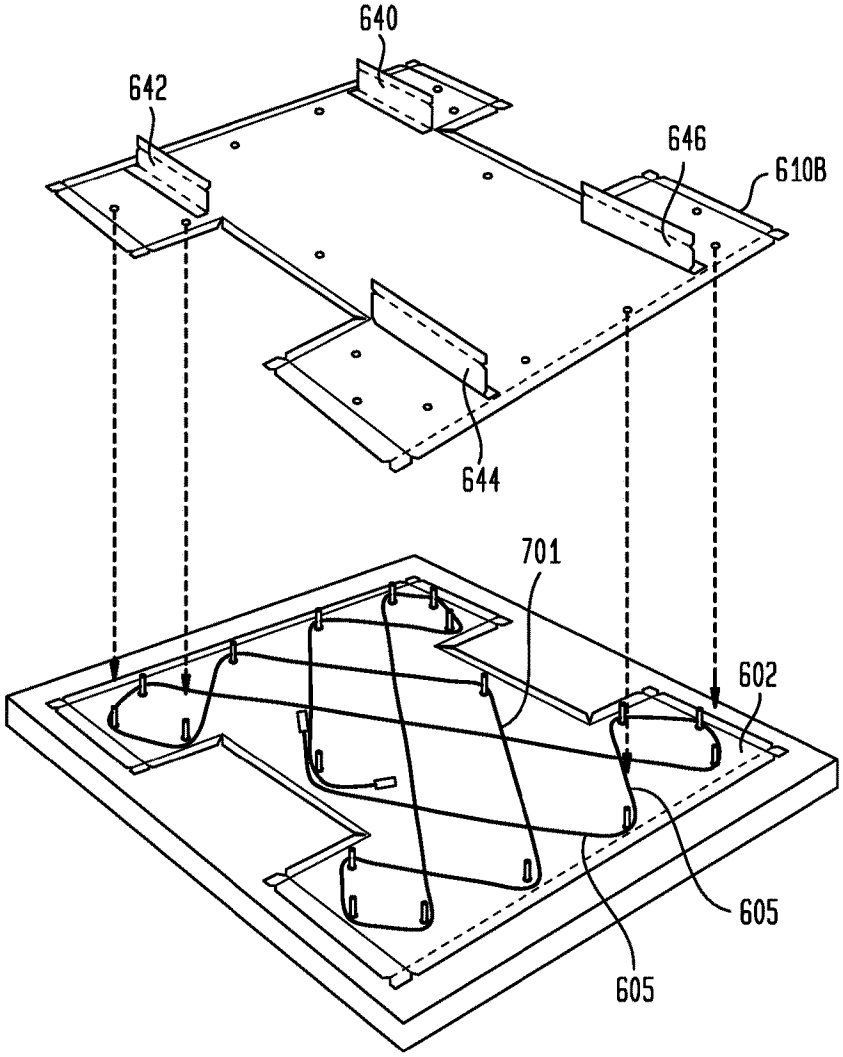
Figure 100:
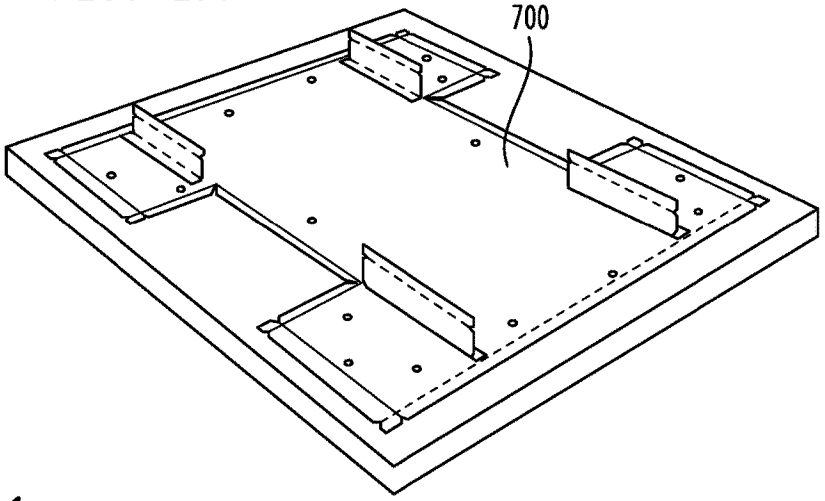
Figure 99:
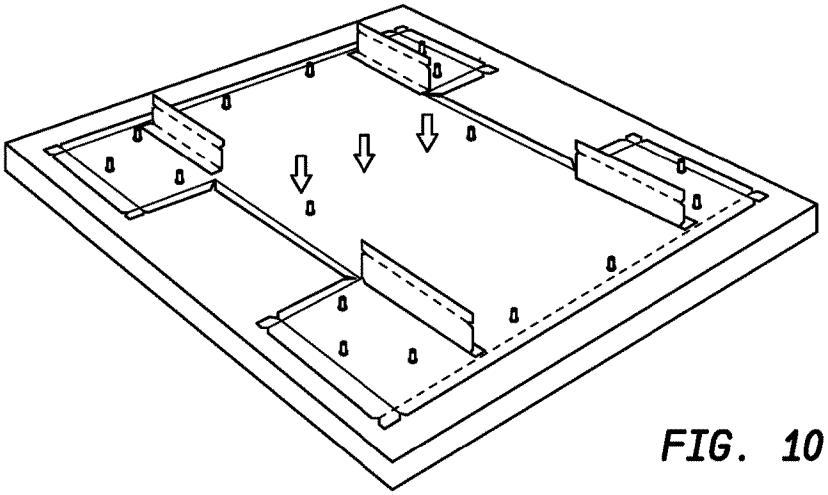
Figure 101:
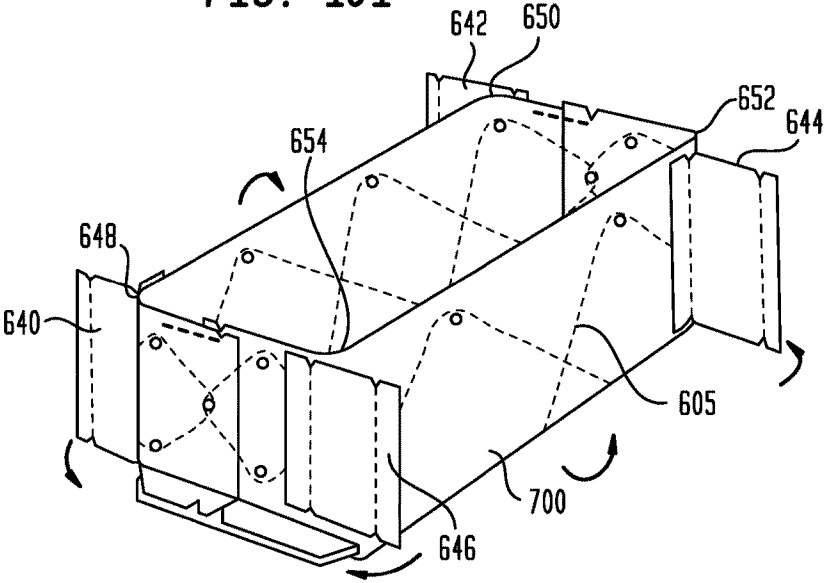
Figure 102:
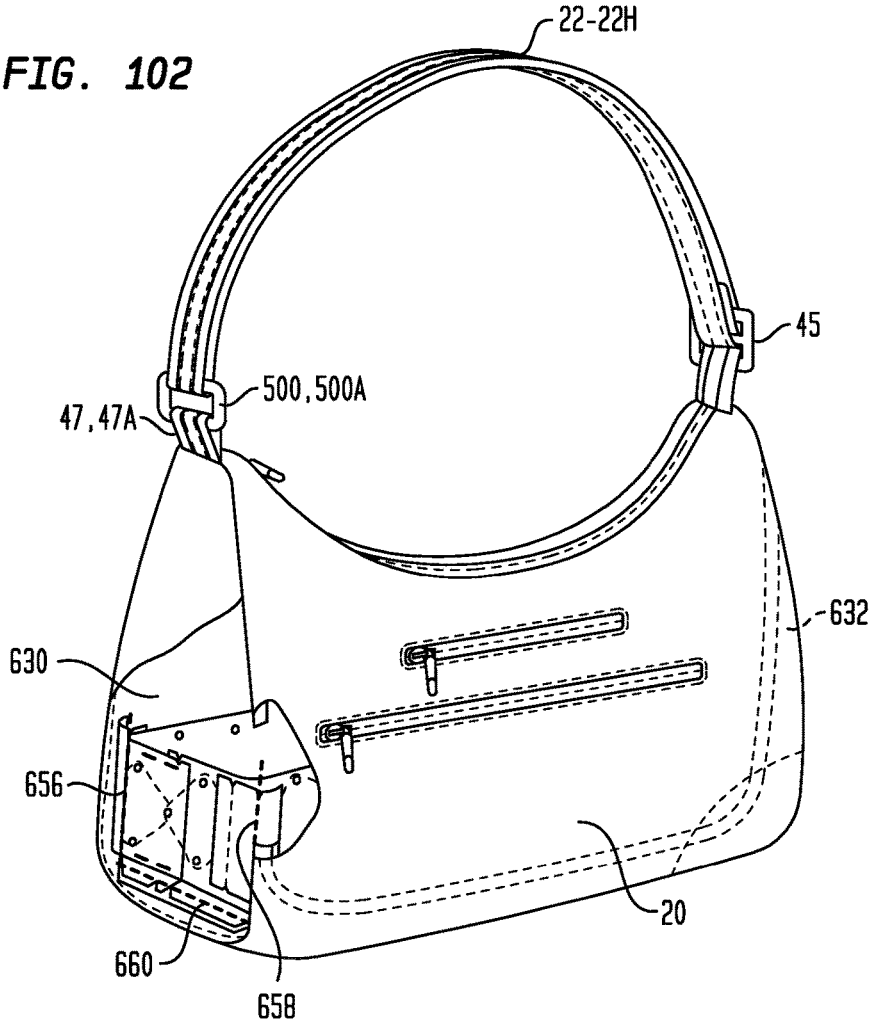
Figure 103:
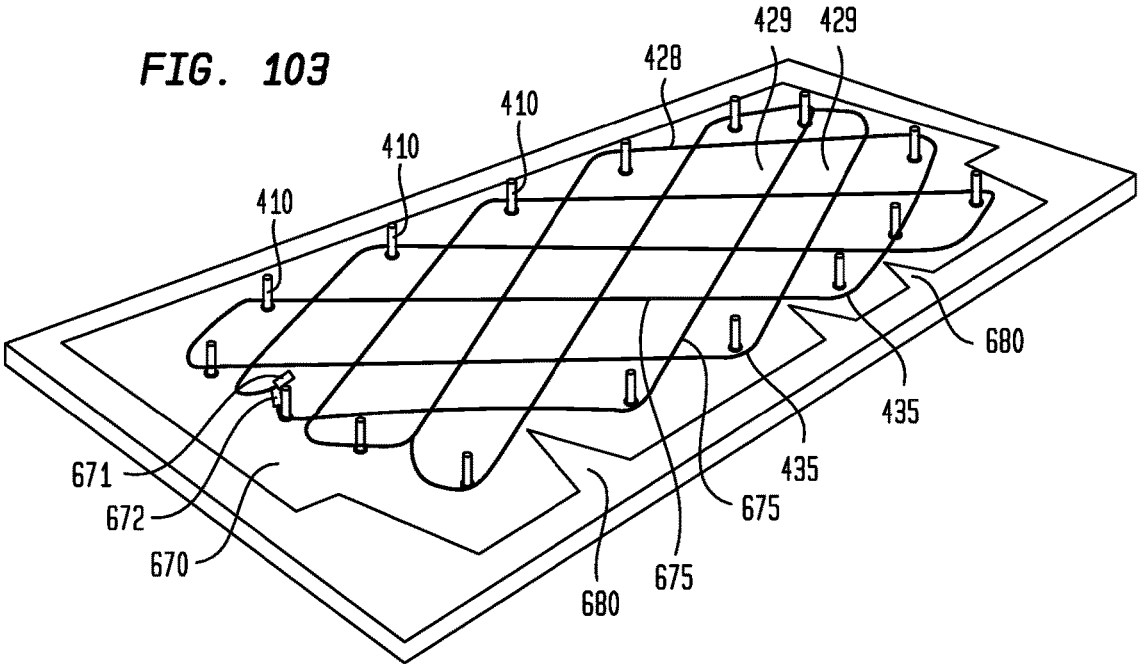
Figure 110:
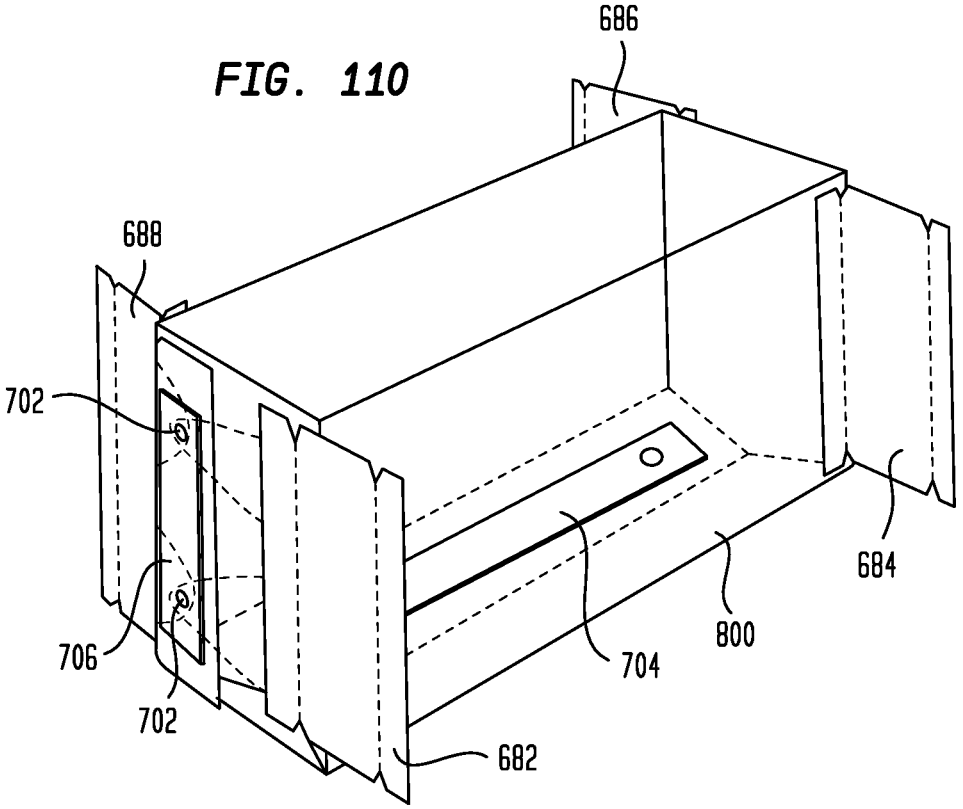
Figure 111:
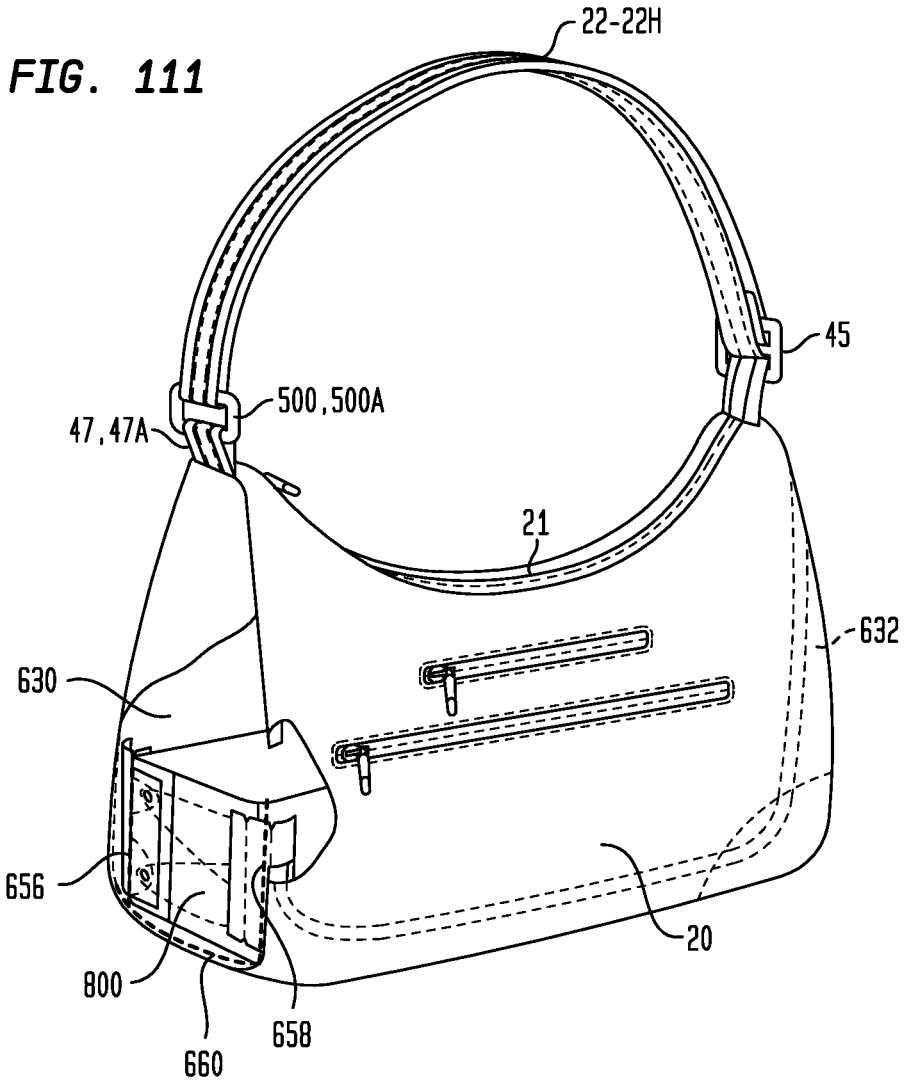
Figure 112:
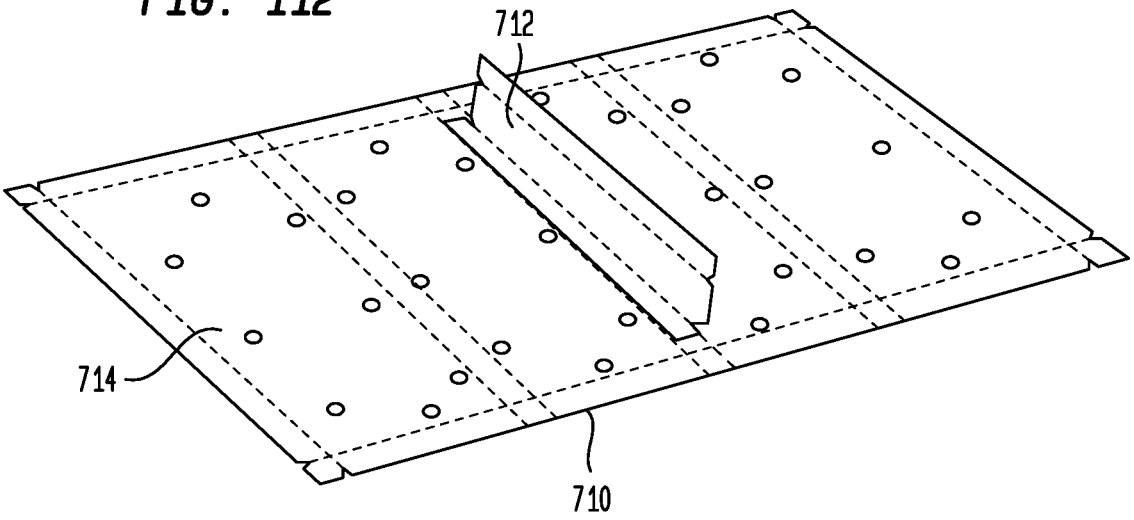
Figure 113:
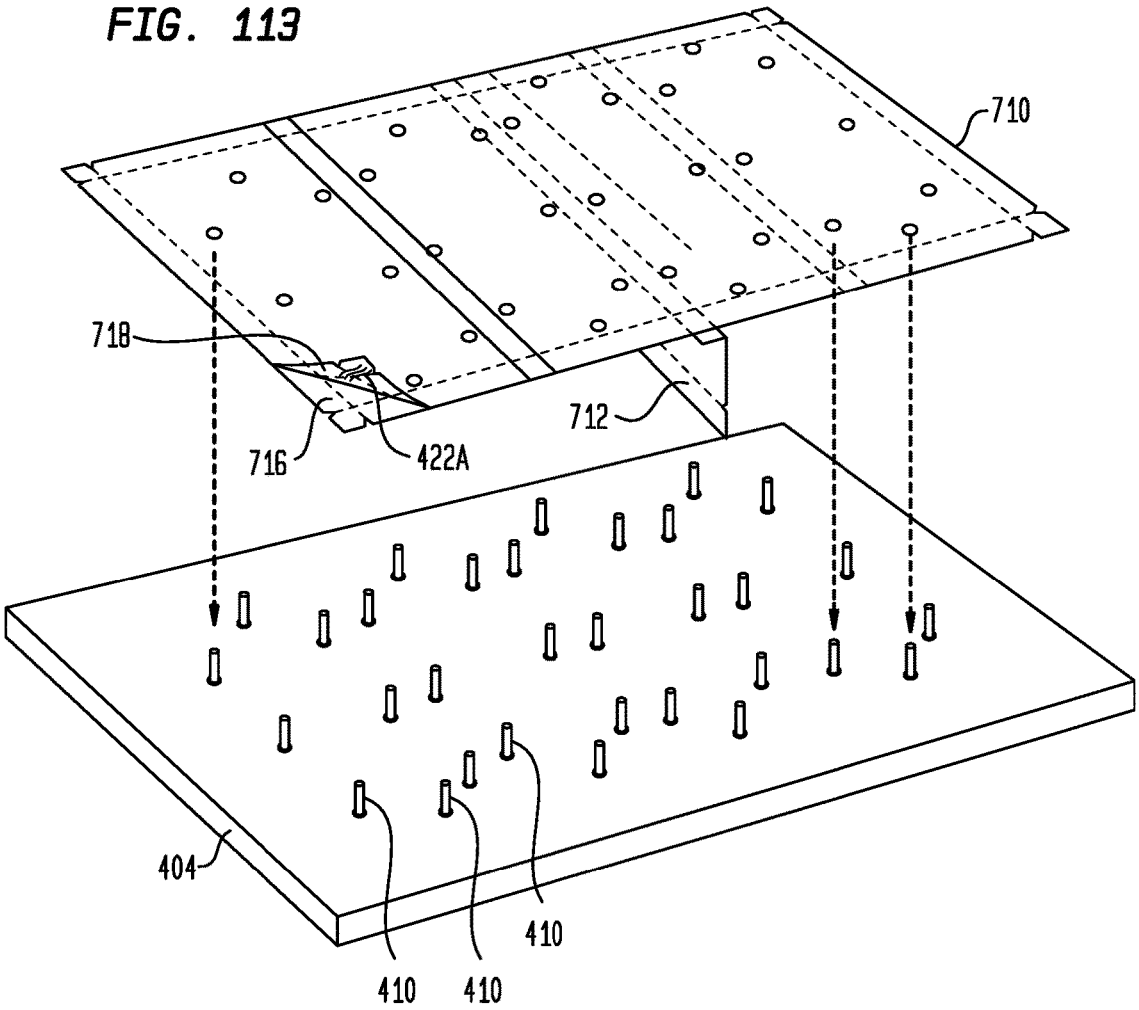
Figure 114:
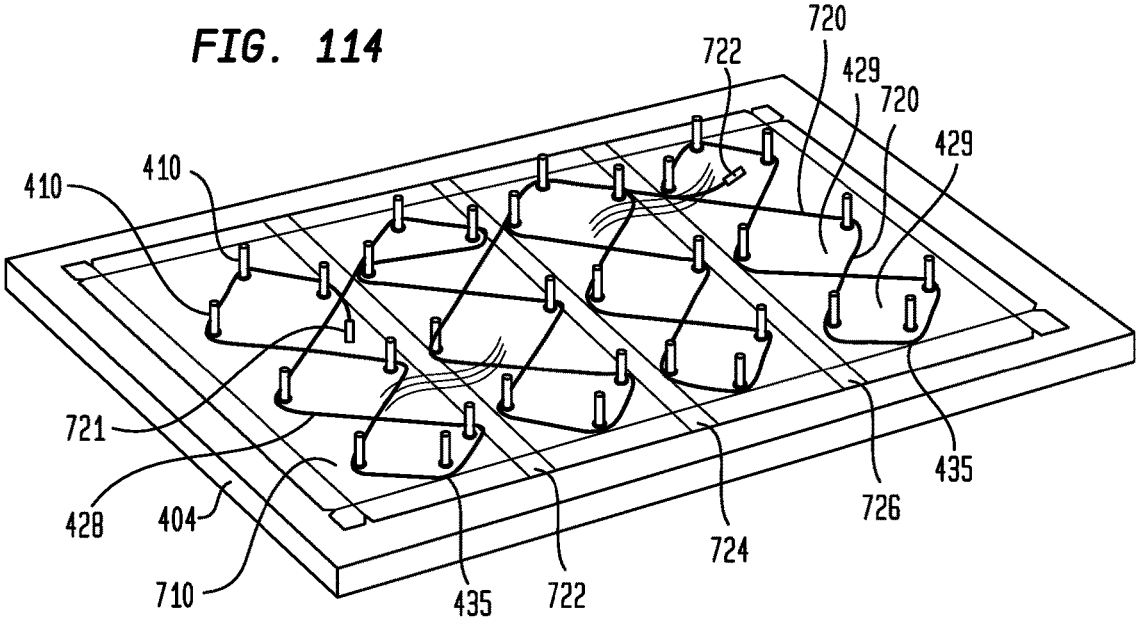
Figure 115:
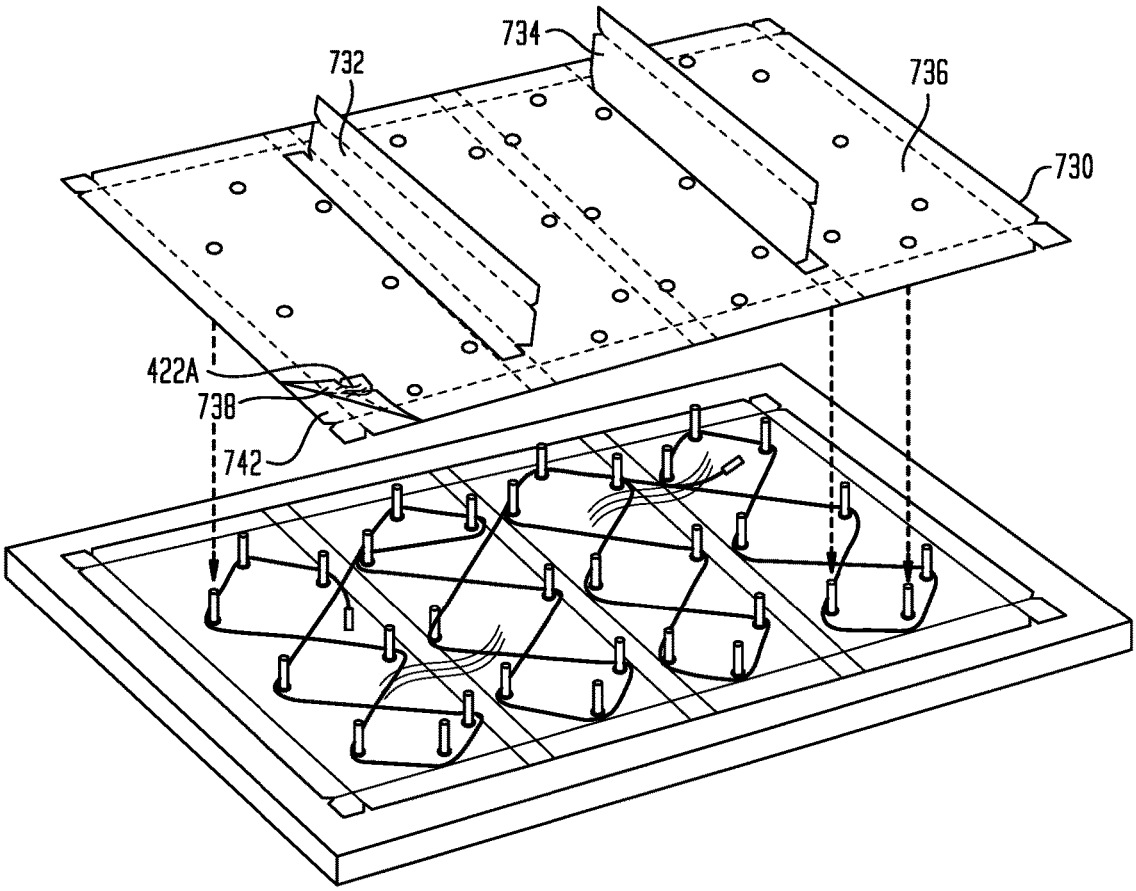
Figure 119:
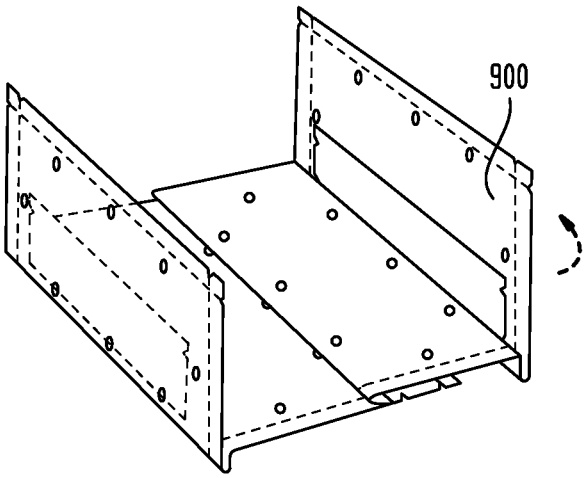
Figure 120:
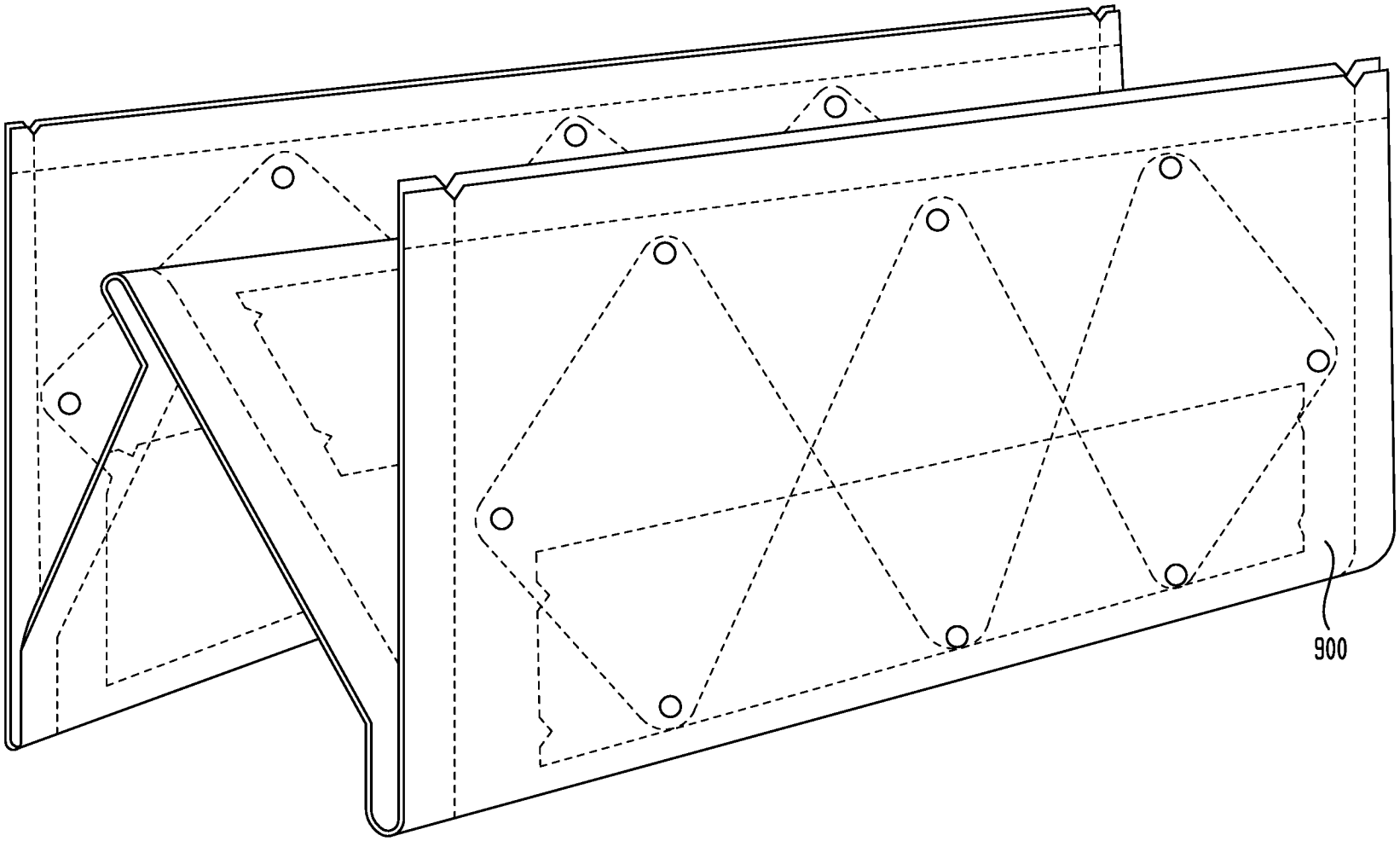
Figure 122:
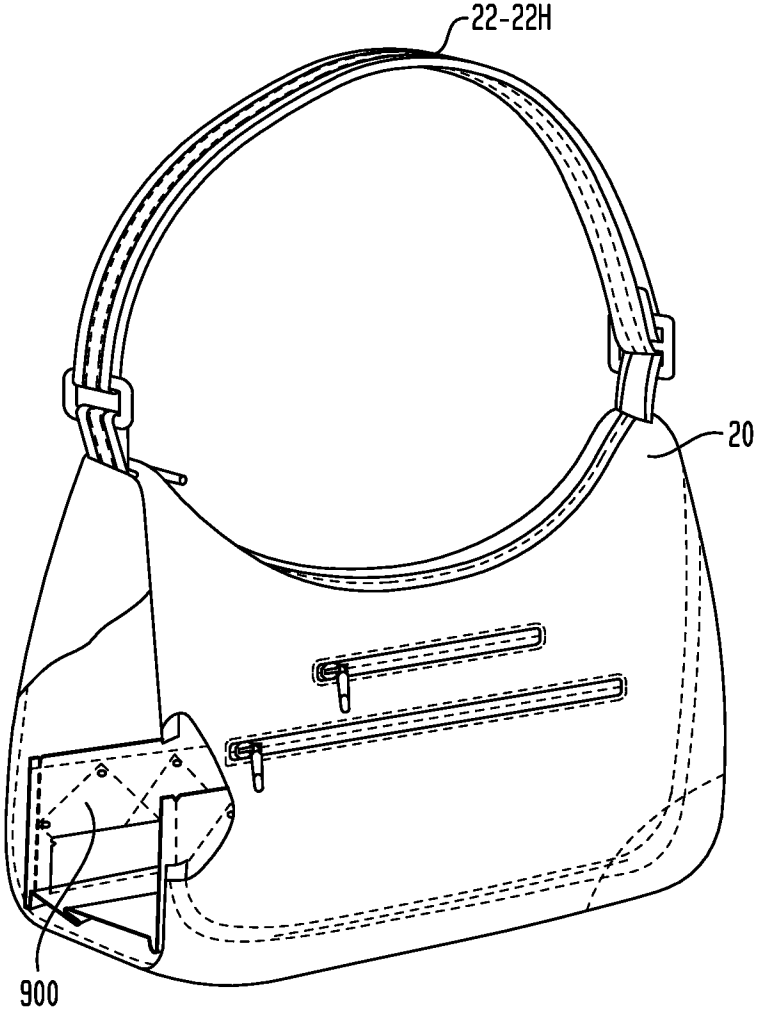
Figure 121:
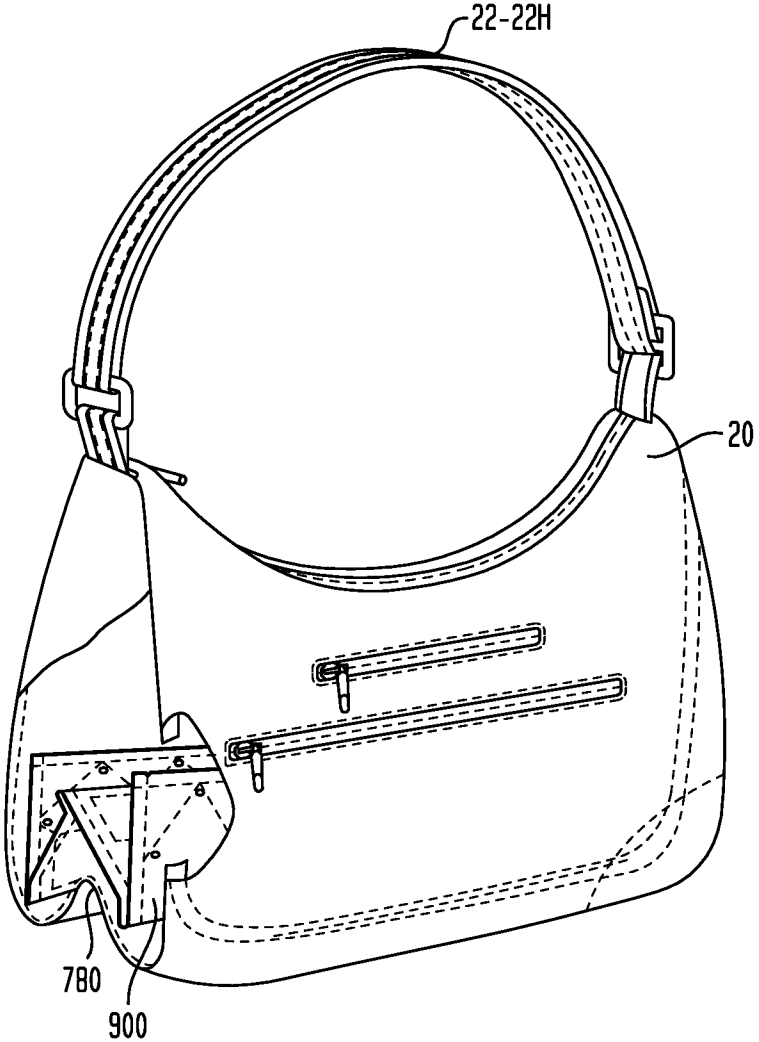
Figure 128:
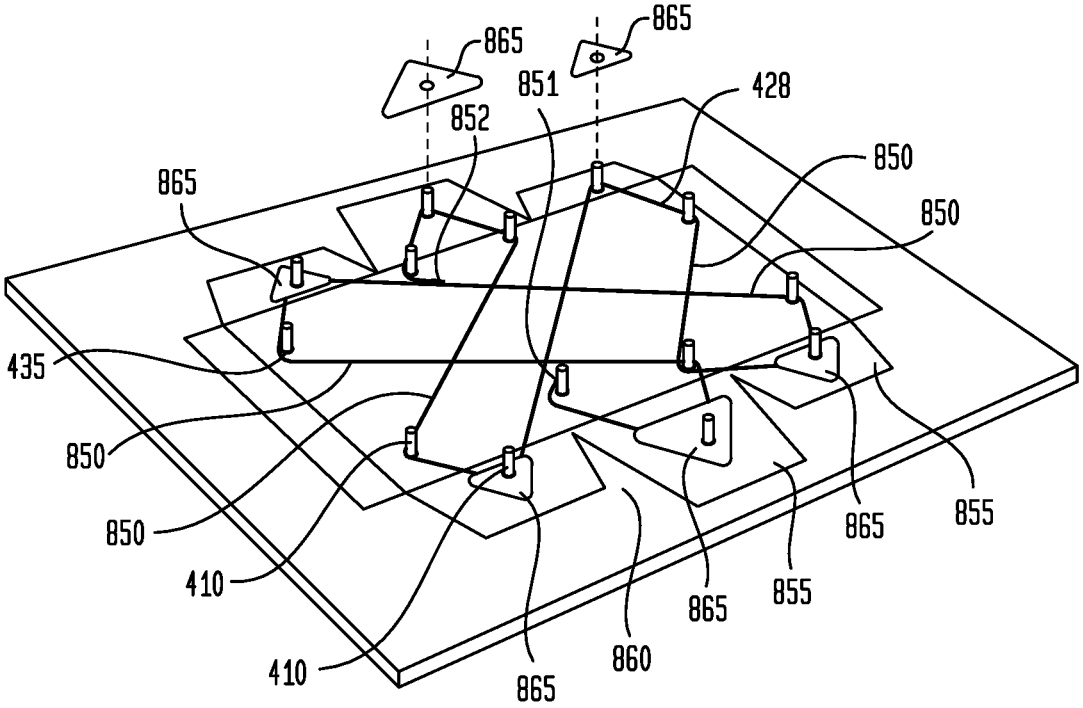
Figure 129:
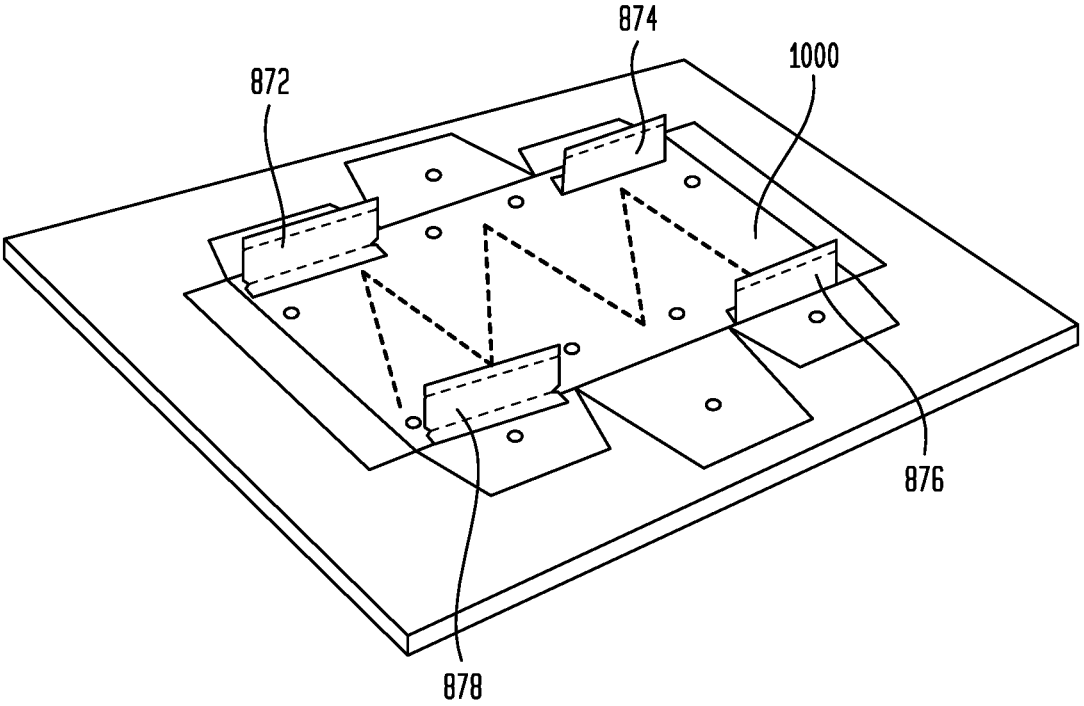
Figure 138:
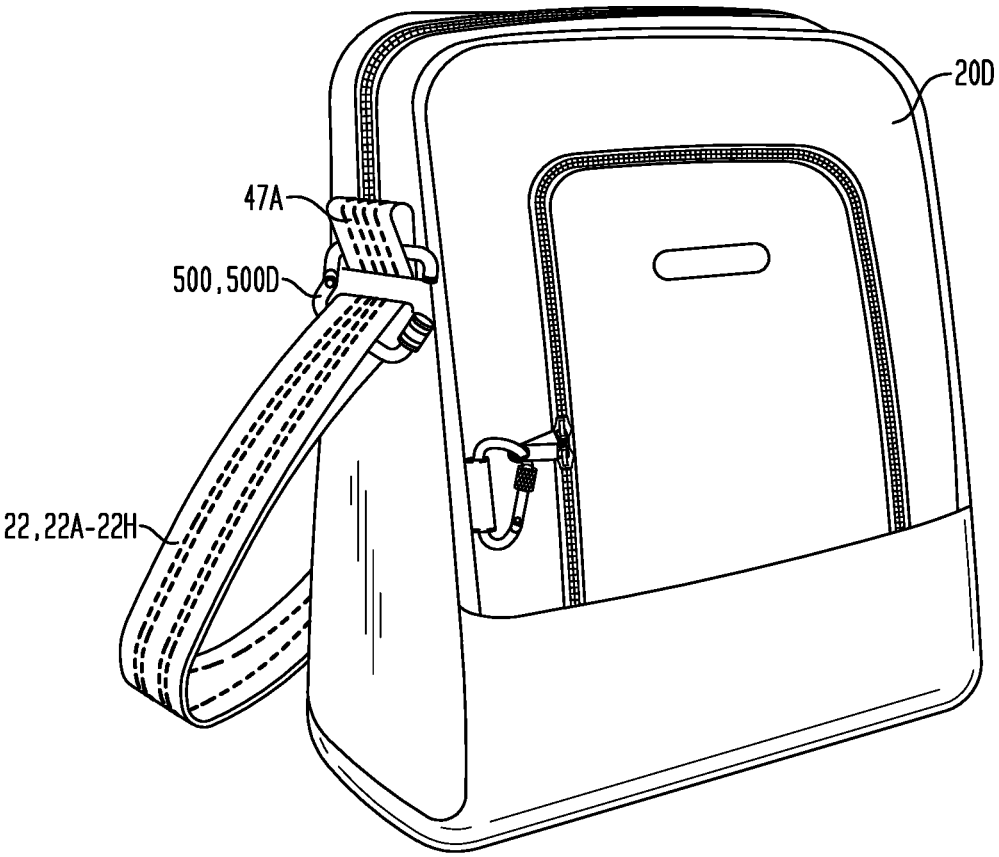
Figure 139:
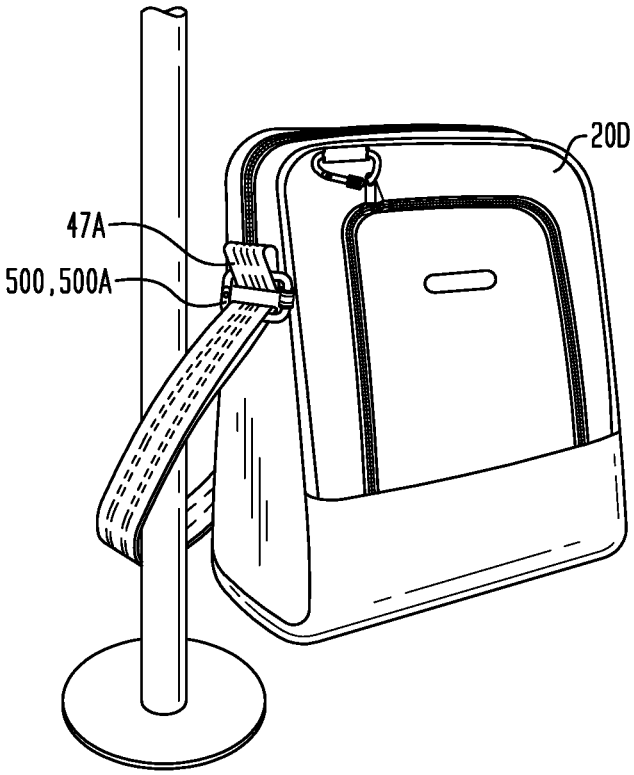
Figure 140:
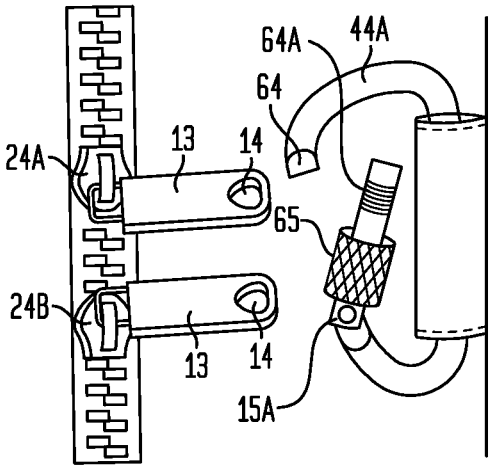
Figure 141:
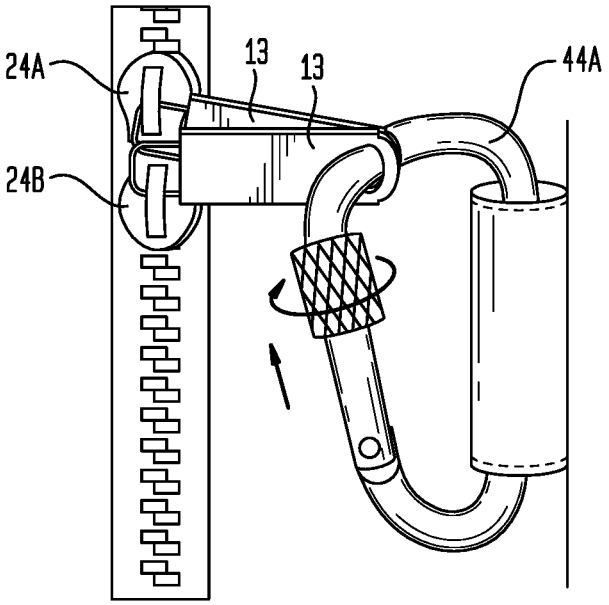
Figure 142:
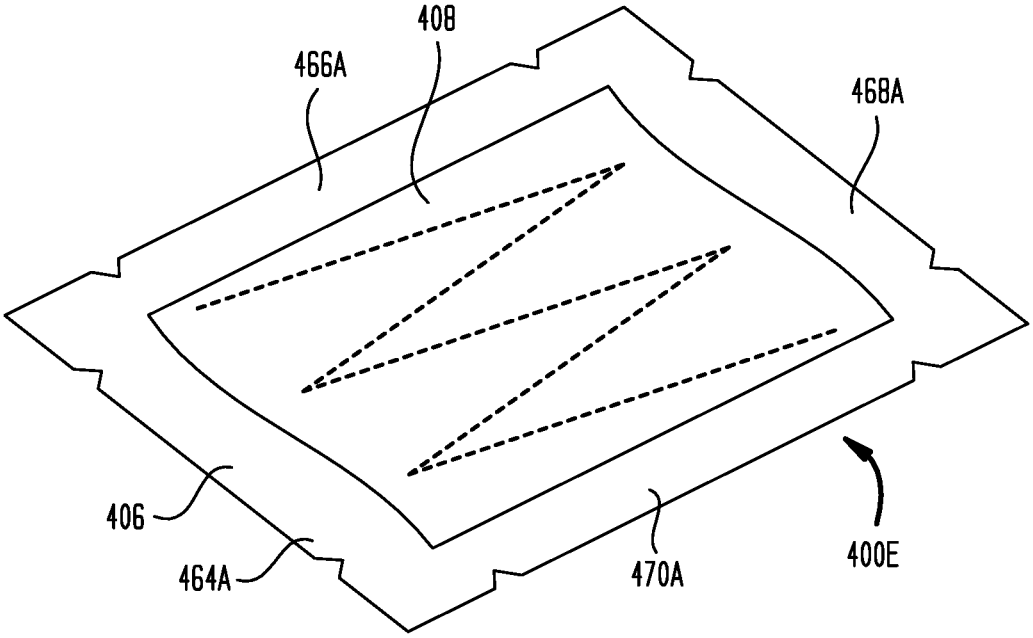

FIG. 71 is a cut-away isometric view illustrating an additional second embodiment of a soft-sided travel bag, as a type of carrying bag, and having an expansion panel, in a compact or unexpanded configuration;

FIG. 72 is an isometric view illustrating the second embodiment of a soft-sided of a travel bag, as a type of carrying bag, and having an expansion panel, in an expanded configuration;

FIG. 73 is an isometric view illustrating an additional third embodiment of a hard-sided travel bag, as a type of carrying bag, and having an expansion panel, in a compact or unexpanded configuration;

FIG. 74 is an isometric view illustrating the third embodiment of a hard-sided travel bag, as a type of carrying bag, and having an expansion panel, in an expanded configuration;

FIG. 75 is an enlarged isometric view illustrating a representative embodiment of an expansion panel incorporating a security panel assembly;

FIGS. 76 and 77 are isometric views illustrating interior compartments of the second embodiment of a soft-sided of a travel bag, as a type of carrying bag, and illustrating representative couplings of an expansion panel incorporating a security panel assembly within a carrying bag;

FIGS. 78-79 are isometric views illustrating steps in the manufacture of a representative embodiment of an expansion panel security panel assembly incorporating two security panel subassemblies;

FIGS. 80-84 are isometric and cross-sectional views illustrating representative embodiments of an expansion panel security panel assembly incorporating two or more security panel subassemblies;

FIGS. 85-89 are isometric views illustrating representative carry bags having representative embodiments of an expansion panel security panel assembly incorporating two security panel subassemblies, in open and closed configurations;

FIGS. 90-95 are isometric views illustrating steps in the manufacture of additional, representative ninth embodiment of a security panel assembly;

FIG. 96 is an isometric cut-away view showing the placement of the folded security panel assembly of FIG. 95 within the exterior bag construction of FIG. 1;

FIGS. 97-101 are isometric views illustrating steps in the manufacture of an additional, representative tenth embodiment of a security panel assembly;

FIG. 102 is an isometric cut-away view showing the placement of the folded security panel assembly of FIG. 101 within the exterior bag construction of FIG. 1;

FIGS. 103-110 are isometric views illustrating steps in the manufacture of additional, representative eleventh embodiment of a security panel assembly;

FIG. 111 is an isometric cut-away view showing the placement of the folded security panel assembly of FIG. 110 within the exterior bag construction of FIG. 1;

FIGS. 112-120 are isometric views illustrating steps in the manufacture of additional, representative twelfth embodiment of a security panel assembly;

FIG. 121 is an isometric cut-away view showing the placement of the folded security panel assembly of FIG. 120 within the exterior bag construction of FIG. 1, in a folded position;

FIG. 122 is an isometric cut-away view showing the placement of the folded security panel assembly of FIG. 119 within the exterior bag construction of FIG. 1, in an expanded position;

FIGS. 123-127 are isometric views illustrating additional arrangements or configurations of representative embodiments of security panel assemblies;

FIGS. 128 and 129 are isometric views illustrating an additional step in the manufacture of various embodiments of a security panel assembly and a resulting thirteenth embodiment of a security panel assembly;

FIGS. 130-137 are isometric views illustrating various additional and representative embodiments of security panel assemblies;

FIGS. 138-139 are isometric views illustrating carrying bag and locking ring embodiments;

FIGS. 140-141 are enlarged isometric views of locking carabiner in an open position and zipper pull tabs coupled to the locking carabiner (in a closed position) of the carrying bag of FIGS. 138 and 139; and FIG. 142 is an isometric view of an additional embodiment of a security panel assembly.

DETAILED DESCRIPTION OF REPRESENTATIVE EMBODIMENTS

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

FIG. 1 is a front elevation of a typical handbag, as a representative carrying bag 20, incorporating various security and anti-theft features associated with the various representative embodiments. FIGS. 37, 39, and 139-140 are isometric views of other typical purses or shoulder bags, as a representative carrying bags 20C and 20D, also incorporating various security and anti-theft features associated with the various representative embodiments. FIGS. 71-74, 76 and 77 are isometric views of other suitcase-type bags, as a representative carrying bags 20A and 20B, also incorporating various security and anti-theft features associated with the various representative embodiments, including one or more expansion panels as discussed in greater detail below. "Carry" and "carrying" are used interchangeably herein, to mean and include any and all verb or noun forms for any act or activity of carrying or any object which may be carried, lifted, etc., such as a carry or carrying strap (e.g., 22, 22A, 22B, 22C, 22D, 22E, 22F, 22G, and/or 22H) for use in carrying a bag 20, for example and without limitation. Carrying bags 20, 20C, 20D, and 20E are illustrated to include a carry (or carrying) strap 22, 22A, 22B, 22C, 22D, 22E, 22F, 22G, and/or 22H (which also may be included with other carry bags such as 20A and 20B), and are defined by an exterior bag 23, 23A configured, in the examples, as trapezoidal, cuboid, rhomboidal, a parallelepiped, ovoid or ellipsoid, or any and all other shapes, for example and without limitation, having a construction of a generally flexible material such as canvas, leather, suede, nylon, ballistic nylon, flexible plastic or other polymeric material and similar materials, or more generally any type of flexible material, such as a woven or nonwoven material, for example and without limitation. Also for example and without limitation, the bag 20, 20A-20E may have any shape or configuration, of any kind or form. The exterior bag 23, 23A may further include reinforcement features such as ribs or slats that are incorporated therein or PVC sheets that are incorporated on the inside surface or sewn to the inside of the material forming the exterior bag 23, 23A. Also for example and without limitation, the exterior bag 23, 23A may include non-flexible components, such as a hard case or hard shell exterior, and further, may include expansion components, such as additional flexible material which may be unzipped to expand the interior size, for either or both flexible and non-flexible exterior bags 23, 23A, illustrated and discussed in greater detail with reference to FIGS. 71-74, 76 and 77. Typically, in a representative embodiment, the exterior bag 23, 23A includes a top opening 21, 21A which is accessible through one or more zippers or other closure mechanisms 24, 24A, 24B with two such zippers 24A and 24B illustrated in FIG. 37 (more particularly, zippers 24A and 24B are illustrated as zipper sliders, having any of various zipper pulls or pull tabs, such as a pull tab 13 or a clasp 11, 11A, 12 having a dual function as both a locking clasp and a pull tab). The exterior bag 23, 23A may also include a front or side pocket 25 accessible through an opening 27 with a zipper mechanism 26, as illustrated in FIG. 1. As illustrated in FIG. 37, the carrying bag 20C further includes a front flap 19, which covers and may be lifted to reveal a front pocket 25A, illustrated in FIG. 38, accessible through an opening 27A with one or more zipper mechanisms 26A, 26B.

Additional embodiments and examples of other types of carrying bags, such as a hard-backed, soft-sided travel bag 20A and a hard case (or hard shell) travel bag 20B, are illustrated and discussed with reference to FIGS. 71-74, 76 and 77. Accordingly, any and all references to a bag 20, bag 20A, 20B, and/or bag 20C should be understood to mean and include the others and any and all of the carrying bags described herein, of any type or configuration. It should be understood that the various components disclosed herein, such as a security panel assembly or subassembly, a carry strap, or any of the various other security features disclosed herein, for example and without limitation, may be included within any and all other carrying bags, of any kind, type, shape or form, currently known or which may become known in the future, and all such embodiments are within the scope of the disclosure.

The zippers 24, 26, as examples of first or primary clasps or fasteners, include or are couplable to another type of security feature, namely, second or secondary clasps or fasteners 11, 12 respectively, as depicted in FIGS. 1 and 19, which function as an additional, secondary fastener or closure mechanism. Thus, for example and without limitation, when the zipper 24, 26 is closed (or zipped), as a first or primary fastener or closure mechanism, the zipper 24, 26 may be attached to an additional, secondary clasp or fastener 11, 12 which includes a catch or tab 28, which in turn may be inserted into a loop or ring 30 that is attached to a base 32 affixed to the outer layer 34 forming the exterior bag 23, effectively securing the slide mechanism of the zipper 24, 26 to the exterior bag 23. The catch 28 is mounted on a plate 35 by means of a pin 33. Plate 35 has a ring 31 attached to zipper 26. The catch 28 must be manually released by pivoting about pin 33 in order to enable movement and release from the loop or ring 30. Thus, the zipper mechanisms 24, 26 are effectively locked to the bag 20 and require an additional manual release operation in order to enable operation of zippers 24, 26 to achieve access though zippered openings to the interior of the bag 20. More particularly, two separate and different operations or actions are then required to gain entry to the contents of the bag 20, namely, manually releasing the second or secondary fastener such as clasp or fastener 11, 11A, 12 as a first step, followed by manually releasing the first or primary fastener, such as unzipping the zipper 24, 26, as a second step.

Not separately illustrated in FIGS. 1 and 19, those having skill in the art will recognize that the orientation of the clasp or fastener 11, 12 may also be reversed, namely, the clasp or fastener 11, 12 may be coupled to the exterior bag 23 and is releasably couplable to the zipper 24, 26, respectively. For example, loop 31 may be coupled or attached to the loop 30 which is attached to the outer layer 34 forming the exterior bag 23. The catch 28 may then be manually and releasably coupled to the zipper 24, 26, such as via a corresponding opening or hole in the zipper pull, instead of the illustrated loop 31, and again, a manual release operation of a clasp or fastener 11, 12 is required in order to enable operation of zippers 24, 26 to achieve access though zippered openings to the interior of the bag 20. A second embodiment of such a second or secondary fastener 11A is illustrated and discussed below with reference to FIGS. 38, 38A and 38B.

Other types of secondary fasteners, in addition to clasps, requiring a manual release to free a zipper or other primary closure mechanism may also be utilized equivalently to the clasp or fastener 11, 11A, 12 for any of the various zippers 24, 26 or other forms of fasteners or closure mechanisms, such as any of the various locking carabiners 44, multi-glide locking snap hook fastener 501, or other locking rings 500, 500A, 500B illustrated herein, for example and without limitation. More particularly, any type or combination of fasteners, clasps or other closure mechanisms requiring at least two different steps to open a compartment or pocket is within the scope of the disclosure, such as a first step of manually releasing a clasp or fastener 11, 11A, 12, followed by a second step of unzipping or otherwise opening the compartment or pocket using a zipper 24, 26, for example and without limitation. This two-step operation, and frequently a two hand operation, to gain access to the contents within a compartment or pocket, significantly diminishes the potential for an unauthorized access without being detected by the consumer holding or wearing the bag 20, 20A-20E, such as when a consumer may be distracted or engaged in another activity in a crowded subway station or compartment, for example and without limitation.

Such additional secondary fasteners 11A, 44A are illustrated in FIGS. 37, 37A, 38, 38A, 38B, 38C, and 39, for use with any type of a carrying bag 20, illustrated as carrying bag 20C. As illustrated in FIG. 38, a front or side pocket 25A, which may be covered by a front flap 19 of a bag 20C (illustrated as elevated to reveal the front pocket 25A), also has a zipper slides (or closures) 26A and 26B, each of which includes a pull tab 13. The pull tab 13 includes an opening or hole 14, which may be secured to a second or secondary fastener 11A, which has a movable gate 15 (rotatable about pin 8), illustrated in an open position in FIGS. 38 and 38A, allowing insertion and locking of the pull tab 13 to the secondary fastener 11A. Movable gate 15 typically has a spring (not separately illustrated) bias to maintain the movable gate 15 in a closed position, illustrated in FIG. 38B. While illustrated for a front or side pocket 25A, those having skill in the art will recognize that the secondary fastener 11A may be utilized for any zippered pocket or compartment, including top or interior pockets or compartments. As illustrated in FIG. 38C, the second or secondary fastener 11A has a reversed orientation or configuration, in which the second or secondary fastener 11A is coupled to the zipper slides (or closures) 24, 26, and is removably couplable to a ring 30A, which in turn is coupled to a loop 41A of the bag 20, 20C, 20D. In this arrangement, second or secondary fastener 11A has a dual function, namely, both as a zipper pull mechanism (in place of a zipper tab 13) and as an additional fastener for added security as a mechanism to provide a releasably locked configuration for a zipper 24, 26.

Referring to FIGS. 37, 39, 140 and 141, zipper closure mechanisms 24A, 24B are illustrated as coupled via pull tab 13 to a locking carabiner 44A, which is coupled through the loop 41 to a bag 20C. The locking carabiner 44A may have any shape or configuration, such as ovoid, elliptical (as illustrated in FIG. 37), rectangular (e.g., locking carabiner 44B), etc., for example and without limitation. The locking carabiner 44A also has a movable gate 15A, and is illustrated in an open position in FIG. 37A to allow insertion of the pull tab 13 onto the locking carabiner 44A (to provide locking of the zippers 24A, 24B to the locking carabiner 44A), and to allow removal of the pull tab 13 from the locking carabiner 44A to allow for movement of the zippers 24A, 24B and access to the interior of the bag 20C. Also not separately illustrated, movable gate 15A typically has a spring bias to maintain the movable gate 15A in a closed position. An interiorly threaded, rotatable socket 65 is rotatably and removably coupleable to the threaded end 64, as illustrated. Alternatively, for example and without limitation, the interiorly threaded, rotatable socket 65 may be rotatably and removably coupleable to a non-threaded end 64, with the threads solely on movable gate 15A, illustrated as threads 64A in FIG. 140. Many other carabiner 44 configurations are available, considered equivalent and within the scope of the disclosure. Generally, the rotatable socket 65 is maintained threaded onto or otherwise coupled to one the threaded end 64, the gate 15A of the locking carabiner 44A is closed, and the rotatable socket 65 is rotated and tightened onto the threaded end 64. When the rotatable socket 65 is rotated (onto the threaded end 64) and tightened, the locking carabiner 44A is effectively secured or locked in a closed position, illustrated in FIGS. 37 and 39, with the zippers 24A, 24B coupled to the locking carabiner 44A via pull tabs 13. As a result, as discussed above, when the zippers 26A, 26B or zippers 24A, 24B are coupled to either the secondary fastener 11A or locking carabiner 44A, respectively, access to any pocket or interior compartment also requires a two-step operation.

Those having skill in the art will also recognize that any of the multi-glide locking snap hook fastener 501 (illustrated in FIGS. 18B and 44), or locking rings 500, 500A, 500B, or other second or secondary fastener (e.g., 11A) may be utilized equivalently to the locking carabiner 44A. For example, a locking carabiner 44B, which operates identically to and has the same structure (with a slightly different shape) as the locking carabiner 44, 44A, is utilized to couple a strap 22, 22A-22H to a bag 20, 20C, such as for the security uses described in greater detail below. As a consequence, the various locking carabiners 44, 44A, 44B and rectangular locking rings 500, 500A, 500B are individually and collectively referred to herein generically or categorically as "locking rings", and reference to a "locking ring" shall be understood to mean and include a locking carabiner 44, 44A, 44B and/or a rectangular locking ring 500, 500A, 500B, for example and without limitation. FIGS. 138 and 139 show additional views of the use of a locking ring 500, 500A for locking the carrying bag 20D around a fixed support.

Not separately illustrated, the zippered openings 21, 21A and 27, 27A may include additional security features. For example, instead of having single row of zipper teeth along each side of the zippered opening 27, 27A or zippered opening 21, 21A, zippered openings 21, 21A and 27, 27A may include two or more rows or tracks of zipper teeth along each side of the zippered opening 27, 27A or zippered opening 21, 21A, such as a double track zipper available from Genmore Zipper Corp. of Taiwan and disclosed in U.S. Pat. No. 8,438,705, the disclosure of which is incorporated herein by reference.

In addition, other types of fasteners or other closure mechanisms for pockets and other bag 20 openings are also within the scope of the disclosure, in addition to the illustrated zippers 24A, 24B, 26A, 26B, such as snaps, tabs, and buttons. In addition, the pocket fastener or closure mechanism, such as a zipper 24, 26, may be independent from or otherwise uncoupled to the secondary fastener, such as clasp or fastener 11, 12, during ordinary use. For example and without limitation, a clasp or fastener 11, 12 may be coupled to the exterior 23 of the bag 20, and utilized selectively by the consumer as a second, back up closure for a pocket 25 or top opening 21, such that a two-step operation is also required to gain access to the contents.

Figure 4:
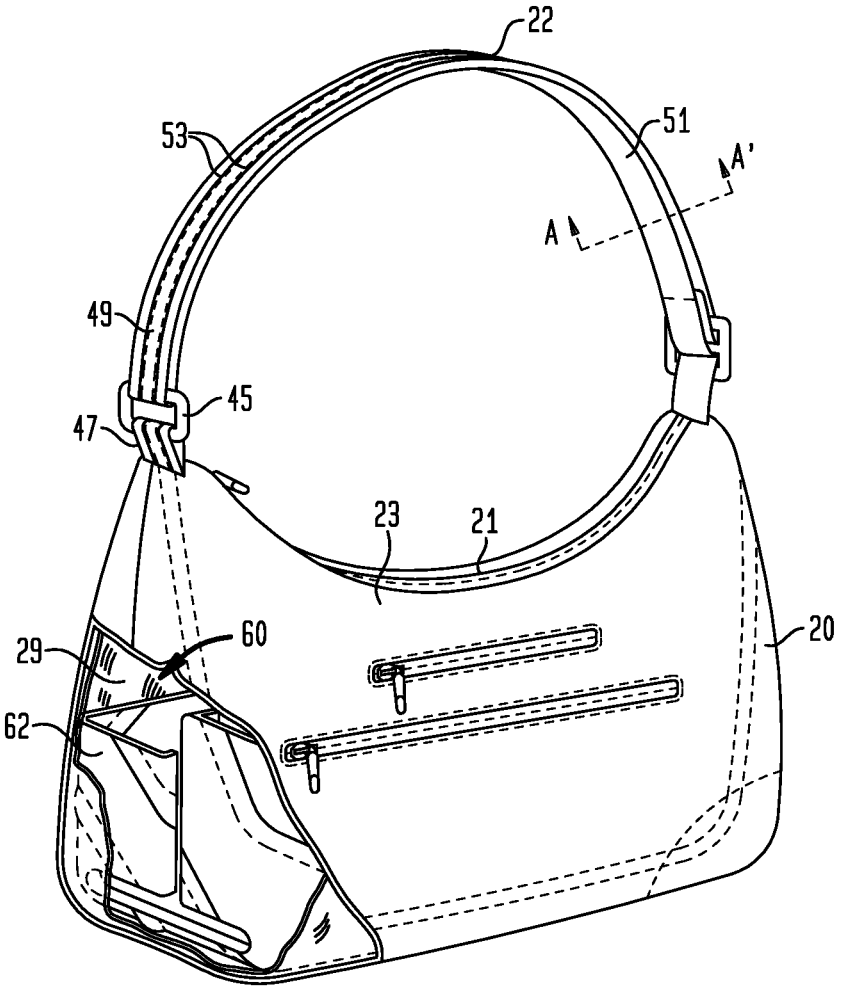
FIG. 4 is an isometric cut-away view showing the placement of the folded security panel assembly of FIG. 3 within the exterior bag construction of FIG. 1.
Figure 4A:
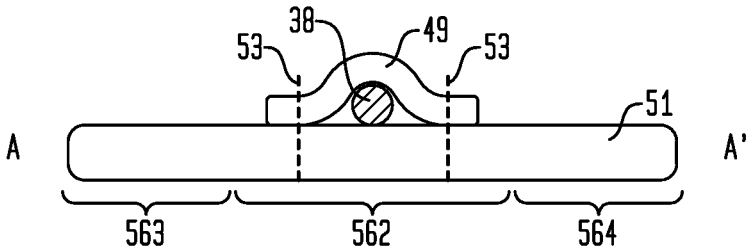
FIG. 4A is cross-sectional view of a representative first embodiment of a carry strap.

Another anti-theft, security feature is the carry strap 22, 22A-22H of bag 20, which includes an elongate, cut-resistant cable 38, which is sewn into or otherwise contained within or as part of the carry strap 22, 22A-22H, and which extends the entire length of the strap 22, 22A-22H. As a result of the incorporated cut-resistant cable 38, the carry strap 22, 22A-22H cannot be cut readily by a potential thief or mugger, who might otherwise quickly cut a carrying strap and run off with a purse, for example. For example, as illustrated in FIGS. 4, 4A and 19, a cut-resistant cable 38 has been sewn longitudinally along the center or middle of the carry strap 22. Additional representative embodiments of a carry strap 22A-22H are illustrated and discussed below with reference to FIGS. 45-61.

Figure 17:
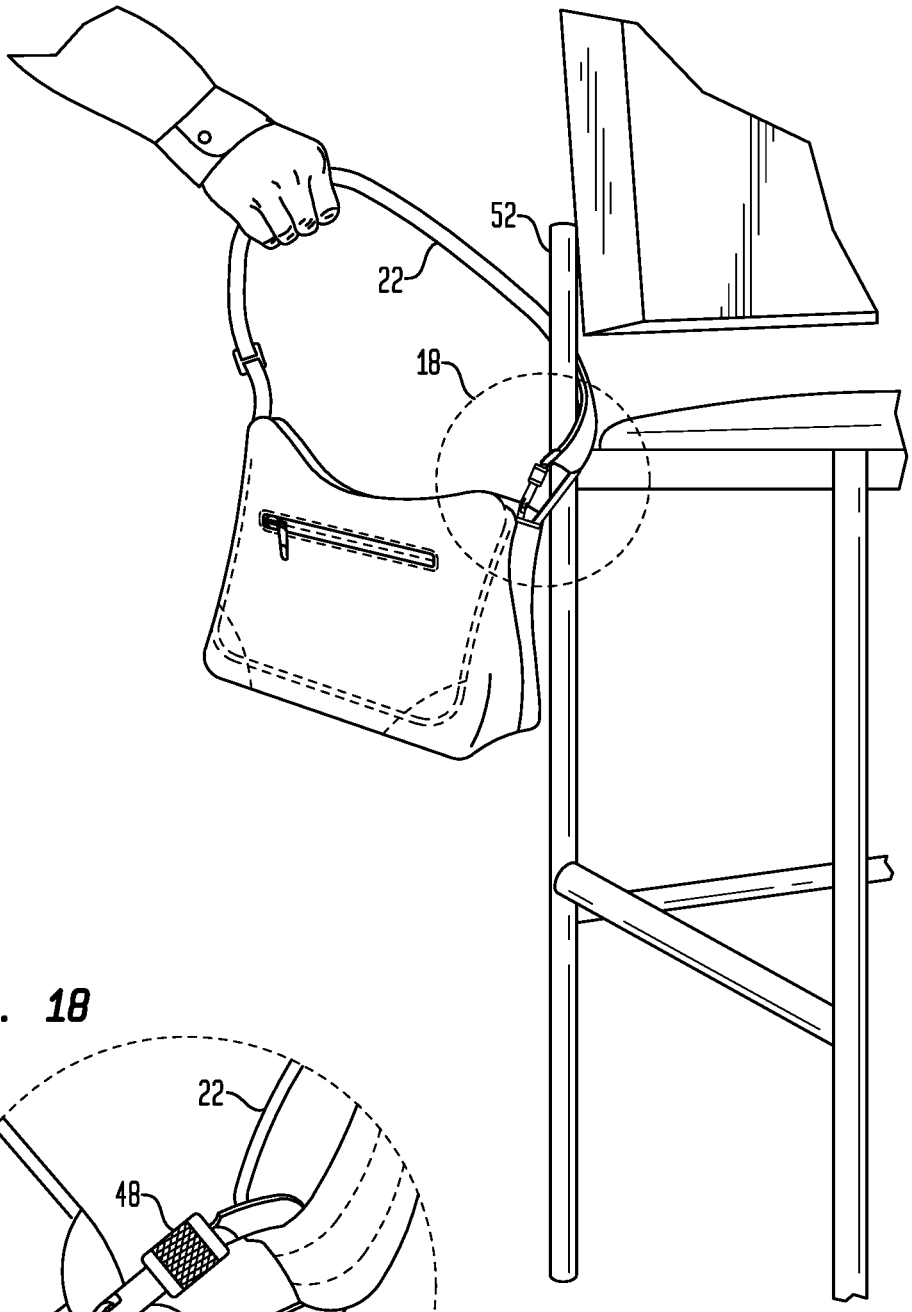
FIG. 17 is an isometric view that illustrates the inclusion and positioning of a representative embodiment of a carabiner or hinged, locking rectangular ring as a security feature associated with the carry strap of a representative embodiment of an exemplary handbag.
Figure 18:
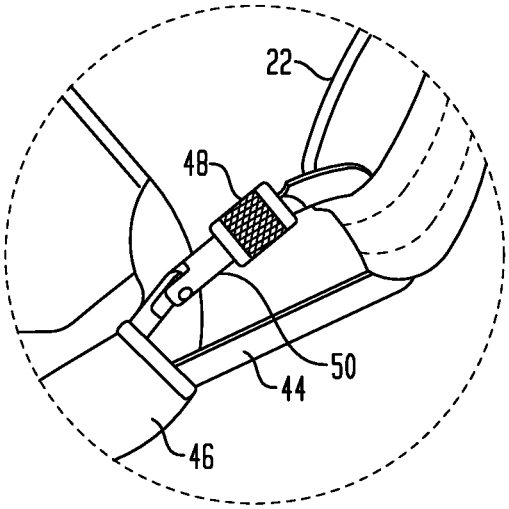
FIG. 18 is an enlarged isometric view of a carabiner construction of a first embodiment of the exemplary handbag of FIG. 17.
Figure 18A:
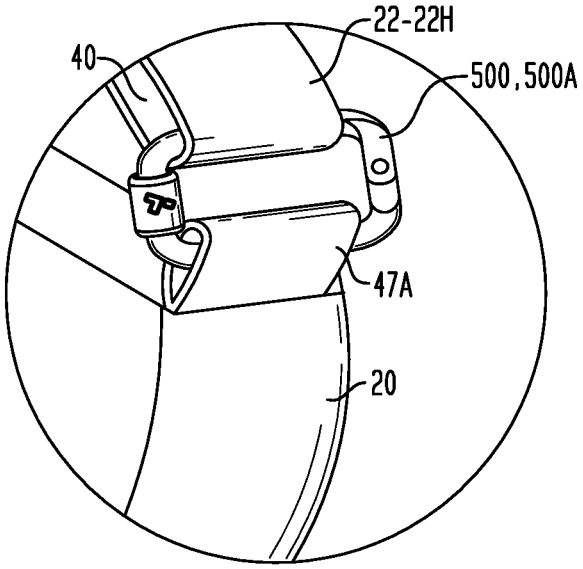
FIG. 18A is an enlarged isometric view of a hinged, locking rectangular ring construction of an alternative, second embodiment of the exemplary handbag of FIG. 17.
Figure 18B:
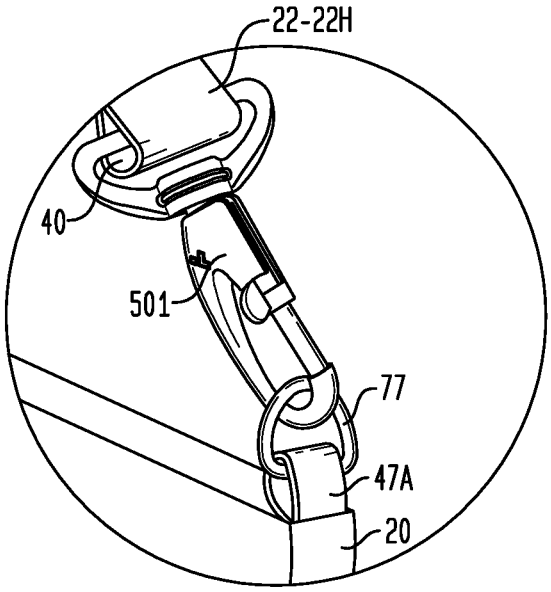
FIG. 18B is an enlarged isometric view of a multi-glide locking snap hook fastener of an alternative, third embodiment of the exemplary handbag of FIG. 17.

In addition to securing a zipper closure, yet another anti-theft, security feature of the representative embodiments is the use of a locking carabiner 44, 44B, or multi-glide locking snap hook fastener 501, or hinged, locking (rectangular) ring 500, 500A, 500B to enable securing the bag 20, 20C, via carry strap 22, 22A-22H to a fixture, such as a chair or post, to diminish the possibility that a potential thief could quickly grab and run off with a purse, for example, when the consumer is seated at a restaurant or café (and might typically hang such a carrying bag on the back of a chair, for example). More particularly, referring to FIGS. 1, 17, 18, 18A, 18B, 37 and 39, a strap 22, 22A-22H is typically attached to bag 20, 20C at one end (or looped through another buckle 45) and to a buckle 42 at its opposite end. The strap 22, 22A-22H also fits though buckle 42 and forms a loop 40 though a locking carabiner 44, 44B as illustrated in FIGS. 18, 37, 39, or through a hinged, locking rectangular ring 500, 500A as illustrated in FIG. 18A, or through multi-glide locking snap hook fastener 501 as illustrated in FIG. 18B, for example. Strap 22, 22A-22H thus forms a loop 40 which enables, in combination with a buckle 42, adjustment of the length of the strap 22, 22A-22H. The strap 22, 22A-22H may have one end fastened into the interior or the exterior of the bag 20 or as illustrated in FIG. 4, to a buckle 45 (or alternatively to a carabiner 44, 44B, or hinged, locking (rectangular) ring 500, 500A, 500B, or a multi-glide locking snap hook fastener 501) attached to a loop 47, 47A, 47B affixed to bag 20. Any and all of these combinations are within the scope of the disclosure. The opposite end of the strap 22, 22A-22H is attached to buckle 42 (e.g., forming a loop through the buckle 42 and then attached back to another part of the strap 22, 22A-22H. The carabiner 44, 44B is also attached to the bag 20, 20C and, in an exemplary embodiment, may slidably fit within a pocket 46 in the side of the exterior bag 20, and in other exemplary embodiments, may be exposed (similarly to buckle 45) as illustrated in various other Figures. For example, instead of a buckle 45 in FIG. 4, a locking carabiner 44, a multi-glide locking snap hook fastener 501, or a hinged, locking rectangular ring 500, 500A, 500B may be utilized, to provide the additional security feature illustrated in FIGS. 17, 18, 18A and 18B.

In order to release the locking carabiner 44, 44B from loop 40 and open the locking carabiner 44, 44B, a rotatable socket 48 must be manually manipulated by rotating (loosening) it and allowing the pivotal arm (or gate) 50 of the carabiner 44, 44B to be movable into an open position. Locking is effectively provided by tightening the rotatable socket 48 when the pivotal arm (or gate) 50 of the carabiner 44, 44B is in a closed position. This construction is shown in more detail in FIGS. 17 and 18 wherein the locking carabiner 44, which may slidably fit into the pocket 46 and thus remains generally hidden during use, is released once the socket 48 is rotated (loosened or unthreaded) so that a pivotal arm (or gate) 50 of the carabiner 44 is released and may be manipulated to open the carabiner 44, such that the loop 40 of strap 22, 22A-22H may be removed from the locking carabiner 44, fitted around a stable object such as a support of a chair or post 52 as depicted in FIG. 17, and reattached to the locking carabiner 44, to thereby retain the bag securely attached to the illustrated chair. The rotatable socket 48 may then be rotated around the mating threads of C-shaped portion of the locking carabiner 44, and held in place in a secure or locked position. This procedure is then reversed to release the bag 20 from the stable object. This operation is the same for a locking carabiner 44B. In other words, the strap 22, 22A-22H coupled to the locking carabiner 44, 44B or hinged, locking rectangular ring 500, 500A, 500B is another security feature of the exemplary bag 20, 20C constructions, by enabling the secure placement of the carry strap 22, 22A-22H around a post or some other object to prevent ease of snatching the bag 20, 20C.

Another variation, using hinged, locking rectangular ring 500, 500A, is illustrated in FIG. 18A. As illustrated, a carry strap 22, 22A-22H is coupled (via loop 40) to a hinged, locking rectangular ring 500, 500A (or 500B), which in turn is coupled through loop 47A to a bag 20. In a representative embodiment, the loop 47A is constructed similarly to a carry strap 22, 22A-22H, such as by incorporating a cable 38 or by having other cut-resistant reinforcement, such as a wire matrix (discussed below) or a cut-resistant, semi-rigid but flexible polymer or plastic sheet. Representative hinged, locking rectangular rings 500, 500A, and 500B are illustrated in FIGS. 40-44.

Another variation, using a multi-glide locking snap hook fastener 501, is illustrated in FIG. 18B. As illustrated, a carry strap 22, 22A-22H is coupled (via loop 40) to a multi-glide locking snap hook fastener 501, which in turn is coupled to a ring 77 or other fitting (or any shape or kind) coupled through loop 47A to a bag 20. In a representative embodiment, the loop 47A is constructed similarly to a carry strap 22, 22A-22H, such as by incorporating a cable 38 or by having other cut-resistant reinforcement, such as a wire matrix (discussed below) or a cut-resistant, semi-rigid but flexible polymer or plastic sheet. A representative multi-glide locking snap hook fastener 501 is illustrated in FIG. 44. In addition, a multi-glide locking snap hook fastener 501 is described in detail and claimed in U.S. Provisional Patent Application No. 62/104,717, filed Jan. 17, 2015, titled "Multi-Glide Locking Snap Hook Fastener", which is commonly assigned herewith, the entire contents of which are incorporated herein by reference with the same full force and effect as if set forth in its entirety herein, and with priority claimed for all commonly disclosed subject matter.

FIG. 4A is cross-sectional view (through the A-A' plane illustrated in FIG. 4) of a representative first embodiment of a carry strap 22, such as illustrated in FIGS. 1 and 4. As illustrated in FIGS. 1, 4 and 4A, a carry strap 22 generally comprises a first piece of flexible material (or webbing) 51, with a wire or cable 38 disposed longitudinally along the middle or center of the flexible material (or webbing) 51, illustrated as central region 562 located between first and second lateral regions 563, 564. The wire or cable 38 and central region 562 of the first flexible material are covered by a second piece of flexible material (or webbing) 49, also disposed longitudinally along the middle or center of the flexible material (or webbing) 51, and secured to the first piece of flexible material (or webbing) 51, such as through stitching 53, securing the wire or cable 38 in between the second flexible material 49 and the central region 562 of the first flexible material 51. As illustrated, the first piece of flexible material (or webbing) 51 is considerably wider (in the lateral dimension) than the second piece of flexible material (or webbing) 49, although this is not required, and many other variations are illustrated and discussed below. More particularly, as illustrated in FIGS. 4 and 4A (showing a cross-section through the A-A' plane of FIG. 4), a first flexible material 51 (having a first length substantially greater than a first width, as illustrated in FIG. 4), also has a first lateral edge and a second lateral edge along its length, has first and second lateral regions 563, 564 along its length, and having a central region 562 along its length in between the first and second lateral regions 563, 564. The carry strap 22 has a substantially cut-resistant cable 38 longitudinally arranged on the central region 562 of the first flexible material 51, and a second flexible material 49 (also having a second length substantially greater than a second width, width the second width smaller than the first width of the first flexible material 51 as illustrated), with the second flexible material 49 coupled over the substantially cut-resistant cable 38 and to the first central region 562 of the first flexible material 51 to secure the substantially cut-resistant cable 38 between the second flexible material 49 and the central region 562 of the first flexible material 51. Not separately illustrated, and depending on the materials selected for the first and second pieces of flexible material 51, 49, the lateral edges (if unfinished) of each of the first and second pieces of flexible material (or webbing) 51, 49 may be folded over and secured, to not be visible (by a consumer) in the finished carry strap 22. As illustrated in FIG. 4A, however, webbing material has been used as the flexible material 51, 49; as known in the fabric arts, "webbing" material is generally a woven strip of fabric or other flexible material which generally extends longitudinally and has a considerably narrower width (lateral dimension), such as to be suitable to form a strap, and typically has finished lateral edges (e.g., to avoid unraveling).

Referring to FIGS. 40-43, a hinged, locking rectangular ring 500, 500A comprises two C-shaped arms 502, 504, which are coupled to each other at a first end through a pin 506, such as a rivet or other attachment, forming a hinge or otherwise allowing pivoting or other rotation of one arm 502, 504 relative to the other arm 504, 502. At their respective second ends, arms 502, 504 are threaded, illustrated as threads 510 and 512, respectively. An interiorly threaded, rotatable socket 508 is rotatably and removably coupleable to the arms 502, 504 at their threaded second ends (510, 512), as illustrated. Generally, the rotatable socket 508 is maintained threaded onto or otherwise coupled to one of the threaded second ends 510, 512, the hinged, locking rectangular ring 500, 500A is closed, and the rotatable socket 508 is rotated and tightened onto the other threaded second end 512, 510. When the rotatable socket 508 is rotated (onto the threads of both the arms 502, 504) and tightened, the hinged, locking rectangular ring 500, 500A is effectively secured or locked in a closed position, illustrated in FIG. 40 for hinged, locking rectangular ring 500. When the rotatable socket 508 is loosened and rotated in the other direction and off of the threads of one (or both) of the arms 502, 504, the arms 502, 504 may be pivoted relative to one another to provide an opening or aperture 520, such that the hinged, locking rectangular ring 500, 500A is in an open position, as illustrated in FIG. 41 for a hinged, locking rectangular ring 500 and FIG. 42 for a hinged, locking rectangular ring 500A.

The size of the opening or aperture 520 may be limited by the configuration or shape of the two C-shaped arms 502, 504, as illustrated in FIG. 42, such as by one or more extensions, stop(s) or detent(s) 514 on or of C-shaped arm 502A for limiting the degree of rotation or pivoting about pin 506, forming hinged, locking rectangular ring 500A as another variation within the scope of the disclosure, and which otherwise operates effectively the same as the hinged, locking rectangular ring 500. In various representative embodiments, the size of the opening or aperture 520 is limited to be narrow and allow only a sliding removal of the carry strap 22, 22A-22H when it is comparatively flat and not folded or bunched, as another security feature. Similarly, the threaded ends of the two C-shaped arms 502, 504 may be sized relative to the loop 47A and vice-versa; for example and without limitation, the loop 47A may be sized to allow insertion or removal of an arm 502, 504 only when the rotatable socket 508 is not attached, such that the arm 502, 504 is also secured within the loop 47A when the rotatable socket 508 is coupled to the corresponding threads 510 or 512. In representative embodiments, the hinged, locking rectangular ring 500, 500A, 500B is provided with an aspect ratio greater than one, having relatively longer arms 502, 504 (as two opposite sides of a rectangle) compared to the first and second ends (as the other two opposite sides of a rectangle), such as to provide a comparatively slender configuration, allowing for a more feminine style for bags 20, 20C such as purses and handbags. Also in representative embodiments, the pin 506 is configured to withstand considerable strain, shear and other types of stressful forces, such that the two C-shaped arms 502, 504 are not separated from each other by a typical force which may be exerted by a potential thief under typical circumstances.

Another variation of a hinged, locking rectangular ring is illustrated in FIG. 43 as hinged, locking rectangular ring 500B. For this embodiment, the hinged, locking rectangular ring 500B is permanently attached to a loop 47A (or loop 40 of strap 22, 22A-22H) through the opening or aperture 522 in arm 504A, and otherwise operates effectively the same as a hinged, locking rectangular ring 500, 500A. Other variations in the shape of the locking ring 500, 500A, 500B, such as triangular, square, pentagonal, hexagonal, octagonal, twisted, spiral, etc. locking rings, are considered equivalent and are also within the scope of the disclosure. Not separately illustrated, the hinged, locking (rectangular) ring 500, 500A, 500B may also include other components, such as one or more additional locking mechanisms, springs, or a stop nut to prevent the rotatable socket 508 from being disengaged from one of the arms 502, 504, or to maintain the hinged, locking (rectangular) ring 500, 500A, 500B in a closed position, for example and without limitation.

In contrast to a locking carabiner 44, 44A, 44B, the locking ring 500, 500A, 500B does not typically require a spring bias mechanism to be maintained in a closed position. Also in structural contrast to a locking carabiner 44, 44A, 44B, the opening or aperture 520 is on a (first) side of the locking ring 500, 500A, 500B directly opposite the (second) side having the pin 506, rather than being on the same side (and typically coupled to the carabiner gate), as would be the case with a locking carabiner 44, 44A, 44B.

FIG. 44 illustrates a multi-glide locking snap hook fastener 501, which as mentioned above is the subject of U.S. Provisional Patent Application No. 62/104,717, filed Jan. 17, 2015, and is incorporated herein by reference with the same full force and effect as if set forth in its entirety herein, and with priority claimed for all commonly disclosed subject matter. As discussed in detail in U.S. Provisional Patent Application No. 62/104,717, the gate 516 of the multi-glide locking snap hook fastener 501 is biased (via a spring, not separately illustrated) into a closed position, as shown in FIG. 44, and several different movements of the gate 516 (via movement of the grip 514 and associated components through the multipart channel 515) are required for opening the multi-glide locking snap hook fastener 501. The multi-glide locking snap hook fastener 501 may be utilized in any of the embodiments discussed herein, such as to replace any of the locking carabiners 44, 44A, 44B, or the locking ring 500, 500A, 500B, for example and without limitation.

Referring to FIGS. 45-61, constructions or assemblies forming carry straps 22A-22H are illustrated, as variations of a carry strap 22 within the scope of the disclosure. As illustrated in FIG. 45, the cut-resistant cable 38 is enclosed or otherwise provided within edge piping 525, which is sewn or otherwise coupled or attached (via flanges, tabs, anchors or flags 545 of the piping 525) in between the flexible material forming the strap 22A, 22B (e.g., along the illustrated sewing lines 531, 533), such as fabric webbing, leather, ballistic nylon, fabric, etc., illustrated as flexible (webbing) material sides 527 and 528. The edge piping 525 having the embedded cut-resistant cable 38 then abuts one of the respective (second) lateral edges 526A and 526B of the flexible material sides 527 and 528, as illustrated. As illustrated in FIG. 46, with two cut-resistant cables 38A and 38B, each in a respective edge piping 525A and 525B, the cut-resistant cables 38A and 38B are also enclosed within respective edge piping 525A and 525B, which are sewn or otherwise coupled or attached (via flanges, tabs, anchors or flags 545 of the piping 525A, 525B) in between the flexible material forming the strap 22A, 22B (e.g., along the illustrated sewing lines 531, 533), such as fabric webbing, leather, ballistic nylon, fabric, etc., illustrated as flexible (webbing) material sides 527 and 528. The edge piping 525A and 525B having the respective embedded cut-resistant cables 38A and 38B then abuts the respective first lateral edges 524A and 524B and second lateral edges 526A and 526B of the flexible material sides 527 and 528, as illustrated.

As would be typical for any strap (e.g., a strap 22, 22A, 22B, 22C, 22D, 22E, 22F, 22G, and/or 22H), the flexible material forming the strap (such as flexible webbing material sides 527 and 528) has or have a length (longitudinal dimension) substantially greater than its width (lateral dimension). The flexible material forming the strap may have any of various thicknesses, as discussed in greater detail below, which may be a uniform or non-uniform thickness in the lateral dimension and also in the longitudinal dimension (e.g., thicker regions may be provided for shoulder padding, and so on, in a region of the strap, both in the longitudinal and lateral dimensions for that region of the strap 22, 22A, 22B, 22C, 22D, 22E, 22F, 22G, and/or 22H). It should be noted that for any and all embodiments of a strap 22, 22A, 22B, 22C, 22D, 22E, 22F, 22G, and/or 22H, the flexible material comprising the strap may be comprised of any of the flexible materials disclosed herein and their equivalents, such as leather, nylon, polyester, polypropylene, acrylic, ballistic nylon, etc., for example and without limitation, and that any flexible material may also be utilized in place of any webbing, also for example and without limitation, and also for any of the various straps 22, 22A, 22B, 22C, 22D, 22E, 22F, 22G, and/or 22H. The flexible material may be one piece which is folded about its middle to provide the two sides 527 and 528, or may be comprised of two (or more) separate pieces of flexible material, such as two pieces of flexible webbing material having finished edges, for example and without limitation. In addition to providing added security by incorporating the cut-resistant cable 38, the edge piping 525 may also provide decoration and/or style to the carry strap 22A, 22B of the bag 20, 20C, 20D, 20E, which may also include decorative piping without a cut-resistant cable 38, for example and without limitation. As another variation illustrated in FIG. 46, cut-resistant cable 38 is incorporated within piping 525 along both edges 524, 526, forming a carry strap 22B having symmetrical piping and twice the reinforcement from the two incorporated cut-resistant cables 38. In other representative embodiments, a second, symmetrical piping 525 may also be provided without inclusion of a cut-resistant cable 38, as mentioned above. Those having skill in the manufacturing arts will recognize that the security cable 38, piping 525 and flexible material sides 527 and 528 may be assembled in line and fed collectively through a sewing or other machine in one or a few steps, and any and all such variations are considered equivalent and within the scope of the disclosure.

Not separately illustrated, in addition to or in lieu of stitching, for example and without limitation, an adhesive or laminate may also be utilized to couple any of the various structures and components of any of the various carry straps 22, 22A, 22B, 22C, 22D, 22E, 22F, 22G, and/or 22H, such as to couple together flexible material sides 527 and 528, piping 525, etc. Accordingly, any and all means and mechanisms of attachment, such as stitching, adhesive, rivets, snaps, for example and without limitation, are considered equivalent and within the scope of the disclosure.

Additional structural and manufacturing advantages are provided by incorporating the cut-resistant cable(s) 38 along the edge(s) of the carry strap 22A, 22B, namely, the capability to fold the end of the cut-resistant cable(s) 38 into the middle or center of the carry strap 22A, 22B in the lateral dimension, illustrated in FIG. 47. This prevents the end of the cut-resistant cable 38 from being in a position to pierce or poke through the flexible material 527, 528 of the carry strap 22A, 22B or project outwardly from the carry strap 22A, 22B. From a manufacturing point of view, the folding of the cut-resistant cable 38 also eliminates any need for separately capping the end of the cable 38, providing a savings in both manufacturing time and expenses.

The ends of the carry strap 22A, 22B are further finished as illustrated in FIGS. 47 and 48. A first portion of an end of the carry strap 22A, 22B is folded back on itself, as illustrated in FIG. 47 as a first fold 529, and may be optionally secured in place, such as through stitching or other sewing through the illustrated sewing lines 537 and/or 539. In addition, the folded end of the carry strap 22A, 22B is folded a second time, as illustrated in FIG. 48 as second fold 534, to form a loop 40 (and/or a loop 47, 47A) for securing to a fastener (such as a multi-glide locking snap hook fastener 501, a hinged, locking rectangular ring 500, 500A, 500B, a carabiner 44, 44B, and/or to a buckle 42, 45), and secured (such as through stitching or other sewing, crimping, riveting, adhesive, etc. through the illustrated (sewing) lines 541 and/or 543, which may be in lieu of or in addition to the stitching or other securing through lines 537 and/or 539). As a result, the end of the cut-resistant cable 38 (or 38A, 38B) is prevented from being in a position to pierce the carry strap 22A, 22B or cut or scrape the consumer, and further remains hidden for aesthetic purposes. This methodology and resulting configuration or arrangement of the end of a carry strap is applicable to any and all of the representative carry straps 22, 22A, 22B, 22C, 22D, 22E, 22F, 22G, and/or 22H, with additional, alternative arrangements and configurations for finishing a free end of a carry strap 22, 22A, 22B, 22C, 22D, 22E, 22F, 22G, and/or 22H illustrated and discussed below with reference to FIGS. 50 and 52.

In another representative embodiment not separately illustrated, the cut-resistant cable 38 is simply maintained in between the flexible material sides 527 and 528, without separately anchoring the cut-resistant cable 38, such as without anchoring the cable 38 along the middle or the edges. For this configuration, the end of the cut-resistant cable 38 may also be folded toward the middle of the carry strap 22, as illustrated, and finished as discussed above for the carry strap 22A, 22B. Alternatively, rather than folding the ends, the carry straps 22A, 22B may also be finished as described below for carry strap 22C, using a substantially flat end cap 544.

FIG. 49 is an isometric view illustrating steps in the manufacture of the representative fourth embodiment of a carry strap 22C; FIG. 50 is an isometric view illustrating the representative fourth embodiment of a carry strap 22C; FIG. 51 is cross-sectional view through the B-B' plane of the representative fourth embodiment of a carry strap 22C; and FIG. 52 is an isometric view of a representative fourth embodiment of a carry strap 22C with a flat end cap 544.

As illustrated in FIG. 49, flexible material sides 527 and 528 are implemented using two pieces of flexible webbing material having respective finished first edges 524A and 524B and finished second edges 526A and 526B. The flexible material sides 527 and 528 are offset from each other laterally, i.e., side-to-side, by a predetermined amount, providing respective lateral (or lateral offset) regions 576 and 577, and coupled to each other such as by sewing or other stitching, illustrated as stitching 532A and 532B. A first cable 38A is then placed above the lateral (or lateral offset) region 576 of first material side 527, and another, second cable 38B is placed below the lateral (or lateral offset) region 577 of the second material side 528, and each lateral (or lateral offset) region 576, 577 is then wrapped around the corresponding cable 38A, 38B, as illustrated in FIGS. 50 and 51. The amount of predetermined offset is selected to provide sufficient flexible (webbing) material to wrap around cables 38A and 38B. The wrapped offset regions 576, 577 of the first and second material sides 527, 528 are then coupled in place, such as by sewing or other stitching, illustrated as stitching 542A and 542B in FIGS. 50 and 51. Adhesives (not separately illustrated) may also be utilized in addition to or in lieu of stitching. In a representative embodiment as illustrated in FIG. 50, the ends of the cables 38A and 38B may be coupled to each other, such as via a crimp 507, for example and without limitation. A substantially flat end cap 544 having a mating recess or lumen 547 (not separately illustrated, as the mating recess is a simple opening or tunnel without any additional structure required) may be slid onto the end of the strap being formed by a sufficient amount to cover the ends of the cables 38A and 38B and secured in place, such as by sewing or other stitching, illustrated as stitching 546 in FIG. 52 (which also secures the ends of the cables 38 and crimp 507), to form a carry strap 22C. A flat end cap 544 may be comprised of any suitable material, typically rubber or a plastic or other polymer, also for example and without limitation.

The flat end cap 544 is typically utilized with a strap 22, 22A, 22B, 22C, 22D, 22E, 22F, 22G, and/or 22H when the strap is utilized with a backpack or another bag 20 embodiment which will have an exposed and free end of a strap 22, 22A, 22B, 22C, 22D, 22E, 22F, 22G, and/or 22H. In other embodiments, such as illustrated in FIGS. 1 and 4, an end of a strap 22, 22A, 22B, 22C, 22D, 22E, 22F, 22G, and/or 22H may be coupled directly to a carrying bag 20, or coupled to any of the various buckles and/or fasteners as mentioned above. The ends of a strap 22, 22A, 22B, 22C, 22D, 22E, 22F, 22G, and/or 22H may also be finished as described above with reference to FIGS. 47 and 48.

As illustrated in FIG. 52, using dashed lines, the ends of the cables 38A and 38B having the crimp 507 have been inserted far enough into the flat end cap 544, past the slot 509, such that the stitching 546 is within a loop formed by the crimped ends of the cables 38A and 38B, securing the flat end cap 544 to the strap 22C. Also illustrated in FIG. 52, the resulting carry strap 22C is sufficiently flexible and has a sufficiently thin form factor to readily slide through (for length adjustment by the user) and be held in a locked position by a ladder lock-type buckle 548. The ladder lock-type buckle 548 may be secured to the carrying bag 20, 20C (such as a backpack) using another piece or section of a carry strap 22C formed into a loop 549, which is then secured to the carrying bag 20.

FIGS. 53-61 are isometric and cross-sectional views of representative fifth, sixth, seventh, eighth and ninth embodiments of a carry strap, respectively carry straps 22D, 22E, 22F, 22G, and 22H. As illustrated in FIG. 53, a single piece of flexible material 527, such as webbing material (or any of the various other flexible materials (e.g., flexible material 561) utilized to form a strap 22, 22A, 22B, 22C, 22D, 22E, 22F, 22G, and/or 22H) may be described as having a middle (or central) region 562 having any predetermined lateral dimension (width) that is less than the overall width of the flexible material 527, and extending along the length (longitudinal dimension) of the flexible material 527, with the balance of the flexible material 527 being described as respective first and second side or lateral regions 563, 564, also extending along the length (longitudinal dimension) of the flexible material 527. In various embodiments illustrated and discussed below with reference to FIGS. 54-61, the middle (or central) region 562 and the first and second side or lateral regions 563, 564 may have a wide range of thicknesses, which may be uniform or non-uniform, e.g., the middle (or central) region 562 may be thicker than the first and second side or lateral regions 563, 564, such as illustrated in FIGS. 54-57 and 59, and as illustrated using dashed lines in FIG. 53 as optional thicker region 499. In other embodiments, the middle (or central) region 562 may have about the same thickness as the first and second side or lateral regions 563, 564, as illustrated in FIGS. 58 and 61. For these various embodiments, each of the first and second side or lateral regions 563, 564 may be wrapped around respective cables 38A and 38B laterally (which have been arranged longitudinally along the first and second side or lateral regions 563, 564) and secured in place, such as by sewing or other stitching, illustrated as stitching 565 in FIG. 54.

Each of the respective first and second side or lateral regions 563, 564 may also be described or conceptually divided into three regions extending longitudinally, respectively first and second medial regions 584A and 584B adjacent the central region 562, respectively first and second lateral regions 579A and 579B adjacent the respective edges 524 and 524, and respective middle regions 589A and 589B. As illustrated in FIG. 53, the respective wires or cables 38A, 38B are placed over the respective middle regions 589A and 589B, the respective first and second lateral regions 579A and 579B are folded over the respective wires or cables 38A, 38B, and respectively coupled to the first and second medial regions 584A and 584B to laterally enclose the respective wires or cables 38A, 38B, such as through stitching, illustrated as respective stitching 565A and 565B.

FIG. 54 is an isometric view of a representative fifth embodiment of a carry strap 22D. As illustrated in FIG. 54, a single piece of webbing 561 is thicker in the middle (or central) region 562, allowing the first and second side or lateral regions 563, 564 to be wrapped around respective cables 38A, 38B and secured in place, as mentioned above, to form a carry strap 22D having a substantially even overall thickness and also generally a substantially thin form factor. Depending upon the comparative thickness of the middle (or central) region 562, as compared to the first and second side or lateral regions 563, 564, depending on the width of the first and second side or lateral regions 563, 564, and depending on the location of the placement of the wires or cables 38 along or within the first and second side or lateral regions 563, 564, various different configurations or arrangements of a carry strap 22D may result, as illustrated in FIGS. 55-57 and 61.

FIG. 55 is cross-sectional view through the F-F' plane of a representative fifth embodiment of a carry strap 22D (of FIG. 54) having a first configuration and a first thickness arrangement; FIG. 56 is cross-sectional view through the C-C' plane of a representative fifth embodiment of a carry strap 22D (of FIG. 54) having a second configuration and a second thickness arrangement; and FIG. 57 is cross-sectional view through the C-C' plane of a representative fifth embodiment of a carry strap 22D (of FIG. 54) having a second configuration and a first thickness arrangement. As illustrated, the middle (or central) region 562 of the webbing 561 has a thickness of "B", each of the first and second side or lateral regions 563, 564 has a thickness of "C" (generally symmetrical laterally, although that is not required), and each of the wires or cables 38A, 38B has a thickness of "D" (also generally symmetrical, although that also is not required). For the embodiment shown in FIG. 55, the placement of each of the wires or cables 38A, 38B is a first predetermined distance from the respective lateral edges 519 of the middle (or central) region 562, e.g., comparatively close to the edges 519 but generally not quite abutting to allow sufficient space for the stitching 565A, 565B. For this embodiment, to provide a carry strap 22D having about or substantially a uniform thickness laterally, the thickness "B" of the middle (or central) region 562 is generally greater than two times the thickness "C" of the first and second side or lateral regions 563, 564 by about the thickness "D" of the wires or cables 38, i.e., B≈2C+D. A significant range of comparative thicknesses are available and within the scope of the disclosure for this embodiment, for example and without limitation, B≈(1.8–2.2)C+D, B≈(1.5–2.5)C+D, B≈(1.0–3.0)C+D, as may be necessary or desirable for any given implementation and tolerance level.

For the embodiment shown in FIG. 56, the placement of each of the wires or cables 38 is a second predetermined distance from the respective lateral edges 519 of the middle (or central) region 562 which is greater than the first predetermined distance of FIG. 55, enough distance to allow each of the first and second side or lateral regions 563, 564 to wrap around the wires or cables 38A, 38B and contact the more medial portions of the respective first and second side or lateral regions 563, 564 as illustrated and as described above, and for the edges 524, 526 to contact (or close to contact) or abut the edges 519 of the middle (or central) region 562. For this embodiment, the carry strap 22D has about or substantially a uniform thickness centrally only (i.e., and is thicker at the lateral edges or regions), with the thickness "B" of the middle (or central) region 562 generally about two times the thickness "C" of the first and second side or lateral regions 563, 564, i.e., B≈2C. A significant range of comparative thicknesses are available and within the scope of the disclosure for this embodiment, for example and without limitation, B≈(1.8–2.2)C, B≈(1.5–2.5)C, B≈(1.0–3.0)C, as may be necessary or desirable for any given implementation and tolerance level.

For the embodiment shown in FIG. 57, the placement of each of the wires or cables 38 is also a second predetermined distance from the respective lateral edges 519 of the middle (or central) region 562, which also is greater than the first predetermined distance of FIG. 55, enough distance to allow each of the first and second side or lateral regions 563, 564 to wrap around the wires or cables 38A, 38B and contact or touch the more medial portions of the respective first and second side or lateral regions 563, 564 as illustrated and discussed above, and for the edges 524, 526 to contact (or close to contact) or abut the edges 519 of the middle (or central) region 562. For this embodiment, the carry strap 22D has a more variable and non-uniform thickness (i.e., is thinner where the edges 524, 526 meet the edges 519 of the middle (or central) region 562), with the thickness "B" of the middle (or central) region 562 is generally greater than two times the thickness "C" of the first and second side or lateral regions 563, 564 by about the thickness "D" of the wires or cables 38, i.e., B≈2C+D, and with similar ranges of comparative thickness as previously described.

As illustrated in FIG. 58, a single piece of webbing material 566 may be folded over a single cable 38 arranged along one of the first or second side or lateral regions 563, 564 and secured, such as by sewing or other stitching, illustrated as stitching 567 and 568, to form a carry strap 22E having a sufficiently even overall thickness (except slightly thicker along the side where the wire or cable 38 is located) and also generally a substantially thin form factor. As illustrated in FIG. 59, a single piece of flexible material (webbing) 561 also is thicker in the middle (or central) region 562, with a second piece of flexible material (webbing) 569 placed over the respective cables 38A, 38B (arranged along the first and second side or lateral regions 563, 564) and secured in place, such as by sewing or other stitching, illustrated as stitching 570A and 570B, to form a carry strap 22F having a substantially even overall thickness and also generally a substantially thin form factor. As illustrated in FIG. 60, a single piece of flexible material (webbing) 572 is thinner in the middle to form a channel 573 for holding or housing a cable 38, with a second piece of webbing 574 placed over the cable 38 and webbing 572 and secured in place, such as by sewing or other stitching, illustrated as stitching 575A and 575B, to form a carry strap 22G having a substantially even overall thickness and also generally a substantially thin form factor. Not separately illustrated in FIGS. 53-61, any of these carry straps 22D, 22E, 22F, 22G and/or 22H, or any of the other carry straps disclosed herein, may also be finished with a substantially flat end cap 544, and also utilized with a ladder lock-type buckle 548, or finished as otherwise described herein, such as illustrated in FIGS. 47 and 48.

As illustrated in FIG. 61, a piece of first flexible material 527 having a generally uniform thickness may be folded over two wires or cables 38A, 38B, each arranged along a respective one of the first or second side or lateral regions 563, 564, with the respective lateral edges 524, 526 abutting or spaced closely to each other centrally, as illustrated. To provide a more uniform thickness, a separate piece of second flexible material 581, also having a generally uniform thickness, is also folded over itself as illustrated, with its respective lateral edges 582, 583 abutting or spaced closely to each other centrally and secured over a first side of the folded, first flexible material 527, such as by sewing or other stitching, illustrated as stitching 578A and 578B, to form a carry strap 22H having a sufficiently even overall thickness and also generally a substantially thin form factor. While they may be comprised of webbing material, for this representative carry strap 22H embodiment, the first and second flexible material 527, 581 do not need finished first and second edges 524A, 524B, 526A, 526B, and may be comprised of any of the flexible materials described herein. For embodiments in which webbing material is utilized, the second flexible material 581 is not required to be folded, and may simply have a smaller width than the first flexible material 527.

Referring again to FIGS. 2-4, the configuration and assembly of a security panel assembly 62 (also referred to equivalently as an interior security panel assembly) which is retained within the bag 20 are depicted. Additional embodiments of security panel assemblies are also illustrated in the various Figures and discussed below and, as a result, any reference herein to a security panel assembly shall be understood to mean and include any and all of the other various security panel assembly and subassembly embodiments disclosed herein, including without limitation security panel assemblies 62, 206, 300, 400-400E, 600, 700, 800, 900, 1000, 1100-1100C, 1300-1300D, and 1400-1400B. In addition, as mentioned above, any reference to a bag 20 should be understood to mean and include any of the other bag embodiments, including bags 20A, 20B, 20C, 20D and 20E, for example and without limitation.

The security panel assembly 62 is fabricated in a manner which enables the bag 20, 20A, 20C, 20D, 20E to remain flexible, yet provides a significant amount of security by preventing cutting though the bag 20, 20A, 20C, 20D, 20E to the interior 60 of the bag 20, 20A, 20C, 20D, 20E for access to its contents. Specifically, the security panel assembly 62 is comprised of layers of flexible or foldable material which are stitched or otherwise attached together over a matrix of wires or cables of cut-resistant material, which can be synthetic (such as a polymer) or metallic, for example and without limitation. The security panel assembly is then positioned within the bag 20, 20A, 20C, 20D, 20E and maintained within the interior 60 of the bag 20, 20A, 20C, 20D, 20E. Thus, a chamber 60 is formed in the bag 20, and typically the security panel assembly is located or positioned between a lining 29 in that chamber 60 and the exterior fabric material 23 or other material defining the bag 20. In other representative embodiments, a security panel assembly may be provided in other or additional positions or locations, such as between a lining and an exterior part of a bag 20 defining an interior or exterior pocket or an expansion panel (815, 1400-1400B), for example and without limitation.

A wire, wires or a wire or fiber matrix (or matrices) will be referred to throughout this disclosure, and it should be understood that reference to a wire, fiber or wire matrix means and includes any type of metallic or nonmetallic wire, cable, fiber, thread or yarn. In various representative embodiments, such a wire can be an approximately 0.1 mm to an approximately 3.5 mm, or more specifically about 0.7 mm to about 1.5 mm, or more specifically about an approximately 0.6 mm, gauge or diameter cable-type wire comprised of many strands of metallic material to provide the resistance of the security panel assembly against being easily and/or quickly cut through. In other representative embodiments, the cable or wire can also be of any other cut-resistant material, such as a polymer and/or carbon fiber, such as a non-metallic, substantially cut-resistant polymer-based fiber, thread or yarn (individually and collectively referred to as a "fiber"), such as a Kevlar® aramid fiber, thread or yarn available from DuPont of Wilmington, Del. US, or a Vectran® liquid crystal polymer multifilament fiber, thread or yarn available from Kuraray America Inc. of Houston, Tex. US. Combinations of different types of material may also be utilized to form the various wires or fibers. For example and without limitation, a cut-resistant fiber may be combined with metallic or carbon fibers or threads, metal alloys, or elastic or rubber fibers or threads, in any of various combinations, such as a combination of steel and polymer.

In addition, a wide variety of metallic, nonmetallic, and hybrid metallic-nonmetallic matrices are illustrated and described in detail below. One of the common features among all of these various wire and fiber matrix embodiments is that each matrix (typically formed using a single length of wire (or fiber)) comprises a plurality of wire crossings or otherwise overlapping intersections which form a plurality of closed wire shapes as described in greater detail below. At many (if not all) of the plurality of wire crossings forming the matrix, the sections of wire are directly touching and abutting each other but are otherwise specifically uncoupled to each other, e.g., they are not crimped, soldered, brazed or otherwise connected at these intersections. Instead, the structural integrity of the matrix is maintained by being coupled to or in between first and/or second material layers, also as discussed in greater detail below. As a result, movement of the sections of wire at these wire crossings is much less restricted than in the prior art, allowing for considerable flexibility and deformation capability while concurrently maintaining the desired level of cut-resistant security.

A representative interior security panel assembly 62, and the various additional representative or exemplary security panel assemblies illustrated in the Figures and discussed below, may have virtually any shape or configuration, to accommodate any shape or configuration of a bag 20-20E or to accommodate other purposes, such as to reinforce and render cut-resistant expansion panels of a bag. For example and without limitation, many of the illustrated representative security panel assemblies are configured for subsequent folding, such as into a box shape, for insertion into the interior of a bag 20-20E, which may have any style, shape or configuration. Other illustrated configurations of a security panel assembly provide for additional folding, such as to compress a bag 20, 20A, 20C, 20D, 20E for shipment. Other shapes, styles and configurations are also within the scope of the disclosure. For example, a hard case suitcase (e.g., bag 20B) may have one or more flexible material expansion panels which may be unfolded and opened to provide for expansion between the two hard case sides of the bag, and an interior security panel assembly having a wire matrix or mesh (described below) may be shaped and configured to be incorporated within such flexible material expansion panels, as an additional security feature of a hard case bag.

Also for example and without limitation, the back side of a carrying bag 20, 20A, 20C, 20D, 20E may either be worn against a consumer's body and not accessible by an intruder or thief, or may be comprised of a shaped, molded material that is substantially cut-resistant. For such embodiments, an interior security panel assembly having a wire matrix or mesh also may not require a corresponding back side, for example, and instead may be defined by four sides, namely, front, lateral (or end) and bottom sides.

Alternatively, referencing FIGS. 20-24, a single wire 200 could be employed that is routed along and across the material layers therebetween, such as by looping of the single wire 200, to avoid having more than two ends 202 and 204 of the wire 200 that need to be addressed or accommodated at an edge of the panel assembly 206.

Figure 2:
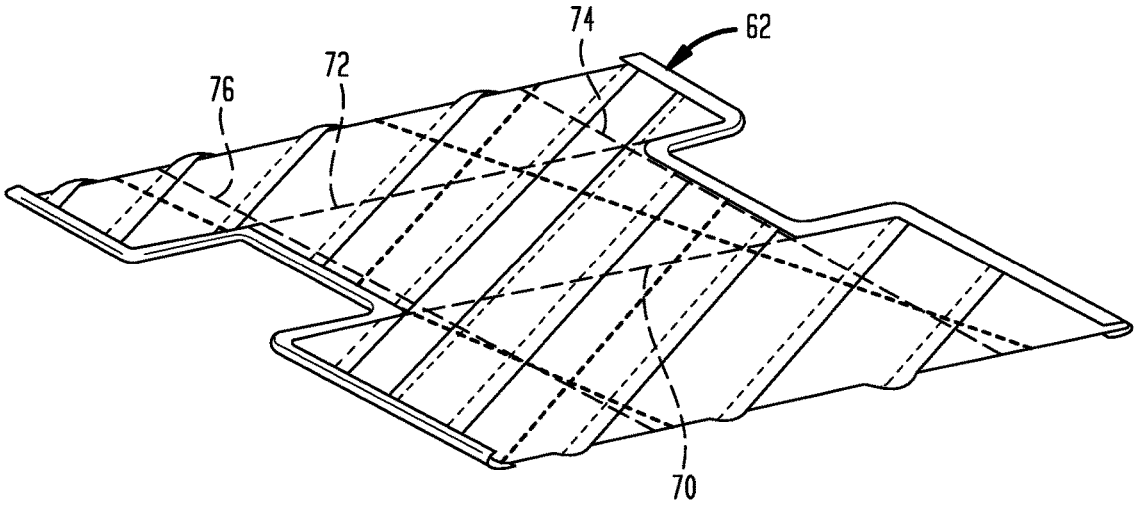
FIG. 2 is an isometric view of a representative embodiment of a security panel assembly of FIG. 3 in an unfolded condition to form an interior security insert within the chamber formed by the exterior bag.
Figure 3:
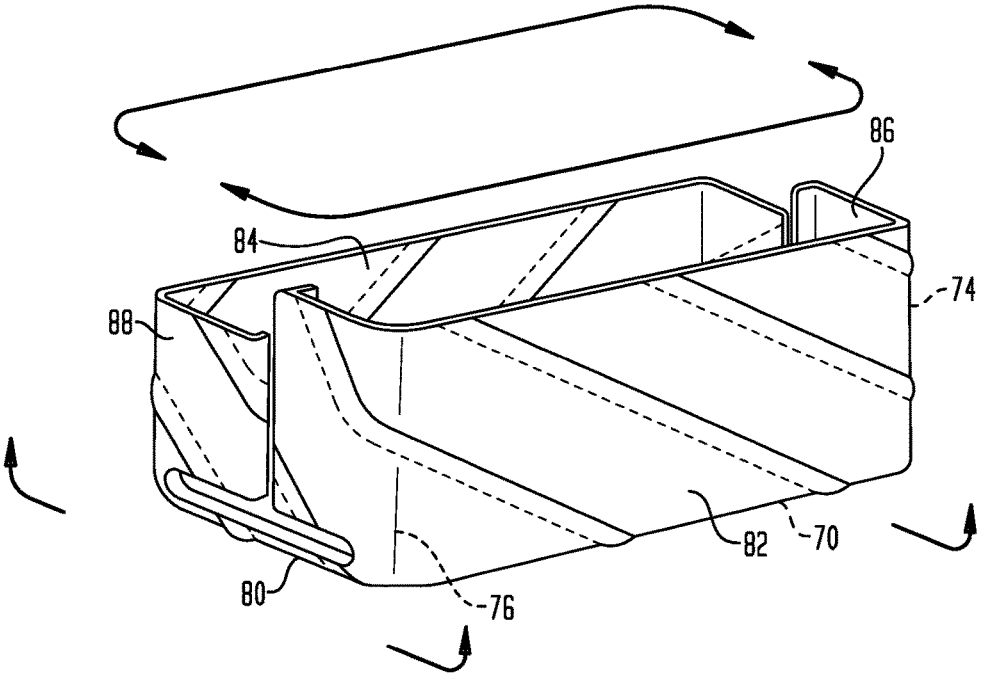
FIG. 3 is an isometric view of an interior security panel assembly which is fabricated and then inserted into an exterior bag and more particularly to the inside chamber of an exterior bag between the material forming the outside layer of the exterior bag and a lining of the exterior bag as illustrated in FIG. 4.

An exemplary security panel assembly 62 is depicted in greater detail in FIGS. 3 and 4. Referring to FIG. 2, the interior security panel assembly 62 in the embodiment depicted is comprised of a single (and flexible or foldable) panel having a profile that can be described as the profile of the Roman Numeral I or upper-case "I". Other configurations, such as a T or U-shape could also be employed, depending on the configuration of the bag 20 and where the security panel assembly is needed for security or protection, as mentioned above. The security panel assembly 62 is, in this instance, comprised of a single panel which is foldable along fold lines 70, 72, 74 and 76. When so folded, the panel assembly 62 defines generally the shape of a box as depicted in FIG. 3. Thus, by folding or shaping along the fold line 70 as well as the fold lines 72, 74 and 76, a box-like structure is formed having a bottom surface 80, opposite side surfaces 82 and 84 and end panels 86 and 88. This box-like assembly or box-like security panel assembly is formed during the manufacturing operation of the bag 20, 20C, 20D by tacking the security panel assembly 62 to the inside face (interior surface) of the material forming the exterior bag 23. Then a lining 29 may be placed over and within the interior of the folded security panel assembly 62 and the other material forming the exterior bag 23. The layers of lining 29, security panel assembly 62 and exterior bag 23 may then be stitched together to form the bag 20, along with any other desired components. An adhesive or laminate may also be used to facilitate assembly of the security panel assembly and/or bag 20. In a representative embodiment, stitching is used to form and create the bag 20, 20A, 20C, 20D, 20E. Lining 29 fits against the interior surface of the security panel assembly 62 to thereby encapsulate the security panel assembly 62 within the bag 20, 20C, 20D, with a "sandwich" of the lining 29, the security panel assembly 62, and the exterior bag 23 forming the carrying bag 20, 20A, 20C, 20D, 20E. Of course, in the practice of the invention, multiple discrete security panels, subpanels, or security panel assemblies 62 may be combined to provide a composite interior security panel assembly. The embodiment depicted provides an easy and representative manner of connecting the security panel assembly 62 to the exterior bag 23. The fold lines, for example fold lines 70 and 72, insure that the security of the chamber or interior 60 of the bag 20 is maintained since the wire matrix (as discussed hereinafter) is continuous though the fold lines and the step of forming the bag effectively insures that the security panel assembly 62 fits over essentially all or most of the interior walls of the bag 20, 20A, 20C, 20D, 20E and also lines the chamber 60. In other representative embodiments, a security panel assembly may also be positioned to protect selected portions of a bag 20-20E, such as a main compartment, rather than all or most of the bag 20-20E. While many of the illustrated, representative embodiments depict a security panel assembly having a five-sided box shape or configuration which is open at the top, those having skill in the art will recognize that closed top configurations and/or more or fewer sides and side shapes are considered equivalent and within the scope of the disclosure, such as pentagonal, hexagonal, octagonal, dodecahedral, etc., for example and without limitation.

The security panel assemblies described herein could also be used in a more rigid bag or container application. As shown in FIGS. 25-27, the security panel assembly 300 is used to pivotally connect a lower container base 302 to cover 304. In this regard, the security panel assembly 300 can form a living hinge-type of connection between the base 302 and cover 304. As illustrated, the panel assembly 300 has a cut-resistant cable or wire 306 that is formed into loops and crosses itself along its length so that only two ends 308 and 310 of the wire 306 are present at an edge of the panel assembly 300.

The base 302 can be a metallic frame 312 having an open-top box or other configuration, and the cover 304 can include a pair of cover members 314 and 316 that cooperate to close the open-top of the box frame 312 when pivoted closed, and to provide access to the bag interior when pivoted open via security panel assemblies 300 extending along either side of the box frame 312 and along the cover members 314 and 316 to form living hinges therebetween.

More specifically, the wire netting 306 (also referred to as a wire matrix) extends and is captured between a pair of inner and outer metal plates 318 and 320 to form each cover member 314 and 316. These plates also can each have a reinforcement wire 321 that extends around their perimeter to provide rigidity thereto. Each wire netting 306 extends down along a corresponding side 322 and 324 of the frame 312 and around the bottom corners of the box frame 312 where it is secured at the bottom 326 of the frame 312. For this purpose, a metal plate 328 and a plastic plate 330 each substantially coextensive with the bottom 326 can be fixed thereto as by riveting to clamp and fix the bottom loops of the wire netting 306 therebetween, as shown in FIGS. 25 and 26.

FIGS. 5-16 illustrate multiple steps and their sequence for the formation of a representative embodiment of a security panel assembly 62.

Figure 6:
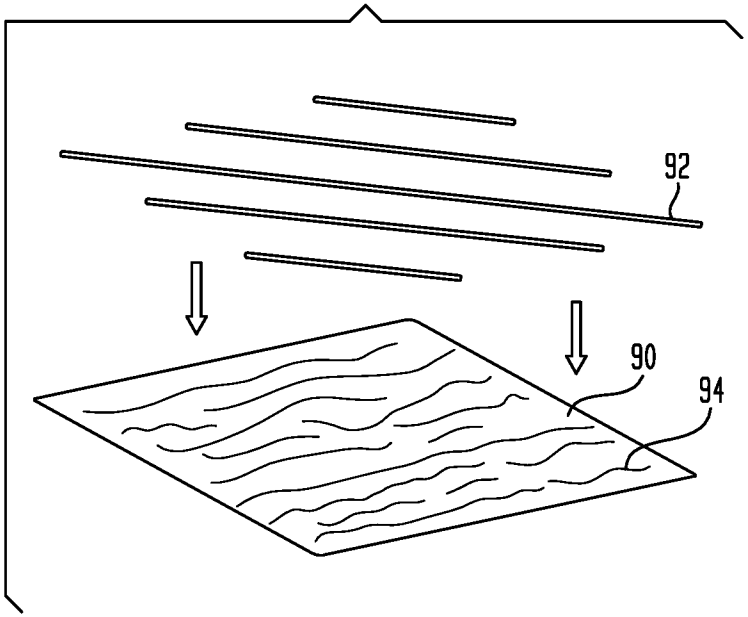
FIG. 6 is an isometric view of a next step in the construction of the representative first embodiment of the interior security panel assembly.
Figure 7:
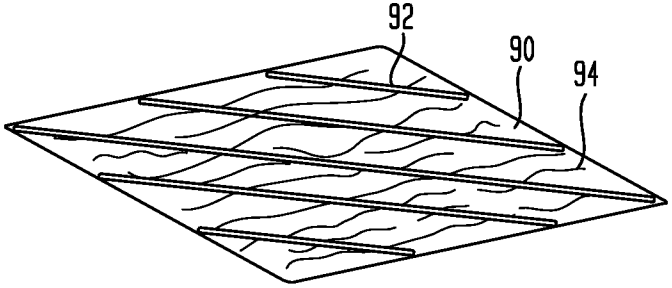
FIG. 7 is yet a further isometric view of an assembly step of the representative first embodiment of the interior security panel assembly.
Figure 5:
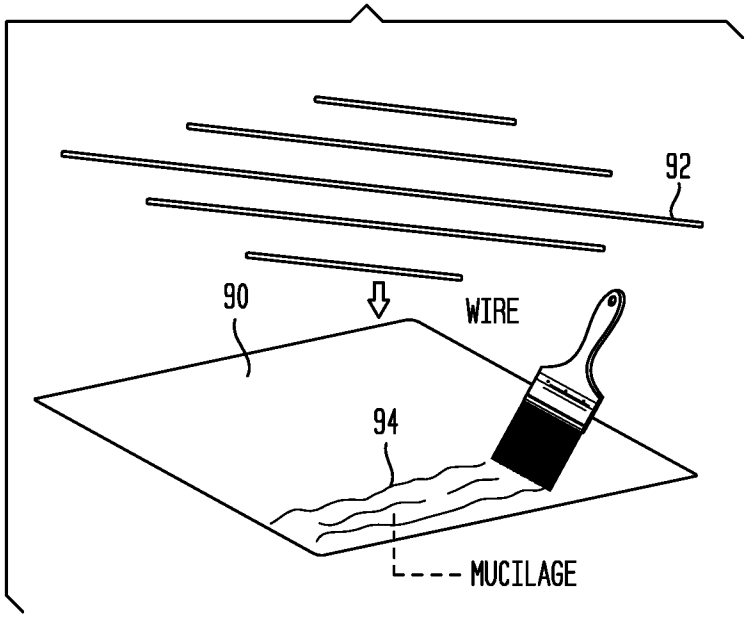
FIG. 5 is an isometric view illustrating a first step in the construction of a representative first embodiment of the interior security panel assembly of the type depicted in FIG. 3.

FIG. 5 depicts a first step which is the cutting and formation of a first layer 90 of flexible or foldable material. The shape and configuration of the first material layer 90 may be that of the Roman Numeral I as previously discussed or any desired shape associated with the design of the bag under construction. The layer 90 of material (and any of the other first and/or second material layers described below, and vice-versa) may be a fabric, a plastic sheet, any woven or nonwoven sheet of material, or other foldable or flexible material. The choice of material is not a limiting feature of the invention. Wires 92 are then placed over the surface of the first layer 90 of material. The wires 92 may be retained in place by a glue or adhesive material 94. In this manner, the wire or wires 92 are secured against shifting relative to the material layer 90 so as not to be captured loosely between the material layers, such that there is no need for extra holding devices such as crimps or the like to secure adjacent runs of the wire(s) to each other. The pattern of the wires 92 in the embodiment depicted is a series of spaced, parallel wires which run diagonally across the surface of the layer 90. FIGS. 6 and 7 illustrate in further detail the placement of the glue or adhesive 94 on the layer 90 and the positioning of the wires 92 on the layer 90 retained by the adhesive or glue material 94.

Figure 8:
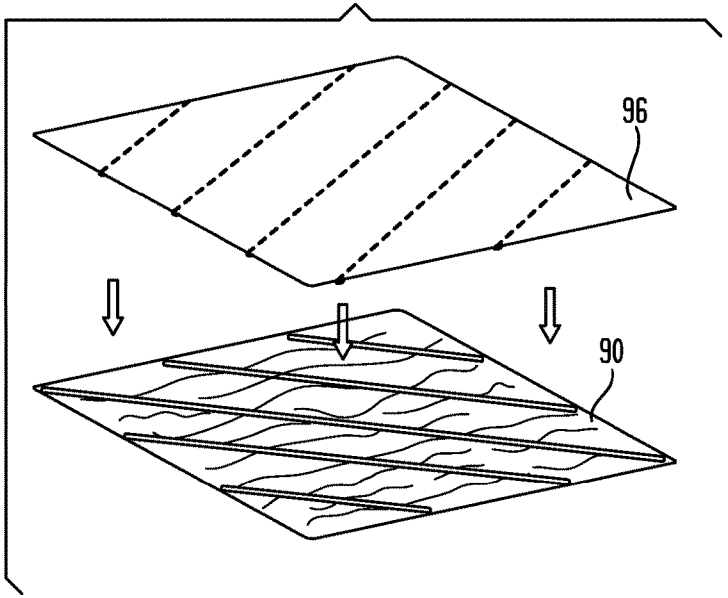
FIG. 8 is an isometric view illustrating the continued steps of manufacture of the representative first embodiment of the interior security panel assembly.
Figure 9:
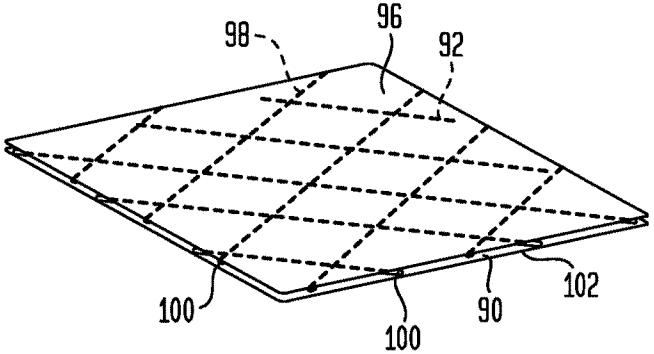
FIG. 9 is an isometric view of an additional manufacturing step associated with the representative first embodiment of the interior security panel assembly.

A second layer 96, substantially identical to the first layer 90, is then prepared with adhered, spaced, parallel wires 98. Alternatively, one of the layers 90 and 96 can be fabric material while the other is a non-woven material. The second layer 96 is rotated 180° (i.e., turned or flipped over) relative to the first layer 90 and placed over the first layer 90 as depicted in FIGS. 8 and 9. Thus, the second layer 96, which includes wires 98, is fitted over the first layer 90 which includes wires 92. Again, the pattern of the wire matrix is not a limiting feature. The chosen matrix in this case is a series of crossed wires which have ends 100 that terminate along a boundary 102, by way of example, of the panel layers 90 and 96.

Figure 10:
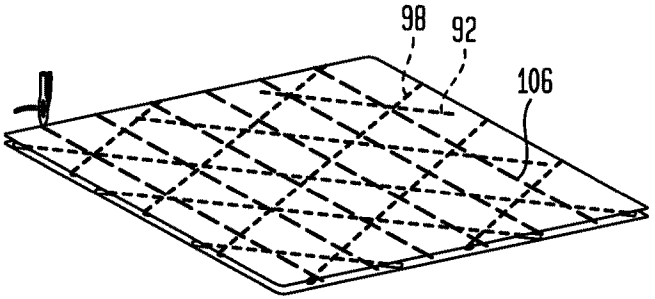
FIGS. 10, 11, 12, 13, 14, 15 and 16 are isometric views that illustrate continued steps in the manufacture of the representative first embodiment of the interior security panel assembly in serial order.

As the next step, illustrated in FIG. 10, the wires 98 and 92 are stitched into position for retention in the desired position by means of a stitching with nylon or thread 106, for example. The wires 92, 98 are retained substantially in position between the layers 90 and 96 by means of the adhesive or glue 94 as well as the stitching 106.

Figure 11:
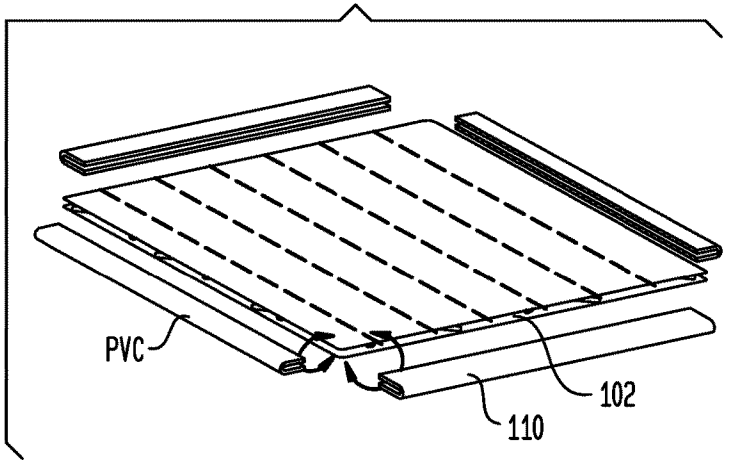
Figure 12:
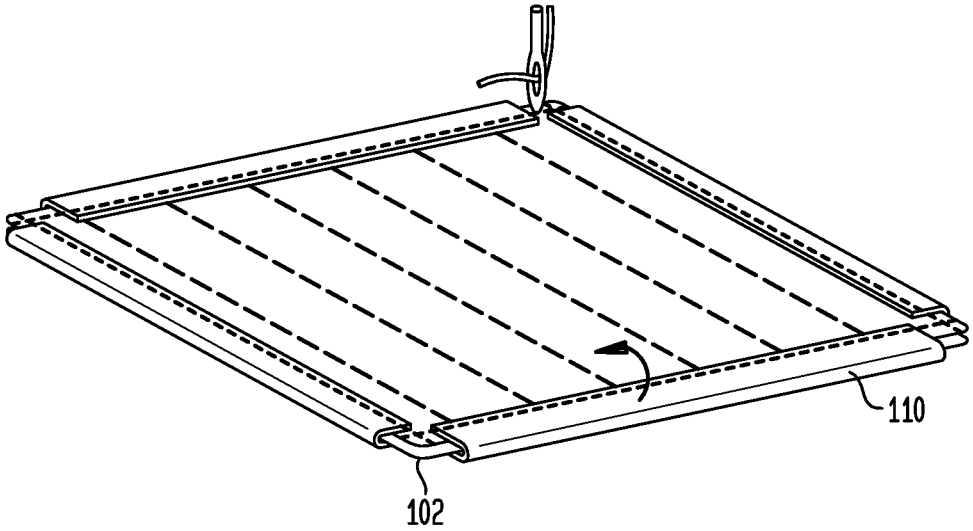
Figure 13:
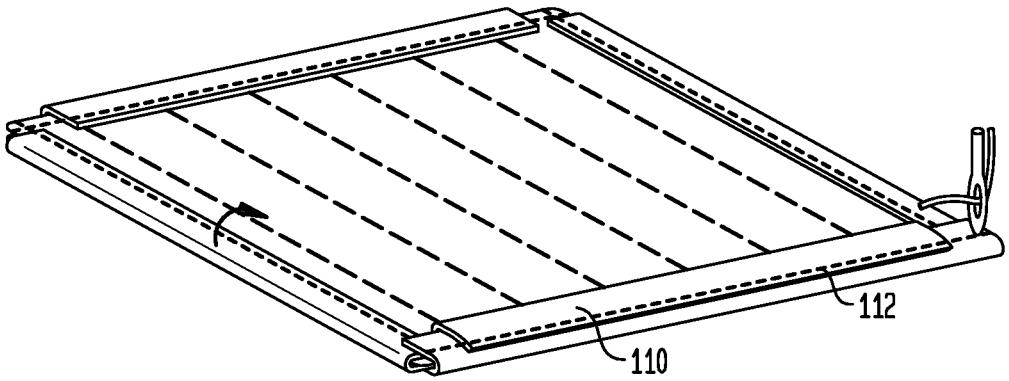

Thereafter, a binding material 110 is provided at least along some of the boundary or edges 102 of the security panel assembly 62 as depicted in FIG. 11. Thus, a binding material 110 such as a PVC binding material or any other type of somewhat flexible binding material 110 is fitted over the edge boundary 102 of the panel assembly 62 and subsequently, upon being fitted, is folded over the boundary edge 102 as depicted in FIG. 12. The folded binding 110 is then stitched along stitch line 112 to form an edge of the security panel assembly 62. The use of a polyvinyl chloride binding 110 or a similar material insures that the ends 100 of wires 92 and 98 will not pierce or project outwardly from the security panel assembly 62. Of course, the wires 92 and 98 are bendable or flexible and thus may be a light cable material or screen wire or some other material that is not easily cut. Typically the wires 92 and 98 are also a metal wire such as about 0.7 mm to 1.5 mm steel wire, but any material which is resistant to cutting can be utilized in the construction. Typically, the wires 92, 98 are in parallel, spaced rows spaced 0.50 to 2 inches.

Figure 14:
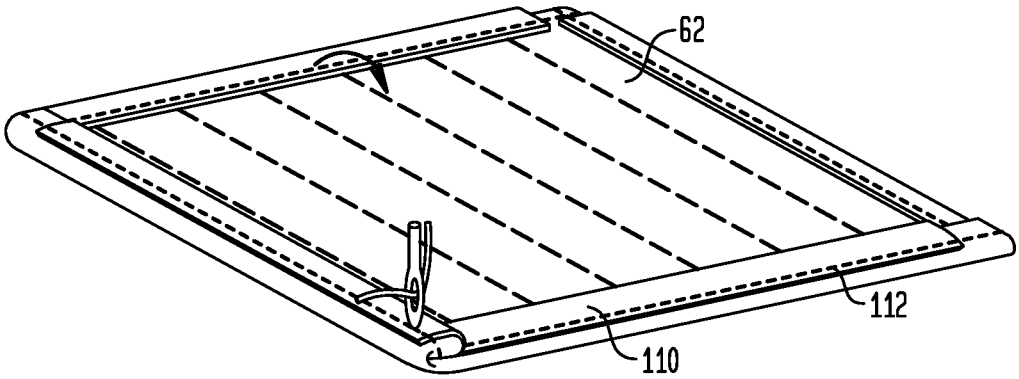
Figure 15:
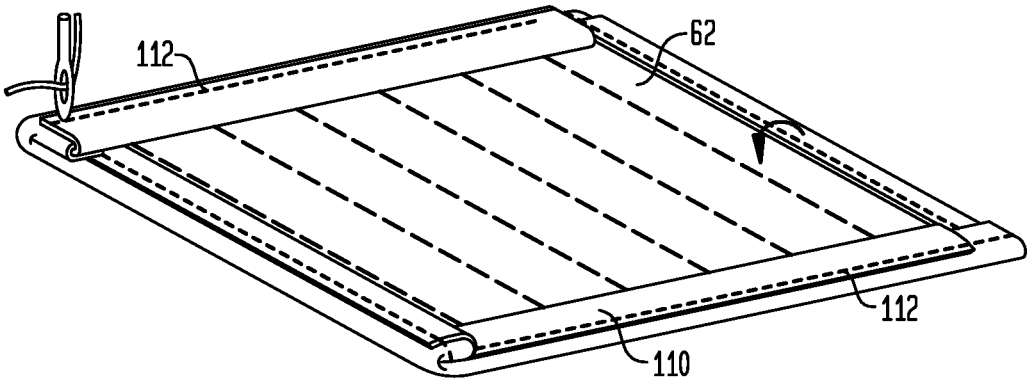
Figure 16:
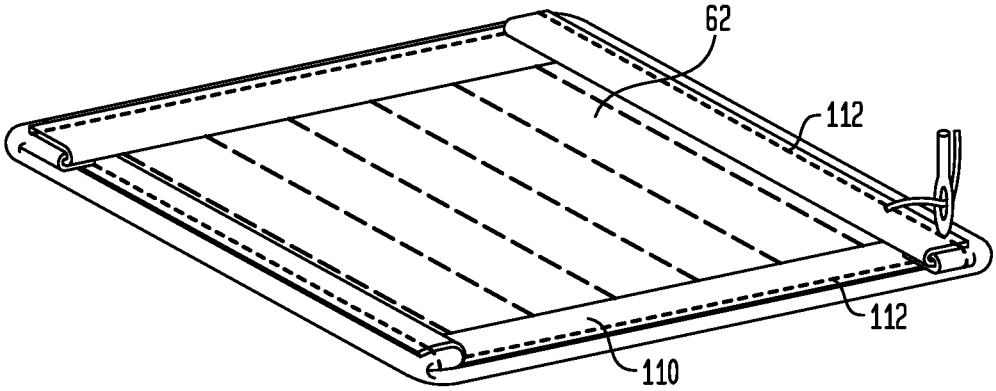

Subsequently, as depicted in FIGS. 14 and 15 all of the panel edges 102 are bound so that the wires 92, 98 will not pierce or project undesirably from the interior security panel assembly 62. The binding 110 is thus preferably provided about the entire circumference of the interior security panel assembly 62. In the illustration, the security panel assembly 62 has a square configuration rather than that of a Roman numeral I. However, the configuration of the interior security panel assembly 62 is not a limiting feature of the invention.

Similarly, referencing FIGS. 20-24, the illustrated security panel assembly 206 can have other configurations as previously discussed. A representative embodiment of a security panel assembly 206 has a single wire, wire 200 forming a wire matrix 215 coupled to panel 208 (as a first material layer), that is fixed such as by adhesive thereto. As shown, to form the wire matrix 215, the wire 200 is looped adjacent the panel 208 edges to avoid numerous free ends of multiple wires at the panel 208 edges, and instead only having the single pair of ends 202, 204 for the wire 200 adjacent one of the side edges of panel 208. Further, these wires cross themselves but because they are adhered to the associated panel, they do not require crimps or the like to hold the adjacent wire portions together to maintain the wire extending in a desired pattern along the panels.

As in other representative embodiments discussed in greater detail below, the single pair of ends 202, 204 (or the other wire ends discussed below) for the wire 200 (248) of the wire matrix 215 may also be turned toward the center of the panel 208, so that the ends 202, 204 do not extend beyond the edges of the panel 208. A covering panel 210 (as a second material layer) may then be attached to the panel 208 having the wire matrix 215, such as through an adhesive, sewing, etc., to form the security panel assembly 206 having the embedded wire matrix 215. Not separately illustrated, but applicable to all embodiments of a security panel assembly (62, 206, 300, 400-400E, 600, 700, 800, 900, 1000, 1100-1100C, 1300-1300D, and 1400-1400B) a second material layer (in any of the embodiments described herein) may also be laminated over the wire matrix 215 (also in any of the embodiments described herein, e.g., wire matrix 415) and first material layer (also in any of the embodiments described herein), typically in an in line assembly process by applying a laminate sheet as the second material layer and using a lamination process as may be known to those having skill in the art.

After the security panel assembly 206 is fabricated, it is incorporated into a bag 20-20E in the manner described previously for security panel assembly 62. The security panel assembly 206 is thus incorporated as a security layer having a wire matrix 215 within the bag 20.

The cable member 38 associated with the carry strap 22, 22A-22H also may be attached to the interior security panel assembly 62, 206 (or the other security panel assemblies disclosed herein) or as discussed above. The shape and configuration of the exterior bag 23 and the interior security panel assembly 62, 206 may be varied in accord with a design consideration. The inclusion of one or more interior security panel assembly 62, 206 within an exterior bag 23 may be adopted.

Figure 30:
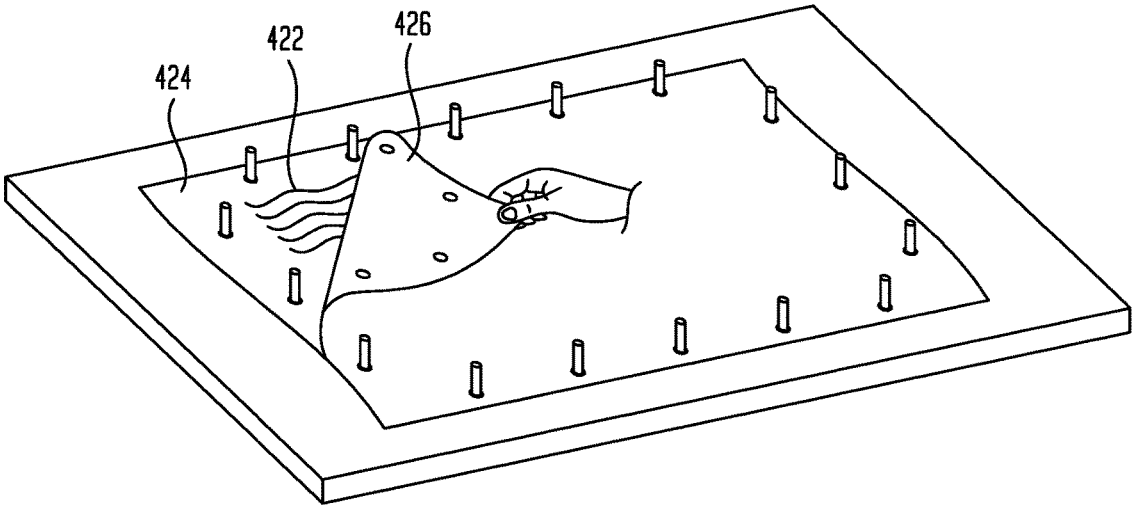

The steps for manufacture of an alternative, fourth embodiment of a representative security panel assembly 400 (FIG. 36) will next be described with reference to FIGS. 29-36. A fixture 402 such as a small handloom is provided as a working base or platform for forming the representative embodiment of the security panel assembly 400. For example, the fixture 402 includes a mounting base or board 404 that is larger than the layers of material 406 and 408 to be received thereon for forming the security panel assembly 400. The mounting board 404 includes several mounting members in the form of pegs 410 that project upwardly therefrom. The mounting pegs 410 can be arranged in substantially parallel rows with a first pair of the parallel rows corresponding to opposite parallel edges 412 and 414 of the material layer 406 and the other or second pair of parallel rows being oriented to extend orthogonal to the first pair of rows and corresponding to the other pair of parallel edges 416 and 418 of the material layer 406. Additional configurations or layouts of mounting pegs 410 on a mounting board 404 are illustrated in the Figures and discussed below, and may be varied depending upon the desired shape of the security panel assembly and desired routing of the wire 200, 428, for example and without limitation. Through-openings, holes, or apertures 420 are formed along and adjacent to the edges 412-418 such that they can be aligned with the mounting pegs 410 for fitting the mounting pegs 410 therethrough. In this regard, since the material layers 406 and 408 are typically comprised of a flexible material such as non-woven or fabric material, the material layer 406 (as well as material layer 408 described more fully hereinafter) can be stretched for fitting the pegs 410 into and through its through openings 420. FIG. 30 shows the material layer 406 held to the mounting board 404 via the mounting pegs 410 extending through the openings 420.

At this time the material layer 406 can have adhesive 422 such as a pressure sensitive adhesive material (422) applied to or exposed thereon on its upwardly facing surface 424. In one approach, the material layer 406 can include a covering sheet 426 made of a material that allows it to be readily removed from pre-applied adhesive 422 thereunder. FIG. 30 shows the cover sheet 426 being pulled off from the material layer 406 so as to expose the adhesive 422 on the material layer surface 424. As an alternative to the use of the cover sheet 426 and pre-applied adhesive, the adhesive 422 could be applied directly to the upwardly facing surface 424 of the material layer 406 as it is held on the mounting board 404 by the mounting pegs 410.

With the material layer 406 having adhesive 422 held on the mounting board 404, a cable or wire 428 can be dispensed from a wire fixture such as spooling mechanism 430 (FIG. 31) so that the wire 428 can be routed around the mounting pegs 410 projecting above the material layer 406 as the wire 428 is unwound or dispensed from the spooling mechanism 430, for example. In various representative embodiments, the wire 428 can be an approximately 0.1 mm to an approximately 3.5 mm, or more specifically about 0.7 mm to about 1.5 mm, or more specifically about an approximately 0.6 mm, gauge or diameter wire of metallic material to provide the security panel assembly 400 resistance against being easily and/or quickly cut through. Alternatively, the cable or wire 428 can also be of any other cut-resistant material, such as a polymer and/or carbon fiber, or other yarn material such as Vectran® which is a high-performance thermoplastic multifilament yarn spun from a liquid crystal polymer, for example and without limitation.

As can be seen in FIGS. 31-33, the wire 428 can be continuously routed around the pegs 410 in a predetermined crossing pattern (and not merely a zig-zag) to form a wire matrix 451 in which the wire crosses itself back and forth, such as the illustrated criss-cross pattern whereby the single length or piece of wire 428 forms a series of specifically closed (not open) wire shapes 429 such as boxes (e.g., squares or rectangles) having their sides oriented at an oblique or other angle to the perimeter edges 412-418 of the material layer 406. The closed wire shapes 429 are formed as a result of the crossings of the wire (428) and may have any selected shape in addition to square or rectangular, such as triangular or hexagonal, for example and without limitation, depending upon the selected routing of the wire 428, but should not be open to allow a cutting instrument to slide through. As a result, closed wire shapes 429 of the wire matrix, without more, are sufficient to provide the cut-resistance security feature, and furthermore, the wire matrix (451 and the others described herein) does not have the potentially weak link of a crimp or other closure or connector utilized to connect adjacent and non-crossing wires in the prior art. In addition, by using the (specifically uncrimped or otherwise uncoupled) crossing pattern, these closed wire shapes form security structures which are also smooth and continuous areas of overlap of the wire, thereby avoiding the raised bumps and points of wear of the prior art crimps. As a result, these crossing points are not readily apparent to the consumer, and do not provide raised areas and other discontinuities that tend to create holes and other wear patterns in a carrying bag. The pegs 410 are of sufficient length so that the wire 428 can be routed tightly around the pegs 410 in a spaced relation to the material layer surface 424 and the adhesive 422 thereon. This allows the wire 428 to be smoothly routed around the pegs 410 without potentially creating hang-ups during this process by contact with the adhesive material 422 thereunder. Additional features of the wire matrix 451 and the other wire matrices disclosed herein are described in greater detail below.

As shown, the present method allows for use of a single wire 428 so that only two ends 432 and 434 need to be manipulated adjacent to one of the edges 412-418 so as not to be exposed therefrom, such as by projecting beyond any of the edges 412-418 or being too closely adjacent thereto. For example, referring to FIGS. 33A and 33B, the wire 428 at the ends 432 and 434 is bent back to extend toward the center of the material layer 406 with the ends 432 and 434 being secured to and on the upwardly facing surface 424 adjacent the end edge 416 of the material layer 406. As the ends 432, 434 are bent closer to the center of the material layer 406 and further from the edges 412-418 than the bent or curved portions 435, this leaves only bent or curved portions 435 of the wire 428 adjacent to the edges 412-418 and further closed thereto. After the second material layer 408 is adhered to the first material layer 406 (as will be described hereinafter), the edges of the resulting laminate structure (comprised of first material layer 406, adhesive 422, wire matrix 451, and second material layer 408) will be substantially sealed without multiple pairs of wire ends adjacent thereto. Thus, the security panel assembly 400 avoids the need to have a protective covering or binding along its perimeter edges that spans the covering layers 406 and 408 to prevent access to multiple pairs of exposed metallic or other wire ends.

Further, as an option, it can be seen that the wire ends 432 and 434 can be provided with a cap 439 thereon that can be of polymeric material (such as a PVC tube) to avoid having exposed ends of the wire 428 between the material layers 406 and 408, particularly when the wire 428 may be comprised of one or more metals or metallic alloys and the ends 432, 434 may be sharp or have sharp edges. This keeps the wire ends 432 and 434 from protruding and poking through the material layers 406 and 408. The leading end 432 can be capped before the wire 428 is routed around the pegs 410. After such routing is complete, the wire 428 can be cut to generate the second or trailing end 434 that is then capped. Manifestly, multiple wires could also be used as desired with additional wires being routed around the mounting pegs 410 in one or more predetermined patterns and secured to the surface 424 via the adhesive 422 in a manner similar to the routing of the wire 428, with the ends of these additional wires also bent back toward the center of first material layer 406 and capped. In this regard, the multiple wires need not be directly connected to each other with separate connector members or clips which would increase cost and potentially generate localized bumps in the security panel assembly 400 where the connectors are located. As such, the only increase in the thickness of security panel assembly 400 over that of the material layers 406 and 408 is due to the thickness of the wire 428 (singular and overlapping) secured therebetween.

Figure 90:
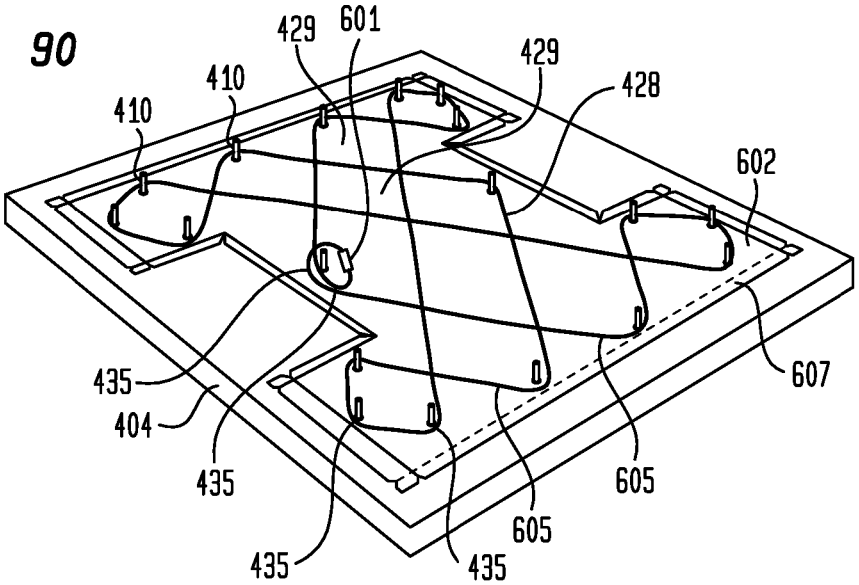

In another representative embodiment, illustrated for example in FIG. 90, the two ends of the routed wire may be capped together, using one cap (e.g., 601) to cover and enclose both ends.

Figure 34:
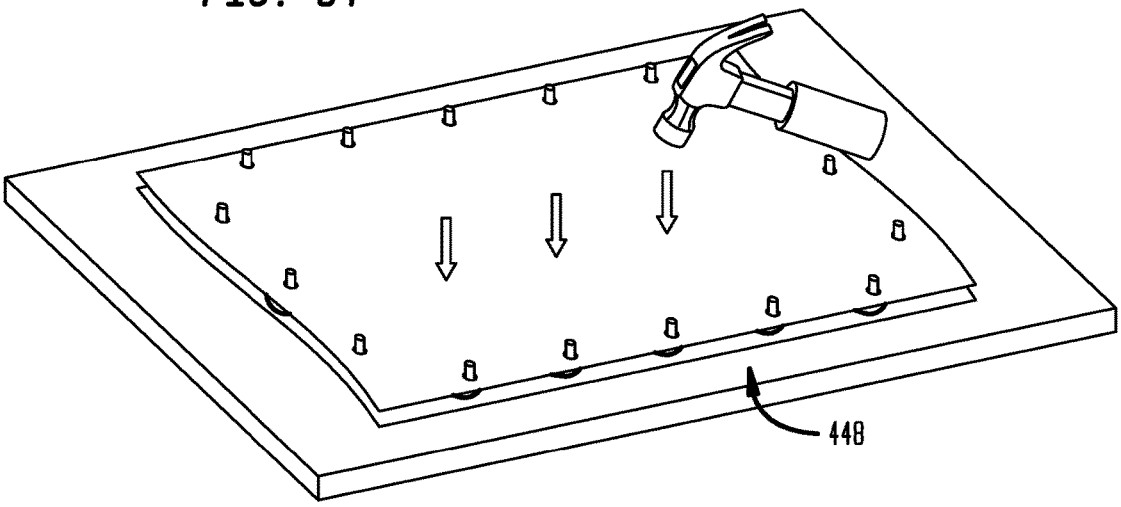
Figure 35:
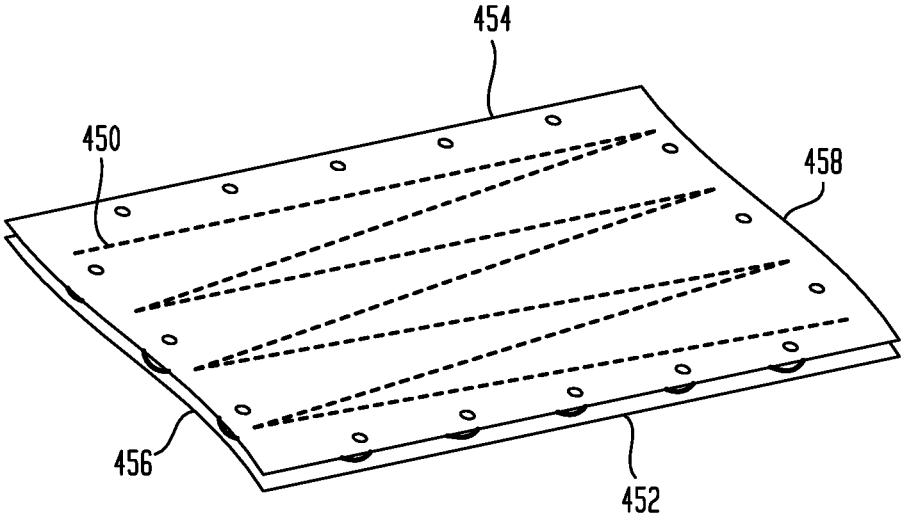
Figure 36:
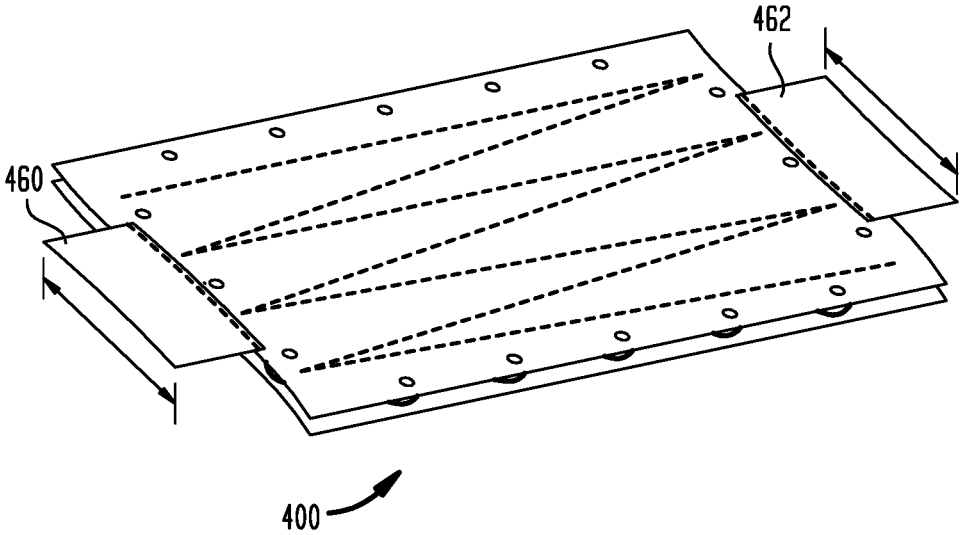

After the wire 428 is routed around the mounting pegs 410 and the wire ends 432 and 434 are capped, positioned and are placed on the adhesive 422 of the upwardly facing surface 424, the second material layer 408 is oriented so that its openings 436 are in alignment with the mounting pegs 410 so that the mounting pegs 410 can be received therethough, as shown in FIG. 34. In this regard, the through openings 436 are located along and adjacent to the opposite side edges 438 and 440 and the opposite end edges 442 and 444 in a manner similar to the positioning of the openings 420 along the edges 412-418 of the first material layer 406.

Since it can be difficult to simultaneously fit multiple pegs 410 through corresponding openings 436, generally the material layers 406 and 408 have to be manipulated so that each opening 424, 436 is individually fit over a corresponding mounting peg 410 or only a few openings 424, 436 at a time are fit over corresponding pegs 410. Thus, in another form, it is contemplated that rather than having the openings configured to be through openings or apertures 436 that are spaced from the corresponding edges 438-444, notch openings 446 could be formed in the material layer 408 instead, as illustrated in FIG. 33B. These notch openings 446 would open to the corresponding edges 438-444 and can have a V-shape (for example) for locating the mounting pegs 410 at or adjacent to the apex of the V-shaped notch openings 446. This allows for the second material layer 408 to be quickly placed down onto the wire 428 for being adhered to the underlying first material layer 406, with multiple mounting pegs 410 or all of the pegs 410 substantially simultaneously fit into the corresponding notch openings 446. In this manner, assembly time for forming the security panel assembly 400, and specifically for the application of second material layer 408 onto or over the wire 428 and first material layer 406, can be significantly reduced.

After the second material layer 408 is held to the mounting board 404 via either the mounting pegs 410 extending in and through the through openings 436 or in and through the notch openings 446, pressure is applied to the second material layer 408 either manually or via a hand held or other tool so as to generate secure a close or intimate contact between the second material layer 408, the wire 428, the adhesive 422 on the first material layer 406, and the first material layer 406 itself. After applying sufficient pressure across the second material layer 408, a laminate structure 448 is created with the wire 428 (forming wire matrix 451) secured and adhered between the adhered together first and second material layers 406 and 408, as shown in FIG. 34. In various representative embodiments, the laminate structure 448, without more, functions as and effectively is a security panel assembly. For this embodiment, additional features are included to form a representative embodiment of a security panel assembly 400.

The mounting members, such as in the form of pegs 410, can be embodied in many different forms, requiring only that they are capable of allowing the wrapping and/or routing of a wire 428 or other cut-resistant material, such as a polymeric fiber or a metallic wire, and may include, for example and without limitation, mounting members such as pegs, hooks, loops, needles, and pins. Continuing with the example, when the mounting members are implemented as needles or sharpened pegs 410, the material layers 406 and 408 do not require the separate formation of openings, holes, or apertures 420, 436; rather, the material layers 406 and 408 may simply be placed over the mounting members, which then directly pierce the flexible material of the material layers 406 and 408. Accordingly, for such an embodiment, first material layer 406 is placed over the mounting members (sharpened pegs or needles 410) with pressure, such that the sharpened pegs or needles 410 pierce and hold or secure the first material layer 406, an adhesive 422 may be applied, a wire 200, 428 is routed, followed by applying the second material layer 408 with pressure, such that the sharpened pegs or needles 410 also pierce the second material layer 408 and sufficient contact of the second material layer 408 is made to the wire 200, 428 and first material layer 406. This also significantly reduces any issues of the proper alignment of the openings, holes, or apertures 420, 436, as such openings, holes, or apertures 420 are automatically created. Depending upon the elasticity or flexibility of the first and second material layers 406, 408, any holes created by sharpened needles or pegs 410 are typically or sufficiently closed upon removal of the laminate structure 448 from the sharpened needles or pegs 410, and may be additionally secured by the adhesive 422.

The laminate 448 is then removed from the fixture 402 by lifting of the material layers 406 and 408 off of the mounting pegs 410, whereupon stitching in a sawtooth pattern 450 is applied as an option in a representative embodiment, such as by a sewing machine, with the stitches interconnecting the material layers 406 and 408 and further securing the wire matrix 451 (formed by wire 428) permanently in place between the material layers 406 and 408. The stitching 450 can be at any number of various locations along the laminate 448 as well as along the perimeter thereof corresponding to material layer edges 412-418 and 438-444. As shown, the stitching 450 extends along opposite long side edges 452 and 454 of the laminate 450 and along oblique lines that extend between the opposite shorter end edges 456 and 458 of the laminate 448. Other stitching patterns are illustrated in the various Figures and discussed below. In addition to stitching, other types of securing mechanisms may also be utilized equivalently to stabilize the laminate structure 448, such as rivets, staples, etc., to the extent necessary or advisable. For example, depending upon the adhesive 422 utilized, no additional stabilization may be needed.

Continuing with the example and referring to FIG. 62, a second material layer 408A is illustrated which has pre-applied pressure sensitive adhesive material (422A) applied to or exposed thereon on its downwardly facing surface 431. In this approach, the second material layer 408A can include a covering sheet 426A made of a material that allows it to be readily removed from pre-applied adhesive 422A thereunder. FIG. 60 shows the cover sheet 426A being pulled off from the second material layer 408A so as to expose the adhesive 422A on the downwardly facing material layer surface 431. The second material layer 408A may then be attached over the wire matrix 451 and first material layer 406 as discussed above with reference to FIGS. 33A and 33B, followed by the steps illustrated and discussed with reference to FIGS. 34-36. In addition, in this representative embodiment, there may or may not be adhesive 422 on the upwardly facing surface 424 of first material layer 406, with adhesion between the various layers provided instead or additionally by adhesive 422A exposed or applied on second material layer 408A. Also as illustrated in FIG. 62, the two ends of the single wire have been joined or capped together, using a single cap 601, away from the periphery of the first material layer.

As mentioned above, one of the common features among all of these various wire and fiber matrix embodiments described herein, including wire matrix 451, is that each matrix (typically formed using a single length of wire (or fiber)) comprises a plurality of wire crossings 453 or otherwise overlapping intersections which form a plurality of closed wire shapes (described in greater detail below). At many (if not all) of the plurality of wire crossings 453 forming the matrix, the sections of wire are directly touching and abutting each other but are otherwise specifically uncoupled to each other, e.g., they are not crimped, soldered, brazed or otherwise connected at these intersections. Instead, the structural integrity of the matrix is maintained by being coupled to or in between first and/or second material layers (e.g., 406, 408), also as discussed in greater detail below with reference to FIGS. 63-66. As a result, movement of the sections of wire at these wire crossings 453 is much less restricted than in the prior art, allowing for a reasonable degree of sliding and rotation between the wire sections, thereby providing considerable flexibility and deformation capability while concurrently maintaining the desired level of cut-resistant security. This allows use of the various security panel assemblies in a wide variety of carrying bags while simultaneously allowing the carrying bags to have flexible, stylish designs.

In addition, other types of panel members can be connected to the security panel assembly 400, such as by stitching along any of the perimeter edges 452-458 thereof. Any number or size of panel members can be utilized which serve as bridge connectors to provide assistance for attaching and incorporating the security panel assembly 400 into a carrying bag 20 to be integrated therein as has been described herein. As shown, the panel members are in the form of opposite tab members 460 and 462, also typically comprised of a flexible material such as fabric, that are centrally connected along the shorter end edges 456 and 458 of the security panel assembly 400.

Figure 63:
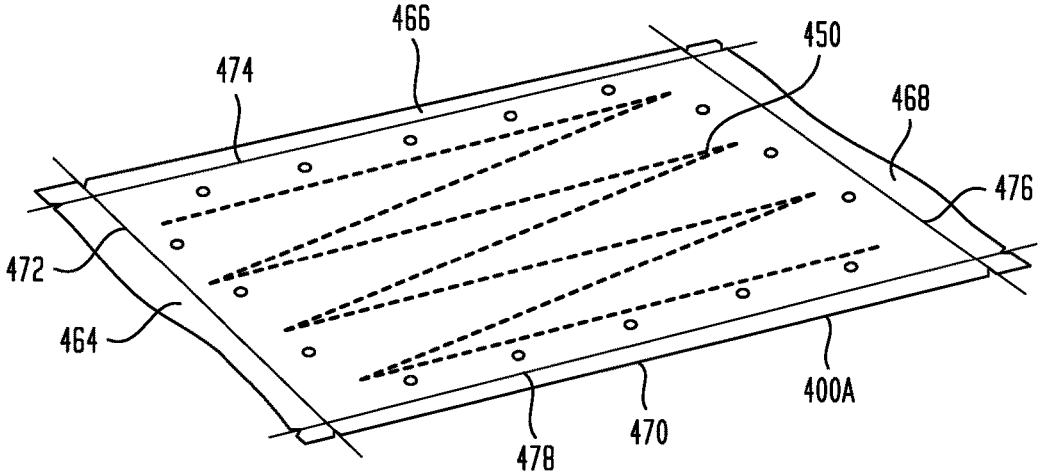

Referring to FIG. 63, instead of utilizing panel members that are in the form of opposite tab members 460 and 462, either or both the first material layer 406 and/or the second material layer 408 are comparatively larger in size, such that the additional material comprising the first material layer 406 and the second material layer 408 is not excess material but instead is utilized to form panel (or flange) members 464, 466, 468, and 470, and are defined by the perimeter stitching 472, 474, 476 and 478, which further serve to add more stability to the security panel assembly 400A as a fifth representative embodiment of a security panel assembly. Stated another way, the "salvage edges" that might have been waste during manufacturing and subsequently removed during finishing are utilized instead for a specific and additional functional purpose, as integrated flange or panel (or tab) members. As a result, flange or panel members 464, 466, 468, and 470 may be considered to be flange or tab members integrally formed as part of the first material layer 406 and the second material layer 408, and also may be utilized as bridge connectors to provide assistance for attaching and incorporating the security panel assembly 400A into a carrying bag 20-20E. As the flange or panel members 464, 466, 468, and 470 may also include the adhesive 422 and/or 422A between the first material layer 406 and second material layer 408 forming these panel members, yet additional stability may also be provided to the security panel assembly 400A.

An additional and equivalent embodiment of a security panel assembly 400E is illustrated in FIG. 142, in which only one of the first material layer 406 and second material layer 408, but not both, is utilized to form the panel (or flange) members 464, 466, 468, and 470. As illustrated in FIG. 142, the first material layer 406 is larger, and only the first material layer 406 is utilized to form the panel (or flange) members 464A, 466A, 468A, and 470A. Those having skill in the art will recognize that the second material layer 408 may also be utilized for this purpose as well.

Figure 64:
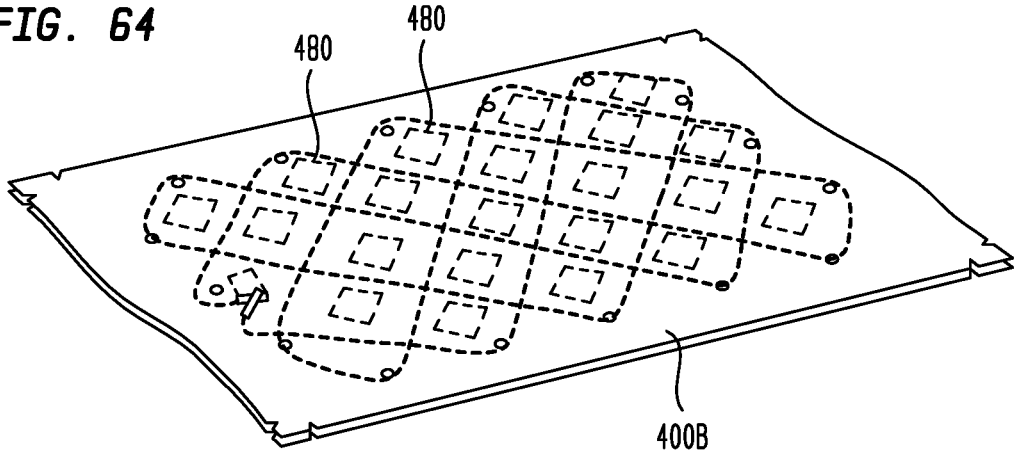
Figure 65:
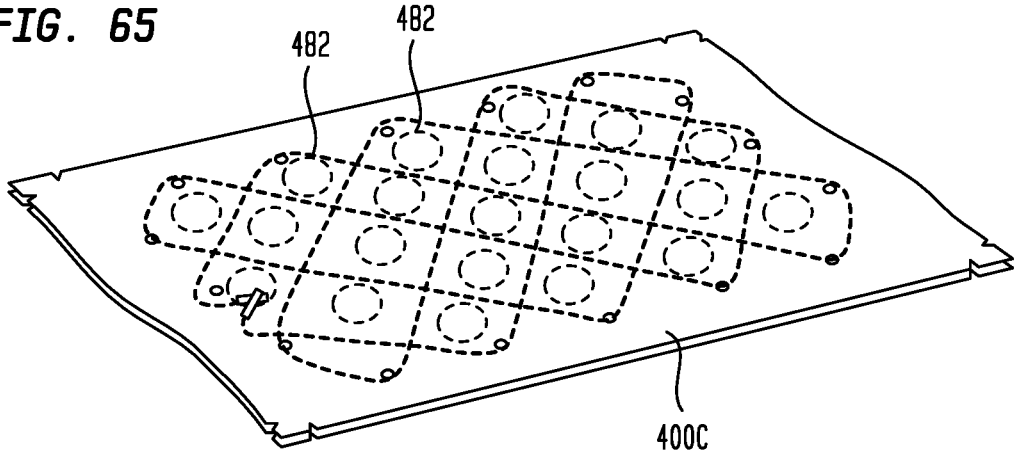
Figure 66:
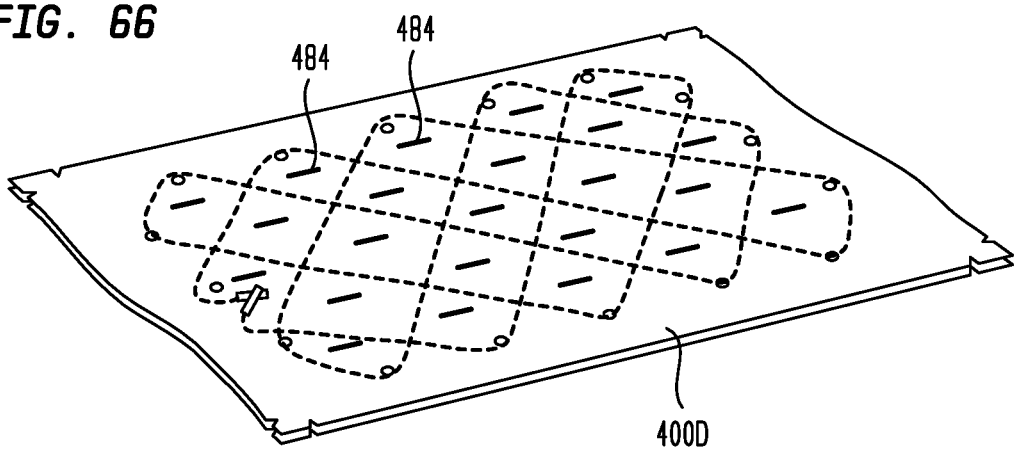

Referring to FIGS. 64-66, additional variations of representative embodiments of the security panel assembly 400 are illustrated as security panel assemblies 400B, 400C, and 400D, respectively sixth, seventh and eighth representative embodiments of a security panel assembly. As illustrated, the wire matrix 451 has been secured using a plurality of stitching patterns which do not touch or cross over the wire 428 forming the wire matrix 451, but are instead confined within the wire shapes 429 (e.g., squares or rectangles) of the wire matrix 451. This may be helpful during fabrication, such as to avoid breaking a needle of a sewing machine, which could potentially occur when stitching over (and possibly hitting) a wire 428 when the wire 428 may be metallic. For example and without limitation, security panel assembly 400B is formed by using a square stitch pattern 480 confined within the wire shapes 429 (e.g., squares, rectangles, diamonds, triangles, parallelograms, rhombuses) of the wire matrix 451; security panel assembly 400C is formed by using a circular stitch pattern 482 confined within the wire shapes 429 of the wire matrix 451; and security panel assembly 400D is formed by using a bar tack stitch pattern 484, also confined within the wire shapes 429 of the wire matrix 451. Any of these various stitching patterns 450, 480, 482, and 484, may be utilized with any of the embodiments of a security panel assembly, and will not be illustrated or discussed additionally for those additional embodiments.

In addition to such various stitching patterns 450, 480, 482, and 484, such as the sawtooth pattern 450, less deterministic or pseudo-random or even whimsical stitching may also be utilized to secure the wire matrix 451 to a first material layer 406 or between a first material layer 406 and a second material layer 408. For example, a fabricator may use any stitching design of any kind, which does not need to be a predetermined pattern, but may be decided in the moment or even instantaneously, as the fabricator is assembling the wire matrix 451 to a first material layer 406 or between a first material layer 406 and a second material layer 408. In addition, the routing of the wire to form the wire matrix 451 may also be less deterministic or pseudo-random, provided adequate or reasonable coverage is provided for the security panel assembly, such as illustrated in FIG. 69, for example and without limitation.

FIGS. 67-70 are isometric views illustrating various additional and representative embodiments of security panel assemblies 1100, 1100A-1100C (thirty first through thirty fourth embodiments), which may be either metallic or nonmetallic, fiber-based security panel assemblies. Instead of utilizing a metallic wire or cable to form a wire matrix, for these representative security panel assemblies 1100, 1100A-1100C, a non-metallic, substantially cut-resistant polymer-based fiber, thread or yarn (individually and collectively referred to as a "fiber") 905 is utilized, such as a Kevlar® aramid fiber, thread or yarn available from DuPont of Wilmington, Del. US, or a Vectran® liquid crystal polymer multifilament fiber, thread or yarn available from Kuraray America Inc. of Houston, Tex. US. It should be noted, however, for the embodiments illustrated in FIGS. 69 and 70, metallic wire or cable may also be utilized to form a matrix 910. Referring to FIGS. 67 and 68, a security panel assembly 1100 is a substantially cut-resistant fabric comprising a plurality of spaced-apart, interwoven, substantially cut-resistant polymer-based fibers, threads or yarns 905. For the security panel assembly 1100 as illustrated, the spaced-apart fibers 905 form a fiber matrix 910, and may be interwoven with other types of threads, yarns or fibers.

In addition, this fiber matrix 910 may also be included or embedded in the webbing (e.g., 527, 528) utilized to form a substantially cut-resistant carry strap 22, 22A-22H. For such embodiments, the cut-resistant yarn or fiber 905 is typically woven with the other fiber material comprising the webbing during manufacture. Also for such embodiments, an additional cut-resistant cable 38 may not be required to provide the desired level of security.

Combinations of different types of material may also be utilized to form the various fibers 905. For example and without limitation, a cut-resistant fiber may be combined with metallic or carbon fibers or threads, or elastic or rubber fibers or threads, in any of various combinations, such as a combination of steel and polymer.

Any type of weaving, braiding or knitting may be utilized, and as illustrated in FIG. 68, a security panel assembly 1100A is a substantially cut-resistant, knitted fabric comprising a plurality of abutting, knitted and substantially cut-resistant polymer-based fibers, threads or yarns 905. In addition to being knitted rather than woven, the security panel assembly 1100A generally comprises little to no other types of threads or fibers, such that the cut-resistant fibers 905 are substantially abutting in the security panel assembly 1100A.

Referring to FIGS. 69 and 70 for a security panel assembly 1100B, 1100C, a substantially cut-resistant polymer-based fiber, thread or yarn 905A is also utilized, generally having a thicker yarn configuration compared to the fibers 905, and otherwise comprised of any of the same types of polymers. The security panel assemblies 1100B, 1100C are fabricated similarly to the metallic wire or cable embodiments described above and as also described below, in which a substantially cut-resistant polymer-based yarn 905A is routed about mounting pegs 410 over a first material layer 915 (which may also include an adhesive 422) to form a fiber matrix 910. For security panel assembly 1100B, the fiber matrix 910 may be secured in place, such as by sewing or other stitching, illustrated as stitching 920, without using a second material layer. For security panel assembly 1100C, a second material layer 925 (shown in a cut-away view in FIG. 68) is placed over the fiber matrix 910 and also may be secured in place, such as by sewing or other stitching, illustrated as stitching 930.

The security panel assemblies 1100, 1100A-1100C may be utilized in any of the various illustrated embodiments, such as for a security panel assembly within a bag 20, 20A-20E. The security panel assemblies 1100, 1100A-1100C are particularly well-suited for use in any of the various expansion panels 815 (or 1400-1400B), discussed below.

FIGS. 71 and 72 illustrate a wheeled, soft-sided travel bag 20A, as a type of carrying bag, having a solid, hard back 802 typically comprised of a polymer, and including wheel wells 804 for housing wheels 806. The terms back, front, sides, top, and bottom are relative terms here and are descriptive of the travel bag 20A (and 20B) when the travel bag 20A (20B) is in an upright position, as illustrated in FIGS. 71-74. In addition, "soft-sided" generally refers to a carrying bag having a flexible material (e.g., ballistic nylon, leather, or any of the other flexible materials disclosed herein) covering the exterior of the travel bag 20A and forming flexible material cover 811, with the travel bag 20A having some flexibility in its panels 805, 807, 809, compared to a "hard-sided" embodiment, such as travel bag 20B. The polymeric hard back 802 is generally substantially cut-resistant, while the remainder of the compartments and exterior bag 23A of the travel bag 20A are typically comprised of a flexible material as discussed above, such as ballistic nylon or leather, for example and without limitation. In various other representative embodiments, the hard back 802 may only partially form the back of the travel bag 20A, such as to form wheel wells 804, and the remainder of the back may then also be comprised of a flexible material. A travel bag 20A also typically includes one or more carry handles 821 and the like.

The main body component 801 of the travel bag 20A may include other structural components, not separately illustrated, such as a rigid frame underneath the flexible material cover 811, a telescoping extendable towing handle, etc. The main body component 801 typically includes a plurality of panels, rectangular planar side wall panels 807 (only one of which is shown), a pair of opposite wall (top and bottom) wall panels, only one of which is shown as top wall panel 809, which together with the back 802, define or form a main body compartment, for carrying items and contents such as clothing, toiletries, etc. The secondary body component 803 may also include other structural components, such as a rigid frame, also not separately illustrated. The secondary body component 803 typically includes a front panel 805 utilized as a cover for the main body compartment. As illustrated, front panel 805 also includes external pockets 813, 814. Access to the interior of the travel bag 20A, i.e., access to the main body compartment, is through a front opening that is closed by front panel 805, which is joined at side edge 817 to the main body component 801, and can be opened and closed by undoing and doing up a zipper 808 along three sides (and possibly also, at least partially, on the side panel having side edge 817). As illustrated in the cut-away portion, each of the various top, bottom, side, and front panels 807, 809, 805 (and those not separately illustrated or visible in FIGS. 71 and 72) include one or more security panel assemblies 62, 206, 300, 400-400E, 600, 700, 800, 900, 1000, 1100-1100C, 1300-1300D (and/or 1400-1400B).

As illustrated in FIGS. 71 and 72, the main body component 801 further comprises an expansion panel 815 (or 1400-1400B), which typically takes the form of a gusset, and which extends around the entire perimeter of the travel bag 20A (along top, bottom, and both side walls). In an alternative embodiment not separately illustrated, the main body component 801 may be joined to the secondary body component 803 by an expansion panel 815 (or 1400-1400B). In another alternative embodiment not separately illustrated, the secondary body component 803 may further comprise an expansion panel 815 (or 1400-1400B), which also typically takes the form of a gusset, and which extends around the entire perimeter of the travel bag 20A. In the expanded state of the travel bag 20A, the expansion panel 815 (or 1400-1400B), peripherally bounds that part of the volume of the main body compartment by which the volume is increased upon unfolding or expansion of the expansion panel 815 (or 1400-1400B), typically as part of the main body component 801, as illustrated in FIG. 72. In the retracted or unexpanded state or configuration of the travel bag 20A, a zipper 810 having mating halves 810*a* and 810*b* on the adjacent ends or edges 822, 824 of the expansion panel 815 of the main body component 801, and which extends about the entire perimeter of the travel bag 20A, are done or zipped up, as illustrated in FIG. 71. All or part of the expansion panel 815 (or 1400-1400B) folds into the interior of the travel bag 20A in the retracted configuration of the travel bag 20A, as discussed in greater detail below.

In a representative embodiment, the size of the travel bag 20A may be expanded by opening or unzipping zipper 810 and expanding the expansion panel 815 (or 1400-1400B). The expansion panel 815 may be integrated or continuous with the various flexible material layers comprising the travel bag 20A, or may be a separate panel which is stitched into or otherwise coupled (e.g., zipped, riveted, stitched) to the various flexible material layers or to an internal frame comprising the travel bag 20A, for example and without limitation. As illustrated in the cut-away view, and as illustrated in FIG. 75, between the flexible material cover

811 and a lining 29A, the travel bag 20A includes one or more security panel assemblies 62, 206, 300, 400-400E, 600, 700, 800, 900, 1000, 1100-1100C, 1300-1300D, and 1400-1400B.

FIGS. 73 and 74 illustrate a wheeled, hard-sided (or hard-shell) travel bag 20B, also as a type of carrying bag, having solid, hard-sided exterior covers 831, 833, 837, typically comprised of a polymer, a composite, or a polymer-coated fabric, for example and without limitation, and including wheel wells 812 for housing wheels 806. In an alternative embodiment not separately illustrated, a hard back 802 may also be included, which may include wheel wells 812 for housing wheels 806, and which may fully or partially comprise the back of the main body component 801A. The polymeric hard-sided exterior covers 831, 833, 837 are generally substantially cut-resistant. The main body component 801A of the travel bag 20B also may include other structural components, not separately illustrated, such as a rigid frame underneath the hard-sided exterior covers 831, 833, 837, a telescoping extendable towing handle, etc. A travel bag 20B also typically includes one or more carry handles 821 and the like.

The main body component 801A typically includes a plurality of panels, rectangular planar side wall panels 807A (only one of which is shown), a pair of opposite wall (top and bottom) wall panels, only one of which is shown as top wall panel 809A, which together with the back 802A, define or form a main body compartment, for carrying items and contents such as clothing, toiletries, etc. The secondary body component 803A may also include other structural components, such as a rigid frame, also not separately illustrated. The secondary body component 803A typically includes a front panel 805A utilized as a cover for the main body compartment. Access to the interior of the travel bag 20B, i.e., access to the main body compartment, is through a front opening that is closed by secondary body component 803A (and/or front panel 805A), which is joined at side edge 817A to the main body component 801A, typically using hinges or other similar rotatable or pivotable fasteners, and can be opened and closed by undoing and doing up latches (buckles or shackles) 818, typically along the side panel 807A (i.e., the side opposite the side with hinges). Not separately illustrated, the travel bag 20B also may include one or more security panel assemblies 62, 206, 300, 400-400E, 600, 700, 800, 900, 1000, 1100-1100C, 1300-1300D, and 1400-1400B.

As illustrated in FIGS. 73 and 74, the secondary body component 803A further comprises an expansion panel 815 (or 1400-1400B), which typically takes the form of a gusset, and which extends around the entire perimeter of the travel bag 20B (along top, bottom, and both side walls). In an alternative embodiment not separately illustrated, the main body component 801A may be joined to the secondary body component 803A by an expansion panel 815 (or 1400-1400B). In another alternative embodiment not separately illustrated, the main body component 801A may further comprise an expansion panel 815 (or 1400-1400B), which also typically takes the form of a gusset, and which extends around the entire perimeter of the travel bag 20A. In the expanded state of the travel bag 20B, the expansion panel 815 (or 1400-1400B) peripherally bounds that part of the volume of the main body compartment by which the volume is increased upon unfolding or expansion of the expansion panel 815 (or 1400-1400B), typically as part of the secondary body component 803A, as illustrated in FIG. 74. In the retracted or unexpanded state or configuration of the travel bag 20B, a latch (buckle or shackle) 819 having mating halves 819*a* and 819*b* on the adjacent ends or edges 826, 828 of the expansion panel 815 (or 1400-1400B) of the secondary body component 803A, and which extends about the entire perimeter of the travel bag 20B, are latched or closed, as illustrated in FIG. 73. All or part of the expansion panel 815 (or 1400-1400B) folds into the interior of the travel bag 20B in the retracted configuration of the travel bag 20B, as discussed in greater detail below. While travel bags 20A and 20B are illustrated as expandable, those having skill in the art will recognize that any suitcase, luggage or other type of travel bag is within the scope of this disclosure and may include one or more security panel assemblies 62, 206, 300, 400-400E, 600, 700, 800, 900, 1000, 1100-1100C, 1300-1300D, and 1400-1400B.

In a representative embodiment, the size of the travel bag 20B may be expanded by opening latch (buckle or shackle) 819 and expanding the expansion panel 815 (or 1400-1400B). The expansion panel 815 (or 1400-1400B) may be a separate panel which is stitched into or otherwise coupled (e.g., zipped, riveted) to the various hard-sided exterior covers 833, 837 or to an internal frame comprising the travel bag 20B, for example and without limitation. As illustrated in FIG. 75, between a flexible material cover 811A (typically comprised of a flexible material as described herein) and a lining 29A, the travel bag 20B includes one or more security panel assemblies 62, 206, 300, 400-400E, 600, 700, 800, 900, 1000, 1100-1100C, 1300-1300D, and 1400-1400B.

FIG. 75 is an enlarged, cut-away view showing the various flexible layers comprising a representative embodiment of an expansion panel 815. In a representative embodiment, the expansion panel 815 is comprised of a flexible material cover 811, 811A or other flexible material exterior layer (such as ballistic nylon, leather, or any of the various other flexible materials discussed herein), a security panel assembly (which may be any of the various security panel assemblies disclosed herein, including without limitation security panel assemblies 62, 206, 300, 400-400E, 600, 700, 800, 900, 1000, 1100-1100C, 1300-1300D, and 1400-1400B, and any of their variations), and optionally a lining 29A, which is also typically a flexible material such as a fabric, for example and without limitation. Depending upon the embodiment, the security panel assembly portion of the expansion panel 815 is fixed to (as discussed with reference to FIGS. 85-89) or is separable from and/or removably couplable to the main body component 801, 801A and/or secondary body component 803, 803A, such as for folding and storage when the bag 20A, 20B is in the compact, unexpanded configuration, as described in greater detail below with reference to FIGS. 76 and 77. Also depending upon the embodiment, the flexible material cover 811, 811A of the expansion panel 815 may always be coupled to the main body component 801, 801A and secondary body component 803, 803A to maintain the structure or structural integrity of the bag 20A, 20B regardless of its expanded or retracted state.

In another representative embodiment, the security panel assembly (e.g., 62, 206, 300, 400-400E, 600, 700, 800, 900, 1000, 1100-1100C, 1300-1300D, and 1400-1400B, and any of their variations) is integrated or combined with the flexible material cover 811, 811A to collectively form the expansion panel 815, and may further include a lining 29A. For example, any of the various security panel assemblies disclosed herein may be comprised of a cut-resistant yarn or other cut-resistant flexible material, as described above, which may be utilized to form a non-metallic wire matrix (e.g., any and all of the various wire matrices disclosed herein and their equivalents) incorporated into the security panel assembly. In a representative embodiment, the wire matrix of the security panel assembly is comprised of a cut-resistant yarn or fiber, such that the security panel assembly is coupled to, integrated or formed as part of the flexible material cover 811, 811A and is always coupled to or integrated on both sides 822, 824 of the travel bag 20A or, correspondingly, both sides 826, 828 of travel bag 20B. For such an embodiment, the expansion panel 815 is gusseted for expansion and readily foldable into the interior of the travel bag 20A, 20B when the travel bag 20A, 20B is not expanded.

FIGS. 76 and 77 illustrate a wheeled, soft-sided travel bag 20A, in an expanded position using expansion panel 815, and also illustrated in an open configuration to show an interior compartment 838 and an interior view of a security panel assembly of an expansion panel 815. Depending upon the embodiment selected, such as a metallic or nonmetallic wire matrix, or a more readily foldable embodiment (discussed below, e.g., security panel assembly 1400-1400B), the security panel assembly (e.g., 62, 206, 300, 400-400E, 600, 700, 800, 900, 1000, 1100-1100C, 1300-1300D, and 1400-1400B) may or may not be sufficiently flexible or foldable to lie comparatively flat within the interior of the travel bag 20A, 20B when the travel bag 20A, 20B is not expanded (e.g., the security panel assembly may curl or bow out), if the security panel assembly were always to be coupled to or integrated on both sides 822, 824 of the travel bag 20A or, correspondingly, both sides 826, 828 of travel bag 20B, about the circumference of the travel bag 20A, 20B, such as riveted to an internal frame, etc. Accordingly, in a representative embodiment of bag 20A illustrated in FIG. 76, the security panel assembly (e.g., 62, 206, 300, 400-400E, 600, 700, 800, 900, 1000, 1100-1100C, 1300-1300D, and 1400-1400B, and any of their variations) is non-removably coupled along a first edge to or integrated with one side (illustrated as side 822 of the travel bag 20A (e.g., using rivets 839) (or side 826 for bag 20B), and is also non-removably coupled (i.e, fixed) along a second, opposite edge of the security panel assembly (e.g., using stitching 823, to illustrate another attachment type, or additional rivets 839 (not separately illustrated)), illustrated as side 824 of the travel bag 20A (or side 828 for bag 20B). For alternative embodiments (such as those using a security panel assembly which is not as foldable as a security panel assembly 1400-1400B), for example, the security panel assembly may be removably couplable to the other side (illustrated as side 824 of the travel bag 20A (or side 828 for bag 20B)), such as via zipper 836 for bag 20B. As a result, for an unexpanded travel bag 20A, 20B, the security panel assembly may remain fully coupled, or may be unzipped or otherwise uncoupled from one side (824, 828) or both sides of the travel bag 20A, 20B (while the flexible material cover 811, 811A is coupled to both sides), and folded back to lie flat within the interior 838 of the travel bag 20A, 20B, for example and without limitation.

In another representative embodiment illustrated in FIG. 77, the security panel assembly (e.g., 62, 206, 300, 400-400E, 600, 700, 800, 900, 1000, 1100-1100C, 1300-1300D, and 1400-1400B, and any of their variations) of the expansion panel 815 may be removably couplable with one side (illustrated as side 822 of the travel bag 20A (or side 826 for bag 20B), such as via zipper 834, and also may be removably couplable to the other side (illustrated as side 824 of the travel bag 20A (or side 828 for bag 20B), such as via zipper 836. As a result, for an unexpanded travel bag 20A, 20B, the security panel assembly may be unzipped or otherwise uncoupled from both sides (822, 824 or 826, 828), and simply removed and stored within the interior 838 of the travel bag 20A, 20B or elsewhere, also for example and without limitation. In other embodiments, such as shown in FIG. 76, the security panel assembly (e.g., 62, 206, 300, 400-400E, 600, 700, 800, 900, 1000, 1100-1100C, 1300-1300D, and 1400-1400B) is fixed to both sides or compartments of the bag 20, 20A, 20B, 20E, e.g., to both the main body component 801, 801A and secondary body component 803, 803A.

Figure 80:
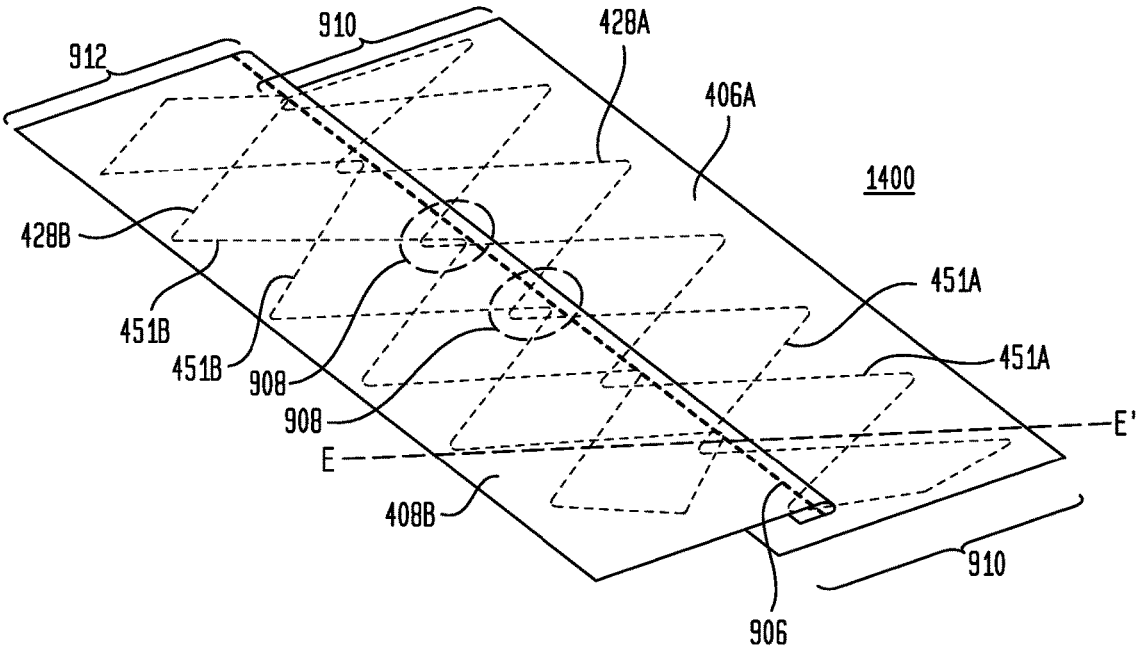
Figure 81:
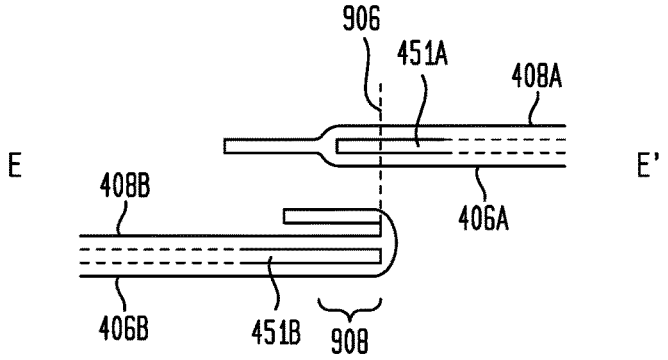
Figure 82:
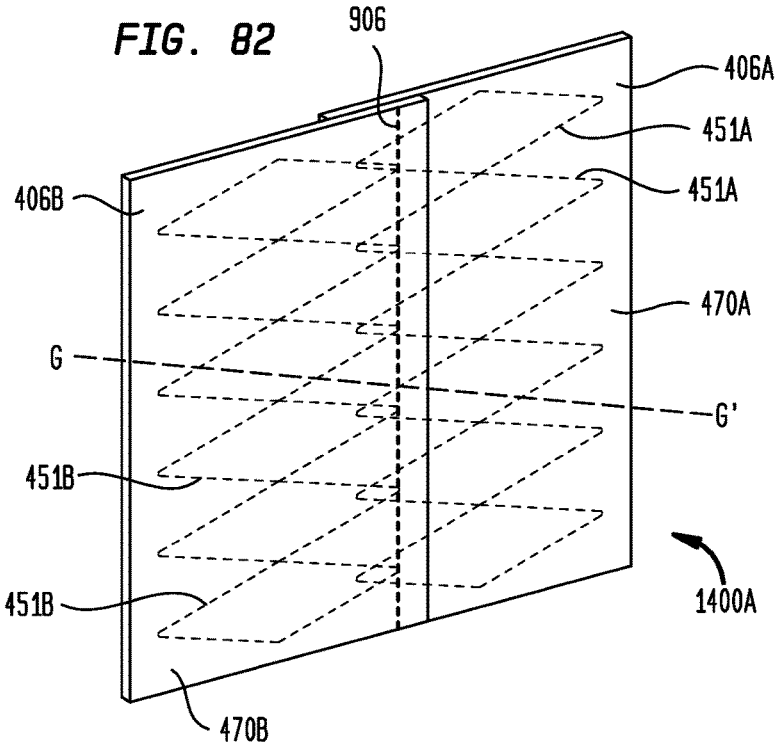
Figure 83:
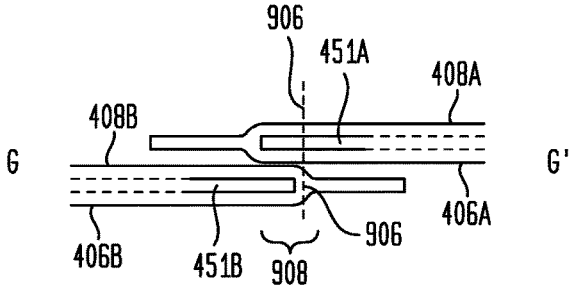
Figure 84:
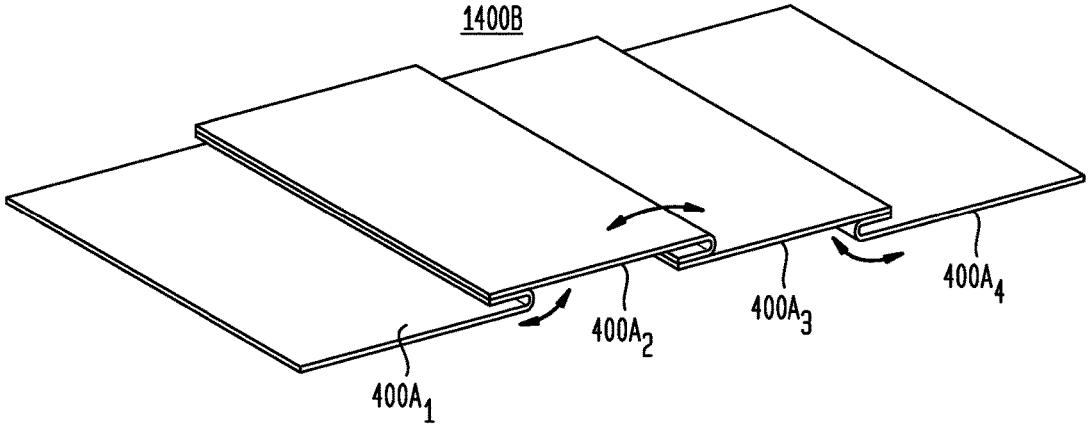

FIGS. 78 and 79 are isometric views illustrating steps in the manufacture of a representative embodiment of an expansion panel security panel assemblies 1400-1400B, each incorporating two or more security panels 400A, which may be considered security panel subassemblies when joined to any of the form expansion panel security panel assemblies 1400-1400B. FIGS. 80 and 82 are isometric views illustrating representative embodiments of an expansion panel security panel assembly incorporating two security panel subassemblies. FIG. 81 is a cross-sectional view (through the E-E' plane of FIG. 80) illustrating representative embodiments of an expansion panel security panel assembly incorporating two security panel subassemblies. FIG. 83 is a cross-sectional view (through the G-G' plane of FIG. 82) illustrating representative embodiments of an expansion panel security panel assembly incorporating two security panel subassemblies. FIGS. 85-89 are isometric views illustrating representative carry bags having representative embodiments of an expansion panel security panel assembly incorporating two security panel subassemblies, in open and closed configurations Those having skill in the art will recognize that security panels 400A are utilized for purposes of illustration and example for the formation of expansion panel security panel assemblies 1400-1400B, and any of the security panels described herein may be utilized instead or in addition. As illustrated in FIGS. 78 and 79, two security panels 400A are utilized, illustrated as first and second security panels 400$A_1$, 400$A_2$. As illustrated in FIG. 84 for expansion panel security panel assembly 1400B, four security panels 400A are utilized, illustrated as first, second, third and fourth security panels 400$A_1$, 400$A_2$, 400$A_3$, and 400$A_4$.

Referring to FIGS. 78-83, each of the first and second security panels 400$A_1$, 400$A_2$ (and 400$A_3$, 400$A_4$ discussed below) may be described as having a first lateral region 902, illustrated as respective first lateral regions 902A and 902B, and having a second lateral region 904, illustrated as respective second lateral regions 904A and 904B. Each of the security panels 400$A_1$, 400$A_2$ (and 400$A_3$, 400$A_4$) has a wire matrix 451, illustrated respectively as wire matrices 451A and 451B using dashed lines (to indicate that each is typically enclosed within flexible material layers 406, 408), with each of the wire matrices 451A and 451B typically being coupled to a first flexible material layer 406, illustrated respectively as first flexible material layers 406A and 406B, each of which also may be coupled to a second flexible material layer 408, illustrated respectively as second flexible material layers 408A and 408B, thereby enclosing the wire matrix 451A between the first flexible material layer 406A and second flexible material layer 408A, and enclosing the wire matrix 451B between the first flexible material layer 406B and second flexible material layer 408B. The respective first lateral regions 902A and 902B are then coupled together, such as through the stitching 906 illustrated in FIGS. 79-83, which also serves as an axis of rotation (or pivot) axis, for the two security panels 400$A_1$, 400$A_2$ to be folded against each other, for a closed, unexpanded configuration, and to be rotated or pivoted apart, moving each of the two second lateral regions 904A and 904B away from each other, for an open, expanded configuration, illustrated in FIGS. 80 and 82.

It is important to note that the respective first lateral regions 902A and 902B are coupled together in such a way that the flange (or edge) area 466B (of the first lateral region 902B) of the second security panel 400$A_2$ is coupled to the first security panel 400$A_1$ in that part of the first lateral region 902A of the first security panel 400$A_1$ which also includes a lateral region (or portion) 914 of the wire matrix 451A of the first security panel 400$A_1$, as illustrated. This provides that in the open and expanded state of the expansion panel security panel assemblies 1400-1400B, the respective first and second wire matrices 451A and 451B overlap or overlay each other, illustrated as overlapping regions 908, and as illustrated in greater detail in the cross-sectional illustrations of FIGS. 81 and 83. As a result, in the open and expanded state of the expansion panel security panel assemblies 1400-1400B, the overlapping wire matrices 451A and 451B provide continuity of security, without any significant gap (i.e., no gap which is much greater than the areas or regions of a security panel assembly between the wire crossings of a wire matrix 451).

The expansion panel security panel assemblies 1400 and 1400A differ insofar as the orientation of coupling of the second security panel 400$A_2$, and otherwise function identically, but with security panel assembly 1400 presenting a more finished appearance (with both flange regions 466 behind the security panel assembly 1400). The expansion panel security panel assemblies 1400 and 1400A may be utilized interchangeably and equivalently, particularly when covered on one side by an exterior covering 811, 811A and on the other side by an interior lining 29A, as previously discussed. The security panel assembly 1400B differs insofar as it includes additional security panels 400A chained or linked for additional lateral expansion, with additional third security panel 400$A_3$ and fourth security panel 400$A_4$, coupled or linked together to provide both expansion and compact folding (and illustrated in FIG. 84 in the open and expanded state of the expansion panel security panel assembly 1400B).

Figure 126:
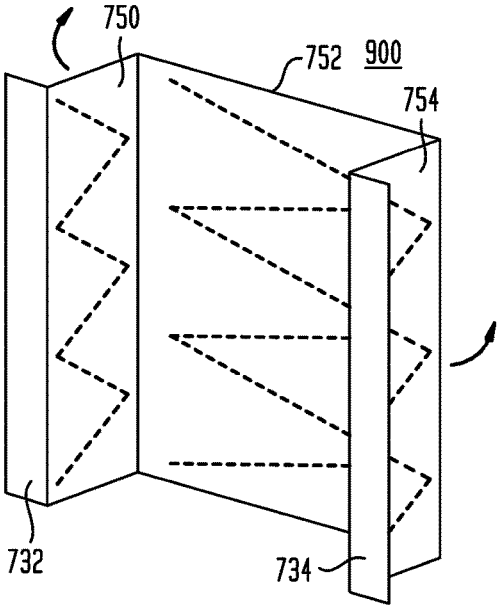
Figure 127:
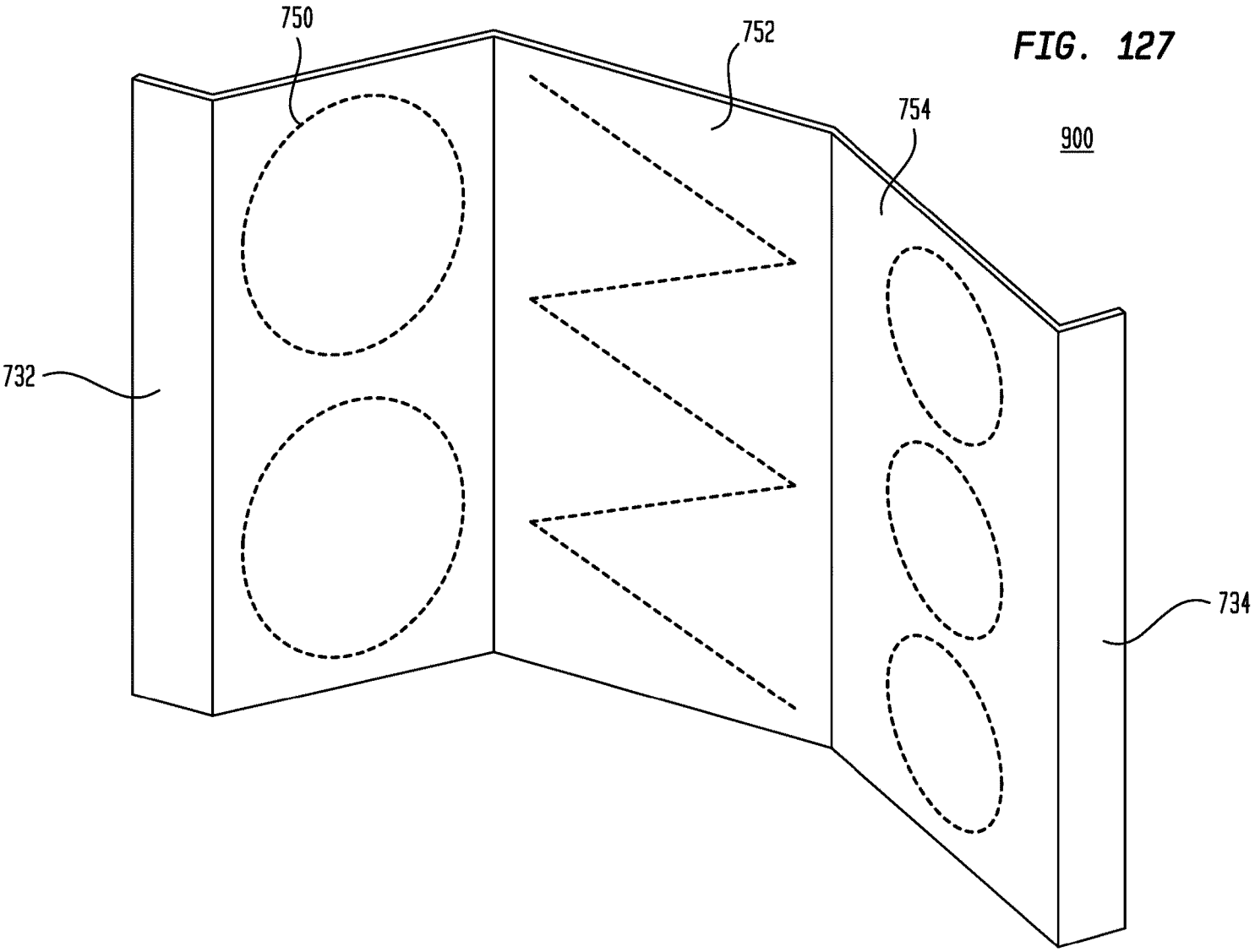

It should also be noted that while not required, for purposes of symmetry, one of the security panels 400A is typically wider than the other, so that the same width is present on each side of the axis of rotation provided by the stitching or coupling 906. As illustrated in FIG. 80, first security panel 400$A_1$ has a first width 910 which is greater than the second width 912 of the second security panel 400$A_2$. In other embodiments, the security panels 400A (providing the subassemblies for the expansion panel) may have the same width, or very different widths (e.g., as illustrated in FIGS. 126-128).

Figure 89:
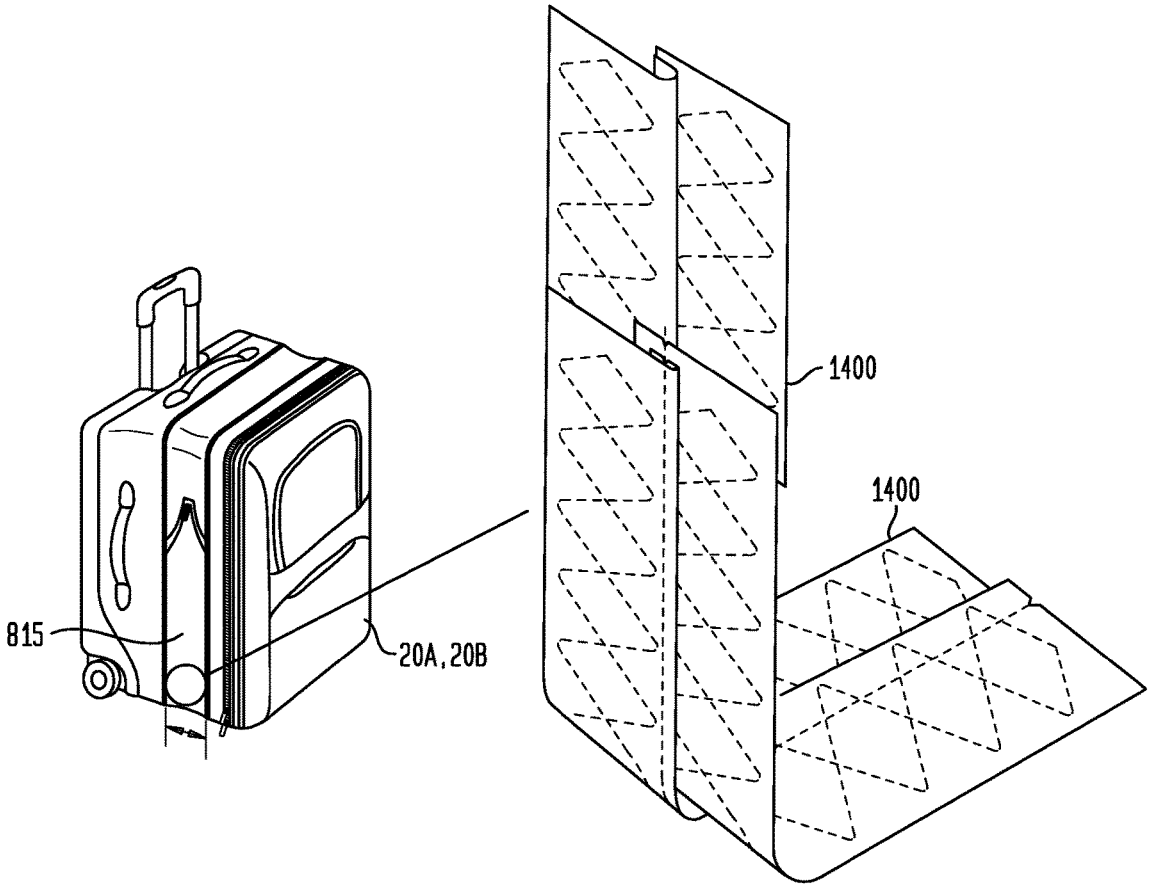

In addition, as illustrated in FIG. 89, the expansion panel security panel assemblies 1400-1400B may also be longitudinally coupled, with multiple expansion panel security panel assemblies 1400-1400B adjacent to each other (such as to extend about the circumference of a larger bag 20A, 20B), generally also with some overlapping of the wire matrices 451A between successive expansion panel security panel assemblies 1400-1400B, as illustrated in FIG. 89. This provides a piecewise continuity, and is particularly useful for successively joining expansion panel security panel assemblies 1400-1400B having different shapes to fit different types and shapes of bags 20, 20A, 20B, for example and without limitation. For example and without limitation, variously-shaped expansion panel security panel assemblies 1400-1400B may be particularly useful to accommodate corners of bags 20, 20A, 20B. Incorporation of and shapes or configurations of the expansion panel security panel assemblies 1400-1400B within an expansion panel 815 are illustrated in FIGS. 85-89 for bags 20A, 20B, and 20F, it being understood that such an expansion panel 815 may be included in any of the bags 20-20E disclosed herein and their equivalents, any and all of which are within the scope of this disclosure.

The expansion panel security panel assemblies 1400-1400B may be coupled within any of the bags 20, 20A-20E using any mechanism, such as stitching, rivets, zippers, snaps, etc., and any and all such fastening or coupling mechanisms are considered equivalent and within the scope of the disclosure. It should be noted that when joined at respective first lateral regions 902A and 902B, the respective second lateral regions 904A and 904B are available to function as tabs or flanges, for example, for coupling as part of an expansion panel 815, in any of the bags 20, 20A-20E. Not separately illustrated, instead of being coupled through stitching 906 or rivets or grommets, for example, there are other mechanisms for coupling the first and second security panels 400$A_1$, 400$A_2$ to each other and to bags 20, 20A, 20B, such as by use of one or more hinges or other pivoting mechanisms, any and all of which are considered equivalent and within the scope of the disclosure.

Accordingly, the security panel assembly 62, 206, 300, 400-400E, 600, 700, 800, 900, 1000, 1100-1100C, 1300-1300D, and 1400-1400B, used as part of or integrated with an expansion panel 815, may be coupled to the sides, compartments, or other remaining portion of the travel bag 20, 20A-20E in a wide variety of ways, any and all of which are within the scope of the disclosure. In addition, those having skill in the art will recognize that when an expansion panel 815 is included in a bag 20, 20A-20E, other security panel assemblies included in the bag 20, 20A-20E will have different sizes and configurations to accommodate the expansion, such as by having multiple security panel assemblies instead of one larger continuous security panel assembly, e.g., a first security panel assembly on a first side of a bag 20, 20A-20E, a second security panel assembly on a second, opposite side of a bag 20, 20A-20E, and with the expansion panel 815 located in between the first and second security panel assemblies.

Figure 85:
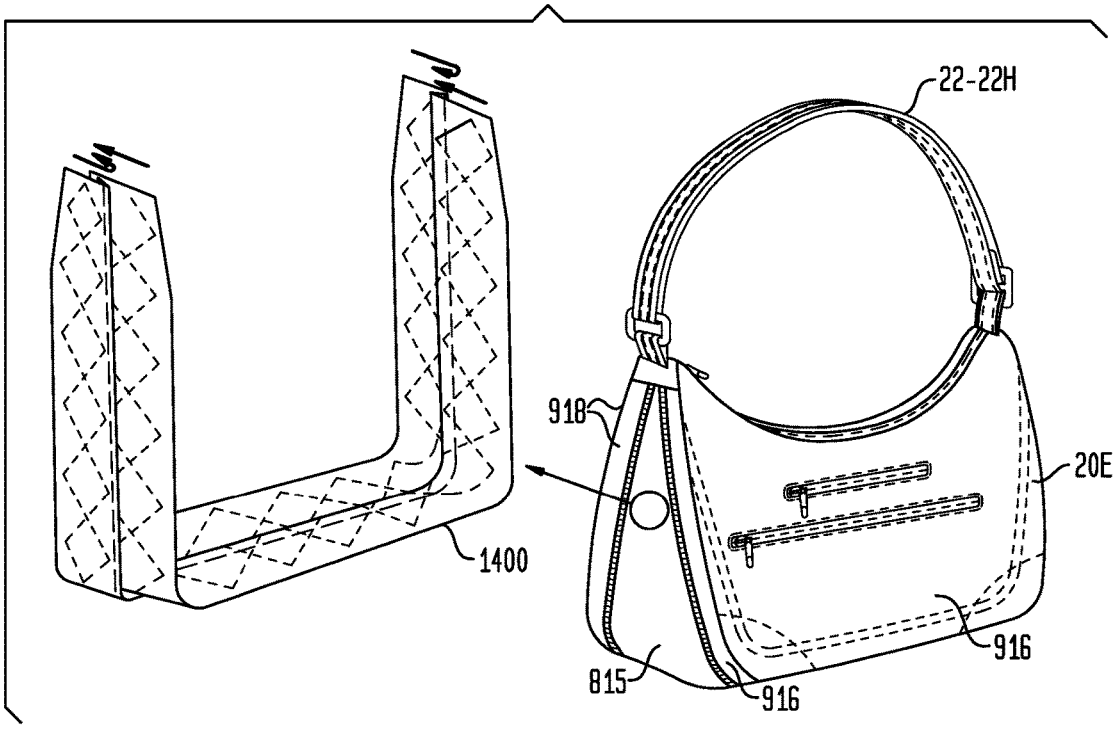
Figure 86:
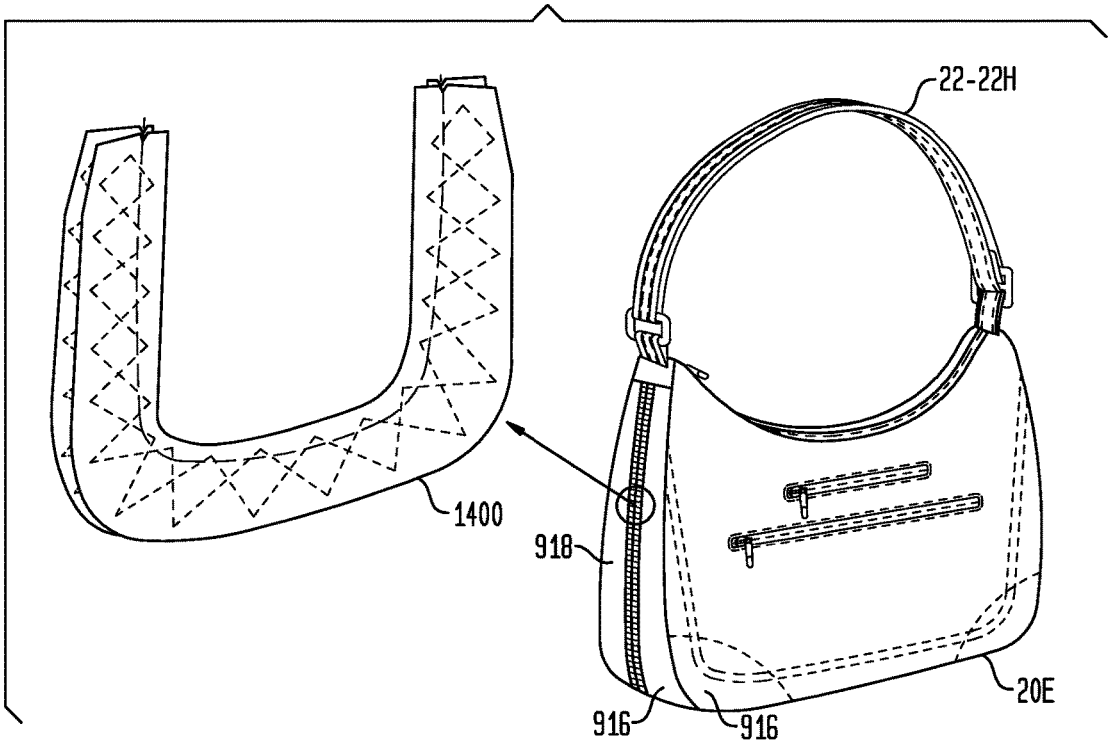
Figure 87:
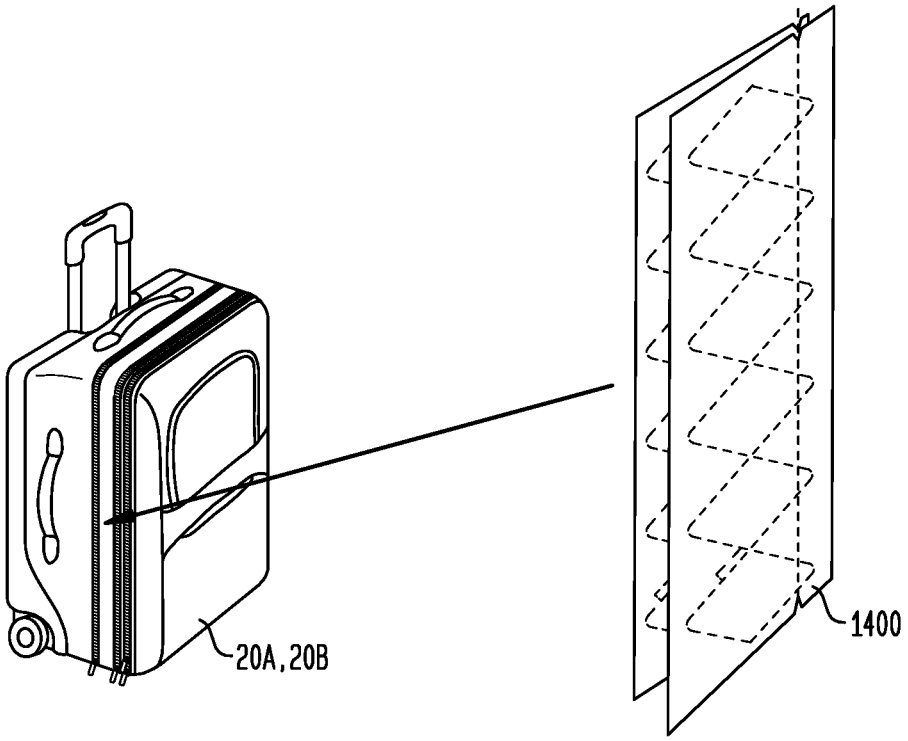
Figure 88:
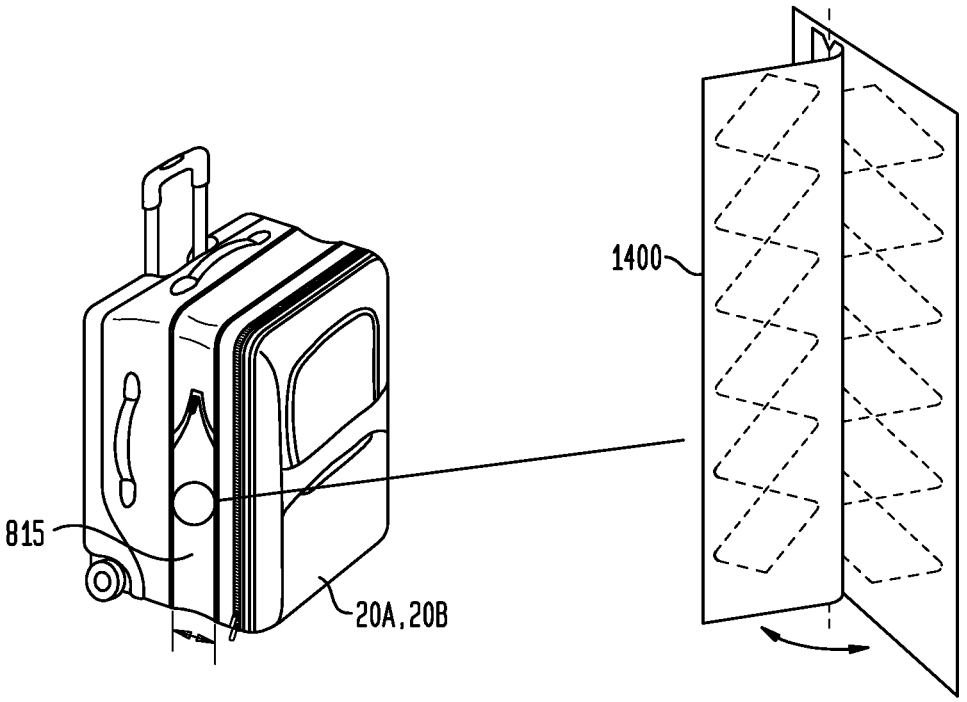

For example, as illustrated in FIGS. 85 and 86, to accommodate the expansion in a bag 20E, other security panel assemblies 62, 206, 300, 400-400E, 600, 700, 800, 900, 1000, 1100-1100C, 1300-1300D within the bag 20E are typically shaped to cover the non-expanding portions of the bag, with one or more security panel assemblies 62, 206, 300, 400-400E, 600, 700, 800, 900, 1000, 1100-1100C, 1300-1300D included in the front portion 916 of the bag 20E having the front side and the front part of the sides of the bag 20E, and with one or more separate security panel assemblies 62, 206, 300, 400-400E, 600, 700, 800, 900, 1000, 1100-1100C, 1300-1300D included in the back or rear portion 918 of the bag 20E having the back side and the back or rear part of the sides of the bag 20E. As mentioned above, however, the rear or back side of a bag 20, 20C, 20D, 20E that may be worn against a user's body may or may not include one or more security panel assemblies 62, 206, 300, 400-400E, 600, 700, 800, 900, 1000, 1100-1100C, 1300-1300D. Additional embodiments of security panel assemblies are illustrated in the Figures and discussed in greater detail below, including additional folding embodiments that may be particularly suited for use as part of an expansion panel 815.

FIGS. 90-96 illustrate the manufacture of yet additional variations of security panel assemblies 600, 600A, 600B, and 600C, respectively ninth, tenth, eleventh and twelfth representative embodiments of a security panel assembly. Security panel assemblies 600, 600A, 600B, and 600C are fabricated similarly to the security panel assemblies previously discussed and, in the interests of brevity, only new or additional features of these security panel assemblies will be discussed.

In addition, regardless of assigned numbering in the Figures, any reference to a wire or wire matrix herein, should be understood to mean and include any of the other respective wires or wire matrices disclosed herein (unless specifically specified or excluded or the context otherwise requires), and any reference to a wire end should be understood to mean and include any of the other respective wire ends disclosed herein. For example and without limitation, a wire or wire matrix of any of the Figures may be metallic or non-metallic (e.g., a flexible polymeric fiber or yarn), or formed having a different configuration or shape, etc. (unless specifically specified or excluded or the context otherwise requires). Similarly, regardless of assigned numbering in the Figures, any reference to a first material layer or a second material layer should be understood to mean and include any of the other respective first and/or second material layers disclosed herein, including composition or material selection, also for example and without limitation. In addition, any of the various security panel assemblies may be utilized for incorporation into any carrying bag 20-20E or expansion panel 815, 1400-1400B, also for example and without limitation, and those having skill in the art will recognize that innumerable combinations, configurations and variations are available, any and all of which are considered equivalent and within the scope of the disclosure.

Figure 91:
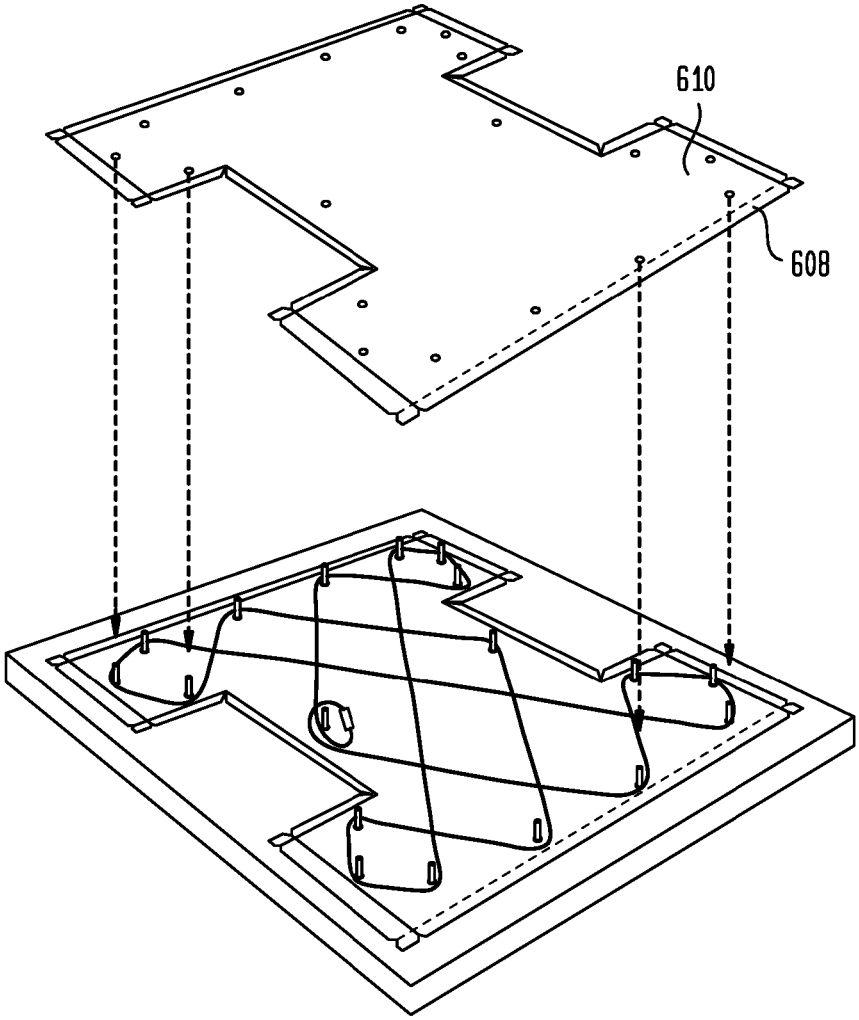
Figure 92:
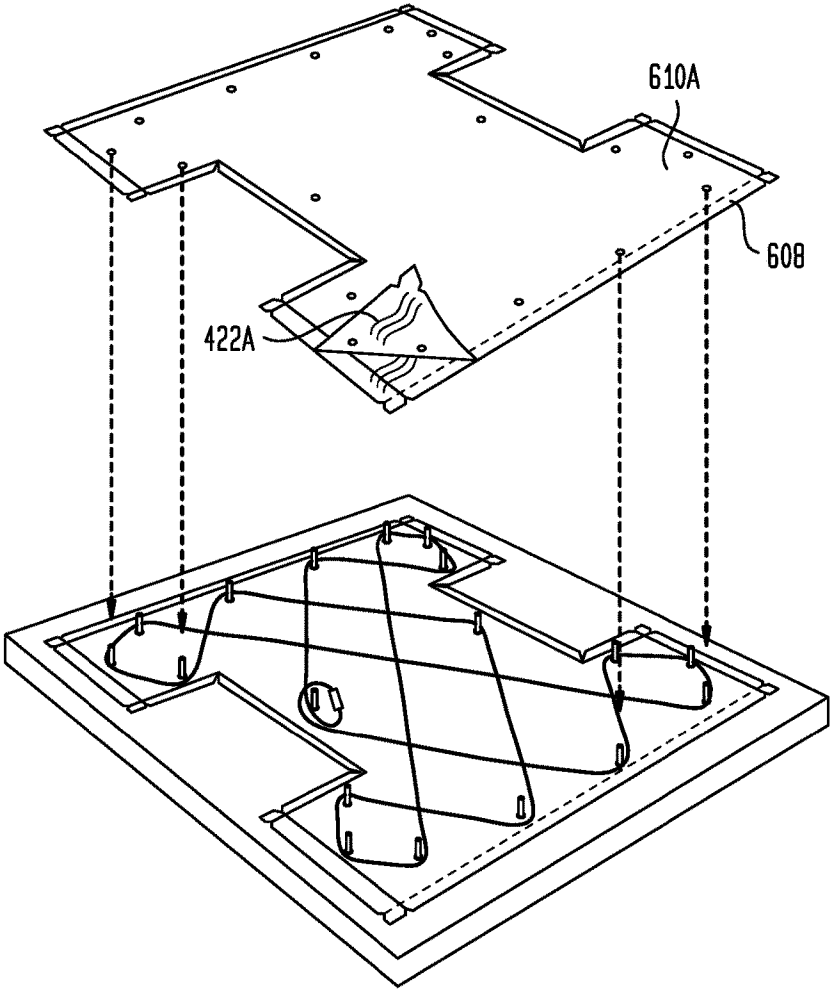

Referring to FIGS. 90-95, a first material layer 602 is also shaped or configured as an uppercase "I" (or Roman Numeral I), similarly to security panel assembly 62, for subsequent ease of folding a security panel assembly 600 into a box shape. For this configuration, the mounting pegs 410 are not in parallel rows (on opposing sides of a rectangular-shaped first material layer 406 of FIGS. 29-34), but instead are configured or positioned about or toward the periphery of the I-shaped first material layer 602, as illustrated. A single wire 428 has been routed about the mounting pegs 410 in a second predetermined pattern to also form an I-shaped wire matrix 605 having bent or curved portions 435 adjacent the periphery of the first material layer 602, and further having ends which have been bent, curved or folded away from the periphery and toward the center of the first material layer 602, as illustrated, and capped together using a single cap 601. An adhesive (such as adhesive 422) may be applied to the upper surface of first material layer 602 (not separately illustrated), and/or an adhesive (such as adhesive 422A) may be applied to the lower surface of a second material layer 610A, as illustrated in FIG. 92. Both the first material layer 602 and the second material layer 610, 610A also respectively have edges or borders 607, 608 which will be utilized, as discussed above, to form integral flange or panel members, illustrated in FIG. 95 (for one half of the security panel assembly 600) as flange or panel members 612, 614, 616, 618, and 620 which may also be utilized as bridge connectors to provide assistance for attaching and incorporating the security panel assembly 600 into a carrying bag 20, as illustrated in FIG. 96.

Figure 93:
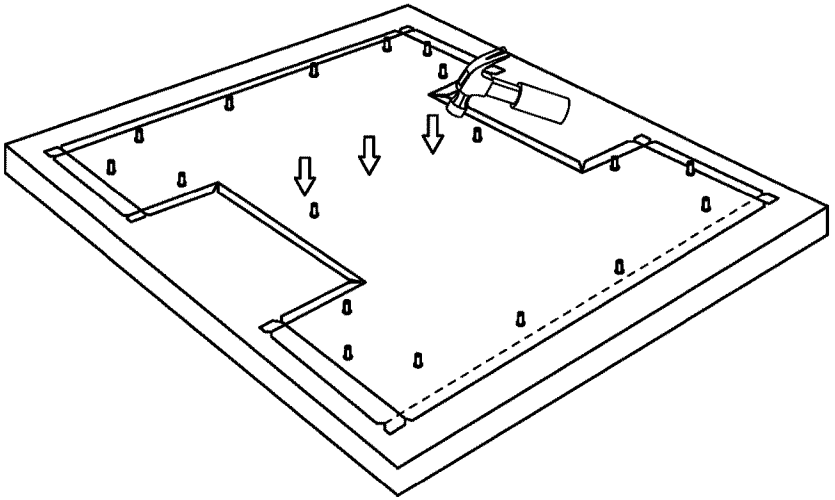
Figure 94:
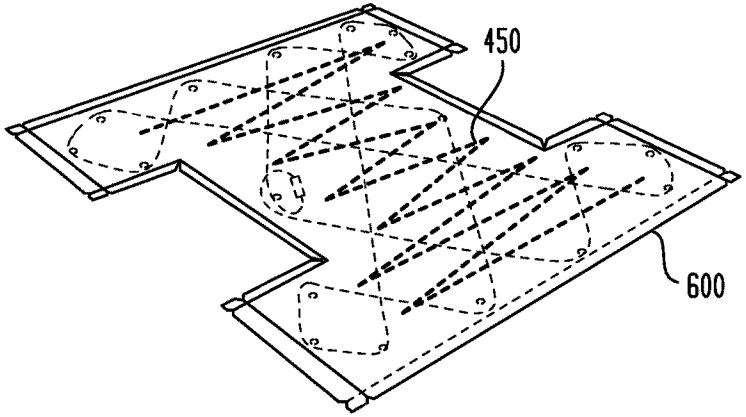

After adhering the second material layer 610 or 610A over the I-shaped wire matrix 605 and first material layer 602, as illustrated in FIGS. 91-93, the I-shaped wire matrix 605 may be secured or stabilized as discussed above, using any predetermined or other pattern, such as the triangular or sawtooth pattern 450 to form security panel assembly 600 as illustrated in FIG. 94, or using a plurality of stitching patterns which do not touch or cross over the wire 428 forming the I-shaped wire matrix 605, as previously discussed.

As indicated above, the security panel assembly 600 may then be folded, such as into a box shape illustrated in FIG. 95, and using flange or panel members 612, 614, 616, 618, and 620, may be incorporated into a bag 20, such as by stitching the flange or panel members 612, 614, 616, 618, and 620 into the bag 20 along the bottom and center seams of the end panels 630, 632, as illustrated by stitch lines 634 and 636 in FIG. 96. Also illustrated in FIG. 96 are the use of a hinged, rectangular locking ring 500, 500A and the use of any of the various carry straps 22, 22A-22H, additionally illustrated as having a surface decoration or texture.

FIGS. 97-102 illustrate the manufacture of another variation of a security panel assembly, security panel assembly 700 as a thirteenth representative embodiment of a security panel assembly. Security panel assembly 700 is fabricated similarly to the security panel assembly 600 previously discussed and, in the interests of brevity, only new or additional features of the security panel assembly 700 will be discussed.

For the security panel assembly 700, the second material layer 610B or 610C (having pre-applied adhesive 422A) has pre-stitched flange or panel members 640, 642, 644 and 646 which are located or positioned such that following adhering the second material layer 610B or 610C over the I-shaped wire matrix 605 (formed by routing a wire 701 as illustrated) and first material layer 602, as illustrated in FIGS. 97-100, when the security panel assembly 700 is folded into a rectangular box shape, the pre-stitched flange or panel members 640, 642, 644 and 646 are each at a respective corner 648, 650, 652, and 654, as illustrated in FIG. 101. Using pre-stitched flange or panel members 640, 642, 644 and 646, the security panel assembly 700 may be incorporated into a bag 20, such as by stitching the flange or panel members 640, 642, 644 and 646 into the bag 20 along the side edge and bottom seams of the end panels 630, 632, as illustrated by stitch lines 656, 658, and 660 in FIG. 102. In addition, the placement of the pre-stitched flange or panel members 640, 642, 644 and 646 allows closure of the seams of the security panel assembly 700 which are offset from the seams of the exterior 23 and/or lining 29, and further allows some overlapping of the wire 701 at the seams of the security panel assembly 700, for added security. Also illustrated in FIG. 102 are the use of a hinged, rectangular locking ring 500, 500A and the use of any of the various carry straps 22, 22A-22H. Not separately illustrated in FIGS. 100 and 101, the security panel assembly 700 may also have additional stitching, as discussed above, to stabilize or secure the I-shaped wire matrix 605 (illustrated with a dotted line in FIG. 101).

FIGS. 103-111 illustrate the manufacture of another variation of a security panel assembly, security panel assembly 800, as an eleventh representative embodiment of a security panel assembly. Security panel assembly 800 is fabricated similarly to the security panel assemblies previously discussed and, in the interests of brevity, only new or additional features of the security panel assembly 800 will be discussed.

Figure 107:
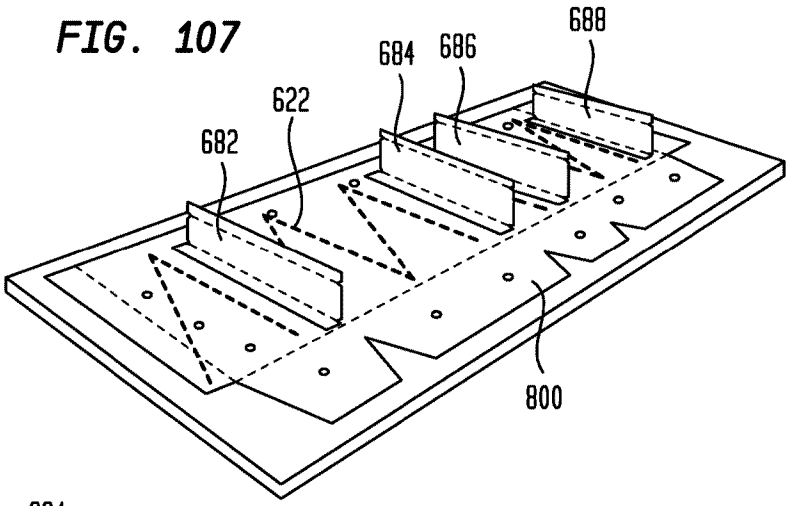
Figure 108:
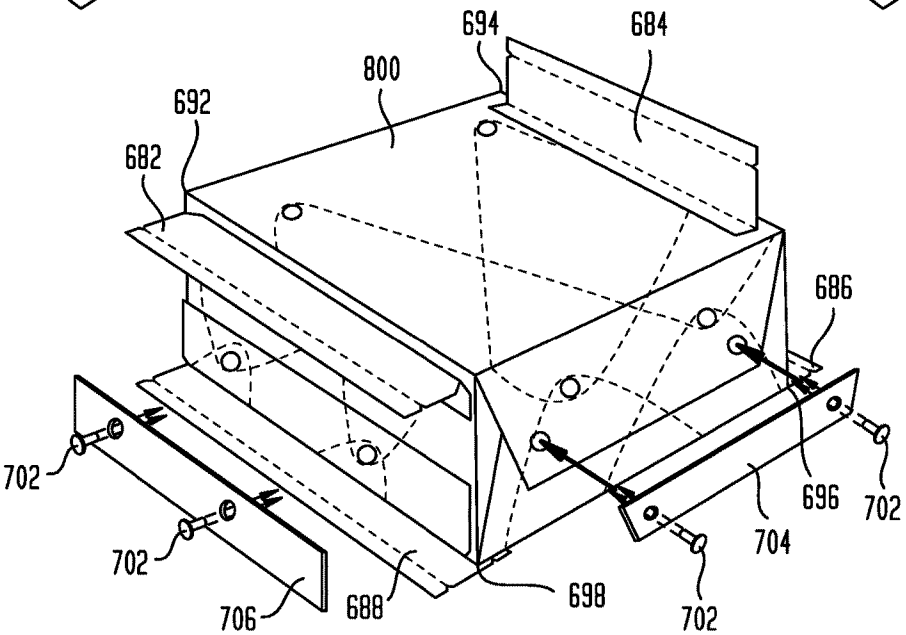
Figure 109:
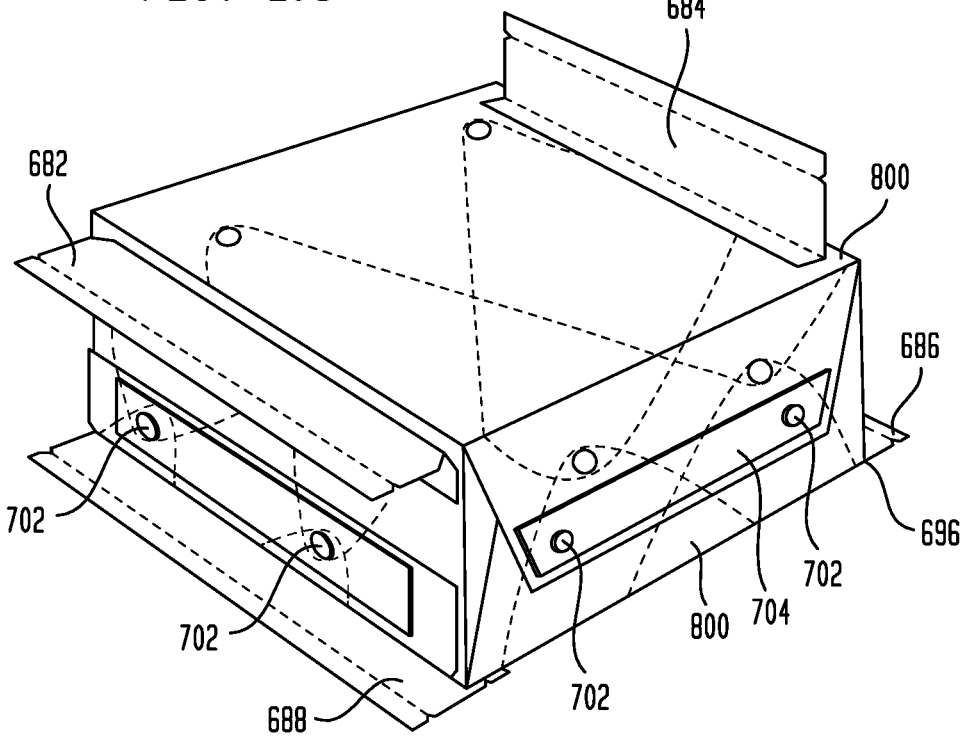

Referring to FIGS. 103-111, a first material layer 670 is configured generally as a rectangle but having cut-outs or notches 680, i.e., sections removed in advance, such that the resulting security panel assembly 800 will also be foldable into a box shape, as illustrated in FIGS. 108-110. The mounting pegs 410 are arrayed correspondingly to accommodate the cut-outs or notches 680. A single wire 428 has been routed about the mounting pegs 410 in a third predetermined pattern to also form a wire matrix 675 having bent or curved portions 435 adjacent the periphery of the first material layer 670, and further having capped ends 671, 672 which have been bent, curved or folded away from the periphery and toward the center of the first material layer 670, as illustrated.

Figure 105:
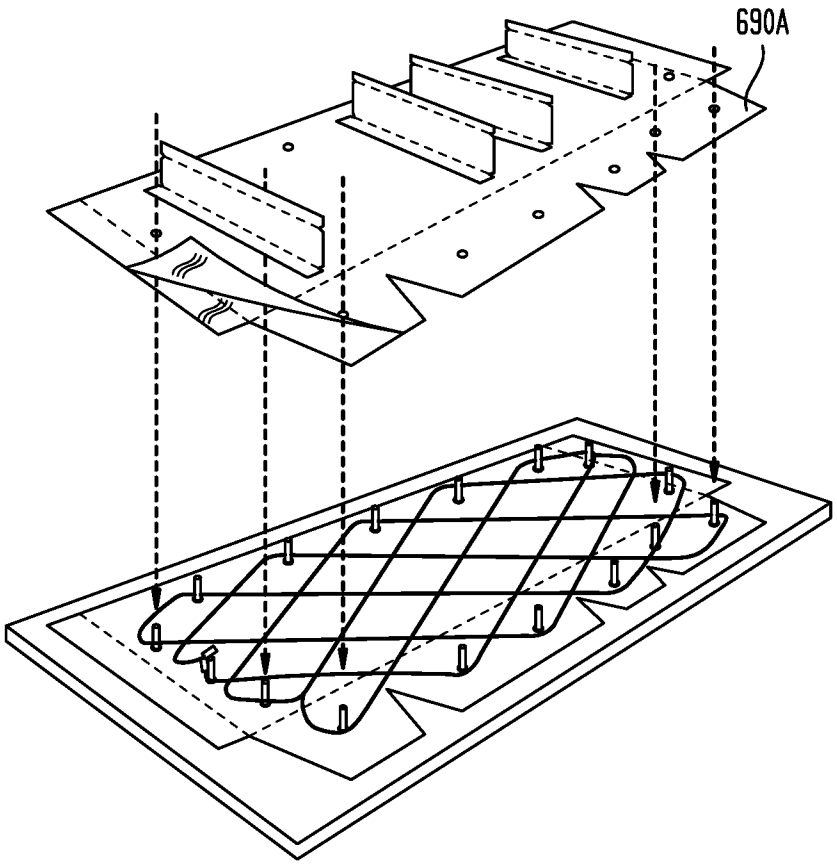

For the security panel assembly 800, the second material layer 690 or 690A (having pre-applied adhesive 422A) has pre-stitched flange or panel members 682, 684, 686 and 688 which are also located or positioned such that following adhering the second material layer 690 or 690A over the wire matrix 675 and first material layer 670, as illustrated in FIGS. 104-107, when the security panel assembly 800 is folded into a rectangular box shape, the pre-stitched flange or panel members 682, 684, 686 and 688 are each at a respective corner 692, 694, 696 and 698, as illustrated in FIGS. 108-110. Using pre-stitched flange or panel members 682, 684, 686 and 688, the security panel assembly 800 may be incorporated into a bag 20, such as by stitching the flange or panel members 682, 684, 686 and 688 into the bag 20 along the side edge and bottom seams of the end panels 630, 632, as illustrated by stitch lines 656, 658, and 660 in FIG. 111. Also illustrated in FIG. 105 are the use of a hinged, rectangular locking ring 500, 500A and the use of any of the various carry straps 22, 22A-22H.

Figure 104:
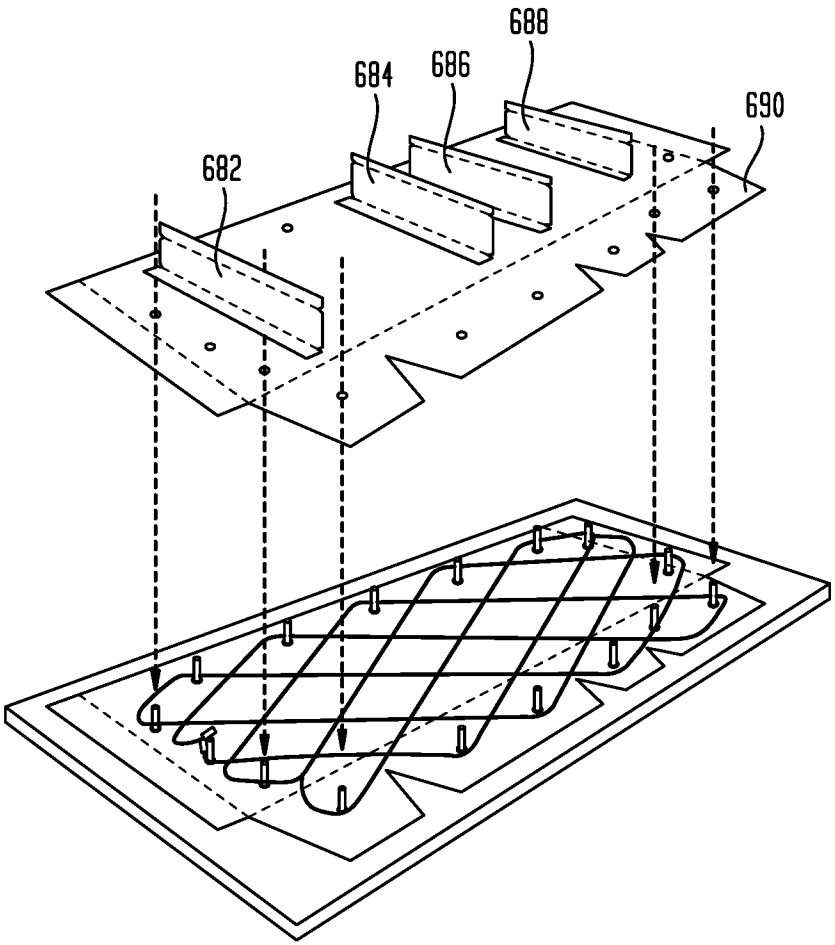
Figure 106:
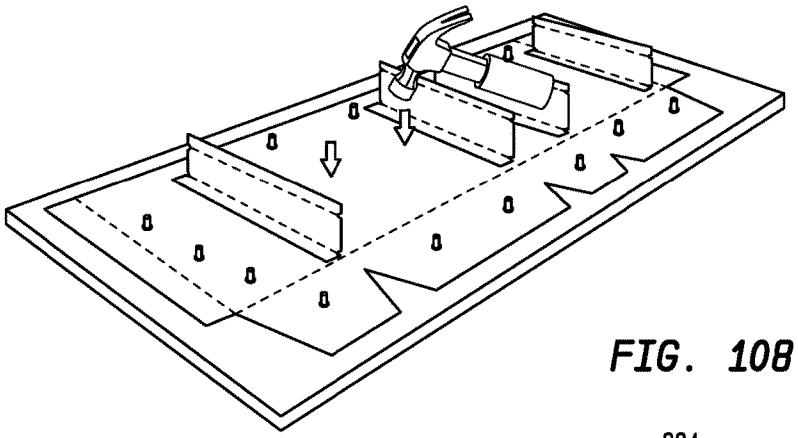

After adhering the second material layer 690 or 690A over the wire matrix 675 and first material layer 670, as illustrated in FIGS. 104-106, the wire matrix 675 may be secured or stabilized as discussed above, using any predetermined pattern, such as another triangular or sawtooth pattern 622 to form security panel assembly 800 as illustrated in FIG. 107, or using any of the other stitching patterns described herein.

After folding the security panel assembly 800 into a box shape, the sides of the folded security panel assembly 800 may be secured to each other, such as by using rivets 702 (or grommets or snaps) and, as another option, a stabilizing bar or panel 704, 706 which may be comprised of any flexible or nonflexible material, such as any of the various woven or nonwoven materials as described above, such as fabric, leather, a polymer, etc., as illustrated in FIGS. 108 and 109. The stabilizing bar or panel 704, 706 may be located or positioned either (or both) on the exterior of the box (as illustrated in FIGS. 108 and 109) or within the interior of the box created by the folded security panel assembly 800.

FIGS. 112-127 illustrate the manufacture of yet additional variations of a security panel assemblies, as a security panel assembly 900, a twelfth representative embodiment of a security panel assembly. Security panel assembly 900 is fabricated similarly to the security panel assemblies previously discussed and, in the interests of brevity, only new or additional features of this security panel assembly will be discussed.

Referring to FIGS. 112-127, one of the significant and notable differences for the security panel assembly 900 is that it is specifically designed and fabricated for comparative or relative ease of folding, such that once incorporated into a bag 20, the bag 20 is also readily foldable, such as to compress the bag 20 for shipment or storage, for example and without limitation, or for incorporation into an expansion panel 815, for use in an expandable travel bag 20A, 20B, 20E, also for example and without limitation. Another significant and notable difference is that security panel assembly 900 may have pre-stitched flange or panel members on both the upper and lower surfaces of the security panel assembly 900, which may be useful in a wide variety of applications.

As illustrated in FIGS. 112-127, a first pre-stitched flange or panel member 712 is coupled to a first side 714 of a first material layer 710, such as by stitching or using an adhesive. The first material layer 710 is then inverted, such that the first side 714 having the first pre-stitched flange or panel member 712 is or will be the lower (and exterior) side of the first material layer 710. While the first material layer 710 is illustrated as generally rectangular, for this configuration, the mounting pegs 410 are not in parallel rows (on opposing sides of a rectangular-shaped first material layer 406 of FIGS. 29-34), but instead are configured or positioned in yet another predetermined pattern about the entirety of the first material layer 710, rather than just the periphery, as illustrated. Also as illustrated, the second, upper side 716 of the first material layer 710 has pre-applied adhesive 422A, exposed by peeling back a cover sheet 718.

A single wire 428 has been routed about the mounting pegs 410 in another, eighth predetermined pattern to also form a wire matrix 720 having capped ends 721, 722 which have been bent, curved or folded away from the periphery and toward the center of the first material layer 710, as illustrated. The predetermined pattern of the wire matrix 720 is designed to provide folding (bending or inflection) regions (or tracks) 722, 724, and 726 which are crossed usually only once (possibly twice) by the single wire 428. The wire matrix 720 not only has bent or curved portions 435 adjacent the periphery of the first material layer 710, but also adjacent to the folding regions 722, 724, and 726, so that when folded, there are no ends of the wires or other potentially sharp items which could pierce the first material layer 710 or second material layer 730 in the vicinity of the folding regions 722, 724, and 726. With this configuration of the wire matrix 720, particularly with the folding regions 722, 724, and 726 which are crossed generally just once by the single wire 428, the folding regions 722, 724, and 726 are significantly more bendable, with the result that the security panel assembly 900 is significantly more foldable and compressible, such as for storage or transport, or for use in an expansion panel 815.

Stated another way, the folding regions 722, 724, and 726, and the layout or configuration of the wire matrix 720, serve to divide a security panel assembly 900 into a plurality of integrated security subpanels (or sections) 750, 752, 754, and 756, for the illustrated configurations. The number and position of security subpanels and pre-stitched flanges or panel members which are utilized may be varied, and innumerable other configurations of security subpanels and pre-stitched flanges or panel members are available and may also be utilized, with both the number, position and configuration of security subpanels and pre-stitched flanges or panel members typically or generally selected to conform to or match the overall configuration of the bag 20-20E into which the security panel assembly 900 will be inserted and to match the selected locations within the bag 20-20E for attachment of the pre-stitched flanges or panel members, and any and all such selections and configurations of security subpanels and pre-stitched flanges or panel members are considered equivalent and within the scope of the disclosure. For example, security panel assembly 900 (FIG. 123) is configured to have two security subpanels 752 and 754, while security panel assembly 900 (FIGS. 125-126) is configured to have three security subpanels 750, 752 and 754, along with a different placement of the pre-stitched flanges or panel members 732, 734.

Figure 116:
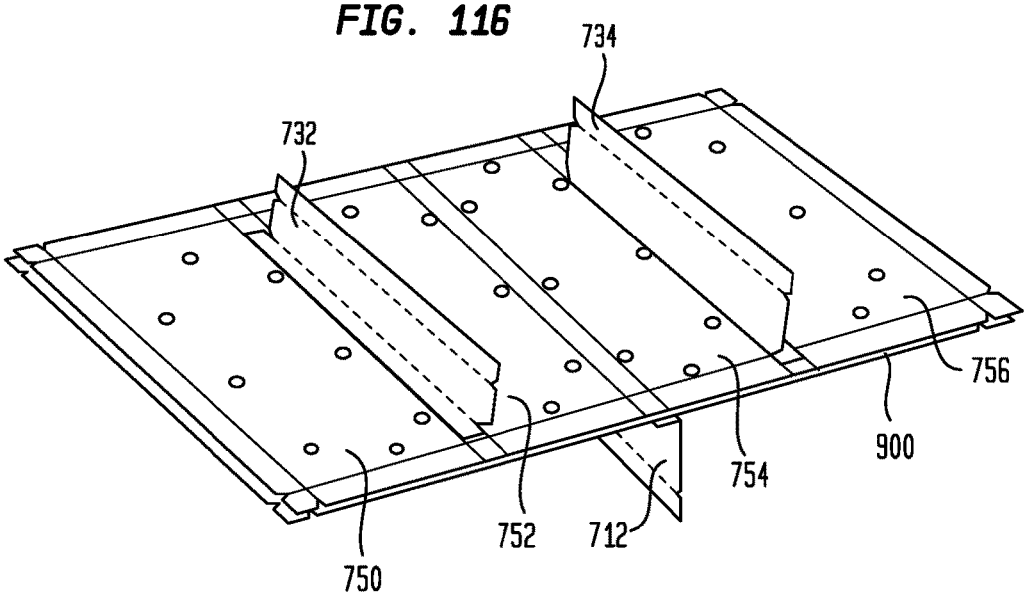

Second and third pre-stitched flanges or panel members 732, 734 are coupled to a first side 736 of the second material layer 730, such as by stitching or using an adhesive. Also as illustrated, the second, lower side 738 of the second material layer 730 may have pre-applied adhesive 422A, exposed by peeling back a cover sheet 742. Following adhering and attachment of the second material layer 730 over the wire matrix 720 and first material layer 710, the resulting security panel assembly 900 has a first pre-stitched flange or panel member 712 on its lower side, and second and third pre-stitched flanges or panel members 732, 734 on its upper side, as illustrated in FIG. 116, which may also be utilized as bridge connectors to provide assistance for attaching and incorporating the security panel assembly 900 into a carrying bag 20, 20C, 20D, as illustrated in FIGS. 121 and 122 (for a bag 20), or for attaching and incorporating the security panel assembly 900 into an expansion panel 815 or into a carrying bag 20.

Figure 117:
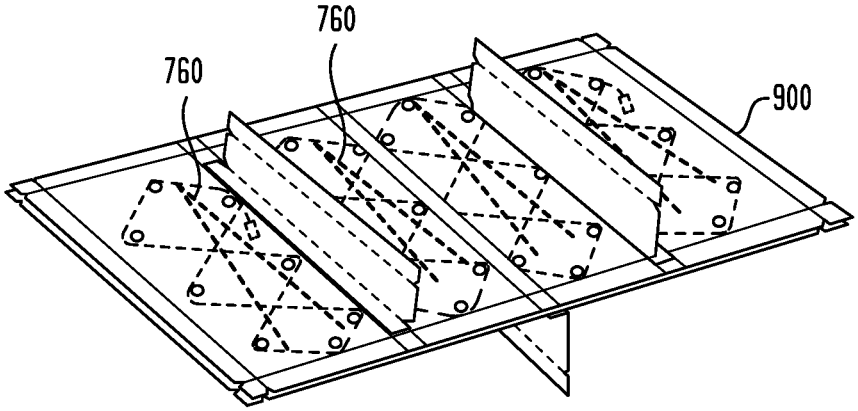
Figure 118:
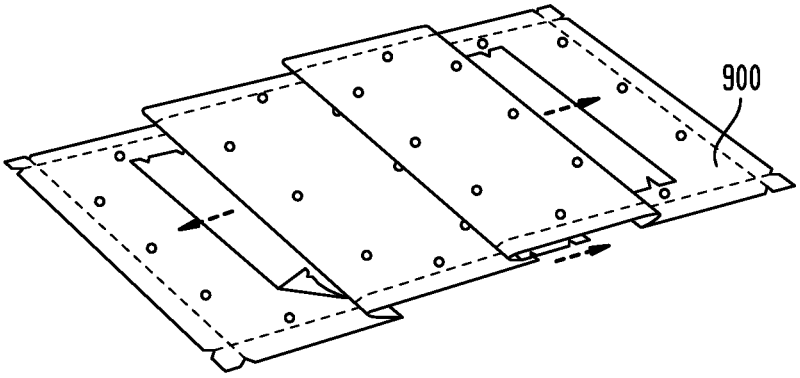

Also as discussed above, the wire matrix 720 may be secured or stabilized using any predetermined pattern, such as the triangular or sawtooth pattern 760 to form security panel assembly 900 as illustrated in FIG. 117, or using a plurality of other stitching patterns discussed above.

The security panel assembly 900 may then have any of a plurality of configurations, and may be folded into a first configuration and unfolded into second and third configurations, for example and without limitation. As illustrated, a security panel assembly 900 may have a flat, unfolded configuration illustrated in FIG. 118, which is especially suitable for use in an expanded position of an expansion panel 815 of a travel bag 20A, 20B or other suitcase, for example, or may be folded into many different configurations, such as into a box or rectangular shape illustrated in FIG. 119 (for use when the bag 20 is in an expanded or open configuration, as illustrated in FIG. 122) and such as into a "W" shape illustrated in FIG. 120 (for use when the bag 20 is in a closed or compressed configuration, as illustrated in FIG. 121).

Figure 123:
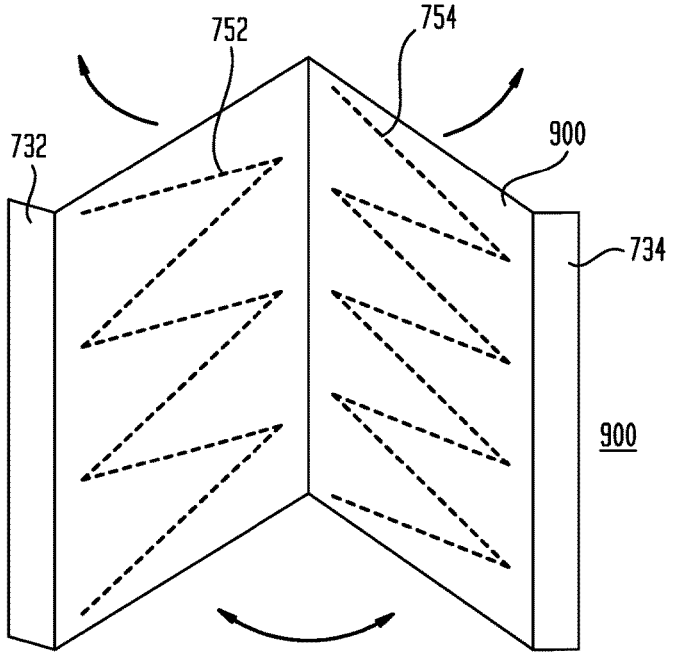
Figure 124:
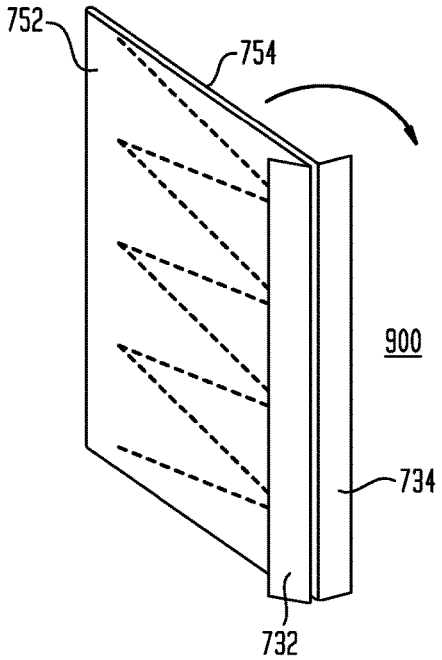

All such configurations are within the scope of the disclosure. In addition, several additional configurations of a security panel assembly 900 may be particularly useful for use in an expansion panel 815. Referring to FIGS. 123 and 124, another embodiment of a security panel assembly 900 is comprised of two subpanels 752 and 754, with second and third pre-stitched flanges or panel members 732, 734 utilized to couple the security panel assembly 900 within an expansion panel 815 and/or to each side (respectively 822 and 824 or 826 and 828) of a travel bag 20A, 20B, for example and without limitation. As illustrated, by having two subpanels, security panel assembly 900 has a "V" configuration, such as for a gusset, which can be folded substantially flat (FIG. 124), such as for when a travel bag 20A, 20B is in an unexpanded state, and which can be fully unfolded, such as for when a travel bag 20A, 20B is in an expanded configuration.

Figure 125:
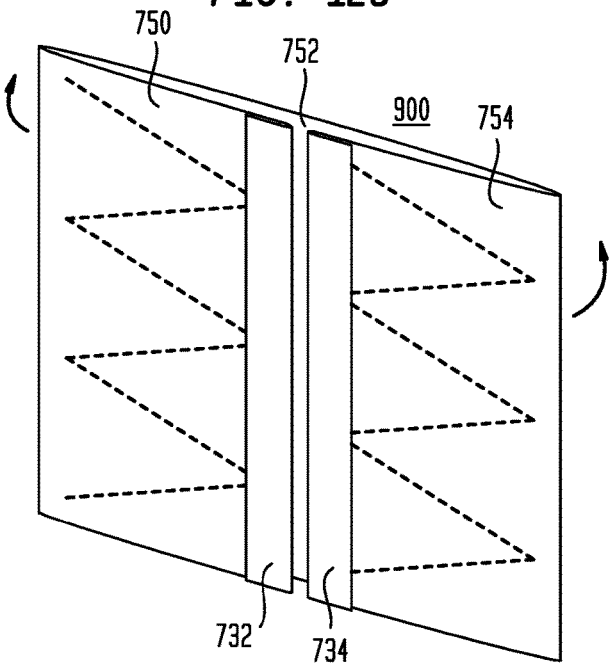

Referring to FIGS. 125-127, another embodiment of a security panel assembly 900 is comprised of three subpanels 750, 752 and 754, with a different configuration of the second and third pre-stitched flanges or panel members 732, 734, and also utilized to couple the security panel assembly 900 within an expansion panel 815 and/or to each side (respectively 822 and 824 or 826 and 828) of a travel bag 20A, 20B. As illustrated, by having three subpanels, security panel assembly 900 has a "U" configuration, such as for a gusset, which can be folded substantially flat (FIG. 125), such as for when a travel bag 20A, 20B is in an unexpanded configuration, and which can be fully unfolded, such as for when a travel bag 20A, 20B is in an expanded configuration, with security panel assembly 900 illustrated as successively unfolding in FIGS. 126 and 127. As discussed above, any of the expansion panel security panel assemblies 1400-1400B may also have any of these configurations.

Using the first pre-stitched flange or panel member 712, the security panel assembly 900 may be coupled longitudinally, such as by stitching along the length of first pre-stitched flange or panel member 712, to the center 780 of the bottom panel of the bag 20. In a representative embodiment, the second and third pre-stitched flanges or panel members 732, 734 are coupled, such as through an adhesive, to the security subpanels 750 and 756, respectively, to provide support for retaining both the box and "W" configurations. In another representative embodiment, the second and third pre-stitched flanges or panel members 732, 734 are coupled, such as through an adhesive or stitching, to a lining, such as a lining of an expansion panel, also for example and without limitation. Not separately illustrated in FIGS. 121 and 122, additional security panel assemblies, including any of those disclosed herein, may be utilized for the end panels of the bag 20.

FIGS. 128-129 illustrate the manufacture of yet additional variations of security panel assemblies, security panel assembly 1000, as a thirteenth representative embodiment of a security panel assembly. Security panel assembly 1000 is fabricated similarly to the security panel assemblies previously discussed and, in the interests of brevity, only new or additional features of the security panel assembly 1000 will be discussed.

Referring to FIGS. 128-129, a first material layer 855 is configured generally stellate or an irregular star-shape, i.e., somewhat rectangular but having cut-outs or notches 860 (generally or substantially triangular sections removed in advance), such that the resulting security panel assembly 1000 will also be foldable into a box shape, as previously described for other embodiments. The mounting pegs 410 are arrayed correspondingly to accommodate the cut-outs or notches 860. A single wire 428 has been routed about the mounting pegs 410 in another predetermined pattern to also form a wire matrix 850 having bent or curved portions 435 adjacent the periphery of the first material layer 855, and further having capped ends 851, 852 which have been bent, curved or folded away from the periphery and toward the center of the first material layer 855, as illustrated.

As illustrated in FIG. 128, stabilizing anchors 865 are utilized for a plurality of predetermined positions of the bent or curved portions 435 which are adjacent the periphery of the first material layer 855. In various representative embodiments, the stabilizing anchors 865 are generally comprised of any flexible or foldable material (discussed above), while in other representative embodiments, the stabilizing anchors 865 may be comprised of a non-flexible or semi-rigid material, such as metal or a semi-rigid, molded plastic, for example and without limitation. The stabilizing anchors 865 may be coupled over the bent or curved portions 435 and the first material layer 855 using an adhesive 422 or a pre-applied adhesive 422A, as previously discussed. The security panel assembly 1000 (FIG. 129) may then be formed using the additional fabrication steps, and also utilized in a bag 20-20E, both as previously discussed with reference to other embodiments.

Figure 130:
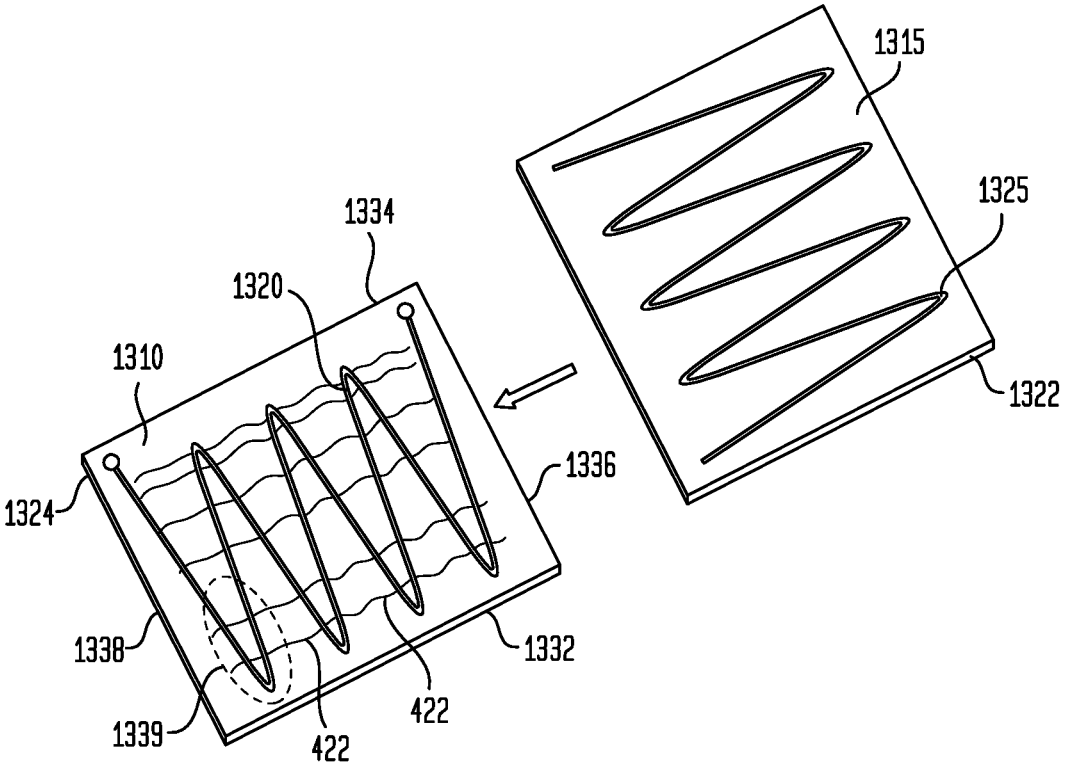
Figure 131:
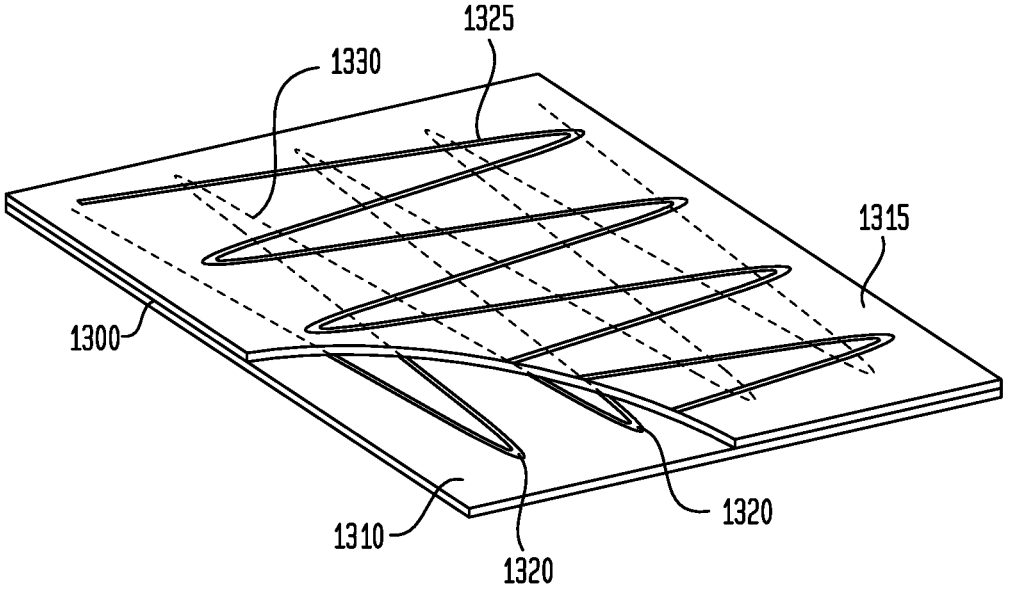

FIGS. 130-137 are isometric views illustrating various additional and representative metallic embodiments, non-metallic fiber-based embodiments, and hybrid metallic-nonmetallic embodiments of security panel assemblies 1300, 1300A-1300D. Referring to FIG. 130, a first metallic wire or cable 1320 has been routed in a sawtooth or zig-zag pattern over a first material layer 1310 (which may also have an adhesive 422, or which first metallic wire or cable 1320 may have been stabilized, such as through stitching (not separately illustrated), to form a first panel 1324. A second metallic wire or cable 1325 also has been routed in a sawtooth or zig-zag pattern over a second material layer 1315 (which may also have an adhesive 422, or which second metallic wire or cable 1325 may have been stabilized, such as through stitching (not separately illustrated), to form a second panel 1322. The second panel 1322 is then overlaid and adhered to the first panel 1324 as illustrated, such as through sewing or stitching (illustrated stitching lines 1330), to form a security panel assembly 1300 as illustrated in a cut-away view in FIG. 131. As the second panel 1322 is typically fabricated like the first panel 1324, it may then be rotated ninety degrees in the same plane (for the patterned second metallic wire or cable 1325 to be substantially orthogonal or perpendicular to the patterned first metallic wire or cable 1320) as illustrated.

Neither of the first or second panels 1324, 1322 (1326) has a wire mesh or wire netting structure, as none of the first metallic wire or cable 1320 and second metallic wire or cable 1325 crosses itself or connects to another wire in the same plane. Once overlaid, the first and second panels 1324, 1322 (1326) form an asymmetrical grid pattern having a plurality of closed wire shapes formed in two different planes or layers which also cross each other in the two different planes or layers, thereby forming a wire matrix in combination in the two different planes or layers. While the patterned second metallic wire or cable 1325 is illustrated as substantially orthogonal or perpendicular (rotated ninety degrees) from the patterned first metallic wire or cable 1320, those having skill in the art will recognize that depending upon the selected patterns of the first and second wires 1320, 1325 (or 1350), any offset or rotation more than about thirty degrees to about forty-five degrees may be sufficient to form a grid pattern that will not allow the cutting instrument to cut any appreciable distance in the security panel assembly 1300-1300D, depending upon the selected or desired level of security; as a result, while about a 90° offset or rotation of the first and second panels 1324, 1322 (1326) to each other may be the simplest and possibly most effective orientation depending upon the selected wire pattern, "substantially orthogonal" as used herein should be understood to mean and include any offset of the first and second panels 1324, 1322 (1326) which is equal to or greater than about 30-45°, depending upon the selected wire patterns of the first and second panels 1324, 1322 (1326), and is only required to form an overall closed wire shape that will limit the distance or length that may be cut in the security panel assemblies 1300-1300D.

Figure 132:
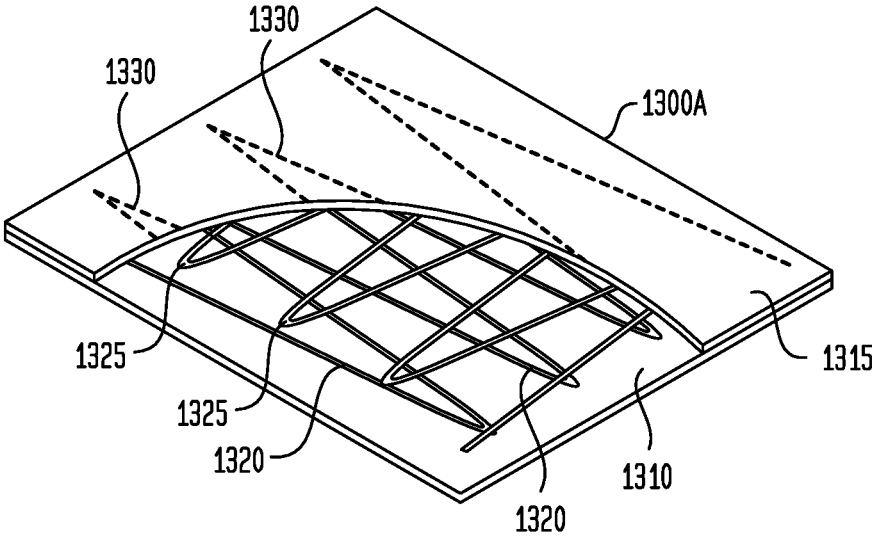

As another variation illustrated in a cut-away view in FIG. 132, the second panel 1322 is flipped over (also as illustrated), such that the second metallic wire or cable 1325 is on the underside of the second material layer 1315 (and if needed depending on its orientation, also may then be rotated ninety degrees in the same plane (for the patterned second metallic wire or cable 1325 also to be substantially orthogonal or perpendicular to the patterned first metallic wire or cable 1320) as illustrated, and then overlaid and adhered to the first panel 1324, such as through sewing or stitching (illustrated stitching lines 1330), to form a security panel assembly 1300A, such that both the first material layer 1310 and second material layer 1315 respectively form the bottom and top surfaces of the security panel assembly 1300A.

Figure 133:
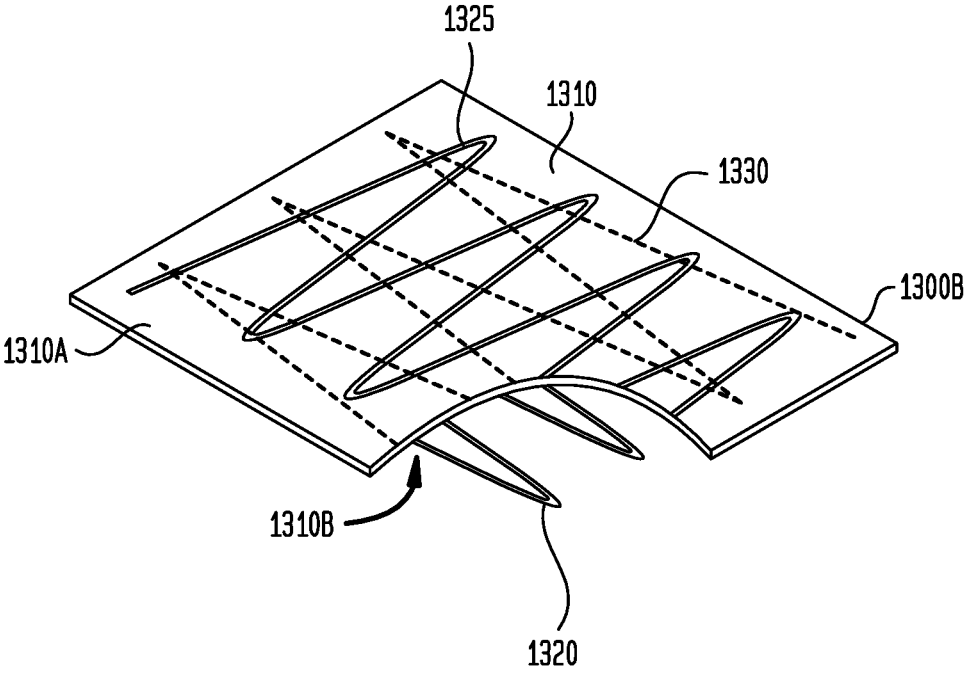

As illustrated in a cut-away view in FIG. 133, a second metallic wire or cable 1325 having the orthogonal configuration described above can also be routed on the underside (or lower surface 1310A) of the first panel 1324 to form a security panel assembly 1300B, such that both sides of a first material layer 1310 include a patterned metallic wire or cable, with a first side 1310B having the first metallic wire or cable 1320 arranged in a sawtooth or zig-zag pattern and secured, and with a second side 1310A having the second metallic wire or cable 1325 arranged in a sawtooth or zig-zag pattern rotated about or substantially ninety degrees, and also secured (stitch lines 1330).

For these embodiments illustrated in FIGS. 130-133, hybrid security panel assemblies may also be formed, using a metallic wire or cable on one layer, such as the first metallic wire or cable 1320 on first material layer 1310, and a substantially cut-resistant, second nonmetallic fiber, yarn or cable on a second layer, such as a substantially cut-resistant, second nonmetallic fiber, yarn or cable 1325, such as a Kevlar® yarn described above, also has been routed in a sawtooth or zig-zag pattern over a second material layer 1315 (which may also have an adhesive 422, or which second nonmetallic fiber, yarn or cable 1350 may have been stabilized, such as through stitching (not separately illustrated), and finished as discussed above, to form a hybrid metal-nonmetal security panel assembly as another type or variation of a security panel assembly 1300, for example and without limitation.

Figure 135:
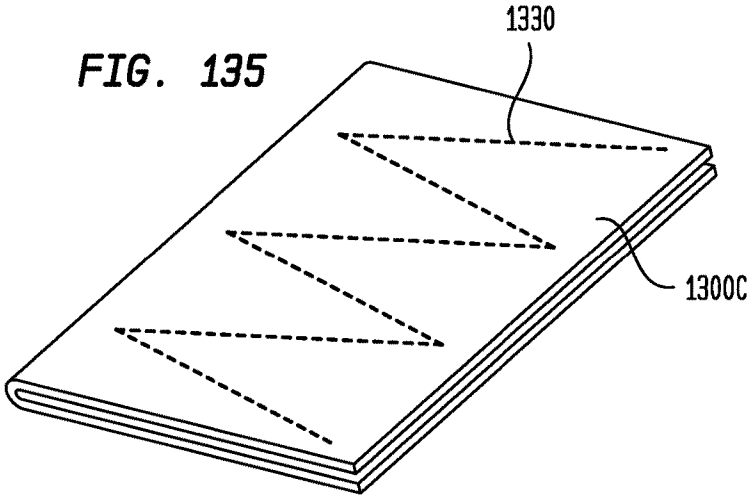
Figure 136:
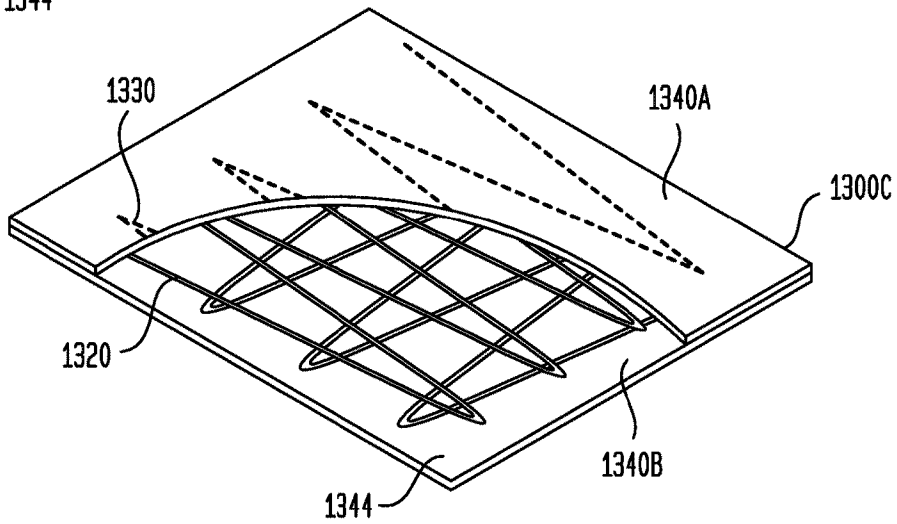
Figure 134:
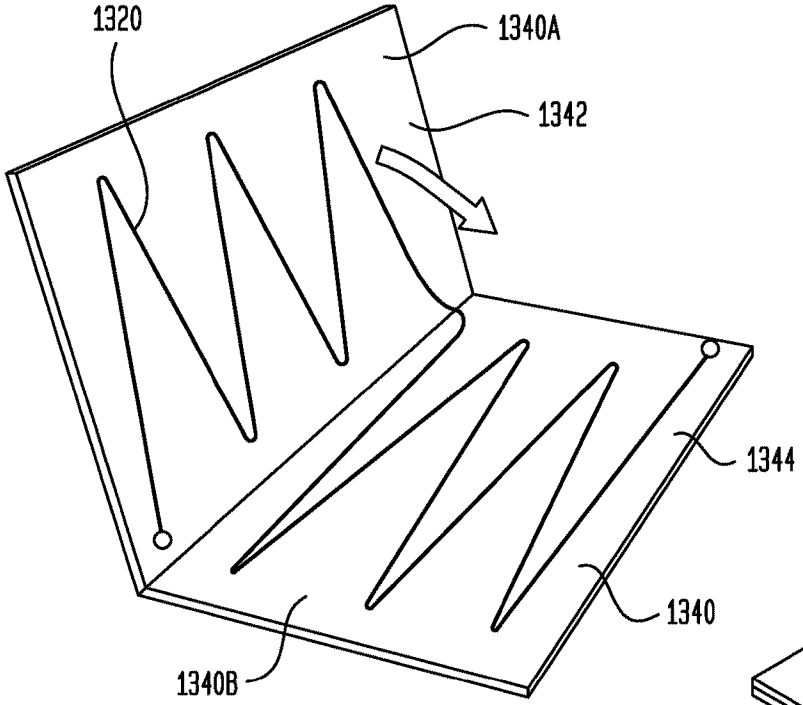
Figure 137:
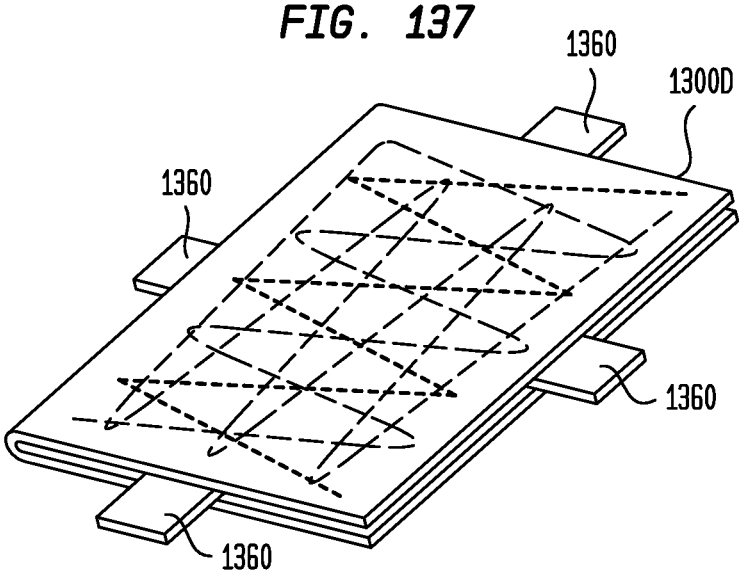

Referring to FIG. 134, a metallic or nonmetallic wire or cable 1320 has been routed in a first sawtooth or zig-zag pattern over a first half (1340A) of a single material layer 1340 (which may also have an adhesive 422, or which first metallic or nonmetallic wire or cable 1320 may have been stabilized, such as through stitching (not separately illustrated), to form a first half-panel 1342, and also has been routed in a second sawtooth or zig-zag pattern over a second half (1340B) of the same material layer 1340, to form a second half-panel 1344. Neither of the first or second half-panels 1342, 1344 has a wire mesh, but nonetheless will form a wire matrix in combination on the two different planes or layers, as discussed above. The second sawtooth or zig-zag pattern of the metallic or nonmetallic wire or cable 1320 on the second half-panel 1344 is substantially orthogonal or perpendicular to the first sawtooth or zig-zag pattern of the metallic or nonmetallic wire or cable 1320 on the first half-panel 1342 as illustrated. The single material layer 1340 having the patterned wire or cable 1320 is then folded in half in a first direction as illustrated, such that the first half-panel 1342 is overlaid and adhered to the second half-panel 1344, such as through sewing or stitching (illustrated stitching lines 1330), to form a security panel assembly 1300C as illustrated in FIG. 135 and as illustrated in a cut-away view in FIG. 136. As another variation illustrated in FIG. 137, tabs or flanges 1360 have been added, as described above, to form a security panel assembly 1300D. Not separately illustrated, the single material layer 1340 having the patterned metallic or nonmetallic wire or cable 1320 also can be folded in half in a second direction opposite the first direction, such that the underside of the first half-panel 1342 is adhered to the underside of the second half-panel 1344, thereby adhering the halves of the single material layer 1340, such as through sewing or stitching, with the patterned metallic or nonmetallic wire or cable 1320 on the outer surfaces, to form another security panel assembly having the same configuration as security panel assembly 1300C, but with the first material layer being folded to be two-ply thick.

These hybrid metal-nonmetal security panel assembly embodiments, along with the nonmetal embodiments, are also particularly useful in expansion panel 815 embodiments as the various zig-zag patterns allow for expansion and compression (or folding) of the patterned wire 1320 when arranged in the longitudinal direction of a travel bag 20A or 20B, for example. More specifically, for each side of a travel bag 20A, 20B, the zig-zag arms 1339 of the first panel 1324 should be oriented longitudinally along the length of the expansion panel 815, with sides 1336 and 1338 oriented along the width of the expansion panel 815 and with sides 1332 and 1334 oriented along the length of the expansion panel 815. This arrangement or configuration of the security panel assemblies 1300-1300D provides that as the expansion panel 815 is expanded or contracted along its width (as illustrated in the various Figures for closed or expanded configurations), the zig-zag arms 1339 flex or accordion into larger or smaller triangles, respectively.

Not separately illustrated in FIGS. 130-137, the ends of the various wires 1320, 1325 may also have a polymeric cap, and may also be bent or curved toward the center of the respective first and second panels 1324, 1322. In addition, any of the various method steps described above may also be utilized to form these security panel assemblies 1300-1300D.

Other wire or fiber patterns may also be utilized equivalently for the security panel assemblies 1300-1300D. For example and without limitation, each arm 1339 could be rectangular, sinusoidal, or oval, in addition to triangular, and such patterns may be combined in the same panel 1322, 1324, 1326. All such variations are within the scope of the disclosure.

Although the invention has been described with respect to specific embodiments thereof, these embodiments are merely illustrative and not restrictive of the invention. In the description herein, numerous specific details are provided, such as examples of electronic components, electronic and structural connections, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. One having skill in the art will further recognize that additional or equivalent method steps may be utilized, or may be combined with other steps, or may be performed in different orders, any and all of which are within the scope of the claimed invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment and not necessarily in all embodiments, and further, are not necessarily referring to the same embodiment. Furthermore, the particular features, structures, or characteristics of any specific embodiment may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect structural coupling, connection or attachment, or adaptation or capability for such a direct or indirect structural coupling, connection or attachment, including integrally formed components and components which are coupled via or through another component.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

Furthermore, any signal arrows in the drawings/Figures should be considered only exemplary, and not limiting, unless otherwise specifically noted. Combinations of components of steps will also be considered within the scope of the present invention, particularly where the ability to separate or combine is unclear or foreseeable. The disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" shall not be limited to a single item or element and include plural references unless the context clearly dictates otherwise and unless specifically disclaimed. Also as used in the description herein and throughout the claims that follow, the meaning of "in" includes "in" and "on" unless the context clearly dictates otherwise. By way of example, though specific claim language may include the word "between", the interpretation of such a word shall not be limited to preclude extent of elements beyond boundaries of the example unless specific disclaimer is made or unless by virtue of prosecution the term is to be limited. The examples of the invention should therefore not be interpreted as limiting unless indicated as such.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims. Thus, while there has been set forth embodiments of the invention, the invention is to be limited only by the following claims and equivalents.

What is claimed is:

1. A carry strap for a carrying bag, the carry strap comprising:

a first wire cable;

a second wire cable; and a first flexible material having its length substantially greater than its width, the first flexible material having a first side and a second side, the first flexible material having a first lateral edge and a second lateral edge along its length, having first and second lateral regions along its length, and having a central region along its length in between the first and second lateral regions, the first lateral region folded around the first wire cable to enclose the first wire cable on the first side of the first flexible material, and the second lateral region folded around the second wire cable to enclose the second wire cable on the first side of the first flexible material.

2. The carry strap of claim 1, wherein the central region has a first thickness and the first and second lateral regions have a second thickness, the first thickness greater than the second thickness.

3. The carry strap of claim 2, wherein the central region has a first side with a first side edge and a second side with a second side edge, and wherein the first lateral edge abuts the first side edge of the central region, and wherein the second lateral edge abuts the second side edge of the central region.

4. The carry strap of claim 1, wherein the central region and the first and second lateral regions have the same thickness.

5. The carry strap of claim 1, wherein the first lateral edge abuts the second lateral edge along the central region.

6. The carry strap of claim 1, further comprising:

at least one second flexible material coupled to the first flexible material.

7. The carry strap of claim 6, wherein the at least one second flexible material is coupled over the folded first and second lateral regions on the first side of the first flexible material.

8. The carry strap of claim 6, wherein the at least one second flexible material is coupled between the first and second wire cables on the first side of the first flexible material.

9. The carry strap of claim 6, wherein the at least one second flexible material is folded longitudinally.

10. The carry strap of claim 1, further comprising:

at least one second flexible material having its length substantially greater than its width, the at least one second flexible material folded along its first and second lateral edges or lateral regions and coupled to the first side of the first flexible material.

11. The carry strap of claim 1, further comprising:

a crimp coupled to an end of the first wire cable and to an end of the second wire cable.

12. The carry strap of claim 11, wherein a first end of the carry strap is folded around a buckle, attachment ring or fitting and attached to a nonadjacent part of the carry strap.

13. The carry strap of claim 1, wherein the first flexible material comprises at least one material selected from the group consisting of: a woven fabric; a woven ballistic nylon fabric; leather; a nonwoven material; a woven fabric or webbing material having finished lateral edges; and combinations thereof.

14. The carry strap of claim 1, wherein the first wire cable and the second wire cable are each comprised of at least one material selected from the group consisting of: metal, metal alloy, carbon fiber, a polymer, elastic, rubber, and combinations thereof.

15. The carry strap of claim 1, wherein the first wire cable and the second wire cable are each comprised of a multifilament polymeric or metallic fiber, thread or yarn.

16. A carry strap for a carrying bag, the carry strap comprising:

a first flexible material having its length substantially greater than its width, the first flexible material having a first side and a second side, the first flexible material having a first and second lateral edges and first and second lateral regions along its length, and having a central region along its length in between the first and second lateral regions;

a first wire cable arranged along the first lateral region on the first side of the first flexible material;

a second wire cable arranged along the second lateral region on the first side of the first flexible material; and a separate second flexible material having its length substantially greater than its width, the second flexible material having a first and second lateral edges and first and second lateral regions along its length, and having a central region along its length in between the first and second lateral regions, the second flexible material coupled over the first and second wire cables and to the first side of the first flexible material.

17. The carry strap of claim 16, wherein the coupling of the second flexible material to the first flexible material comprises:

a first stitching spaced apart from the first lateral edges of the first and second flexible materials and lateral to the first wire cable;

a second stitching along a first part of the central regions of the first and second flexible materials and in between the first and second wire cables;

a third stitching along a second part of the central regions of the first and second flexible materials and in between the first and second wire cables; and a fourth stitching spaced apart from the second lateral edges of the first and second flexible materials and lateral to the second wire cable.

18. The carry strap of claim 16, wherein the central region of the first flexible material has a first thickness and the first and second lateral regions of the first flexible material have a second thickness, the first thickness greater than the second thickness.

19. The carry strap of claim 16, wherein the second flexible material has a uniform thickness.

20. The carry strap of claim 16, wherein the first wire cable and the second wire cable are each comprised of at least one material selected from the group consisting of: metal, metal alloy, carbon fiber, a polymer, elastic, rubber, and combinations thereof.

21. The carry strap of claim 16, wherein the first wire cable and the second wire cable are each comprised of a multifilament polymeric or metallic fiber, thread or yarn.

22. A carry strap for a carrying bag, the carry strap comprising:

a first flexible material having a first length substantially greater than a first width, the first flexible material having a first and second lateral edges and first and second lateral regions along its length, and having a central region along its length in between the first and second lateral regions, the central region having a longitudinal channel;

at least one wire cable arranged in the longitudinal channel of the central region of the first flexible material; and at least one second flexible material having a second length substantially greater than a second width, the at least one second flexible material having a first and second lateral edges and first and second lateral regions along its length, and having a central region along its length in between the first and second lateral regions of the at least one second flexible material, the at least one second flexible material arranged over the at least one wire cable and coupled to the central region of the first flexible material to secure the at least one wire cable between the at least one second flexible material and the central region of the first flexible material.

23. The carry strap of claim 22, wherein the second width is equal to or smaller than the first width.

24. The carry strap of claim 22, wherein the coupling of the at least one second flexible material to the first flexible material comprises:

a first stitching spaced apart from the first lateral edge of the at least one second flexible material; and a second stitching spaced apart from the second lateral edge of the at least one second flexible material.

25. The carry strap of claim 24, wherein the coupling of the at least one second flexible material to the first flexible material further comprises:

a third stitching along a first part of the central regions of the first and second flexible materials;

a fourth stitching along a second part of the central regions of the first and second flexible materials.

26. The carry strap of claim 22, wherein the coupling of the at least one second flexible material to the first flexible material comprises:

a first stitching spaced apart from the first lateral edge of the at least one second flexible material and adjacent a first side of the at least one wire cable; and a second stitching spaced apart from the second lateral edge of the at least one second flexible material and adjacent a second side of the at least one wire cable.

27. The carry strap of claim 22, wherein the at least one wire cable is comprised of at least one material selected from the group consisting of: metal, metal alloy, carbon fiber, a polymer, elastic, rubber, and combinations thereof.

28. The carry strap of claim 22, wherein the at least one wire cable is comprised of a multifilament polymeric or metallic fiber, thread or yarn.

* * * * *